US012535086B2

(12) United States Patent
Sundström

(10) Patent No.: US 12,535,086 B2
(45) Date of Patent: Jan. 27, 2026

(54) SYSTEM AND METHOD FOR PUMP CONTROL BASED ON PUMP VIBRATIONS

(71) Applicant: S.P.M. Instrument AB, Strängnäs (SE)

(72) Inventor: Tim Sundström, Åkers Styckebruk (SE)

(73) Assignee: S.P.M. Instrument AB, Strängnäs (SE)

( * ) Notice: Subject to any disclaimer, the term of this patent is extended or adjusted under 35 U.S.C. 154(b) by 0 days.

(21) Appl. No.: 18/698,186

(22) PCT Filed: Oct. 10, 2022

(86) PCT No.: PCT/SE2022/050915

§ 371 (c)(1),
(2) Date: Apr. 3, 2024

(87) PCT Pub. No.: WO2023/059264

PCT Pub. Date: Apr. 13, 2023

(65) Prior Publication Data

US 2024/0318667 A1 Sep. 26, 2024

(30) Foreign Application Priority Data

Oct. 9, 2021 (SE) ..... 2151245-4
Oct. 9, 2022 (SE) ..... 2251176-0

(51) Int. Cl.
*F04D 29/66* (2006.01)
*F04D 29/42* (2006.01)
*F04D 29/46* (2006.01)

(52) U.S. Cl.
CPC ..... *F04D 29/669* (2013.01); *F04D 29/4293* (2013.01); *F04D 29/468* (2013.01)

(58) Field of Classification Search
CPC ..... F04D 29/468; F01D 17/143
See application file for complete search history.

(56) References Cited

U.S. PATENT DOCUMENTS 2,824,700 A 2/1958 Weston
2,927,536 A 3/1960 Rhoades
(Continued)

FOREIGN PATENT DOCUMENTS

BR PI 0603403-9 A 4/2008
CA 507503 A 11/1954
(Continued)

OTHER PUBLICATIONS

Extended European search report, dated Sep. 2, 2015; Application No. 13744257.0, in 4 pages.
(Continued)

*Primary Examiner* — Brian O Peters
(74) *Attorney, Agent, or Firm* — Knobbe, Martens, Olson & Bear, LLP

(57) ABSTRACT

A method of operating a centrifugal pump (10) having a casing forming a volute (75) in which a rotatable impeller (20) is disposed for urging a fluid material (30) into the volute, the method comprising: monitoring a fluid pressure pulsation event inside the pump casing; generating, based on said monitoring, a vibration signal indicative of occurrence of said first fluid pressure pulsation event; generating a reference signal indicative of a rotational reference position of said rotating impeller; determining a temporal relation value (FI, FI(r)) based on time of occurrence of said fluid pressure pulsation event (SP(r)) and said reference signal.

28 Claims, 52 Drawing Sheets

(56) References Cited

U.S. PATENT DOCUMENTS 3,149,820 A * 9/1964 Maio ..... F01D 17/146 415/55.1
3,155,790 A 11/1964 Lemonnier
3,482,523 A 12/1969 Morando
3,554,012 A 1/1971 Sohoel
3,705,516 A 12/1972 Reis
3,802,634 A 4/1974 Mix
3,806,278 A 4/1974 Grennan
3,918,831 A 11/1975 Grennan
4,070,132 A 1/1978 Lynch
4,302,813 A 11/1981 Kurihara
4,378,194 A 3/1983 Bandukwalla
4,404,640 A 9/1983 Dumbeck et al.
4,417,849 A 11/1983 Morris
4,419,046 A 12/1983 Carlini
4,528,852 A 7/1985 Sohoel
4,744,242 A 5/1988 Anderson et al.
4,828,454 A 5/1989 Morris et al.
4,831,365 A 5/1989 Thomas et al.
4,894,644 A 1/1990 Thomas
4,912,661 A 3/1990 Potter
4,988,979 A 1/1991 Sasaki et al.
4,991,442 A 2/1991 Matsumoto
5,109,700 A 5/1992 Hicho
5,192,929 A 3/1993 Walker et al.
5,201,292 A 4/1993 Grajski et al.
5,258,923 A 11/1993 Imam et al.
5,365,787 A 11/1994 Hernandez et al.
5,386,945 A 2/1995 Nose et al.
5,390,545 A 2/1995 Doan
5,445,028 A 8/1995 Bianchi et al.
5,548,540 A 8/1996 Staver et al.
5,633,811 A 5/1997 Canada et al.
5,752,665 A 5/1998 Wason
5,825,657 A 10/1998 Hernandez
5,852,793 A 12/1998 Board et al.
5,870,699 A 2/1999 Canada et al.
5,895,857 A 4/1999 Robinson et al.
5,911,362 A 6/1999 Wood et al.
6,041,339 A 3/2000 Yu et al.
6,053,047 A 4/2000 Dister et al.
6,155,790 A 12/2000 Pyotsia et al.
6,260,004 B1 7/2001 Hays et al.
6,330,525 B1 12/2001 Hays et al.
6,332,116 B1 12/2001 Qian et al.
6,351,713 B1 2/2002 Board et al.
6,351,714 B1 2/2002 Birchmeier
6,496,782 B1 12/2002 Claus et al.
6,560,566 B1 5/2003 Lysen
6,591,682 B1 7/2003 Lysen
6,618,128 B2 9/2003 Van Voorhis et al.
6,801,864 B2 10/2004 Miller
6,874,364 B1 4/2005 Campbell et al.
6,874,366 B2 4/2005 Magne Ortega et al.
7,010,445 B2 3/2006 Battenberg et al.
7,027,953 B2 4/2006 Klein
7,133,801 B2 11/2006 Song
7,136,794 B1 11/2006 Bechhoefer
7,352,076 B1 4/2008 Gabrys
7,489,254 B2 2/2009 Rodriguez et al.
7,505,852 B2 3/2009 Board
7,640,139 B2 12/2009 Sahara et al.
7,699,249 B2 4/2010 Jarvinen
7,770,458 B2 8/2010 Blanchard et al.
7,949,496 B2 5/2011 Lindberg et al.
8,020,792 B2 9/2011 Theberge et al.
8,762,104 B2 6/2014 Hedin
8,810,396 B2 8/2014 Hedin
8,812,265 B2 8/2014 Hedin
9,091,259 B2 7/2015 Tamminen et al.
9,200,980 B2 12/2015 Hedin
9,213,671 B2 12/2015 Hedin
9,279,715 B2 3/2016 Hedin
9,341,512 B2 5/2016 Shrivastav
9,416,787 B2 8/2016 Tamminen et al.
9,441,776 B2 9/2016 Byrne et al.
9,772,219 B2 9/2017 Hedin
9,863,845 B2 1/2018 Mesiä et al.
9,885,634 B2 2/2018 Hedin
9,964,430 B2 5/2018 Hedin
9,964,634 B2 5/2018 Nikolov et al.
10,133,257 B2 11/2018 Hedin
10,260,935 B2 4/2019 Hedin
10,330,523 B2 6/2019 Hedin
10,337,957 B2 7/2019 Hedin
10,670,176 B2 6/2020 Byrne et al.
10,788,808 B2 9/2020 Hedin
10,809,152 B2 10/2020 Hedin
10,852,179 B2 12/2020 Hedin
11,015,972 B2 5/2021 Hedin
11,054,301 B2 7/2021 Hedin
11,255,747 B2 2/2022 Hedin
11,561,127 B2 1/2023 Hedin
11,599,085 B2 3/2023 Hedin
11,614,357 B2 3/2023 Hedin
12,105,498 B2 10/2024 Hedin
2002/0017139 A1 2/2002 Werner et al.
2003/0040885 A1 2/2003 Schoess et al.
2003/0047008 A1 3/2003 Gopalakrishnan et al.
2003/0062025 A1 4/2003 Samoto et al.
2003/0129062 A1 7/2003 Sabini et al.
2003/0130811 A1 7/2003 Boerhout
2003/0133808 A1 7/2003 Sabini et al.
2003/0137648 A1 7/2003 Van Voorhis et al.
2003/0182071 A1 9/2003 Ditommaso et al.
2004/0025590 A1 2/2004 Schaad et al.
2004/0083009 A1 4/2004 Curless et al.
2004/0101048 A1 5/2004 Paris
2004/0107078 A1 6/2004 Chiu et al.
2004/0186680 A1 9/2004 Jin et al.
2004/0199348 A1 10/2004 Hitchcock et al.
2004/0246284 A1 12/2004 Mura et al.
2004/0255679 A1 12/2004 Valderrama Reyes et al.
2004/0255680 A1 12/2004 Ortega et al.
2005/0011266 A1 1/2005 Robinson et al.
2005/0033501 A1 2/2005 Liu et al.
2005/0209811 A1 9/2005 Lindberg et al.
2005/0246150 A1 11/2005 Shiromaru et al.
2005/0252205 A1 11/2005 Stavale et al.
2006/0120854 A1 6/2006 Wakeman et al.
2006/0138258 A1 6/2006 Jarvinen
2006/0150738 A1 7/2006 Leigh
2007/0033785 A1 2/2007 Kohring
2007/0112443 A1 5/2007 Latham et al.
2007/0145168 A1 6/2007 Theberge et al.
2007/0212210 A1 9/2007 Kernan et al.
2007/0241920 A1 10/2007 Rodriguez et al.
2007/0282545 A1 12/2007 Board
2008/0033695 A1 2/2008 Sahara et al.
2008/0161959 A1 7/2008 Jerard et al.
2008/0223135 A1 9/2008 Blanchard et al.
2009/0035018 A1 2/2009 Koga et al.
2009/0164142 A1 6/2009 Studer et al.
2009/0193900 A1 8/2009 Janssens et al.
2009/0256874 A1 10/2009 Samoto et al.
2009/0259348 A1 10/2009 Syu
2010/0147627 A1 6/2010 Lakomiak et al.
2010/0288051 A9 11/2010 Janssens et al.
2010/0292937 A1 11/2010 Hosny et al.
2011/0285532 A1 11/2011 Hedin
2011/0295556 A1 12/2011 Hedin
2011/0295557 A1 12/2011 Hedin
2011/0297768 A1 12/2011 Theberge et al.
2012/0296582 A1 11/2012 Hedin
2012/0326443 A1 12/2012 Vince et al.
2012/0330580 A1 12/2012 Fruh et al.
2013/0064682 A1 3/2013 Sun et al.
2013/0108473 A1 5/2013 Tamminen et al.
2014/0365176 A1 12/2014 Hedin
2014/0372079 A1 12/2014 Hedin
2015/0032389 A1 1/2015 Hedin
2015/0086382 A1 3/2015 Tamminen et al.
2015/0375235 A1 12/2015 Roitto et al.

(56) References Cited

U.S. PATENT DOCUMENTS

| | | | | |
|---|---|---|---|---|
| 2016/0090857 | A1* | 3/2016 | Blaylock | F01D 9/02 415/146 |
| 2017/0036213 | A1 | 2/2017 | Pirttiniemi et al. | |
| 2017/0219420 | A1 | 8/2017 | Takahashi | |
| 2017/0225172 | A1 | 8/2017 | Nower et al. | |
| 2017/0356301 | A1 | 12/2017 | Florindo | |
| 2017/0356450 | A1 | 12/2017 | Cheng et al. | |
| 2018/0100480 | A1 | 4/2018 | Duquette et al. | |
| 2018/0126384 | A1 | 5/2018 | Robles et al. | |
| 2018/0369829 | A1 | 12/2018 | Kaartinen et al. | |
| 2019/0162748 | A1 | 5/2019 | Haylock et al. | |
| 2019/0203736 | A1 | 7/2019 | Hambe et al. | |
| 2020/0263559 | A1* | 8/2020 | Blaylock | F01D 9/026 |
| 2021/0088368 | A1 | 3/2021 | Sheth | |
| 2021/0199523 | A1 | 7/2021 | Sheth et al. | |
| 2021/0223094 | A1 | 7/2021 | Hedin | |
| 2022/0042513 | A1 | 2/2022 | Sarkar et al. | |
| 2022/0341815 | A1 | 10/2022 | Hedin | |
| 2023/0297066 | A1 | 9/2023 | Hedin | |
| 2023/0302460 | A1 | 9/2023 | Sundström | |
| 2023/0304849 | A1 | 9/2023 | Hedin | |
| 2023/0324216 | A1 | 10/2023 | Hedin | |
| 2023/0338962 | A1 | 10/2023 | Sundström | |
| 2024/0189829 | A1 | 6/2024 | Sundström | |
| 2024/0253053 | A1 | 8/2024 | Sundström | |

FOREIGN PATENT DOCUMENTS

| | | | |
|---|---|---|---|
| CA | 2456566 | A1 | 7/2004 |
| CA | 2456608 | A1 | 7/2004 |
| CN | 1926413 | A | 3/2007 |
| CN | 101173868 | A | 5/2008 |
| CN | 101266197 | B | 9/2008 |
| CN | 109635847 | A | 4/2019 |
| CN | 208873487 | | 5/2019 |
| CN | 107159435 | B | 7/2019 |
| CN | 110285045 | | 9/2019 |
| CN | 110374869 | A | 10/2019 |
| CN | 209943103 | U | 1/2020 |
| CN | 114555292 | A | 5/2020 |
| CN | 111618659 | A | 9/2020 |
| CN | 109331984 | B | 10/2020 |
| CN | 112621382 | A | 4/2021 |
| CN | 212898882 | U | 4/2021 |
| CN | 112834142 | A | 5/2021 |
| CN | 114689298 | A | 7/2022 |
| DE | 3424692 | A1 | 2/1986 |
| DE | 4218799 | A1 | 12/1993 |
| DE | 10135674 | A1 | 2/2003 |
| EP | 0107178 | A2 | 5/1984 |
| EP | 1226414 | A2 | 7/2002 |
| EP | 1477783 | A2 | 11/2004 |
| EP | 1513254 | A1 | 3/2005 |
| EP | 2296724 | A1 | 3/2011 |
| EP | 2810027 | A1 | 12/2014 |
| EP | 3 1 44 070 | A1 | 3/2017 |
| EP | 4060436 | A1 | 9/2022 |
| FI | 20030078 | A | 1/2003 |
| FI | 20146166 | A | 7/2016 |
| FR | 1093003 | | 4/1955 |
| GB | 2190198 | A | 11/1987 |
| GB | 2451310 | A | 1/2009 |
| GB | 2559541 | | 8/2018 |
| GB | 2599702 | A | 4/2022 |
| IN | 201721025862 | | 1/2019 |
| JP | S60195426 | A | 10/1985 |
| JP | H01127934 | A | 5/1989 |
| JP | H01178814 | A | 7/1989 |
| JP | H04279826 | A | 10/1992 |
| JP | 11179636 | A | 7/1999 |
| JP | 2000-141275 | A | 5/2000 |
| JP | 2003-141275 | | 5/2000 |
| JP | 2020-015106 | A | 1/2020 |
| KR | 101638623 | B1 | 7/2016 |
| KR | 20200056635 | A | 5/2020 |
| RU | 94006918 | A | 4/1996 |
| SU | 1389847 | A1 | 4/1988 |
| WO | WO 1995/13655 | A1 | 5/1995 |
| WO | WO 1995/27183 | A1 | 10/1995 |
| WO | WO 1996/05486 | A1 | 2/1996 |
| WO | WO 1998/01831 | A1 | 1/1998 |
| WO | WO 2000/04361 | A1 | 1/2000 |
| WO | WO 2001/003840 | A1 | 1/2001 |
| WO | WO 2001/31309 | A2 | 5/2001 |
| WO | WO 2002/073150 | A2 | 9/2002 |
| WO | WO 2002/090267 | A1 | 11/2002 |
| WO | WO 2003/062766 | A1 | 7/2003 |
| WO | WO 2004/065014 | A1 | 8/2004 |
| WO | WO 2007/124528 | A1 | 11/2007 |
| WO | WO 2007/137132 | A2 | 11/2007 |
| WO | WO 2010/020287 | A1 | 2/2010 |
| WO | WO 2010/074643 | A1 | 7/2010 |
| WO | WO 2010/074645 | A1 | 7/2010 |
| WO | WO 2010/074646 | A1 | 7/2010 |
| WO | WO 2010/074648 | A1 | 7/2010 |
| WO | WO 2010/128928 | A1 | 11/2010 |
| WO | WO 2011/087440 | A1 | 7/2011 |
| WO | WO 2011/160069 | A1 | 12/2011 |
| WO | WO 2013/112713 | A1 | 8/2013 |
| WO | WO 2015/077735 | A1 | 5/2015 |
| WO | WO 2016/022663 | A2 | 2/2016 |
| WO | WO 2016/107988 | A1 | 7/2016 |
| WO | WO 2016/176788 | A1 | 11/2016 |
| WO | WO 2017/093608 | A1 | 6/2017 |
| WO | WO 2017/093609 | A1 | 6/2017 |
| WO | WO 2019/070544 | A1 | 4/2019 |
| WO | WO 2019/204882 | A1 | 10/2019 |
| WO | WO 2019/232511 | A1 | 12/2019 |
| WO | WO 2021/055879 | | 3/2021 |
| WO | WO 2021/055879 | A1 | 3/2021 |
| WO | WO 2021/206600 | A1 | 10/2021 |
| WO | WO 2022/000072 | A1 | 1/2022 |
| WO | WO 2022/109126 | A1 | 5/2022 |
| WO | WO 2022/216218 | A1 | 10/2022 |
| WO | WO 2022/216219 | A1 | 10/2022 |
| WO | WO 2024/080915 | A1 | 4/2024 |

OTHER PUBLICATIONS

International Search Report, dated May 15, 2013, from PCT/SE2013/050079, in 5 pages.

Extended European search report, dated Sep. 16, 2015; Application No. 12810816.4, in 6 pages.

Autocorrelation—Wikipedia, the free encyclopedia, Dec. 12, 2008, p. 2-6, http://en.wikipedia.org/wik+B160+B151:D154+B160+B+B151:D159.

Chang, et al., "A Novel Envelop Detector for High-Frame Rate, High-Frequency Ultrasound Imaging", IEEE Transactions on Ultrasonics, Ferroelectrics, and Frequency Control, 2007, vol. 54, No. 9, pp. 1792-1801.

Das et al., "Interpretation of mill vibration signal via wireless sensing" in Minerals Engineering, vol. 24, No. 3, dated Sep. 15, 2019, pp. 245-251.

Doguer et al., "New Time Domain Method for the Detection of Roller Bearing Defects" Proceedings of International Conference on Condition Monitoring & Machinery Failure Prevention Technologies CM 2008, Edinburgh, Jul. 2008.

Mais, Jason, Spectrum Analysis—The key features of analyzing spectra, https://www.skf.com/binaries/pub12/Images/0901d1968024acef-CM5118-EM-Spectrum-Analysis_tcm_12-113997.pdf, viewed online on Apr. 20, 2022, published on May 2002 (Year: 2002).

Milman, Andrew, "Mathematical Principles of Remote Sensing: Making Inferences from Noisy Data", Sleeping Bear Press, Michigan, 1999. pp. 215-233.

Renwick, John, Condition Monitoring of Machinery Using Computerized Vibration Signature Analysis, IEEE Transactions On Industry Applications, vol. IA-20, No. 3, May/Jun. 1984, pp. 519-527 (Year: 1984).

(56) References Cited

OTHER PUBLICATIONS

Robinson, et al., "How Advanced Analysis Identifies Lubrication Problems", Machinery Health, Pumps & Systems, 2007, pp. 66-67.
Robinson, James C., "Autocorrelation as a Diagnostic Tool", 2007, pp. 1-22.
Rouse, What is Nyquist Theorem, Whatis.com, Sep. 2005.
Dominick, Joe, "PeakVue as a Part of a Reliability Based Maintenance Program", Emerson Process Management—CSI, DoctorKnow® Application Paper, 2010 pp. 1-15.
Elliot, et al., "13.2 Correlation and Autocorrelation Using the FFT", Fast Transforms: Algorithms, Analyses, Applications (New York: Academic Press), 1982, pp. 545-547.
Autocorrelation from Wikipedia, 2009, http:// en.wikipedia.org/wiki/autocorrelation, pp. 1-6.
Lundy, James, "Detecting Lubrication Problems Using Shock Pulse", Lubrication & Fluid Power, Feb. 2006.
European Search Report for International App. No. 19154113.5, dated Jun. 6, 2019, in 7 pages.
European Search Report for European App. No. 21210020.0, dated Jun. 7, 2022, in 10 pages.
European Search Report for European App. No.21822089.5, dated Mar. 12, 2024, in 10 pages.
Supplemental Partial European Search Report for EP Application No. 13837138, mailed May 4, 2016, in 4 pages.
International Search Report, dated Jun. 7, 2011, from corresponding PCT Application No. PCT/SE2011/050035.
International Search Report for International App. No. PCT/SE2013/051062, dated Feb. 21, 2014, in 6 pages.
Banks, Jeffrey et al., "Lubrication Level Diagnosis using vibration analysis", 2004 IEEE Aerospace Conference proceedings, vol. 6, Mar. 6, 2004, pp. 3528-2534.
International search report dated Sep. 11, 2012 from corresponding PCT Application No. PCT/SE2012/050827.
Extended European Search Report for International App No. 19162332.1 dated Jul. 18, 2019 in 10 pages.
European Search Report for Application No. EP10772330 dated Oct. 20, 2017.
International search report dated Jul. 7, 2010 from corresponding PCT Application PCT/SE2010/050257.
European Search Report for Application No. 17292870.6 dated Mar. 14, 2018.
European Search Report in European Application No. 22199346.2 dated Jan. 16, 2023 in 8 pages.
International Search Report and Written Opinion of the International Searching Authority in PCT/SE2021/000006 dated Jul. 1, 2021 in 11 pages.
International Seach Report is PCT/SE2021/00004 dated Jul. 15, 2021 in 5 pages.
International Search Report and Written Opinion mailed Jun. 15, 2022 in Application No. PCT/SE2022/050362 in 11 pages.
International Preliminary Report on Patentability for International PCT Application No. PCT/SE2022/050915 dated Jan. 12, 2024 in 15 pages.
International Search Report and Written Opinion for International PCT Application No. PCT/SE2022/050915 dated Dec. 7, 2022 in 14 pages.
International Search Report and Written Opinion received in International Application No. PCT/SE2023/050332, mailed May 24, 2023, in 19 pages.
International Search Report and Written Opinion received in International Application No. PCT/SE2023/050333, mailed May 24, 2023, in 20 pages.
Maleki-Moghaddam et al., A method to predict shape and trajectory of charge in industrial mills, in: minerals engineering, vol. 46, pp. 157-168, May 9, 2013; section 3.1.1, toe position.
Chinese Search Report received in Corresponding Chinese Application No. 2021800407603 dated Jun. 3, 2024.
Extended European Search Report received in corresponding EP Application No. 21783733.5 dated Jul. 19, 2024.
Swedish Search Report received in Sweden Application No. 2450329-4 mailed Oct. 18, 2024.
"Affinitetslagarna," Wikipedia SE, 2021, 1 pg.
Aka et al., "Numerical investigation of volute tongue design on hemodynamic characteristics and hemolysis of the centrifugal blood pump," SN Applied Sciences, 2021, 3:49, pp. 1-9.
"Back pressure," Wikipedia, 2023, pp. 1-2.
Bernoulli, "Bernoulli's principle," Wikipedia, 2021, pp. 1-12.
"Bernoullis ekvation," Wikipedia SE, 2021, pp. 1-3.
Bowles, "Effects and Control of Pulsation in Gas Measurement," 2021, pp. 1-11.
"Centrifugal force," Wikipedia, 2023, pp. 1-13.
"Centrifugal pump," Wikipedia, 2021, pp. 1-8.
Cheah et al., "Numerical Flow Simulation in a Centrifugal Pump at Design and Off-Design Conditions," International Journal of Rotating Machinery, vol. 2007, Article ID: 83641, 2007, pp. 1-9.
Cui et al., "Analysis of Radial Force and Vibration Energy in a Centrifugal Pump," Mathematical Problems in Engineering, vol. 2020, Article ID 6080942, 2020, pp. 1-12.
Corbo et al., "Practical Design Against Pump Pulsations," Proceedings of the Twenty-Second International Pump Users Symposium, 2005, pp. 138-177.
"Den teoretiska pumpkurvan," 2021, pump hand boken, pp. 1-3.
"Draft tube," Wikipedia, 2020, pp. 1-3.
Elsey, "The Silent Pump Killer: Radial Thrust," Pump & Systems, 2021, pp. 1-8.
"Eulers ekvation," Pumphandboken 3.2.3, pp. 1-3.
Evans, "Calculating Radial Thrust," Pump & Systems, 2011, pp. 1-5.
"Fictitious force," Wikipedia, 2023, pp. 1-11.
Fluid Engineering Inc. "Minimizing Pressure Pulsations by Pump," Infomedia, 2010, pp. 1-11.
"Francis turbine," Wikipedia, 2021, pp. 1-6.
"Frequency," Wikipedia, 2023, pp. 1-8.
"Forluster och verkningsgrad i centrifugalpumpar," Masosine Process Pumps, 2021, pp. 1-3.
Gülich, "Centrifugal Pumps," Springer, 2008.
Henshaw, "The Function of the Volute," Pump & Systems, 2012, pp. 1-4.
"Impeller," Wikipedia, 2021, pp. 1-5.
"Introduktion till kapitlet om pumpar," Chesterton Connect, pp. 1-3.
Kernan, "Pumps 101: Operation, Maintenance and Monitoring Basics," ITT, 2010, pp. 1-10.
"KSB Radial Thrust," KSB, 2023, pp. 1-7.
"KSB Specific Speed," KSB, 2023, pp. 1-7.
"Mill race," Wikipedia, 2021, pp. 1-3.
"Newton's laws of motion," Wikipedia, 2021, p. 1-8.
"Pelton wheel," Wikipedia, 2021, pp. 1-6.
"Phase (waves)," Wikipedia, 2023, pp. 1-7.
"Pump," Wikipedia, 2021, pp. 1-6.
"Reactive centrifugal force," Wikipedia, 2023, pp. 1-4.
"Rotordynamisak pumpars grunder," Chesterton Connect, 2021, pp. 1-3.
"Specific speed," Wikipedia, 2021, pp. 1-5.
Stebler, "Fluid Mekanik,", Fysika Institutionen CTH 1985, pp. 1-39.
"Turbine," Wikipedia, 2021, pp. 1-7.
"Uppfordringshöjd," Masosine Process Pumps, 2021, pp. 1-3.
Venturi, "Venturi Effect," Wikipedia, pp. 1-7.
Vogel, "The Importance of Best Efficiency Point (BEP)," Efficient Plant, 2013, pp. 1-111.
"Volute (pump)," Wikipedia, 2021, pp. 1-2.
"Water turbine," Wikipedia, 2021, pp. 1-12.
WNEK, "Pressure Pulsations Generated by Centrifugal Pumps," Warren Pumps, 1987, pp. 1-7.
"Affinity Laws," Intro to Pumps, 2023, pp. 1-5.
Alatalo, "Charge Dynamics in Tumbling Mills Simulation and Measurement with an In-Mill Sensor," Licentiate Thesis, 2011, 66 pgs.
"Attrition (erosion)," Wikipedia, 2020, pp. 1-3.
"Axis," Wiktionary, 2021, pp. 1-5.
"A smart mill liner package that provides maximum productivity to your operation," FLSmidth, 2021, pp. 2.
"Axis of rotation," Wiktionary, 2021, 1 pg.

(56) References Cited

OTHER PUBLICATIONS

:Brittleness, Wikipedia, 2020, pp. 1-4.
Campbell et al., "Sag Mill Monitoring Using Surface Vibrations," Proceedings Internatioanl Autogenous and Semiautogenous Grinding Tecnology, 2001.
"Centrifugal force," Wikipedia, 2020, pp. 1-9.
"Centripetal force," Wikipedia, 2020, pp. 1-10.
"ChipperEKG," Andritz, Pulp & Paper, 2013, pp. 1-8.
"Compressive strength," Wikipedia, 2020, pp. 1-5.
"Control Theory," Wikipedia, 2021, pp. 1-18.
"Crusher," Wikipedia, 2022, pp. 1-11.
Donker, S., "On-Line Sensors for Measuring the Total Ball and Charge Level in Tumbling Mills," University of Cape Town, Centre for Minerals Research, Apr. 2014.
Dynamic Image Analysis, https://www.sympatec.com/en/particle-measurement/sensors/dynamic-image-analysis/, printed Jul. 1, 2025.
Gugel, "Optimal Sag mill Control Using Vibration & Digital Signal Processing Techniques," SAG Conference, 2015, pp. 1-8.
"Granite," Wikipedia, pp. 1-7.
"Hematite," Wikipedia, 2020, pp. 1-6.
Holmes et al., "An On-line Surface Vibration Monitoring System for AG/SAG Mills," Conference Paper, 2006.
Samotics, powerpoint 2023, p. 1.
"Instance-based learning," Wikipedia, 2021, pp. 1-2.
"Iron oxide," Wikipedia, 2020, pp. 1-7.
"Kalman filter," Wikipedia, 2021, pp. 1-39.
Karesvuori, et al., " Integrated Approach to Monitoring and Control of Mineral Grinding rocesses," IFAC, 2006, pp. 1-6.
Kongas et al., "New Particle Size Analysis System for Mineral Slurries," IFAC New Technologies for Automation of Metallurgical Industry, 2003, pp. 309-314.
Laser Scattering Particle Size Distribution Analyzer, https://www.horiba.com/usa/products/detail/action/show/Product/partica-la-960v2-1944/, printed Jul. 1, 2025.
"Least mean squares filter," Wikipedia, 2022, pp. 1-7.
"Liquid-ring pump," Wikiepdia, 2023, pp. 1-3.
"LoadIQ Mill Scanning Technology," FLSmidth, 2021, pp. 1-8.
"LoadIQ Smart sensor Technology," FLSmidth, 2022, pp. 1-6.
Löfdahl, "Estimeringsmetoder för vibrationsbaserade kvarnfyllnadsmätningar," 2008:228 CIV, 46 pgs.
"Magnetite," Wikipedia, 2020, pp. 1-10.
Mastersizer for Particle Size Measurement, https://www.mining-technology.com/products/mastersizer/, printed Jul. 1, 2025.
McClure, "Overload Detection in Semi-Autogenous Grinding: A Nonlinear Process Monitoring Approach," 9th International Symposium on Advanced Control of Chemical Processes, IFAC, 2015, 6 pgs.
"Mill (grinding)," Wikipedia, 2019, pp. 1-6.
"Mill Vibration Analysis," MillSlicer, 2019, pp. 1-5.
"Natural frequency," Wikipedia, 2023, pp. 1-2.
Orhan et al., "Tool wear evaluation by vibration analysis during end milling of AISI D3 cold work tool steel with 35 HRC hardness," NDT&E International 40, 2007, pp. 121-126.
Outotec, "Outotec MillSense mill charge sensor system," https://www.outotec.com/products/analyzers-and-automation/millsense-mill-charge-s , printed on Oct. 29, 2019, 4 pgs.
Particle size analyzers, https://www.malvernpanalytical.com/en/products/category/particle-size-analyzers, printed Jul. 1, 2025.
"Perth-based company Process IQ, ideal partner for United States revolutionary mining technology," 2017, 2 pgs.
"Piston pump," 2023, Wikipedia, pp. 1-2.
"Polar coordinate system," Wikipedia, 2020, pp. 1-9.
"Pump," Wikipedia, 2023, pp. 1-19.
"Pump cavitation and how to avoid it," Xylem, Jun. 2017, pp. 1-12.
"Principle of SAG Mill Operation," image.
"PSI 300i particle size analyzer," Metso:Outotec, 2021, pp. 1-6.
PSI® 500i particle size analyzer, https://www.metso.com/portfolio/psi-500i-particle-size-analyzer/, printed Jul. 1, 2025.
"Reciprocating pump," Wikipedia, 2023, pp. 1-3.
"Regression analysis," Wikipedia, 2023, pp. 1-12.
"Rheology," Wikipedia, 2022, pp. 1-10.
"Rotary vane pump," Wikipedia, 2023, pp. 1-3.
Spencer et al., "Prediction of AG/SAG Mill Variables from Surface Vibrations," Research Gate, 2006, pp. 1-7.
Tahir et al., "The Correlation Between Tool Wear and Vibration Signals from Piezoelectric in End Milling of AISI P20+NI," Journal of Mechanical Engineering, vol. SI3(2), 2017, pp. 49-62.
"Tenacity (mineralogy)," Wikipedia, 2020, 1 pg.
"TriSlicer Mill Vibration Analysis," Process IQ, 2022, pp. 1-6.
"Vacuum Pump," 2023, Wikipedia, pp. 1-12.
Yin et al., " Impact Load Behavior between Different Charge and Lifter in a Laboratory-Scale Mill," MDPI, 2017.
International Preliminary Report on Patentability in PCTSE2023051006 dated Apr. 15, 2025.
International Search Report and Written Opinion in PCTSE2023051006 dated Dec. 20, 2023.
International Search Report & Written Opinion received in International Application No. PCT/SE2023/000010 dated Jan. 15, 2024.
European Search Report received in EP application No. 22785077.3 dated Apr. 17, 2025.
European Search Report received in EP application No. 22785076.5 dated Apr. 29, 2025.
Swedish Search Report received in SE Application No. 2351161-1 date Apr. 29, 2024.
Swedish Search Report received in SE Application No. 2351160-3 date May 2, 2024.
International Search Report and Written Opinion received in International Application No. PCT/SE2024/000003 dated Jun. 10, 2024.

* cited by examiner

Memory 460

| #01 | #02 | #03 |
|---|---|---|
| Time slot | | |
| dt | P(i) | S(i) |
| i | Position | Se(i) |
| 1 | 0 | Se1 |
| 2 | 0 | Se2 |
| 3 | 1 | Se3 |
| 4 | 0 | Se4 |
| 5 | 0 | Se5 |
| 6 | 0 | Se6 |
| 7 | 0 | Se7 |
| 8 | 0 | Se8 |
| 9 | 0 | Se9 |
| 10 | 0 | Se10 |
| 11 | 0 | Se11 |
| 12 | 0 | Se12 |
| 13 | 0 | Se13 |
| 14 | 0 | Se14 |
| 15 | 0 | Se15 |
| 16 | 0 | Se16 |
| 17 | 0 | Se17 |
| 18 | 0 | Se18 |
| 19 | 0 | Se19 |
| 20 | 0 | Se20 |

| | | |
|---|---|---|
| 21 | 0 | Se21 |
| 22 | 0 | Se22 |
| 23 | 0 | Se23 |
| 24 | 0 | Se24 |
| 25 | 0 | Se25 |
| 26 | 0 | Se26 |
| 27 | 0 | Se27 |
| 28 | 0 | Se28 |
| 29 | 0 | Se29 |
| 30 | 0 | Se30 |
| 31 | 0 | Se31 |
| 32 | 0 | Se32 |
| 33 | 0 | Se33 |
| 34 | 0 | Se34 |
| 35 | 0 | Se35 |
| 36 | 0 | Se36 |
| 37 | 0 | Se37 |
| 38 | 0 | Se38 |
| 39 | 0 | Se39 |
| 40 | 0 | Se40 |

SYSTEM AND METHOD FOR PUMP CONTROL BASED ON PUMP VIBRATIONS

TECHNICAL FIELD

The present invention relates to the field of a centrifugal pump and to the monitoring of a centrifugal pump. The present invention also relates to the field of control of a centrifugal pump. The present invention also relates to an apparatus for monitoring of an internal state of a centrifugal pump. The present invention also relates to an apparatus for controlling an internal state of a centrifugal pump. The present invention also relates to a computer program for monitoring of an internal state of a centrifugal pump. The present invention also relates to a computer program for controlling an internal state of a centrifugal pump.

DESCRIPTION OF RELATED ART

In some industries, such as in the paper production industry, there is a need to transport fluid material, such as pulp. Also in the mining industry, there is a need to transport fluid material. Other industries, such as the dairy industry, also have a need to transport fluids, such as milk products. Moreover, there is a need to transport fluid material, such as water, in many instances of modern society, such as for providing water to a water tower and/or providing water for irrigation purposes in the farming industry.

A centrifugal pump can achieve transportation of fluid material. For this purpose a centrifugal pump has a rotatable part fitted with vanes and known as an impeller. The impeller imparts motion to the fluid which is directed through the pump. The pressure for achieving the required head is produced by centrifugal acceleration of the fluid in the rotating impeller. The fluid may flow axially towards the impeller, is deflected by it and flows out through apertures between the vanes. Thus, the fluid undergoes a change in direction and is accelerated. This produces an increase in the pressure at the pump outlet. The fluid exits the impeller into a volute, which collects the flow and directs it towards the pump outlet. The volute is a gradual widening of the spiral casing of the pump. Alternatively, when leaving the impeller, the fluid may first pass through a ring of fixed vanes which surround the impeller and is commonly referred to as a diffuser, before entering the volute and being passed to the pump outlet. The operation of a centrifugal pump is often discussed in terms involving the concept of an operating point of the pump.

US 2003/0129062 (ITT Fluid Technology) discloses that the operating point of a pump is commonly thought of as the flow rate and Total Dynamic Head (TDH) that the pump is delivering. US 2003/0129062 also discloses a method for determining the operating point of a centrifugal pump based on motor torque and motor speed. According to US 2003/0129062 a method for determining whether a centrifugal pump is operating in a normal flow operating range includes the steps of: determining a motor torque/TDH relationship over a range of speeds for a minimum flow rate in order to obtain a minimum flow operating range for the centrifugal pump; determining a motor torque/TDH relationship over a range of speeds for a maximum flow rate in order to obtain a maximum flow operating range for the centrifugal pump; determining the actual operating motor torque and TDH of the centrifugal pump at a given operating point; and determining whether the actual operating motor torque and TDH of the centrifugal pump falls within the minimum flow and maximum flow operating ranges of the centrifugal pump.

U.S. Pat. No. 9,416,787 B2 (ABB Technology Oy) discloses that the flow rate to head curve (QH curve) and the flow rate to power curve (QP curve) of the pump are provided by the pump manufacturer, and can be available for all pumps. U.S. Pat. No. 9,416,787 B2 also discloses a method for determining the flow rate (Q) produced by a pump, when the pump is controlled with a frequency converter, which produces estimates for rotational speed and torque of the pump, and the characteristic curves of the pump are known. The method includes determining the shape of a QH curve of the pump, dividing the QH curve into two or more regions depending on the shape of the QH curve, determining on which region of the QH curve the pump is operating, and determining the flow rate (Q) of the pump using the determined operating region of the characteristic curve.

SUMMARY

In view of an aspect of the state of the art, a problem to be addressed is how to provide an improved manner of identifying an internal state of a centrifugal pump during operation.

This problem is addressed by examples, such as by a method and/or a system and/or a pump, as disclosed in this disclosure.

In view of an aspect of the state of the art, a problem to be addressed is how to provide an improved manner of optimizing the operation of a centrifugal pump. This problem is addressed by examples, such as by a method and/or a system and/or a pump, as disclosed in this disclosure.

In view of an aspect of the state of the art, a problem to be addressed is how to improve the efficiency of the pumping process in a centrifugal pump. This problem is addressed by examples, such as a system and or a pump and/or a method, as disclosed in this application disclosure.

In view of an aspect of the state of the art, a problem to be addressed is how to provide an improved manner of identifying and/or visualizing and/or controlling an internal state of a centrifugal pump during operation so as to improve the pumping process in a centrifugal pump. This problem is addressed by examples, such as by a method and/or a system and/or a pump, as disclosed in this disclosure.

BRIEF DESCRIPTION OF THE DRAWINGS

For simple understanding of the present invention, it will be described by means of examples and with reference to the accompanying drawings, of which

DETAILED DESCRIPTION

Figure 1A:
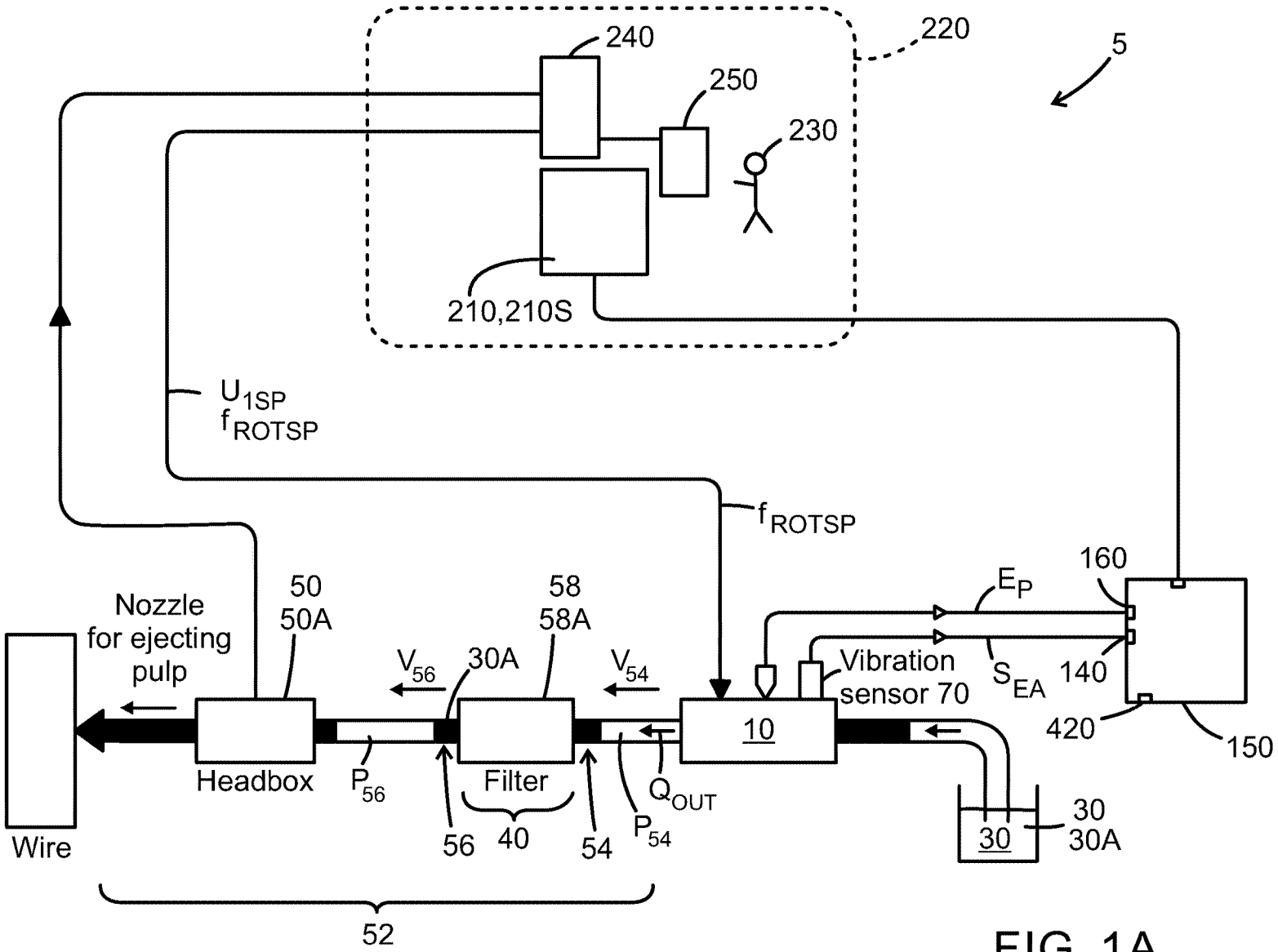
FIG. 1A shows a somewhat diagrammatic and schematic side view of a system including a centrifugal pump.

In the following text similar features in different examples will be indicated by the same reference numerals.

FIG. 1A shows a system 5 including a centrifugal pump 10 for a causing a fluid 30 to be transported, via a piping system 40, to a fluid material consumer 50. The fluid system to which the pump is coupled, including the piping system 40 and the fluid material consumer 50, is herein referred to as fluid system 52.

The fluid 30 may comprise fiber slurry 30A for paper production in a paper-making machine used in the pulp and paper industry to create paper in large quantities at high speed. The fluid material consumer 50 may include a headbox 50A, also referred to as head tank, whose purpose is to maintain a constant head (i.e. constant pressure) on the fiber slurry 30A. The fluid material consumer 50 may include a basis weight valve (not shown) whose purpose is to modulate the flow of fluid 30A as it is mixed with white water on its way to the head box 50A, as well as forming wire where a paper sheet begins to take shape.

The basis weight of paper is calculated by the weight per a given unit area. Production of high quality paper requires precise control of the basis weight valve. Fluctuations in paper layer thickness or basis weight of the paper can result in uneven drying, a poor finished product and/or waste since such fluctuations may require rejection of the produced paper. Thus, it is desired to achieve a constant flow $Q_{OUT}$, as delivered from the centrifugal pump 10 so as to enable the production of high quality paper.

In the field of fluid dynamics, Bernoulli's principle states that an increase in the speed of a fluid occurs simultaneously with a decrease in static pressure or a decrease in the fluid's potential energy. Thus, when a volume of fluid is flowing horizontally from a first region 54 of high pressure to a second region 56 of low pressure, then there is more pressure behind than in front. This gives a net force on the volume, accelerating it along the streamline. In the example illustrated in FIG. 1, the piping system 40 leading the fluid 30 from the first region 54 of high pressure to the second region 56 of low pressure includes a piping component 58 that may include a filter 58A.

Bernoulli's principle, for a volume of fluid flowing horizontally at a speed v from a first region 54 of high pressure $P_H$ to a second region 56 of low pressure $P_L$, can be expressed in mathematical terms as follows:

$$P + 1/2 * D * v * v = \text{Constant}, \quad \text{(Eq. 1)}$$

Where

P=Pressure in the fluid material,

D=Density of the fluid material v=the speed at which the fluid material flows

Thus, with reference to FIG. 1, when applying Bernoulli's principle to a volume of fluid flowing horizontally at a speed $v_{54}$ in a first region 54 of higher pressure $P_{54}$ to a second region 56 of lower pressure $P_{56}$, the fluid will flow at a speed $v_{56}$ in the second region 56, as indicated by equation 2 below:

$$P_{54} + 1/2 * D * v_{54} * v_{54} = P_{56} + 1/2 * D * v_{56} * v_{56} \quad \text{(Eq. 2)}$$

Where $P_{54}$=Pressure in the fluid material in first region 54,

D=Density of the fluid material $v_{54}$=the speed at which the fluid material flows in first region 54

$P_{56}$=Pressure in the fluid material in second region 56, $v_{56}$=speed at which the fluid material flows in second region 56

Figure 1B:
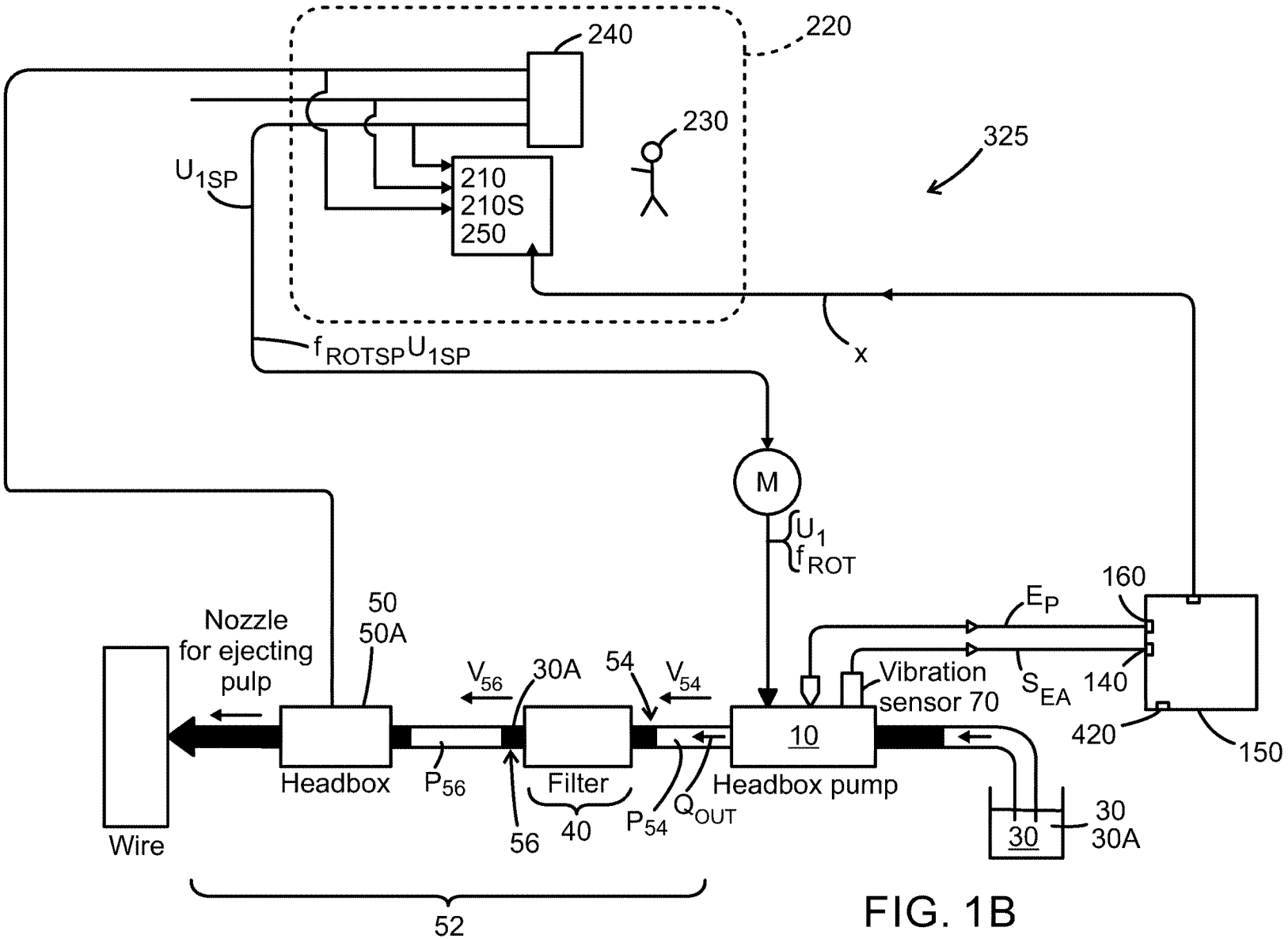
FIG. 1B shows another somewhat diagrammatic and schematic side view of a system including a centrifugal pump.

FIG. 1B shows another somewhat diagrammatic view of a system 325 including a centrifugal pump 10. Thus, reference numeral 325 relates to a system including a pump 10 having a rotatable impeller 20, as discussed in this document. The system 325 of FIG. 1B may include parts, and be configured, as described above in relation to FIGS. 1A and 2A and/or as described elsewhere in this document.

Whereas the pump user input/output interface 250, in the example illustrated in FIG. 1A, is coupled to the regulator 240 and the HCI 210 is a separate input/output interface coupled to the analysis apparatus 150, or monitoring module 150A, the system illustrated in FIG. 1B may provide an integrated HCI 210, 250, 210S. Thus, the input/output interface 210 of FIG. 1B may be configured to enable all the input and/or output described above in conjunction with interfaces 210 and 250.

Figure 2A:
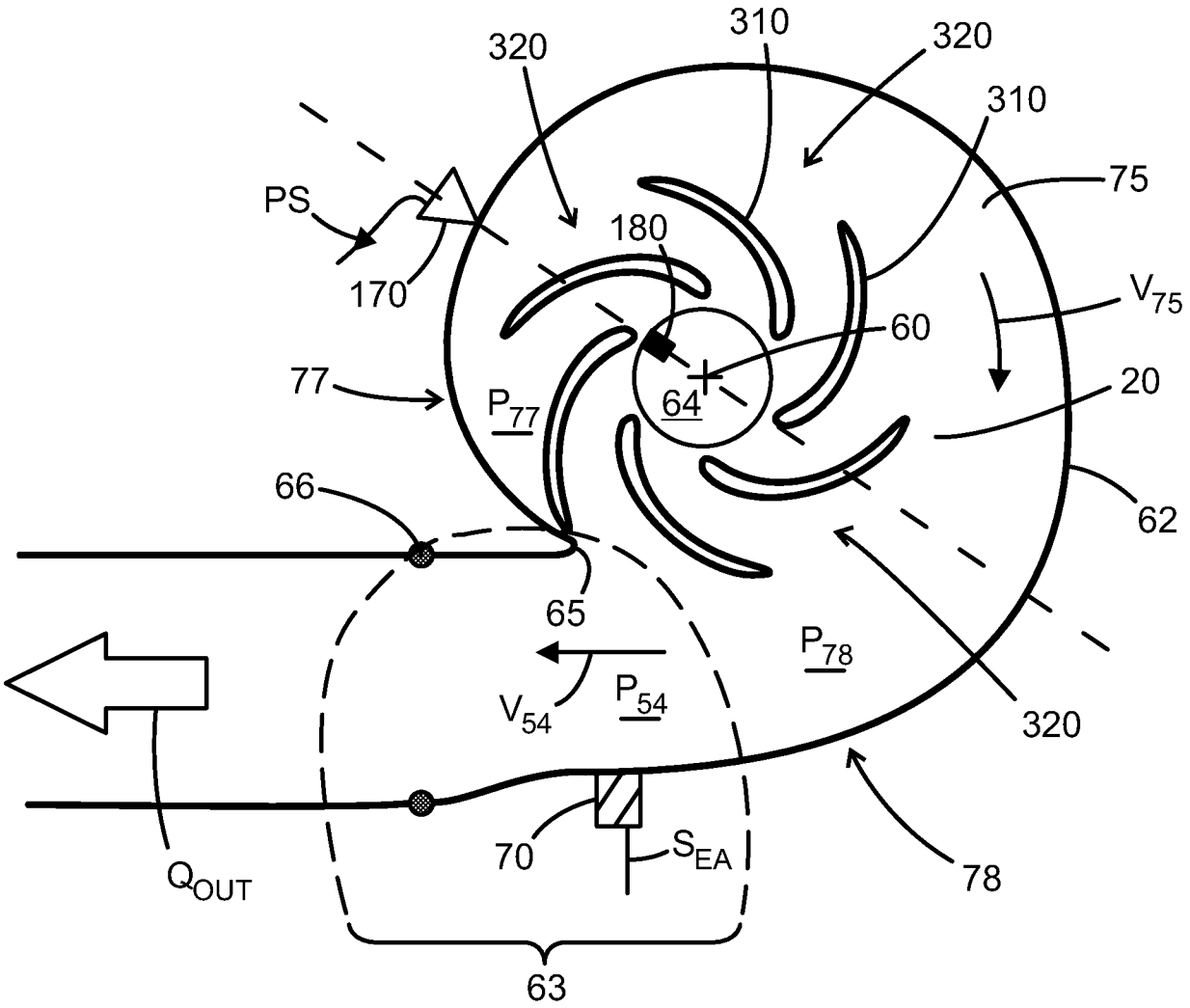
FIG. 2A is an illustration of a centrifugal pump 10.

FIG. 2A is an illustration of an example of a centrifugal pump 10. The pump 10 comprises a casing 62 in which a rotatable impeller 20 is disposed so that it can rotate around an axis of rotation 60. The casing 62 defines a pump inlet 64 for fluid material 30 and an outlet 66 for the fluid material 30. The casing also defines a volute 75. The volute 75 may be a curved funnel that increases in cross sectional area as fluid material 30, flowing therein, approaches the outlet 66, which may also be referred to as a discharge port 66.

The volute 75 of a centrifugal pump 10 is that part of the casing that receives the fluid 30 being pumped by the impeller 20. The impeller 20 has a number L of vanes 310 for urging, when the impeller 20 rotates, the fluid material 30 from the pump inlet 64 into the volute 75. The example impeller shown in FIG. 1, has 6 vanes 310. The vanes 310 define a number of impeller passages 320 for causing the fluid material 30 to flow from the pump inlet 64 into the volute 75. In other words, the L vanes 310 define L impeller passages 320, the number L being L=6 in the example illustrated in FIG. 2A.

The casing 62 has an outlet portion 63 separating a first part 77 of said volute 75 from a second part 78 of the volute. The first volute part 77 has a first, smaller, cross sectional area, and the second volute part 78 has a second, larger, cross sectional area. The outlet portion of the pump illustrated in FIG. 2A has a volute tongue 65. The sensor 70, $\mathbf{70}_{78}$ of example pump 10 of FIG. 2A may be attached to the casing 62 at the second volute part 78 by the larger cross sectional area near the outlet 66 of the pump 10.

As the fluid travels along the volute it is joined by more and more fluid 30 exiting the rotating impeller passages 320 but, as the cross sectional area of the volute increases, the velocity v75 is maintained if the pump is running close to the flow $Q_{OUT}$ for which the pump was designed. In this manner, the fluid 30 is forced to exit the pump outlet 66 thereby causing a fluid material flow $Q_{OUT}$ from the outlet 66. In this context, the "flow $Q_{OUT}$ for which the pump was designed" may also be referred to as the flow $Q_{OUTBEP}$ which is the flow at the Best Efficiency Point (BEP) of the pump.

The flow $Q_{OUT}$ for which the pump was designed, i.e. the design flow, may also be referred to as the design point, or design operating point. The design point is often referred to as the Best Efficiency Point, BEP, of operation. Referring to FIG. 2A, the volute 75 increases in cross sectional area as fluid material 30, flowing therein, approaches the outlet 66. The volute receives fluid from the impeller passages 320, maintaining the velocity $v_{75}$ of the fluid in the volute at a constant value during operation at design operating point. This is because, as the fluid travels along the volute 75 it is joined by more and more fluid, received from the impeller passages 320, but since the cross-sectional area of the volute increases, the velocity $v_{75}$ is maintained when the pump operates at design operating point.

However, if the pump has a low flow rate then the fluid velocity $v_{75}$ will decrease along the volute, and fluid pressure will increase along the volute. Conversely, if the pump flow is higher than design, the fluid velocity will increase across the volute and the pressure will decrease. This is a consequence of the continuity equation, and it follows from Bernoulli's principle. It is also consequence of the first law of thermodynamics.

Figure 2B:
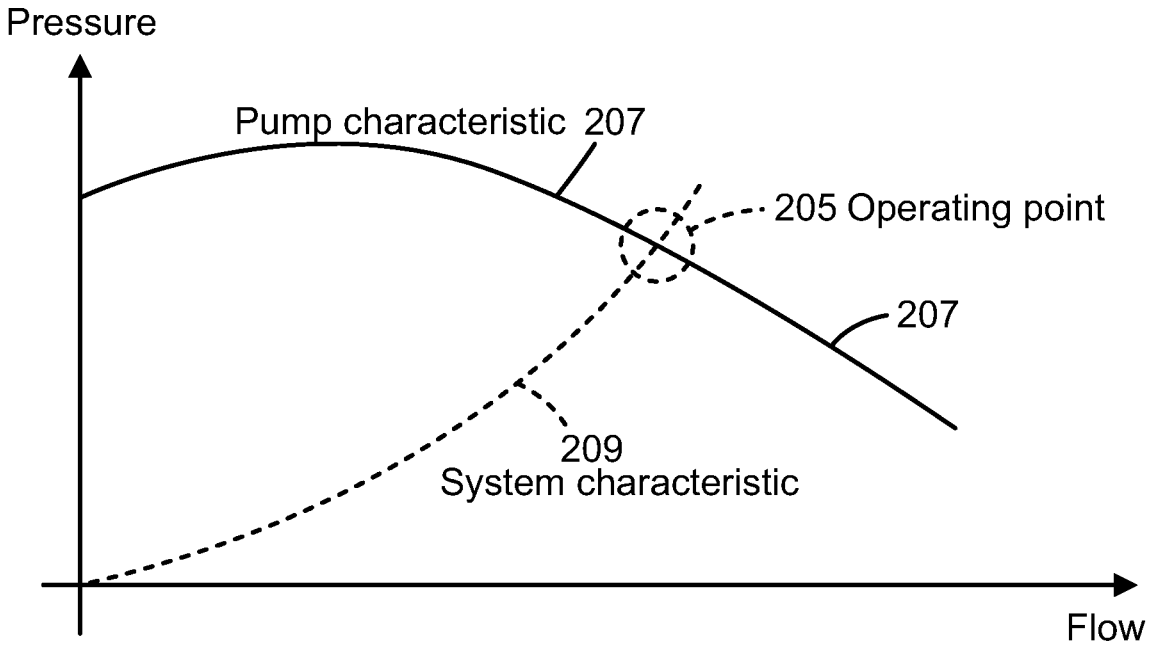
FIG. 2B is a plot illustrating the operating point of the pump of FIG. 2A.

FIG. 2B is a plot illustrating an operating point 205 of the pump of FIG. 2A in a flow versus pressure diagram. Referring to FIG. 2B and FIG. 1, the operating point 205 of the pump 10 is indicated by the intersection of a pump curve 207 and the system curve 209 of the particular system 52, 40, 50 to which the pump outlet 66 is connected (See FIG. 2B in conjunction with FIG. 1).

The pump curve 207 indicates how the pump pressure will change with flow. In a fluid system 52, 40, 50 that fluctuates in pressure and flow over time, the system curve 209 changes over the lifetime and operation of the system 52. Accordingly, the operating point 205 of the pump 10 can move along the pump curve 207. When the operating point 205 moves away from the best efficiency point, BEP, there is typically an increase in fluid pressure pulsations.

Pressure pulsations are fluctuations in the fluid pressure. During operation, the centrifugal pump may cause such pressure pulsations. Some pressure pulsations are fluctuations in the fluid pressure being developed by the pump at the pump outlet 66. Thus, the fluid 30 exiting the pump outlet 66 may exhibit a fluid material flow $Q_{OUT}$ with a pressure pulsation $P_{FP}$. The fluid pressure pulsation $P_{FP}$ has a repetition frequency $f_R$ dependent on a speed of rotation $f_{ROT}$ of the impeller 20.

Referring to FIG. 2A, a sensor 70 may be mounted on the casing 62 for generating a vibration signal $S_{EA}$, $S_{MD}$, Se(i), S(j), S(q) dependent on the fluid material pressure pulsation $P_{FP}$.

A sensor 70 may, for example, be embodied by an accelerometer. An example of an accelerometer includes a Micro Electro-Mechanical System, abbreviated MEMS.

Accordingly, a sensor 70 may include a semiconductor silicon substrate configured as a MEMS accelerometer.

A sensor 70 may alternatively be embodied by a piezoelectric accelerometer.

Alternatively, a sensor 70 may be embodied by piezoresistive sensor 70. A piezoresistive sensor 70 may operate as a strain gauge configured to measure stress. A piezoresistive sensor 70 may include a piezoresistive material configured to be deformed when a force is applied to it, the deformation causing a change in the sensor resistance.

Yet another example of sensor 70 is a velocity sensor. A velocity sensor 70 includes a coil and magnet arrangement configured to measure velocity.

The pump may also be also provided with a position sensor 170 for generating a position signal EP, PS, P(i), P(j), P(q) indicative of a rotational position of said impeller 20 in relation to the casing 62. As shown in FIG. 2A, a position marker device 180 may be provided in association with the impeller 20 such that, when the impeller 20 rotates around the axis of rotation 60, the position marker 180 passes by the position sensor 170 once per revolution of the impeller, thereby causing the position sensor 170 to generate a revolution marker signal value PS.

Whereas FIG. 2A illustrates that a single position marker 180 may be provided in association with the impeller 20, the position marker 180 thereby causing the position sensor 170 to generate a revolution marker signal value $P_S$ once per revolution, it is noted that position signal values $P_S$, $P_C$ may alternatively be generated more than once per revolution. For example, position signal values PS, $P_C$ may be generated more than once per revolution by providing more than one position marker 180 in association with the impeller 20. Alternatively, position signal values $P_S$, $P_C$ may be generated by an encoder 170 which is mechanically coupled to the rotating pump impeller 20. Thus, the position sensor 170 may be embodied by an encoder 170 which is mechanically coupled to the rotating pump impeller 20 such that the encoder generates e.g. one marker signal $P_S$ per vane 310 in the rotating impeller 20 during rotation of the impeller 20. In this manner, the encoder 170 may deliver L marker signals $P_S$ per revolution of the impeller 20.

Alternatively, the position sensor 170 for generating a position signal EP, PS, P(i), P(j), P(q) may include a light source 170, such as e.g. a laser, in combination with a light detector 170 that cooperates with position marker device 180 in the form of a reflective tape 180 on a rotating part.

Alternatively, the position sensor 170 for generating a position signal EP, PS, P(i), P(j), P(q) may include an inductive probe 170 that is configured to detect the presence of a metal or magnetic part 180 on the rotating shaft. The metal or magnetic part 180 may be embodied e.g. by a bolt, or a wedge. The inductive probe 170 position detector is advantageously efficient also in dirty environments. Yet another example of position sensor 170 and position marker device 180 arrangement includes a Hall effect sensor 170 that cooperates with a magnet 180 mounted on a rotating part. The Hall effect sensor 170 is advantageously insensitive to dust and dirt.

As regards physical location of the position sensor 170 and position marker device 180 arrangement, the following may be considered:

When there is risk for torsional movement of a rotating shaft, for example if the shaft is too weak compared with the torque it may be preferable to mount the position marker device 180 as close as possible to the impeller 20 so as to avoid adverse effects on the measurements by the torsional movement.

Although the above example relates to pulp, the fluid to be pumped by a pump 10 may be any fluid material 30. The fluid material 30 may be water. Water has a density of about 997 kg per cubic metre. Sometimes the fluid to be pumped includes pieces of solid material. For example, the fluid material 30 may comprise a mixture of water and solids denser than water, such as sand or crushed rock material, also referred to as slurry.

A slurry is a mixture of solids denser than water suspended in liquid. The pieces of solid material may have a density that differs from the density of water. Moreover, sometimes the compressibility of the fluid material 30 differs from that of water.

The fluid material 30 may alternatively be an oil.

Table 1 provides some examples of fluid materials and example solid materials that may be suspended in the fluid 30. Table 1 also provides some material properties, including density.

TABLE 1

| Material in fluid | Density (kg per cubic metre) | Tenacity | Compressive strength (MPa) |
|---|---|---|---|
| Water | 997 | | |
| Oil | 840-950 | | |
| Aluminium | 2700 | Malleable | 30-280 |
| Granite | 2700 | Brittle | Above 200 |
| Hematite ($Fe_2O_3$) | 5150 | Brittle | Appr 155 |
| Magnetite ($Fe_3O_4$) | 5180 | Brittle | Appr 100 |
| Zinc | 7130 | Brittle | 75-160 |
| Iron | 7870 | Malleable | 110-220 |
| Silver | 10500 | Malleable | 45-300 |
| Gold | 19320 | Ductile | 20-205 |

The outlet of the centrifugal pump 10 may include, or be coupled to, a filter 58 (See FIG. 1 in conjunction with FIG. 2A).

It is desirable to obtain a high degree of efficiency of the pumping process. One aspect of pumping process efficiency is the amount of pulsation in the flowing material 30 leaving the pump 10. Hence, it is desirable to maximize the flow $Q_{OUT}$ of fluid material from a pump while minimizing pulsation in the pumped fluid.

The efficiency of the pumping process in a centrifugal pump 10 depends on a number of variables affecting the internal state of the centrifugal pump 10. One variable that has an impact on the efficiency of the pumping process in a centrifugal pump 10 is the operating point of the centrifugal pump 10. Hence, it is desirable to control the operating point so as to achieve an optimal pumping process.

In order to maximise the amount of output material 95 from the centrifugal pump 10 it is therefore desirable to maintain an optimal state of the centrifugal pump process.

In this context it is noted that centrifugal pump power consumption per pumped volume increases when the centrifugal pump 10 operates away from BEP.

Another variable that has an impact on the efficiency of the pumping process in a centrifugal pump 10 is the system pressure, also referred to as backpressure. The backpressure of the system may vary e.g. if there is a valve in the flow path of the piping system 40 (See FIG. 1). Alternatively, the backpressure of the system may vary when the piping system 40 includes a filter 58, that can exhibit a varying degree of clogging.

Clogging of filter 58 may occur as a consequence of particles that are caught in the filter, thereby gradually reducing the cross sectional effective flow area through the filter 58. An increased clogging therefore leads to a reduced effective flow area which in turn leads to a higher pressure drop over the filter 58.

In this connection, it is noted that some fluids 30, such as slurry or pulp, may exhibit properties that are not constant over time, since the composition of some fluid material 30, such as slurry or pulp, may vary over time. The variation of the properties of the fluid material 30 may affect the efficiency of the pumping process of the centrifugal pump 10. Hence, the efficiency of the pumping process may be variable over time.

Referring to FIGS. 1A and 1*i*, the system 5, 325 may include a control room 220 allowing a pump operator 230 to operate the centrifugal pump 10. The analysis apparatus 150 may be configured to generate information indicative of an internal state of the centrifugal pump 10. The analysis apparatus 150 also includes an apparatus Human Computer Interface (HCI) 210 for enabling user input and user output. The HCI 210 may include a display, or screen, 210S for providing a visual indication of an analysis result. The analysis result displayed may include information indicative of an internal state of the centrifugal pump process for enabling the operator 230 to control the centrifugal pump.

A centrifugal pump controller 240 may be configured to deliver an impeller speed set point value $U1_{SP}$, $f_{ROTSP}$ so as to control the rotational speed $f_{ROT}$ of the impeller 20. According to some embodiments, the set point value $U1_{SP}$, $f_{ROTSP}$ is set by the operator 230.

The pump user input/output interface 250, in the example illustrated in FIG. 1A, is coupled to the regulator 240 and the HCI 210 is coupled to the analysis apparatus 150, or monitoring module 150A, configured to generate information indicative of an internal state of the centrifugal pump 10. Thus, when coupled only to monitoring module 150A as shown in FIG. 1A, the HCI 210 is advantageously possible to add, in a control room 220, without any need to modify any previously existing input/output interface 250 and regulator 240 used by a pump operator 230 to operate the centrifugal pump 10.

An object to be addressed by solutions and examples disclosed in this document is to describe methods and systems for an improved monitoring of an internal state X in a centrifugal pump 10 during operation. It is also an object, to be addressed by solutions and examples disclosed in this document, to describe methods and systems for an improved control of an internal state X in a centrifugal pump 10 during operation. Moreover, an object to be addressed by solutions and examples disclosed in this document is to describe methods and systems for an improved Human Computer Interface (HCI) relating to conveying useful information about the internal state X in a centrifugal pump during operation. Another object to be addressed by this document is to describe methods and systems for an improved Graphical User Interface relating to the pumping process in a centrifugal pump 10.

When the pump 10 is coupled to a fluid system 52, some aspects of the fluid system 52 may be affected by the internal state X of the pump. For example, if the pump delivers a fluid flow that exhibits a pulsation, such pulsation may cause resonance in some part of the fluid system 52. According to some examples, some aspects of a fluid system 52 can be measured or estimated in terms of parameters Y1, Y2, Y3, . . . Yn, describing such aspects of the fluid system 52.

Thus, an object to be addressed by some solutions and examples disclosed in this document is to describe methods and systems for an improved control of parameters Y1, Y2, Y3, . . . Yn relating to the fluid system 52.

Yet another object to be addressed by solutions and examples disclosed in this document is to describe methods and systems for an improved Human Computer Interface (HCI) relating to conveying useful information about a parameter Y1, Y2, Y3, . . . Yn relating to the fluid system 52 during operation of the centrifugal pump 10.

In this connection it may also be an object to be addressed by solutions and examples disclosed in this document to convey useful information about a parameter Y1, Y2, Y3, . . . Yn relating to the fluid system 52 during operation of the centrifugal pump 10 while also conveying useful information about a corresponding internal state X in the centrifugal pump 10 during operation.

Figure 2C:
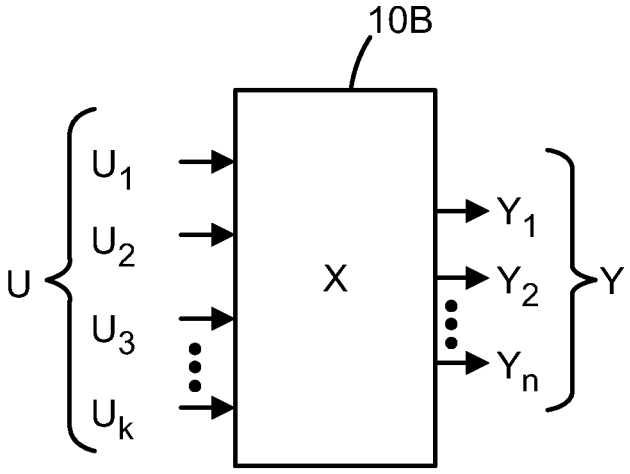
FIG. 2C is a block diagram illustrating a centrifugal pump as a box 10B receiving a number of inputs U1, . . . Uk.

FIG. 2C is a block diagram illustrating a centrifugal pump as a box 10B receiving a number of inputs U1, . . . Uk, causing the pump to have an internal state X. The internal state X of the pump may be described, or indicated, by a number of internal state parameters X1, X2, X3, . . . , Xm, where the index m is a positive integer.

Similarly, one or several aspects Y of the system 52 to which the pump 10 is coupled may be monitored. Thus, a system 52 coupled to receive fluid from a pump 10 may exhibit an output system state Y that can be described by a number of output parameters Y1, Y2, Y3, . . . Yn, where the index n is a positive integer. With reference to FIG. 1C it is noted that, for the purpose of analysis, a centrifugal pump 10 may be regarded as a black box 10B having a number of input variables, referred to as input parameters U1, U2, U3, . . . Uk, where the index k is a positive integer.

Using the terminology of linear algebra, the input variables U1, U2, U3, . . . Uk may be collectively referred to as an input vector U; the internal state parameters X1, X2, X3, . . . , Xm may be collectively referred to as an internal state vector X; and the output parameters Y1, Y2, Y3, . . . Yn may be collectively referred to as an output vector Y.

The internal state X of the pump 10, at a point in time termed r, can be referred to as X(r).

That internal state X(r) can be described, or indicated, by a number of parameter values, the parameter values defining different aspects of the internal state X(r) of the pump 10 at time r.

The internal state X(r) of the black box centrifugal pump 10B depends on the input vector U(r), and the output vector Y(r) depends on the internal state vector X(r).

Thus, during operation of the pump 10, the internal state X(r) can be regarded as a function of the input U(r):

$$X(r)=f_1(U(r)), \text{ wherein}$$

X(r) denotes the internal state X of the pump 10 at a point in time termed r; and U(r) denotes the input vector to the pump 10 at a point in time termed r Likewise, the output Y of the black box 10B can be regarded as a function of the internal state X:

$$Y(r)=f_2(X(r))$$

Figure 2D:
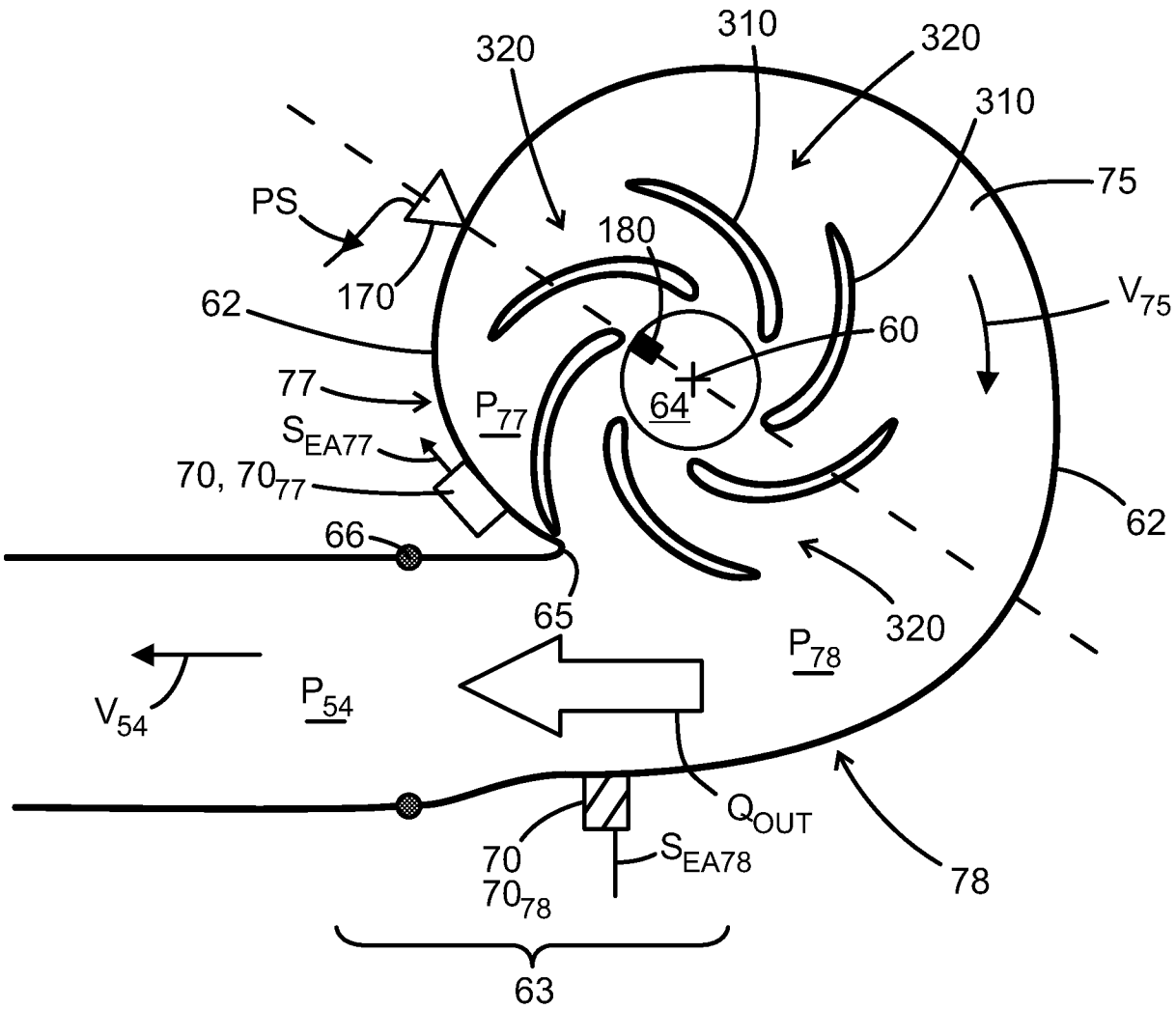
FIG. 2D is an illustration of an example of a centrifugal pump 10.

FIG. 2D is an illustration of an example of a centrifugal pump 10. The pump 10 of FIG. 2D may include parts, and be configured, as described above in relation to FIGS. 1A and 2A and/or as described elsewhere in this document. However, the example centrifugal pump 10 of FIG. 2D may include a sensor 70, $\mathbf{70}_{77}$ attached to the casing 62 at the first volute part 77 by the narrower cross sectional area near the tongue 65.

Thus, whereas the example pump of FIG. 2A has a sensor $\mathbf{70}_{78}$ attached to the casing 62 at the second volute part 78 by the larger cross sectional area near the outlet of the pump, the example pump of FIG. 2D also has a sensor $\mathbf{70}_{77}$ attached to the casing 62 at the first volute part 77 by the narrower cross sectional area near the tongue 65. Alternatively, the sensor $\mathbf{70}_{77}$ attached to the casing 62 at the first volute part 77 replaces the sensor $\mathbf{70}_{77}$. One or several sensors 70 may be placed so as to detect vibrations emanating from fluid pressure pulsations $P_{FP}$ that depend on a speed of rotation $f_{ROT}$ of the impeller 20.

Figure 2E:
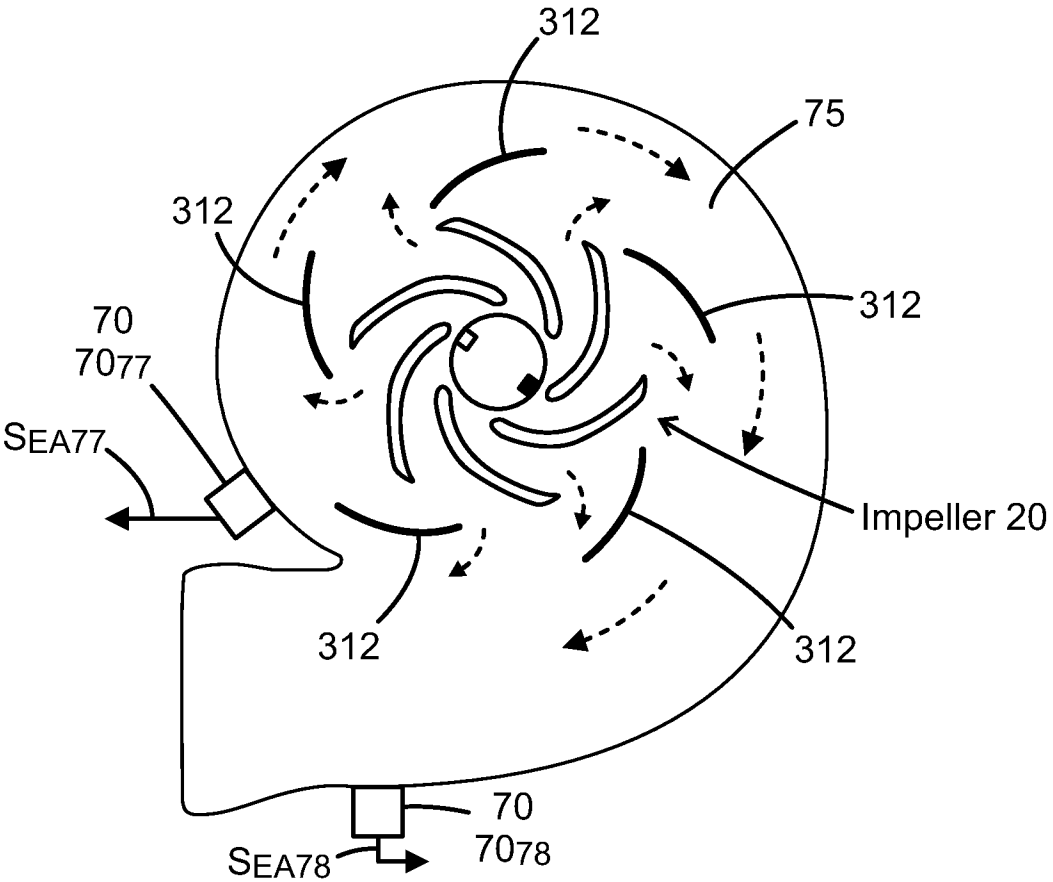
FIG. 2E is an illustration of yet another example of a centrifugal pump 10.

FIG. 2E is an illustration of another example of a centrifugal pump 10. The pump of FIG. 2E has a casing comprising a number fixed vanes 312 which are positioned between said volute 75 and said impeller 20.

Figure 3:
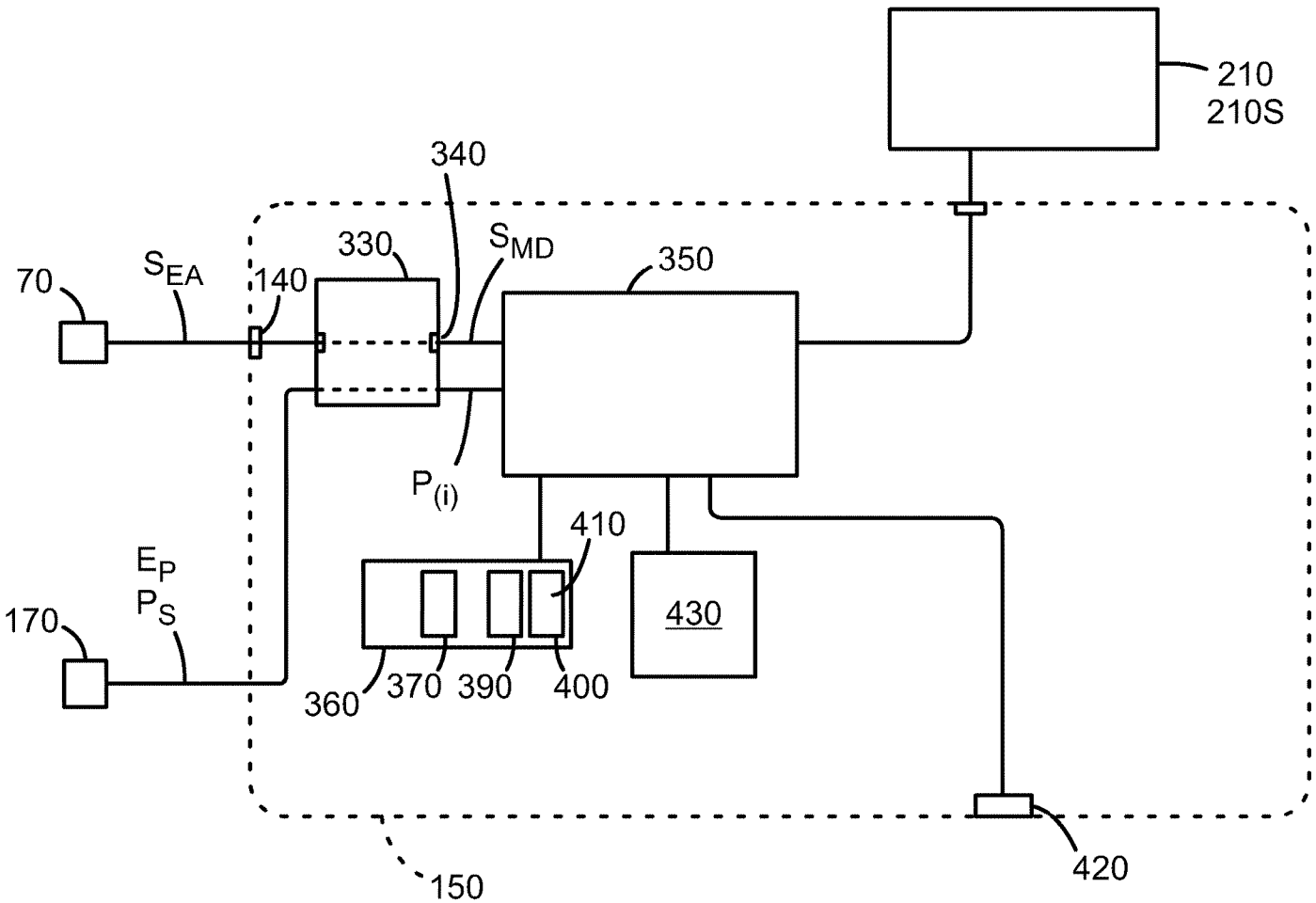
FIG. 3 is a schematic block diagram of an example of the analysis apparatus 150 shown in FIG. 1.

FIG. 3 is a schematic block diagram of an example of the analysis apparatus 150 shown in FIG. 1. The analysis apparatus 150 has an input 140 for receiving the analogue vibration signal $S_{EA}$, from the vibration sensor 70. The input 140 is connected to an analogue-to-digital (A/D) converter 330. The A/D converter 330 samples the received analogue vibration signal $S_{EA}$ with a certain sampling frequency $f_S$ so as to deliver a digital measurement data signal $S_{MD}$ having said certain sampling frequency $f_S$ and wherein the amplitude of each sample depends on the amplitude of the received analogue signal at the moment of sampling. The digital measurement data signal $S_{MD}$ is delivered on a digital output 340 which is coupled to a data processing device 350.

With reference to FIG. 3, the data processing device 350 is coupled to a computer readable medium 360 for storing program code. A computer readable medium 360 may also be referred to as a memory 360. The program memory 360 is preferably a non-volatile memory. The memory 360 may be a read/write memory, i.e. enabling both reading data from the memory and writing new data onto the memory 360. According to an example, the program memory 360 is embodied by a FLASH memory. The program memory 360 may comprise a first memory segment 370 for storing a first set of program code 380 which is executable so as to control the analysis apparatus 150 to perform basic operations. The program memory 360 may also comprise a second memory segment 390 for storing a second set of program code 394. The second set of program code in the second memory segment 390 may include program code for causing the analysis apparatus 150 to process a detected signal. The signal processing may include processing for generating information indicative of an internal state of a centrifugal pump, as discussed elsewhere in this document. Moreover, the signal processing may include control of the internal state of a centrifugal pump, as discussed elsewhere in this document. Thus, the signal processing may include generating data indicative of an internal state of a centrifugal pump, as disclosed in connection with embodiments of status parameter extractor 450 of e.g. FIGS. 5, 15 and/or 24.

The memory 360 may also include a third memory segment 400 for storing a third set of program code 410. The set of program code 410 in the third memory segment 400 may include program code for causing the analysis apparatus to perform a selected analysis function. When an analysis function is executed, it may cause the analysis apparatus to present a corresponding analysis result on user interface 210, 210S or to deliver the analysis result on a port 420.

The data processing device 350 is also coupled to a read/write memory 430 for data storage. Hence, the analysis apparatus 150 comprises the data processor 350 and program code for causing the data processor 350 to perform certain functions, including digital signal processing functions. When it is stated, in this document, that the apparatus 150 performs a certain function or a certain method, that statement may mean that the computer program runs in the data processing device 350 to cause the apparatus 150 to carry out a method or function of the kind described in this document.

The processor 350 may be a Digital Signal Processor. The Digital Signal Processor 350 may also be referred to as a DSP. Alternatively the processor 350 may be a Field Programmable Gate Array circuit (FPGA). Hence, the computer program may be executed by a Field Programmable Gate Array circuit (FPGA). Alternatively, the processor 350 may comprise a combination of a processor and an FPGA. Thus, the processor may be configured to control the operation of the FPGA.

Figure 4:
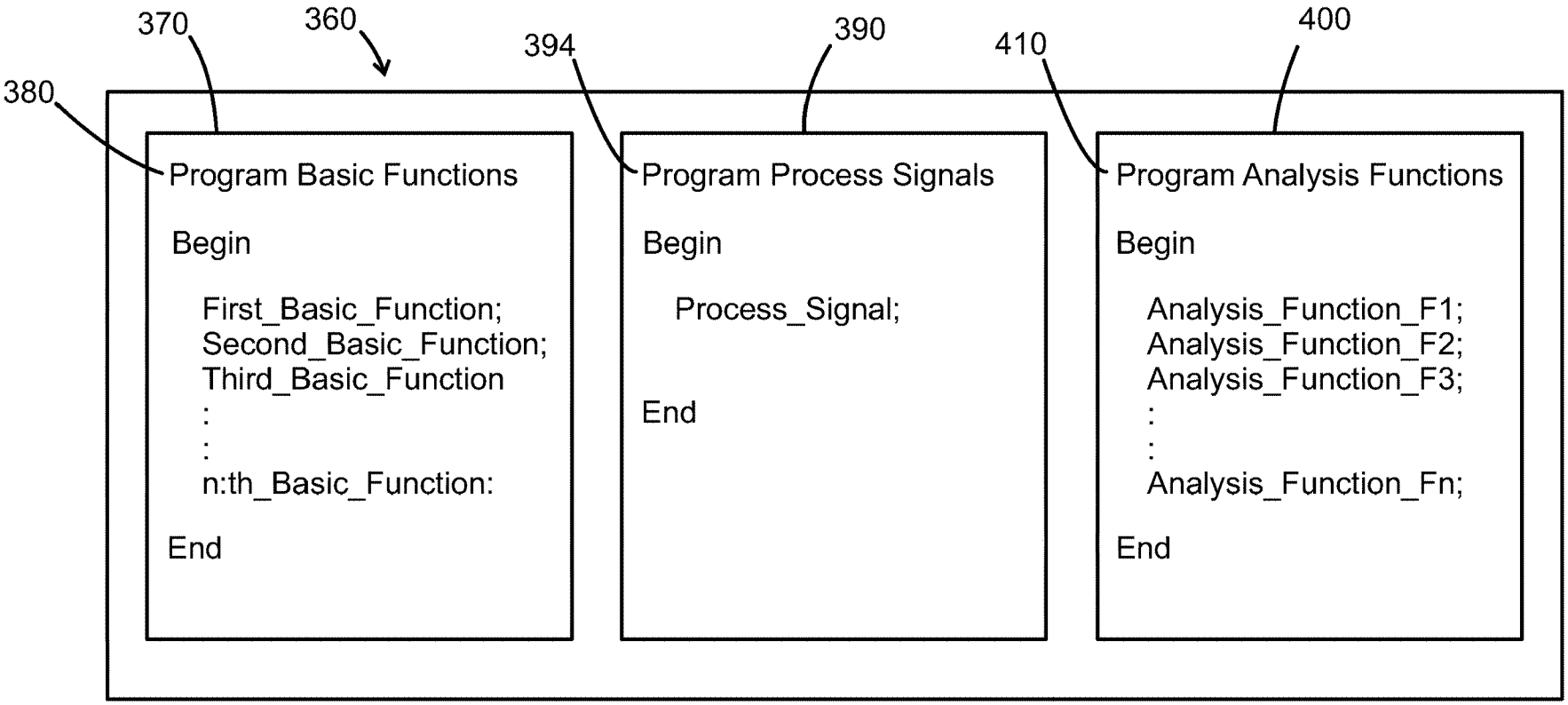
FIG. 4 is a simplified illustration of the program memory 360 and its contents.

FIG. 4 is a simplified illustration of the program memory 360 and its contents. The simplified illustration is intended to convey understanding of the general idea of storing different program functions in memory 360, and it is not necessarily a correct technical teaching of the way in which a program would be stored in a real memory circuit. The first memory segment 370 stores program code for controlling the analysis apparatus 150 to perform basic operations. Although the simplified illustration of FIG. 4 shows pseudo code, it is to be understood that the program code may be constituted by machine code, or any level program code that can be executed or interpreted by the data processing device 350 (FIG. 3).

The second memory segment 390, illustrated in FIG. 4, stores a second set of program code 394. The program code 394 in segment 390, when run on the data processing device 350, will cause the analysis apparatus 150 to perform a function, such as a digital signal processing function. The function may comprise an advanced mathematical processing of the digital measurement data signal $S_{MD}$.

Figure 27A:
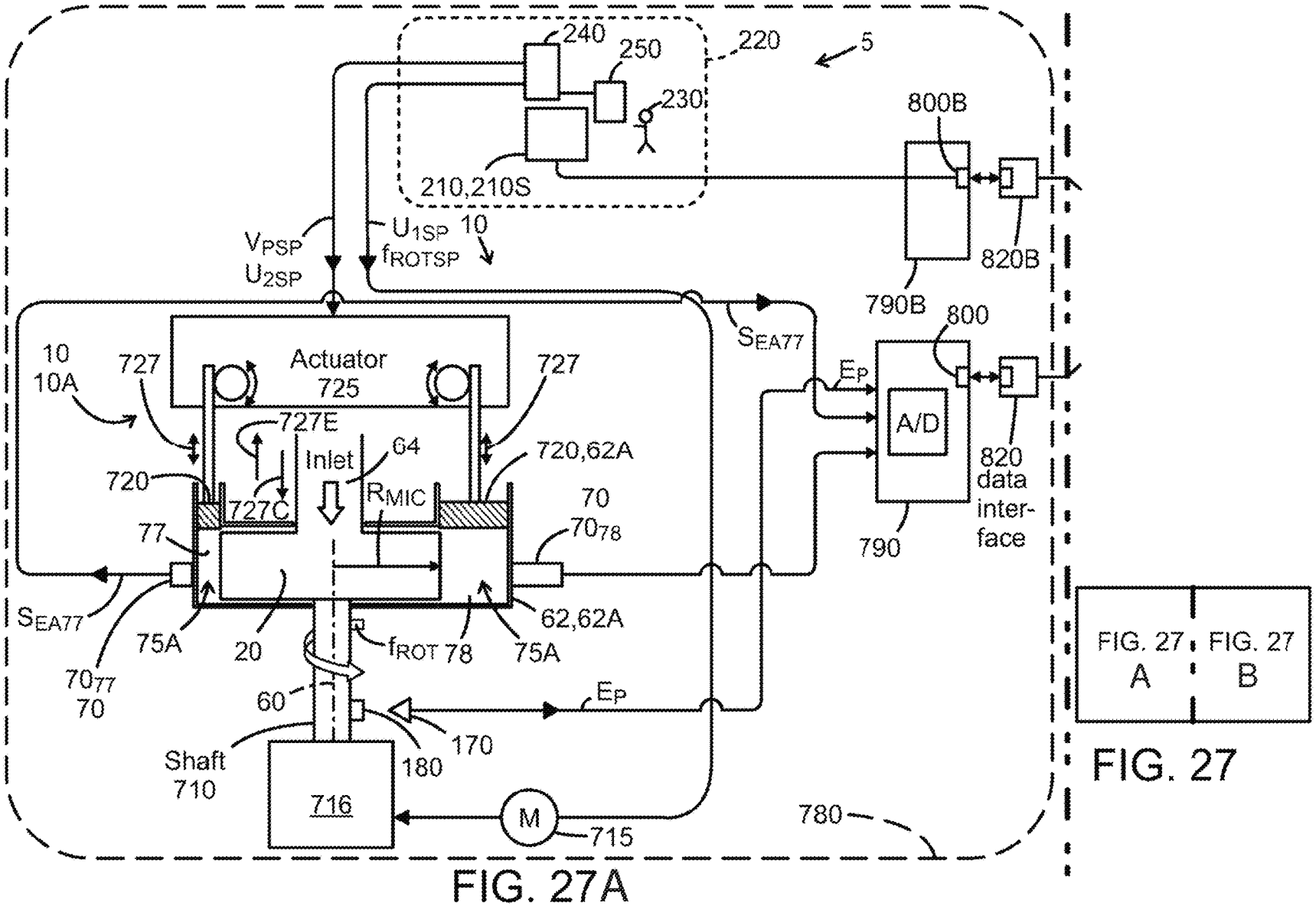
FIG. 27A-FIG. 27B are portions of a single figure (collectively referred to herein as FIG. 27), split across multiple sheets for clarity, and show a schematic block diagram of a distributed process monitoring system.
Figure 27B:
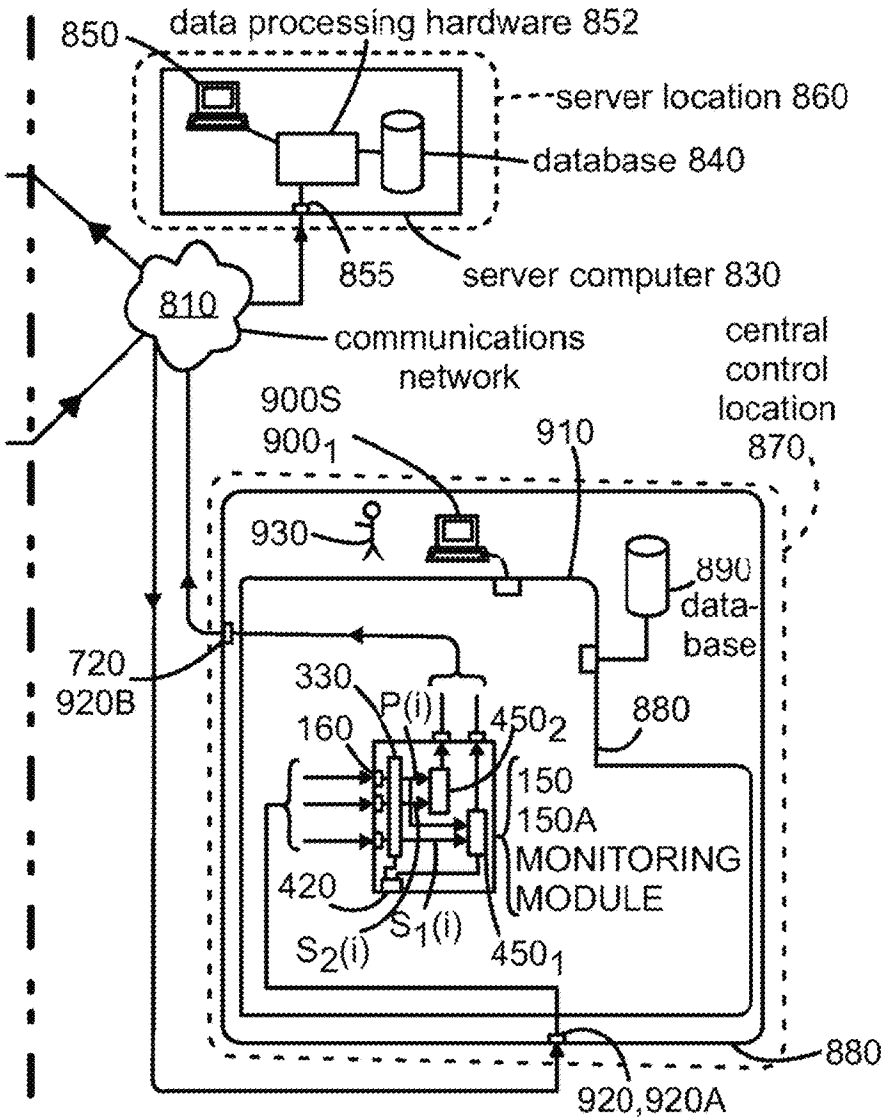
Figures 29, 29A:
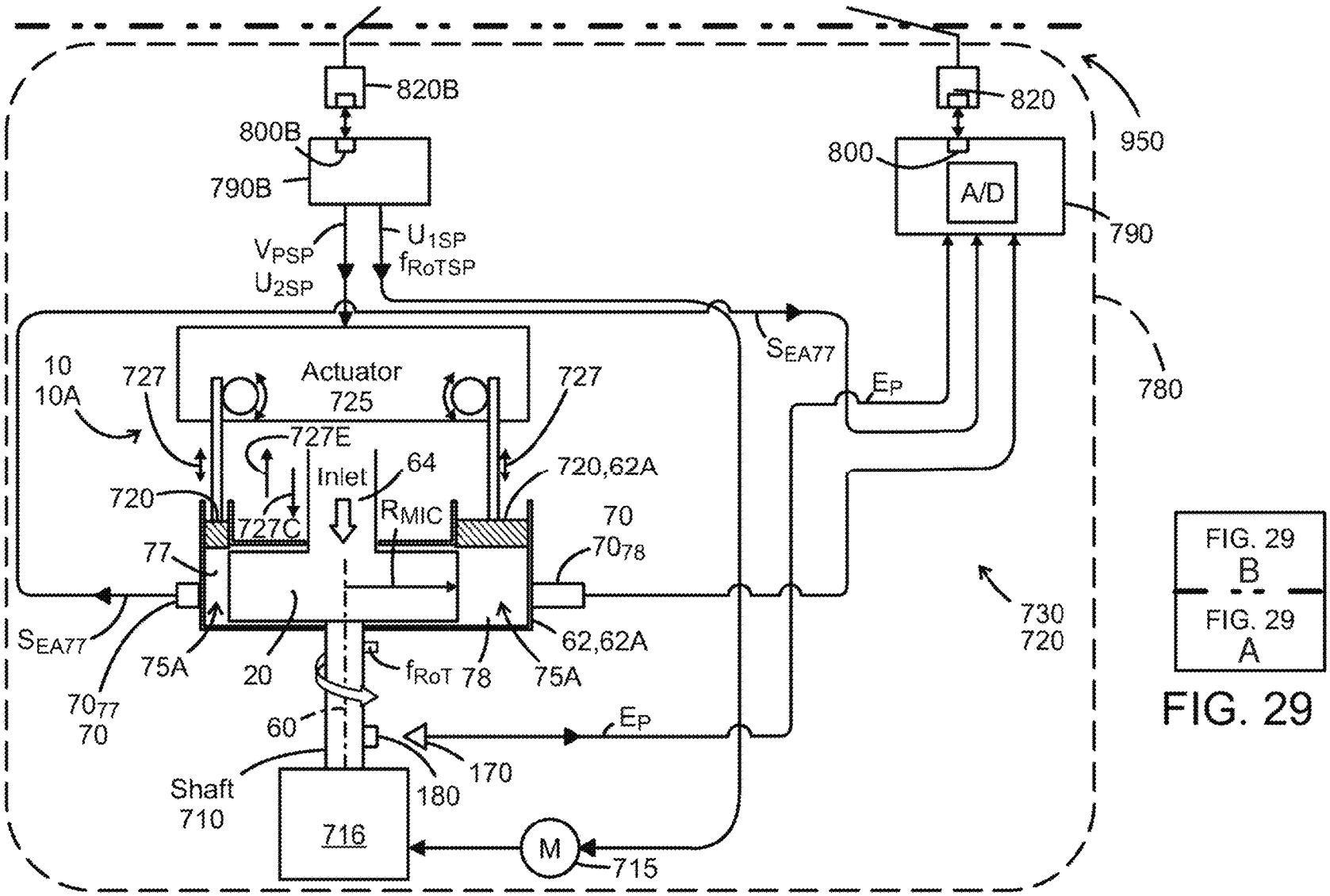
FIG. 29A-FIG. 29B are portions of a single figure (collectively referred to herein as FIG. 29), split across multiple sheets for clarity, and show a schematic block diagram of yet another embodiment of a distributed process control system.
Figure 29B:
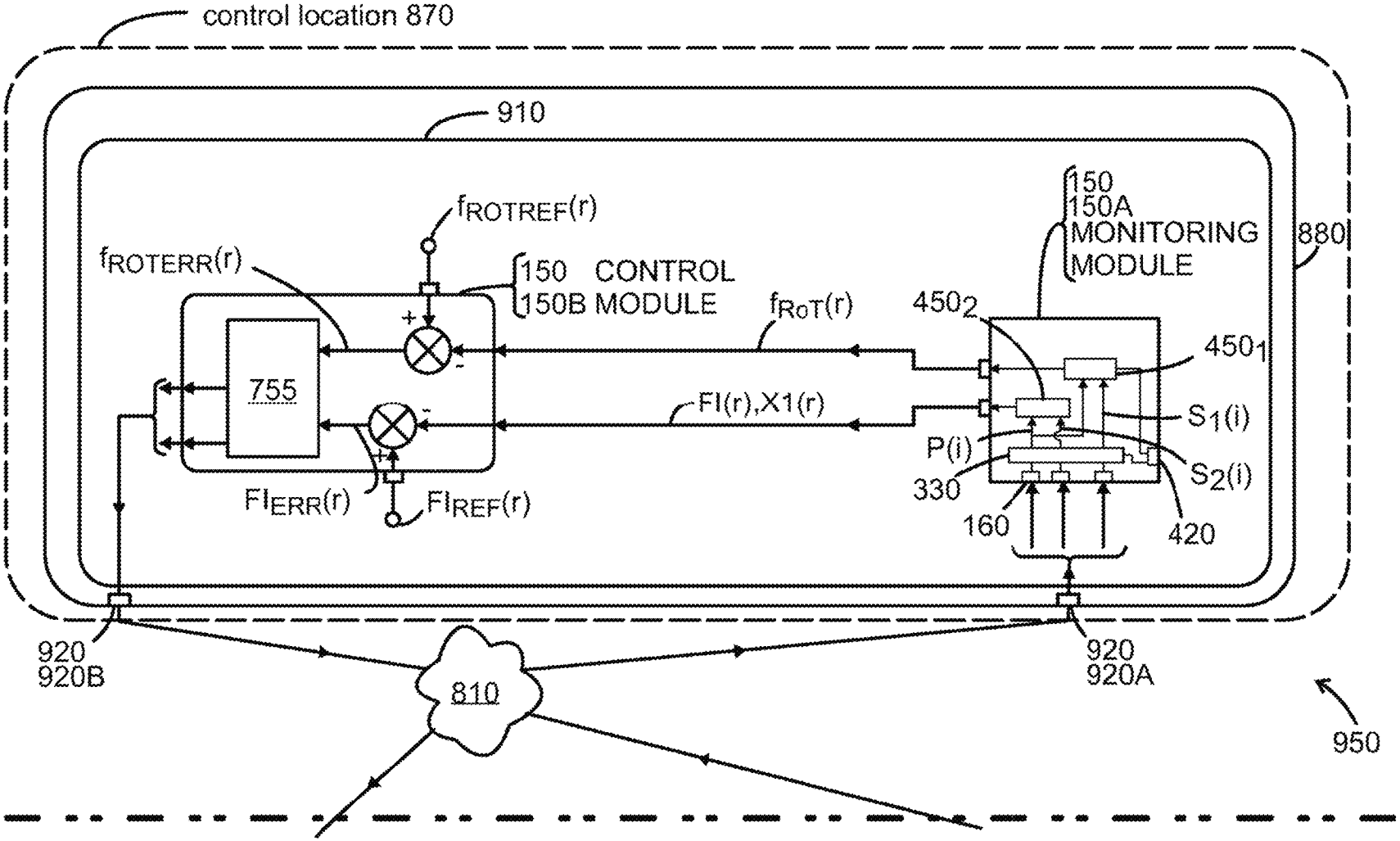

A computer program for controlling the function of the analysis apparatus 150 may be downloaded from a server computer 830 (See FIG. 27, or FIG. 29). This means that the program-to-be-downloaded is transmitted to over a communications network 810 (See FIG. 27, or FIG. 29). This can be done by modulating a carrier wave to carry the program over the communications network 810. Accordingly the downloaded program may be loaded into a digital memory, such as memory 360 (See FIGS. 3 and 4). Hence, a program 380 and/or a signal processing program 394 and/or an analysis function program 410 may be received via a communications port, such as port 420 (FIG. 1 & FIG. 3) or port 920 (See FIG. 27) or port 800B (see FIG. 27) or port (see FIG. 27), so as to load it into program memory 360.

Accordingly, this document also relates to a computer program product, such as program code 380 and/or program code 394 and/or program code 410 loadable into a digital memory of an apparatus, such as memory 360 (See FIGS. 3 and 4). The computer program product comprises software code portions for performing signal processing methods and/or analysis functions when said product is run on a data processing unit 350 of an apparatus 150. The term "run on a data processing unit" means that the computer program plus the data processing device 350 carries out a method of the kind described in this document.

The wording "a computer program product, loadable into a digital memory of a analysis apparatus" means that a computer program can be introduced into a digital memory of an analysis apparatus 150 so as achieve an analysis apparatus 150 programmed to be capable of, or adapted to, carrying out a method of a kind described in this document. The term "loaded into a digital memory of an apparatus" means that the apparatus programmed in this way is capable of, or adapted to, carrying out a function described in this document, and/or a method described in this document. The above mentioned computer program product may also be a program 380, 394, 410 loadable onto a computer readable medium, such as a compact disc or DVD. Such a computer readable medium may be used for delivery of the program 380, 394, 410 to a client. As indicated above, the computer program product may, alternatively, comprise a carrier wave which is modulated to carry the computer program 380, 394, 410 over a communications network. Thus, the computer program 380, 394, 410 may be delivered from a supplier server to a client having an analysis apparatus 150 by downloading over the Internet.

Figure 5:
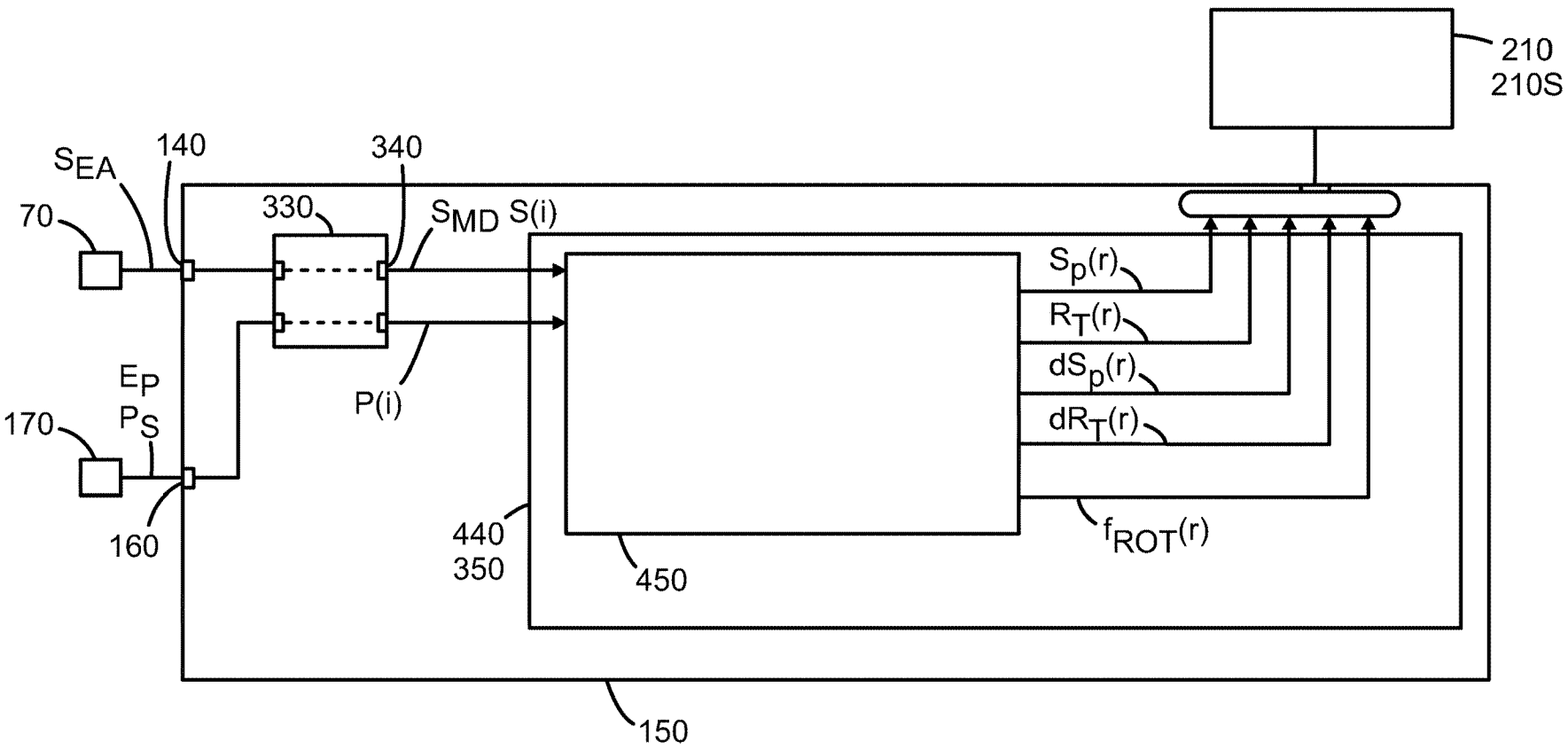
FIG. 5 is a block diagram illustrating an example of the analysis apparatus 150.

FIG. 5 is a block diagram illustrating an example of the analysis apparatus 150. In the FIG. 5 example, some of the functional blocks represent hardware and some of the functional blocks either may represent hardware, or may represent functions that are achieved by running program code on the data processing device 350, as discussed in connection with FIGS. 3 and 4.

The apparatus 150 in FIG. 5 shows an example of the analysis apparatus 150 shown in FIG. 1 and/or FIG. 3. For the purpose of simplifying understanding, FIG. 5 also shows some peripheral devices coupled to the apparatus 150. The vibration sensor 70 is coupled to the input 140 of the analysis apparatus 150 to deliver an analogue measuring signal $S_{EA}$, also referred to as vibration signal $S_{EA}$, to the analysis apparatus 150.

Moreover, the position sensor 170 is coupled to the second input 160. Thus, the position sensor 170 delivers the position signal Ep, dependent on the rotational position of the impeller 20, to the second input 160 of the analysis apparatus 150.

The input 140 is connected to an analogue-to-digital (A/D) converter 330. The A/D converter 330 samples the received analogue vibration signal $S_{EA}$ with a certain sampling frequency $f_S$ so as to deliver a digital measurement data signal $S_{MD}$ having said certain sampling frequency $f_S$ and wherein the amplitude of each sample depends on the amplitude of the received analogue signal at the moment of sampling. The digital measurement data signal $S_{MD}$ is delivered on a digital output 340, which is coupled to a data processing unit 440. The data processing unit 440 comprises functional blocks illustrating functions that are performed. In terms of hardware, the data processing unit 440 may comprise the data processing unit 350, the program memory 360, and the read/write memory 430 as described in connection with FIGS. 3 and 4 above. Hence, the analysis apparatus 150 of FIG. 5 may comprise the data processing unit 440 and program code for causing the analysis apparatus 150 to perform certain functions.

The digital measurement data signal $S_{MD}$ is processed in parallel with the position signal Ep. Hence, the A/D converter 330 may be configured to sample the position signal Ep simultaneously with the sampling of the analogue vibration signal $S_{EA}$. The sampling of the position signal Ep may be performed using that same sampling frequency $f_S$ so as to generate a digital position signal $E_{PD}$ wherein the amplitude of each sample P(i) depends on the amplitude of the received analogue position signal Ep at the moment of sampling. As mentioned above, the analogue position signal Ep may have a marker signal value $P_S$, e.g. in the form of an electric pulse having an amplitude edge that can be accurately detected and indicative of a certain rotational position of the monitored impeller 20. Thus, whereas the analogue position marker signal $P_S$ has an amplitude edge that can be accurately detected, the digital position signal $E_{PD}$ will switch from a first value, e.g. "0" (zero), to a second value, e.g. "1" (one), at a distinct time.

Hence, the A/D converter 330 may be configured to deliver a sequence of pairs of measurement values S(i) associated with corresponding position signal values P(i). The letter "i" in S(i) and P(i) denotes a point in time, i.e. a sample number. Hence, the time of occurrence of a rotational reference position of said rotating impeller 20 can be detected by analysing a time sequence of the position signal values P(i) and identifying the sample P(i) indicating that the digital position signal $E_{PD}$ has switched from the first value, e.g. "0" (zero), to the second value, e.g. "1" (one).

Figures 6A, 6B:
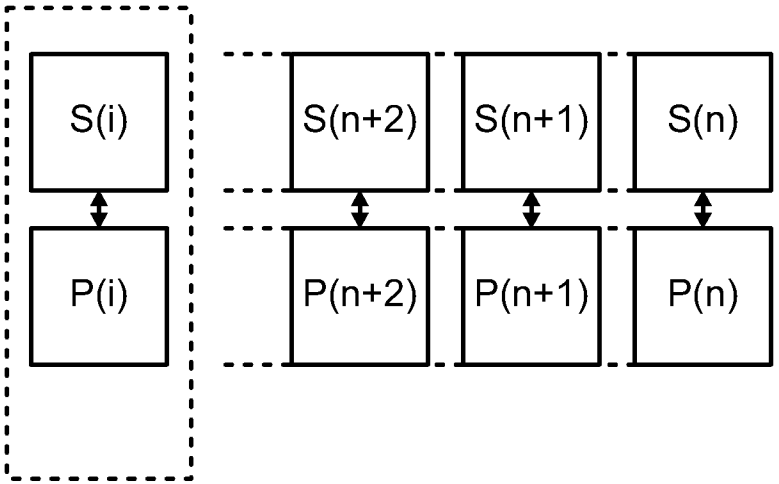
FIG. 6A is an illustration of a signal pair S(i) and P(i) as delivered by the A/D converter 330.
FIG. 6B is an illustration of a sequence of the signal pair S(i) and P(i) as delivered by the A/D converter 330.

FIG. 6A is an illustration of a signal pair S(i) and P(i) as delivered by the A/D converter 330.

FIG. 6B is an illustration of a sequence of the signal pair S(i) and P(i) as delivered by the A/D converter 330. A first signal pair comprises a first vibration signal amplitude value S(n), associated with the sample moment "n", being delivered simultaneously with a first position signal value P(n), associated with the sample moment "n". It is followed by a second signal pair comprising a second vibration signal amplitude value S(n+1), associated with the sample moment "n+1", which is delivered simultaneously with a second position signal value P(n+1), associated with the sample moment "n+1", and so on.

With reference to FIG. 5, the signal pair S(i) and P(i) is delivered to a status parameter extractor 450. The example status parameter extractor 450 of FIG. 5 is configured to generate an amplitude peak value $S_P(r)$ based on a time sequence of measurement sample values S(i).

The status parameter extractor 450 is also configured to generate a temporal relation value $R_T(j)$, also referred to as $R_T(r)$, based on a temporal duration ($T_D$) between time of occurrence of the amplitude peak value $S_P(r)$ and time of occurrence of a rotational reference position of said rotating impeller. As mentioned above, the time of occurrence of a rotational reference position of said rotating impeller can be detected by analysing a time sequence of the position signal values P(i) and identifying a sample P(i) indicating that the digital position signal $E_{PD}$ has switched from the first value, e.g. "0" (zero), to the second value, e.g. "1" (one).

Figure 7:
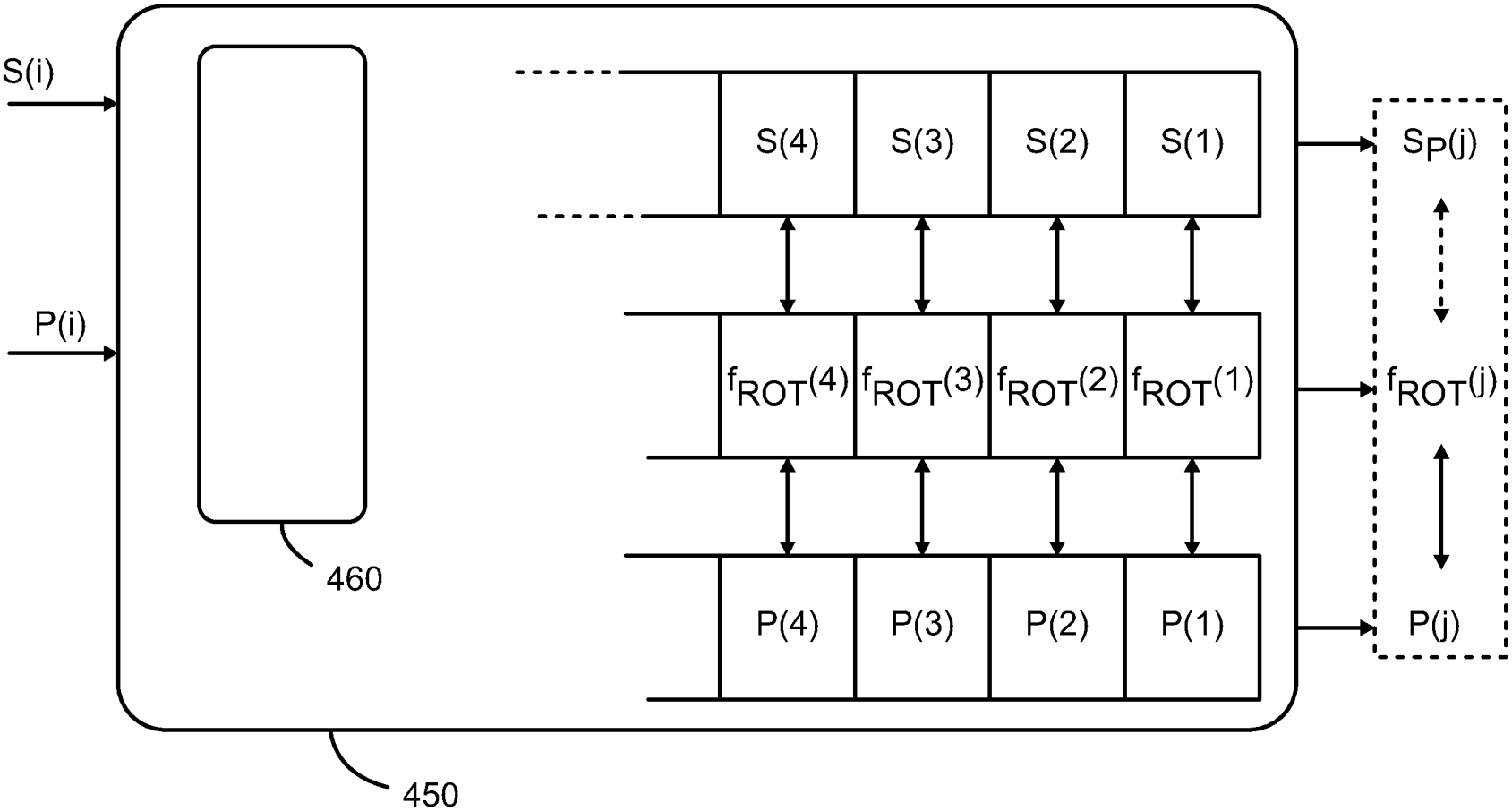
FIG. 7 is a block diagram that illustrates an example of a part of a status parameter extractor 450.
Figure 8A:
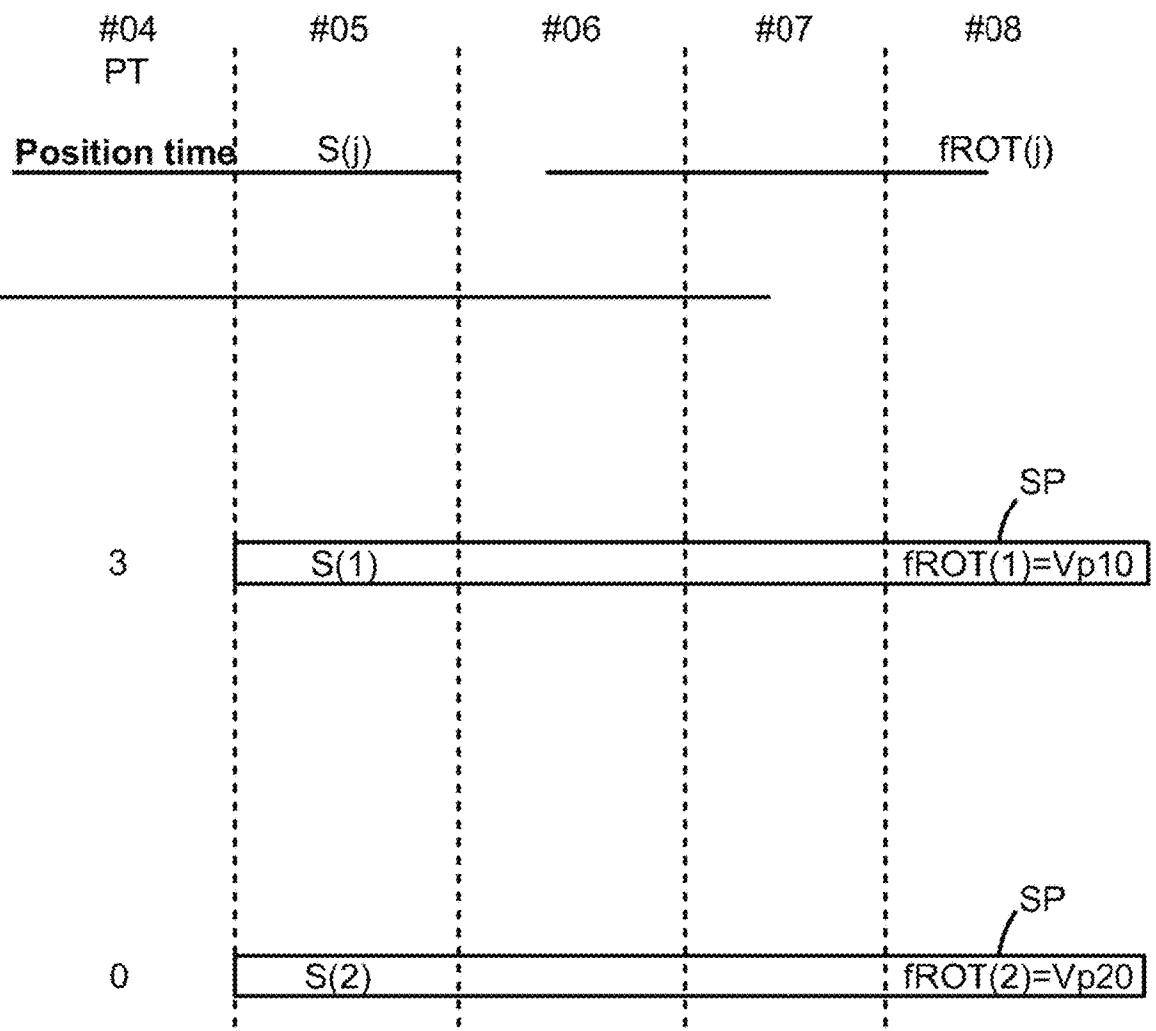
FIG. 8A-FIG. 8E are portions of a single figure (collectively referred to herein as FIG. 8), split across multiple sheets for clarity, and illustrate a simplified illustration of an example of the memory 460 and its contents.
Figure 8B:
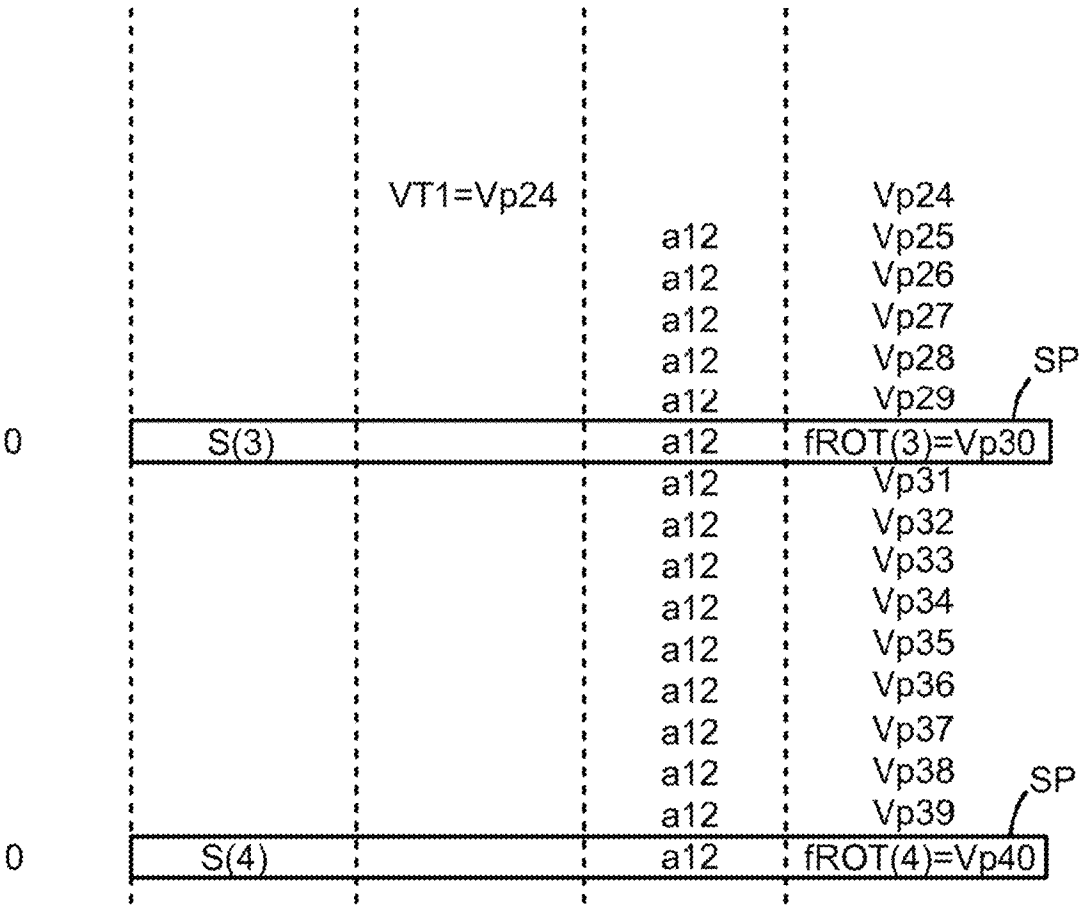
Figure 8C:
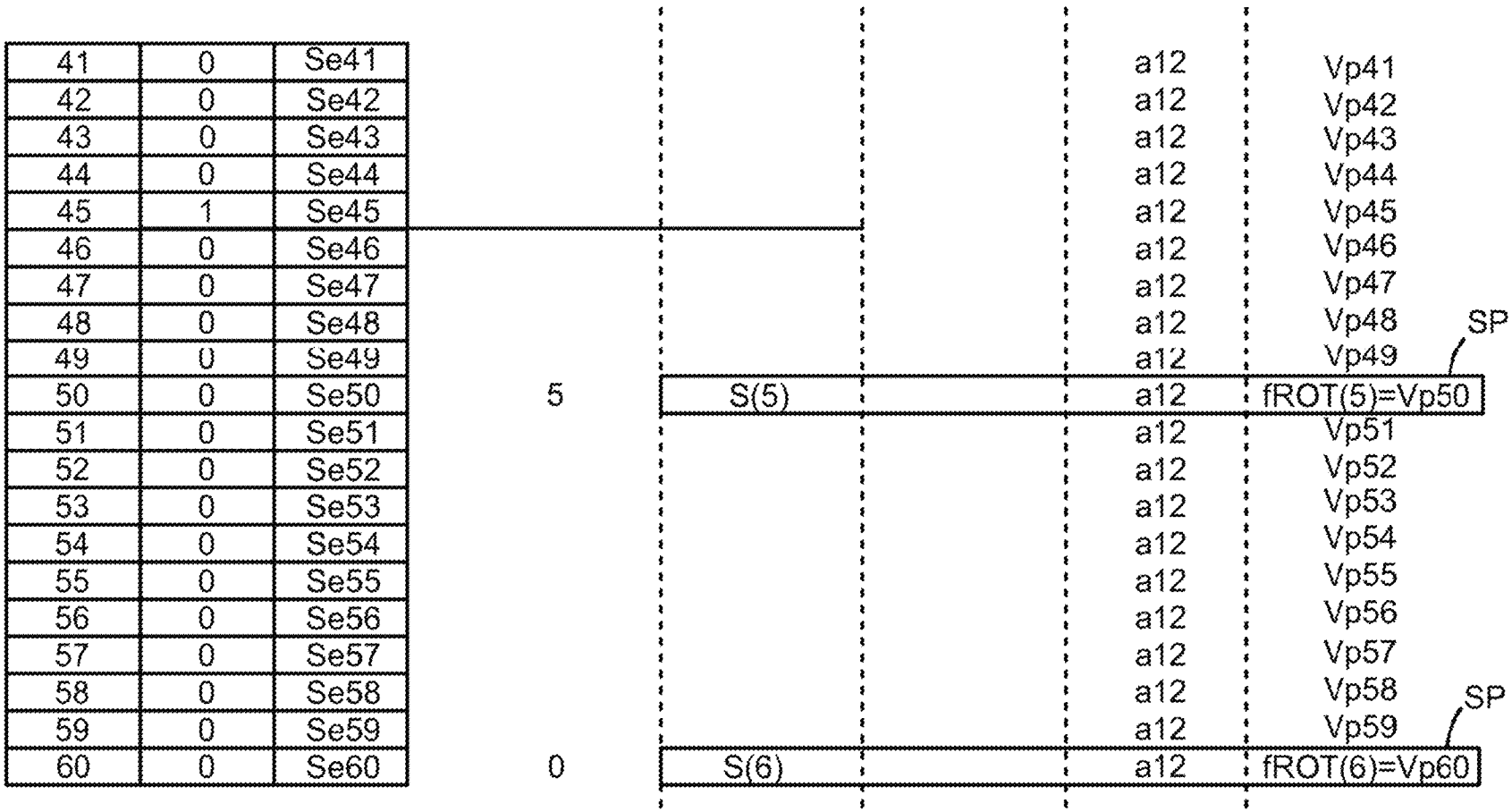
Figure 8D:
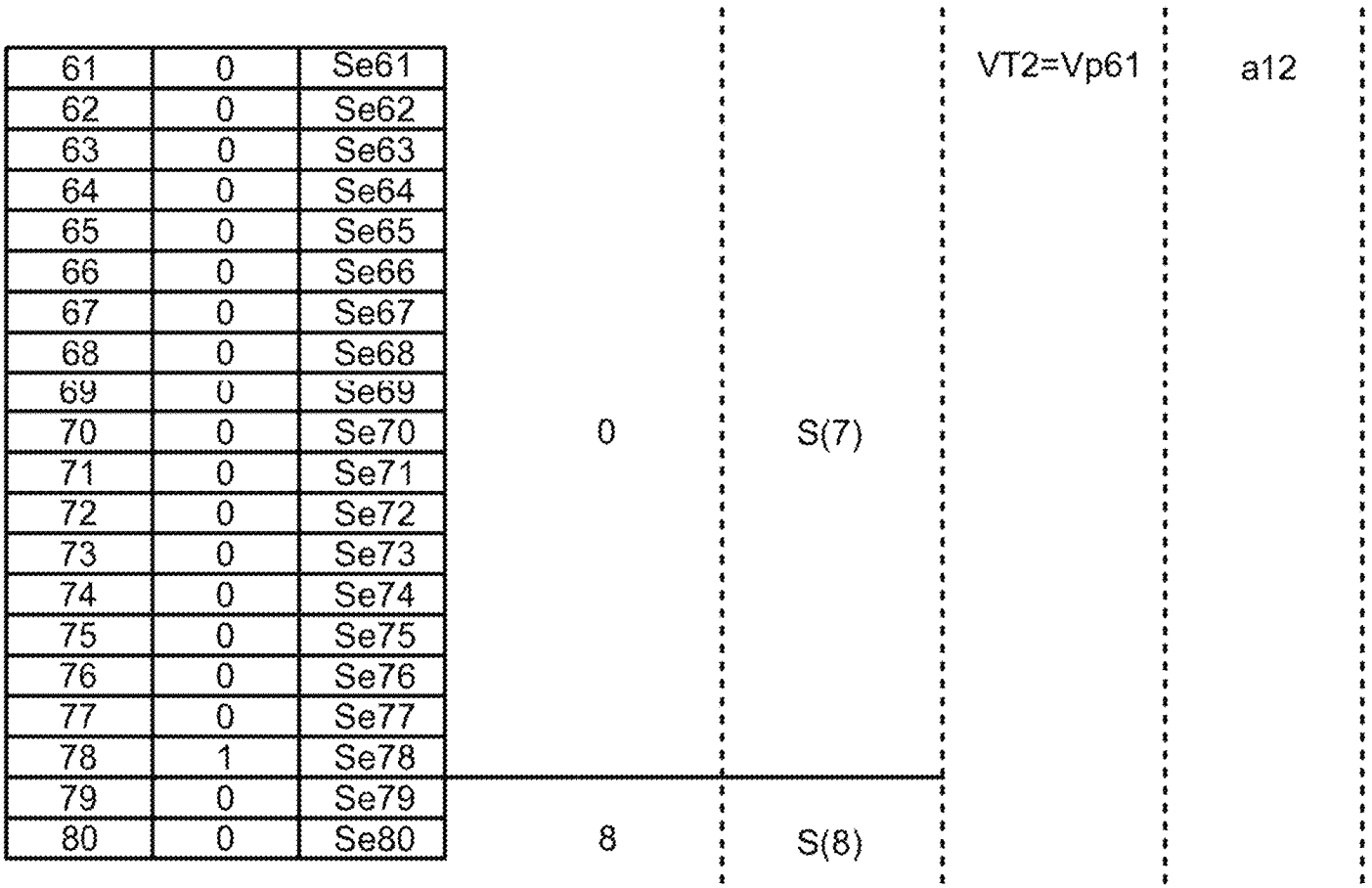
Figure 8E:
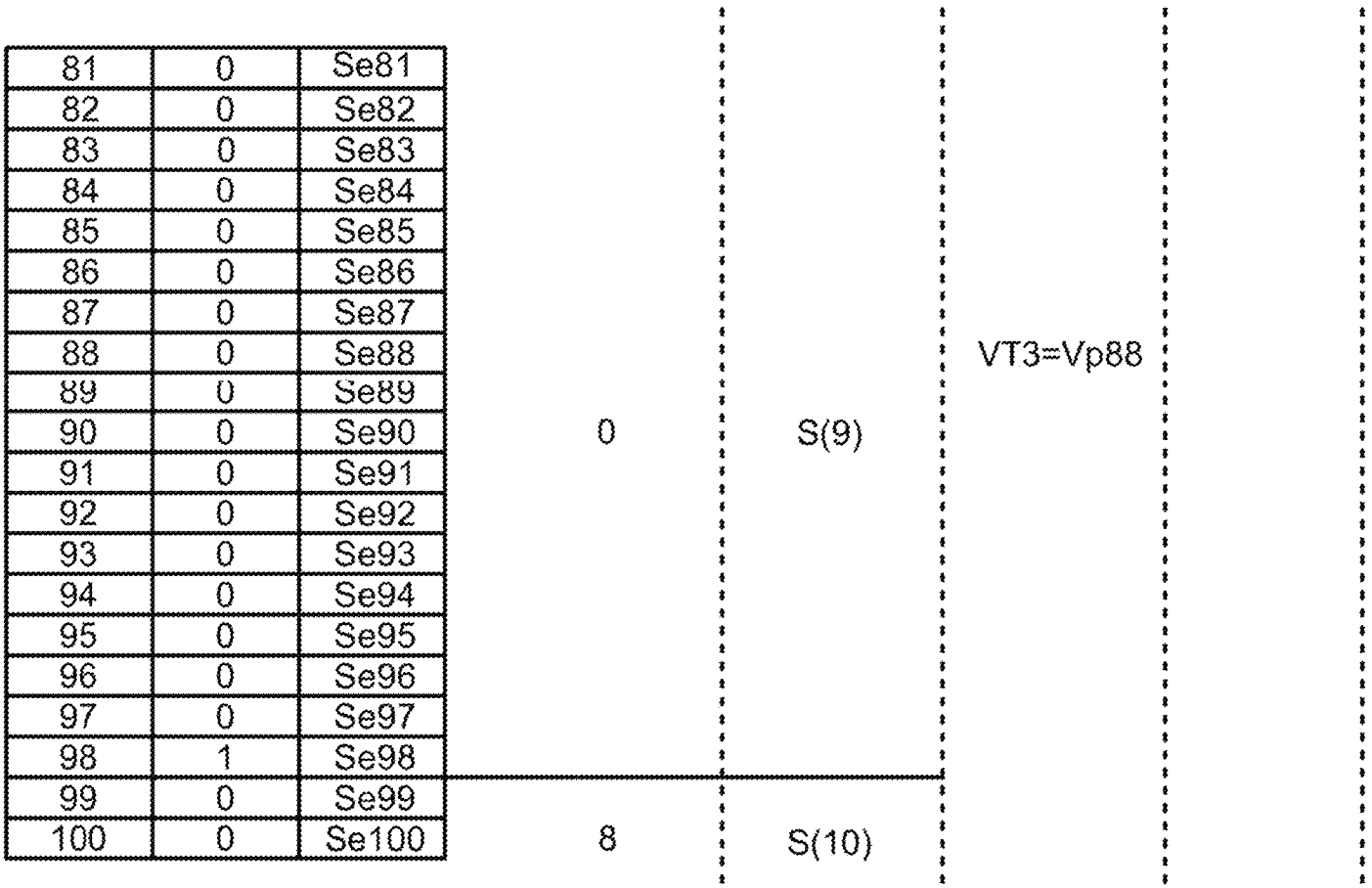

FIG. 7 is a block diagram that illustrates an example of a part of a status parameter extractor 450. According to an example the status parameter extractor 450 comprises a memory 460. The status parameter extractor 450 is adapted to receive a sequence of measurement values S(i) and a sequence of positional signals P(i), together with temporal relations there-between, and the status parameter extractor 450 is adapted to provide a sequence of temporally coupled values S(i), $f_{ROT}(i)$, and P(i). Thus, an individual measurement value S(i) is associated with a corresponding speed value $f_{ROT}(i)$, the speed value $f_{ROT}(i)$ being indicative of the rotational speed of the impeller 20 at the time of detection of the associated individual measurement value S(i). This is described in detail below with reference to FIGS. 8-13.

FIG. 8 is a simplified illustration of an example of the memory 460 and its contents, and columns #01, #02, #03, #04 and #05, on the left hand side of the memory 460 illustration, provide an explanatory image intended to illustrate the temporal relation between the time of detection of the encoder pulse signals P(i) (See column #02) and the corresponding vibration measurement values S(i) (See column #03).

As mentioned above, the analogue-to-digital converter 330 samples the analogue electric measurement signal $S_{EA}$ at an initial sampling frequency $f_S$ so as to generate a digital measurement data signal $S_{MD}$. The encoder signal P may also be detected with substantially the same initial temporal resolution $f_S$, as illustrated in the column #02 of FIG. 8.

Column #01 illustrates the progression of time as a series of time slots, each time slot having a duration $dt=1/f_{sample}$; wherein $f_{sample}$ is a sample frequency having an integer relation to the initial sample frequency $f_S$ with which the analogue electric measurement signal $S_{EA}$ is sampled. According to a preferred example, the sample frequency $f_{sample}$ is the initial sample frequency $f_S$. According to another example the sample frequency $f_{sample}$ is a first reduced sampling frequency $f_{SR1}$, which is reduced by an integer factor M as compared to the initial sampling frequency $f_S$.

In column #02 of FIG. 8 each positive edge of the encoder signal P is indicated by a "1". In this example a positive edge of the encoder signal P is detected in the 3:rd, the 45:th, the 78:th time slot and in the 98:th time slot, as indicated in column #02. According to another example, the negative edges of the positional signal are detected, which provides an equivalent result to detecting the positive edges. According to yet another example both the positive and the negative edges of the positional signal are detected, so as to obtain redundancy by enabling the later selection of whether to use the positive or the negative edge.

Column #03 illustrates a sequence of vibration sample values S(i). Column #05 illustrates the corresponding sequence of vibration sample values S(j), when an integer decimation is performed. Hence, when integer decimation is performed by this stage, it may e.g. be set up to provide an integer decimation factor M=10, and as illustrated in FIG. 8, there will be provided one vibration sample value S(j) (See column #05 in FIG. 8) for every ten samples S(i) (See column #03 in FIG. 8). According to an example, a very accurate position and time information PT, relating to the decimated vibration sample value S(j), is maintained by setting the PositionTime signal in column #04 to value PT=3, so as to indicate that the positive edge (see col #02) was detected in time slot #03. Hence, the value of the PositionTime signal, after the integer decimation is indicative of the time of detection of the position signal edge P in relation to sample value S(1).

In the example of FIG. 8, the amplitude value of the PositionTime signal at sample i=3 is PT=3, and since decimation factor M=10 so that the sample S(1) is delivered in time slot 10, this means that the edge was detected M-PT=10−3=7 slots before the slot of sample S(1).

Accordingly, the apparatus 150 may operate to process the information about the positive edges of encoder signal P(i) in parallel with the vibration samples S(i) in a manner so as to maintain the time relation between positive edges of the encoder signal P(i) and corresponding vibration sample values S(i), and/or integer decimated vibration sample values S(j), through the above mentioned signal processing from detection of the analogue signals to the establishing of the speed values $f_{ROT}$.

Figure 9:
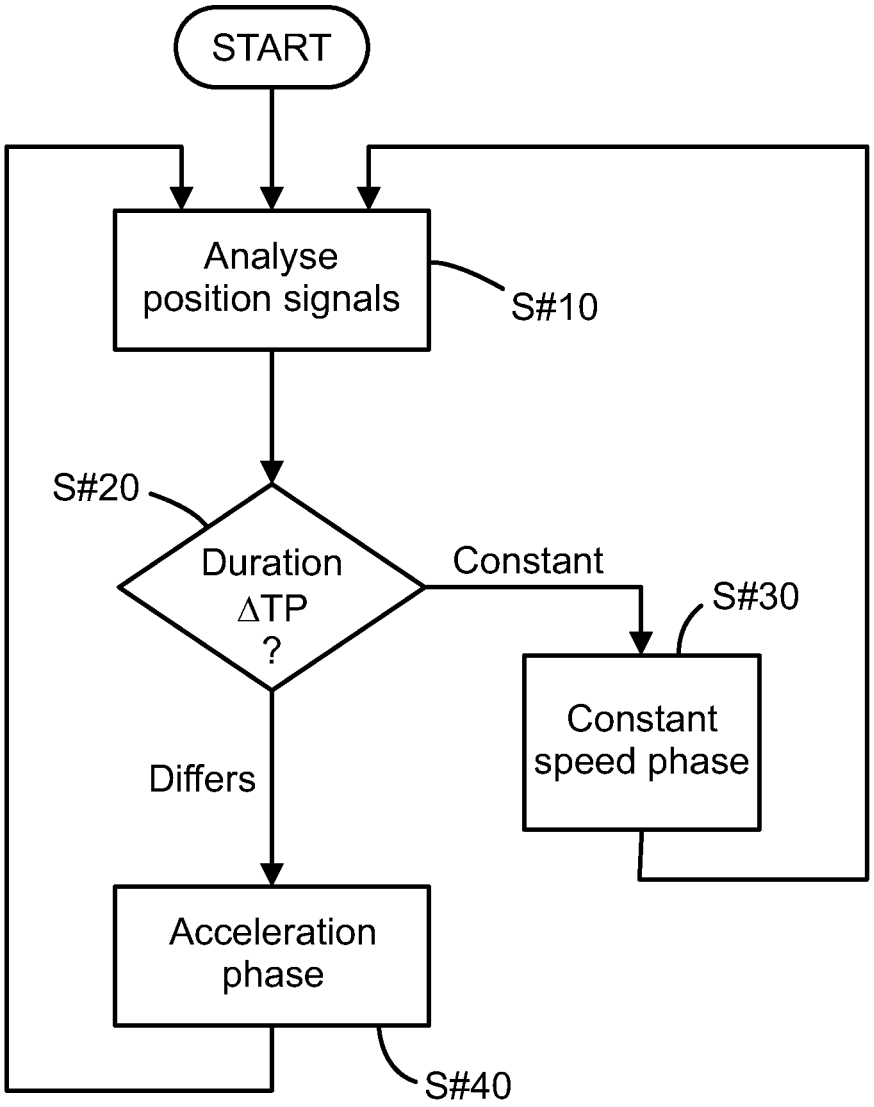
FIG. 9 is a flow chart illustrating an example of a method of operating the status parameter extractor 450 of FIG. 7.

FIG. 9 is a flow chart illustrating an example of a method of operating the status parameter extractor 450 of FIG. 7.

According to an example, the status parameter extractor 450 analyses (Step S #10) the temporal relation between three successively received position signals, in order to establish whether the monitored rotational impeller 20 is in a constant speed phase or in an acceleration phase. This analysis may be performed on the basis of information in memory 460, as described above (See FIG. 8).

If the analysis reveals that there is an identical number of time slots between the position signals, status parameter extractor 450 concludes (in step #20) that the speed is constant, in which case step S #30 is performed.

In step S #30, the status parameter extractor 450 may calculate the duration between two successive position signals, by multiplication of the duration of a time slot dt=1/fs with the number of time slots between the two successive position signals. When the position signal is provided once per full revolution of the monitored impeller 20, the speed of revolution may be calculated as $$V=1/(n_{diff}*dt),$$

wherein $n_{diff}$=the number of time slots between the two successive position signals. During constant speed phase, all of the sample values S(j) (see column #05 in FIG. 8) associated with the three analyzed position signals may be assigned the same speed value $f_{ROT}=V=1/(n_{diff}*dt)$, as defined above. Thereafter, step S #10 may be performed again on the next three successively received position signals. Alternatively, when step S #10 is repeated, the previously third position signal P3 will be used as the first position signal P1 (i.e. P1:=P3), so that it is ascertained whether any change of speed is at hand.

If the analysis (Step S #10) reveals that the number of time slots between the 1:st and the 2:nd position signals differs from the number of time slots between the 2:nd and 3:rd position signals, the status parameter extractor 450 concludes, in step S #20) that the monitored rotational impeller 20 is in an acceleration phase. The acceleration may be positive, i.e. an increase in rotational speed, or the acceleration may be negative, i.e. a decrease in rotational speed also referred to as retardation.

In a next step S #40, the status parameter extractor 450 operates to establish momentary speed values during acceleration phase, and to associate each one of the measurement data values S(j) with a momentary speed value Vp which is indicative of the speed of rotation of the monitored impeller at the time of detection of the sensor signal ($S_{EA}$) value corresponding to that data value S(j).

According to an example the status parameter extractor 450 operates to establish momentary speed values by linear interpolation. According to another example the status parameter extractor 450 operates to establish momentary speed values by non-linear interpolation.

Figure 10:
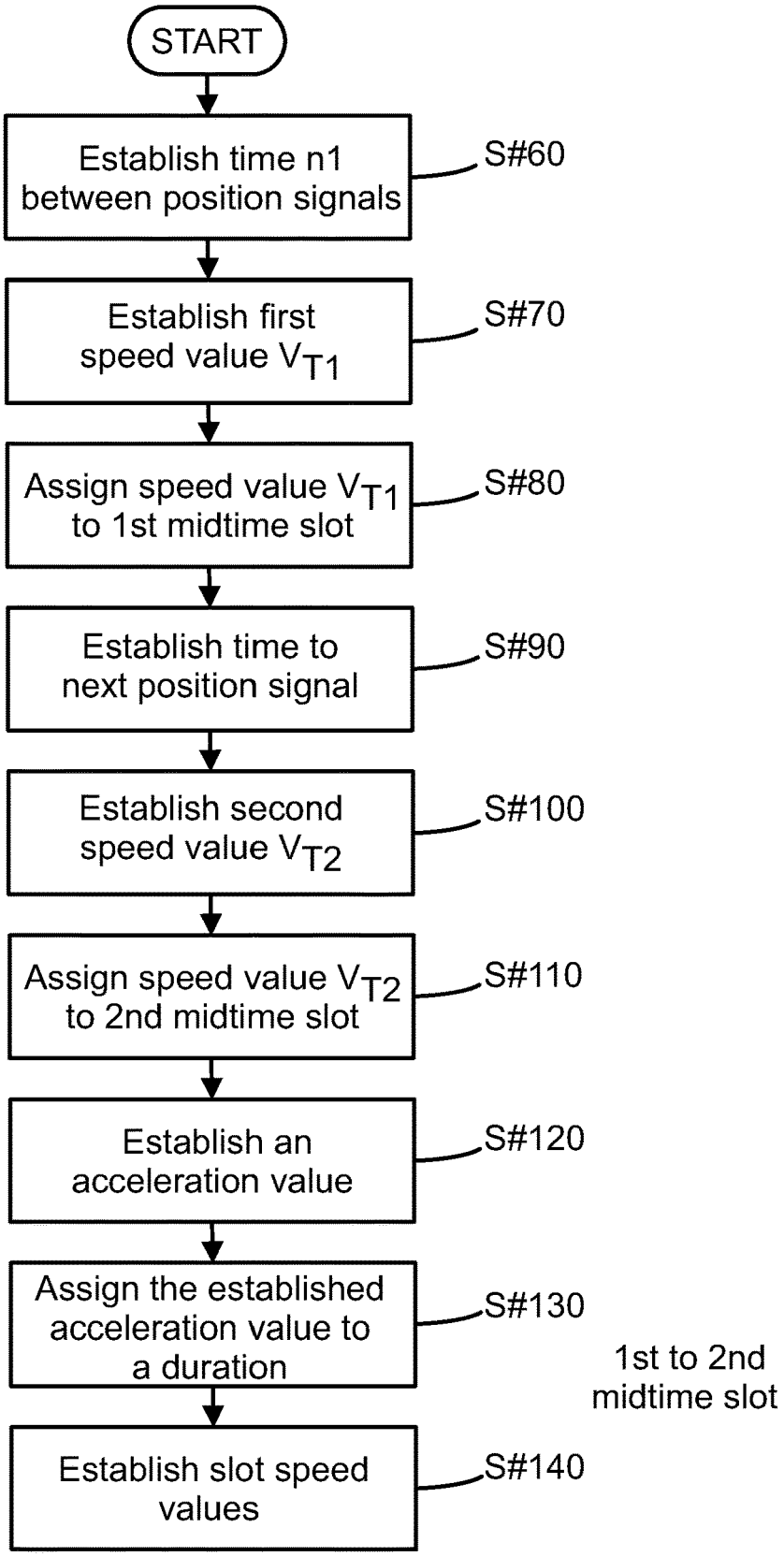
FIG. 10 is a flow chart illustrating an example of a method for performing step S #40 of FIG. 9.

FIG. 10 is a flow chart illustrating an example of a method for performing step S #40 of FIG. 9. According to an example, the acceleration is assumed to have a constant value for the duration between two mutually adjacent position indicators P (See column #02 in FIG. 8). Hence, when

- the position indicator P is delivered once per revolution, and
- the gear ratio is 1/1: then
- the angular distance travelled by the rotating impeller 20 between two mutually adjacent position indicators P is one (1) revolution, which may also be expressed as 360 degrees, and
- the duration is $T=n_{diff}*dt$,
  - where $n_{diff}$ is the number of slots of duration dt between the two mutually adjacent position indicators P.

With reference to FIG. 8, a first position indicator P was detected in slot i1=#03 and the next position indicator P was detected in slot i2=#45. Hence, the duration was $n_{diff1}$=i2−i1=45−3=42 time slots.

Hence, in step S #60 (See FIG. 10 in conjunction with FIG. 8), the status parameter extractor 450 operates to establish a first number of slots $n_{diff1}$ between the first two successive position signals P1 and P2, i.e. between position signal P(i=3) and position signal P(i=45).

In step S #70, the status parameter extractor 450 operates to calculate a first speed of revolution value VT1. The first speed of revolution value VT1 may be calculated as $$VT1=1/(n_{diff1}*dt),$$

wherein

VT1 is the speed expressed as revolutions per second, $n_{diff1}$=the number of time slots between the two successive position signals; and dt is the duration of a time slot, expressed in seconds.

Since the acceleration is assumed to have a constant value for the duration between two mutually adjacent position indicators P, the calculated first speed value VT1 is assigned to the time slot in the middle between the two successive position signals (step S #80).

Hence, in this example wherein first position indicator P1 was detected in slot $i_{P1}$=#03 and the next position indicator P2 was detected in slot $i_{P2}$=#45; the first mid time slot is slot $i_{P1-2}=i_{P1}+(i_{P2}-i_{P1})/2=3+(45-3)/2=3+21)=24$.

Hence, in step S #80 the first speed of revolution value VT1 may be assigned to a time slot (e.g. time slot i=24) representing a time point which is earlier than the time point of detection of the second position signal edge P(i=45), see FIG. 8.

The retro-active assigning of a speed value to a time slot representing a point in time between two successive position signals advantageously enables a significant improvement since it enables a drastic reduction of the inaccuracy of the speed value, as explained in connection with FIG. 13. Whereas state of the art methods of attaining a momentary rotational speed value of a centrifugal pump impeller 20 may have been satisfactory for establishing constant speed values at several mutually different speeds of rotation, the state of the art solutions appear to be unsatisfactory when used for establishing speed values for a rotational centrifugal pump impeller 20 during an acceleration phase. In this connection, it is noted that impeller speed may be affected by fluid pressure variations in the fluid system.

By contrast, the methods according to examples disclosed in this document enable the establishment of speed values with an advantageously small level of inaccuracy even during an acceleration phase.

In a subsequent step S #90, the status parameter extractor 450 operates to establish a second number of slots $n_{diff2}$ between the next two successive position signals. In the example of FIG. 8, that is the number of slots $n_{diff2}$ between slot 45 and slot 78, i.e. $n_{diff2}=78-45=33$.

In step S #100, the status parameter extractor 450 operates to calculate a second speed of revolution value VT2. The second speed of revolution value VT2 may be calculated as $$VT2 = Vp61 = 1/(n_{diff2} * dt),$$

wherein $n_{diff2}$=the number of time slots between the next two successive position signals P2 and P3. Hence, in the example of FIG. 8, $n_{diff2}$=33 i.e. the number of time slots between slot 45 and slot 78.

Since the acceleration may be assumed to have a constant value for the duration between two mutually adjacent position indicators P, the calculated second speed value VT2 is assigned (Step S #110) to the time slot in the middle between the two successive position signals.

Hence, in the example of FIG. 8, the calculated second speed value VT2 is assigned to slot 61, since 45+(78−45)/2=61.5. Hence the speed at slot 61 is set to $$V(61):=VT2.$$

Hence, in this example wherein one position indicator P was detected in slot i2=#45 and the next position indicator P was detected in slot i3=#78; the second mid time slot is the integer part of:

$$i_{P2-3} = i_{P2} + (i_{P3} - i_{P2})/2 = 45 + (78 - 45)/2 = 45 + 33/2 = 61,5$$

Hence, slot 61 is the second mid time slot $i_{P2-3}$.

Hence, in step S #110 the second speed value VT2 may advantageously be assigned to a time slot (e.g. time slot i=61) representing a time point which is earlier than the time point of detection of the third position signal edge P(i=78), see FIG. 8. This feature enables a somewhat delayed real-time monitoring of the rotational speed while achieving an improved accuracy of the detected speed.

In the next step S #120, a first acceleration value is calculated for the relevant time period. The first acceleration value may be calculated as:

$$a12 = (VT2 - VT1)/((i_{VT2} - i_{VT1}) * dt)$$

In the example of FIG. 8, the second speed value VT2 was assigned to slot 61, so $i_{VT2}$=61 and first speed value VT1 was assigned to slot 24, so $i_{VT1}$=24.

Hence, since dt=1/fs, the acceleration value may be set to $$a12 = fs * (VT2 - VT1)/(i_{VT2} - i_{VT1})$$

for the time period between slot 24 and slot 60, in the example of FIG. 8.

In the next step S #130, the status parameter extractor 450 operates to associate the established first acceleration value a12 with the time slots for which the established acceleration value a12 is valid. This may be all the time slots between the slot of the first speed value VT1 and the slot of the second speed value VT2. Hence, the established first acceleration value a12 may be associated with each time slot of the duration between the slot of the first speed value VT1 and the slot of the second speed value VT2. In the example of FIG. 8 it is slots 25 to 60. This is illustrated in column #07 of FIG. 8.

In the next step S #140, the status parameter extractor 450 operates to establish speed values for measurement values s(j) associated with the duration for which the established acceleration value is valid. Hence speed values are established for each time slot which is associated with a measurement value s(j), and associated with the established first acceleration value a12.

During linear acceleration, i.e. when the acceleration a is constant, the speed at any given point in time is given by the equation:

$$V(i) = V(i-1) + a * dt, \quad \text{(Eq. 3)}$$

wherein

V(i) is the momentary speed at the point of time of slot i

V(i−1) is the momentary speed at the point of time of the slot immediately preceding slot i a is the acceleration dt is the duration of a time slot According to an example, the speed for each slot from slot 25 to slot 60 may be calculated successively in this manner, as illustrated in column #08 in FIG. 8. Hence, momentary speed values Vp to be associated with the detected measurement values Se(25), Se(26), Se(27) . . . Se(59), and Se(60) associated with the acceleration value a12 may be established in this manner (See time slots 25 to 60 in column #08 in conjunction with column #03 and in conjunction with column #07 in FIG. 8).

Hence, momentary speed values S(j) [See column #05] to be associated with the detected measurement values S(3), S(4), S(5), and S(6) associated with the acceleration value a12 may be established in this manner.

According to another example, the momentary speed for the slot 30 relating to the first measurement value s(j)=S(3) may be calculated as:

$$V(i=30)=Vp30=VT1+a*(30-24)*dt=Vp24+a*6*dt$$

The momentary speed for the slot 40 relating to the first measurement value s(j)=S(4) may be calculated as:

$$V(i=40)=Vp40=VT1+a*(40-24)*dt=Vp40+a*16*dt$$

or as:

$$V(i=40)=Vp40=V(30)+(40-30)*dt=Vp30+a*10*dt$$

The momentary speed for the slot 50 relating to the first measurement value s(j)=S(5) may then subsequently be calculated as:

$$V(i=50)=Vp50=V(40)+(50-40)*dt=Vp40+a*10*dt$$

and the momentary speed for the slot 60 relating to the first measurement value s(j)=S(6) may then subsequently be calculated as:

$$V(i=60)=Vp50+a*10*dt$$

When measurement sample values S(i) [See column #03 in FIG. 8] associated with the established acceleration value have been associated with a momentary speed value, as described above, an array of data including a time sequence of measurement sample values S(i), each value being associated with a speed value V(i), $f_{ROT}(i)$, may be delivered on an output of said status parameter extractor 450.

Alternatively, if a decimation of sample rate is desired, it is possible to do as follows: When measurement sample values S(j) [See column #05 in FIG. 8] associated with the established acceleration value have been associated with a momentary speed value, as described above, an array of data including a time sequence of measurement sample values S(j), each value being associated with a speed value V(j), $f_{ROT}(j)$, may be delivered on an output of said status parameter extractor 450.

Figure 11:
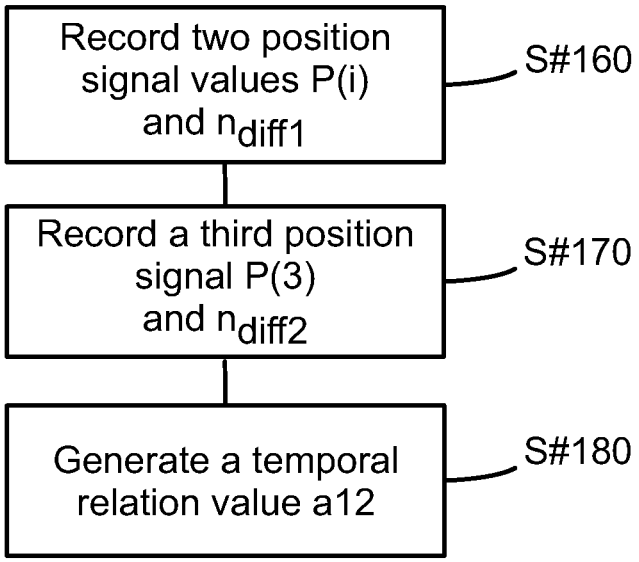
FIG. 11 is a flow chart illustrating another example of a method.

With reference to FIG. 11, another example of a method is described. According to this example, the status parameter extractor 450 operates to record (see step S #160 in FIG. 11) a time sequence of position signal values P(i) of said position signal (Ep) such that there is a first temporal relation $n_{diff1}$ between at least some of the recorded position signal values (P(i)), such as e.g. between a first position signal value P1(i) and a second position signal value P2(i). According to an example, the second position signal value P2(i) is received and recorded in a time slot (i) which arrives $n_{diff1}$ slots after the reception of the first position signal value P1(i) (see step S #160 in FIG. 11). Then the third position signal value P3(i) is received and recorded (see step S #170 in FIG. 11) in a time slot (i) which arrives ndiff2 slots after the reception of the second position signal value P2(i).

As illustrated by step S #180 in FIG. 11, the status parameter extractor 450 may operate to calculate a relation value $$a12=n\text{diff}1/n\text{diff}2$$

If the relation value a12 equals unity, or substantially unity, then the status parameter extractor 450 operates to establish that the speed is constant, and it may proceed with calculation of speed according to a constant speed phase method.

If the relation value a12 is higher than unity, the relation value is indicative of a percentual speed increase.

If the relation value a12 is lower than unity, the relation value is indicative of a percentual speed decrease.

The relation value a12 may be used for calculating a speed V2 at the end of the time sequence based on a speed V1 at the start of the time sequence, e.g. as $$V2=a12*V1$$

Figure 12:
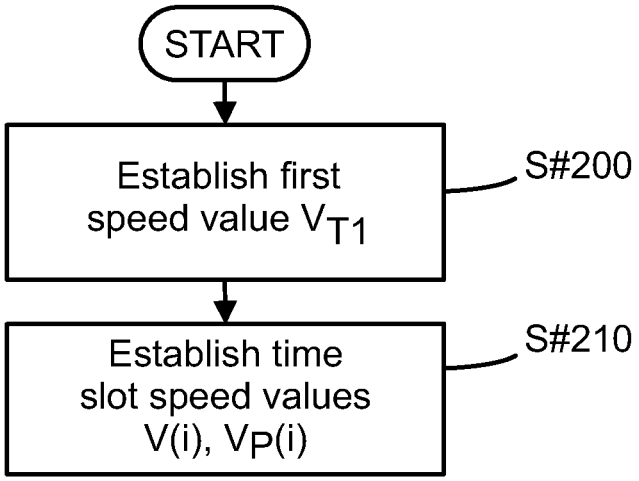
FIG. 12 is a flow chart illustrating an example of a method for performing step S #40 of FIG. 9.

FIG. 12 is a flow chart illustrating an example of a method for performing step S #40 of FIG. 9. According to an example, the acceleration is assumed to have a constant value for the duration between two mutually adjacent position indicators P (See column #02 in FIG. 8). Hence, when

- the position indicator P is delivered once per revolution, and
- the gear ratio is 1/1: then
- the angular distance travelled between two mutually adjacent position indicators P is 1 revolution, which may also be expressed as 360 degrees, and
- the duration is T=n*dt,
  - where n is the number of slots of duration dt between the first two mutually adjacent position indicators P1 and P2.

In a step S #200, the first speed of revolution value VT1 may be calculated as $$VT1=1/(n_{diff1}*dt),$$

wherein

- VT1 is the speed expressed as revolutions per second,
- ndiff1=the number of time slots between the two successive position signals; and
- dt is the duration of a time slot, expressed in seconds. The value of dt may e.g be the inverse of the initial sample frequency fs.

Since the acceleration is assumed to have a constant value for the duration between two mutually adjacent position indicators P, the calculated first speed value VT1 is assigned to the first mid time slot in the middle between the two successive position signals P(i) and P(i+ndiff1).

In a step S #210, a second speed value VT2 may be calculated as $$VT2=1/(\text{ndiff}2*dt),$$

wherein

VT2 is the speed expressed as revolutions per second, ndiff2=the number of time slots between the two successive position signals; and dt is the duration of a time slot, expressed in seconds. The value of dt may e.g. be the inverse of the initial sample frequency fs.

Since the acceleration is assumed to have a constant value for the duration between two mutually adjacent position indicators P, the calculated second speed value VT2 is assigned to the second mid time slot in the middle between the two successive position signals P(i+ndiff1) and P(i+ndiff1+ndiff2).

Thereafter, the speed difference $V_{Delta}$ may calculated as $$V_{Delta} = VT2 - VT1$$

This differential speed $V_{Delta}$ value may be divided by the number of time slots between the second mid time slot and the first mid time slot. The resulting value is indicative of a speed difference dV between adjacent slots. This, of course, assumes a constant acceleration, as mentioned above.

The momentary speed value to be associated with selected time slots may then be calculated in dependence on said first speed of revolution value VT1, and the value indicative of the speed difference between adjacent slots.

When the measurement sample values S(i), associated with time slots between the first mid time slot and the second mid time slot, have been associated with a momentary speed value, as described above, an array of data including a time sequence of measurement sample values S(i), each value being associated with a speed value V(i) is delivered on an output of said status parameter extractor 450. The momentary speed value V(i) may also be referred to as $f_{ROT}(i)$.

In summary, according to some examples, a first momentary speed value VT1 may be established in dependence of the angular distance delta-$FI_{p1-p2}$ between a first positional signal P1 and a second positional signal P2, and in dependence of the corresponding duration delta-$T_{p1-p2}=t_{P2}-t_{P1}$.

Thereafter, a second momentary speed value VT2 may be established in dependence of the angular distance delta-$FI_{p2-p3}$ between the second positional signal P2 and a third positional signal P3, and in dependence of the corresponding duration delta-$T_{p2-p3}=t_{P2}-t_{P1}$.

Thereafter, momentary speed values for the rotational impeller 20 may be established by interpolation between the first momentary speed value VT1 and the second momentary speed value VT2.

In other words, according to examples, two momentary speed values VT1 and VT2 may be established based on the angular distances delta-$FI_{p1-p2}$, delta-$FI_{p2-p3}$ and the corresponding durations between three consecutive position signals, and thereafter momentary speed values for the rotational impeller 20 may be established by interpolation between the first momentary speed value VT1 and the second momentary speed value VT2.

Figure 13:
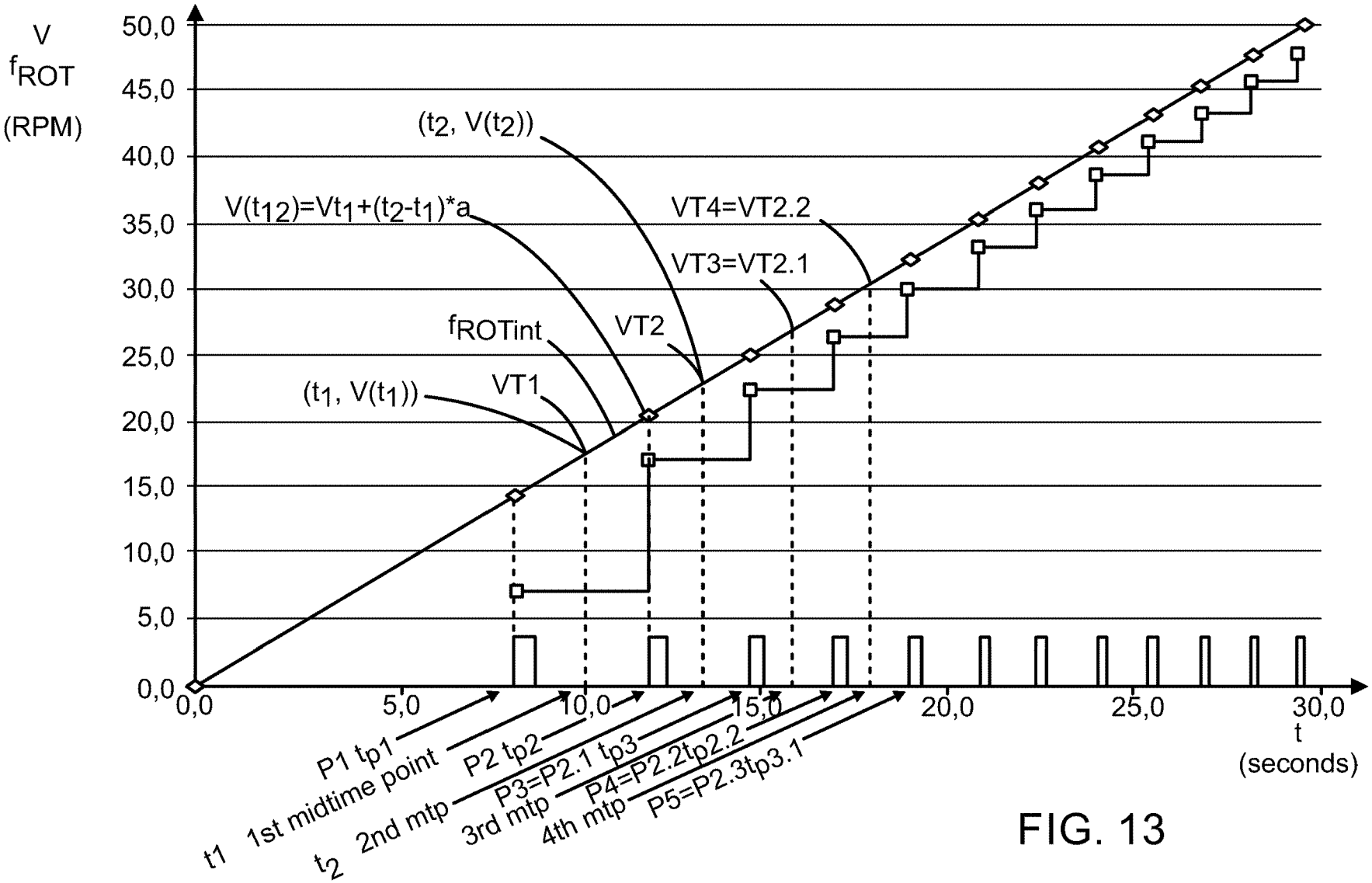
FIG. 13 is a graph illustrating a series of temporally consecutive position signals, each position signal being indicative of a full revolution of the monitored impeller.

FIG. 13 is a graph illustrating a series of temporally consecutive position signals P1, P2, P3, . . . , each position signal P being indicative of a full revolution of the monitored impeller 20. Hence, the time value, counted in seconds, increases along the horizontal axis towards the right.

The vertical axis is indicative of speed of rotation, graded in revolutions per minute (RPM). With reference to FIG. 13, effects of the method according to an example are illustrated. A first momentary speed value $V(t_1)$=VT1 may be established in dependence of the angular distance delta-$FI_{p1-p2}$ between the first positional signal P1 and the second positional signal P2, and in dependence of the corresponding duration delta-$T_{1-2}=t_{P2}-t_{P1}$. The speed value attained by dividing the angular distance delta-$FI_{p1-p2}$ by the corresponding duration $(t_{P2}-t_{P1})$ represents the speed $V(t_1)$ of the rotational impeller 20 at the first mid time point $t_1$, also referred to as mtp (mid time point), as illustrated in FIG. 13.

Thereafter, a second momentary speed value $V(t_2)$=VT2 may be established in dependence of the angular distance delta-FI between the second positional signal P2 and a third positional signal P3, and in dependence of the corresponding duration delta–T2–3=$T_{P3}-T_{P2}$.

The speed value attained by dividing the angular distance delta-FI by the corresponding duration $(t_{P3}-t_{P2})$ represents the speed $V(t_2)$ of the rotational impeller 20 at the 2:nd mid time point $t_2$ (2:nd mtp), as illustrated in FIG. 13.

Thereafter, momentary speed values for time values between the first mid time point and the 2:nd mid time point may be established by interpolation between the first momentary speed value VT1 and the second momentary speed value VT2, as illustrated by the curve $f_{ROTint}$.

Mathematically, this may be expressed by the following equation:

$$V(t12) = V(t1) + a*(t12 - t1) \quad \text{(Eq. 4)}$$

Hence, if the speed of the impeller 20 can be detected at two points of time (t1 and t2), and the acceleration a is constant, then the momentary speed at any point of time can be calculated. In particular, the speed V(t12) of the impeller at time t12, being a point in time after $t_1$ and before $t_2$, can be calculated by $$V(t12) = V(t_1) + a*(t12 - t_1) \quad \text{(Eq. 4)}$$

wherein a is the acceleration, and $t_1$ is the first mid time point $t_1$ (See FIG. 13).

The establishing of a speed value as described above, as well as the compensatory decimation as described with reference to FIGS. 20, 21, and 22, may be attained by performing the corresponding method steps, and this may be achieved by means of a computer program 94 stored in memory 60, as described above. The computer program may be executed by a DSP 50. Alternatively the computer program may be executed by a Field Programmable Gate Array circuit (FPGA).

The establishing of a speed value $f_{ROT}(i)$ as described above may be performed by the analysis apparatus 150 when a processor 350 executes the corresponding program code 380, 394, 410 as discussed in conjunction with FIG. 4 above. The data processor 350 may include a central processing unit 350 for controlling the operation of the analysis apparatus 14. Alternatively, the processor 50 may include a Digital Signal Processor (DSP) 350. According to another example the processor 350 includes a Field programmable Gate Array circuit (FPGA). The operation of the Field programmable Gate Array circuit (FPGA), may be controlled by a central processing unit 350 which may include a Digital Signal Processor (DSP) 350.

Identification of Data Relating to the Operating Point of a Centrifugal Pump

During operation of a centrifugal pump 10 there may be an occurrence of pressure fluctuations $P_{FP}$ in the fluid material 30 being pumped. The pressure fluctuations in the fluid material 30 may cause mechanical vibration $V_{FP}$ in the pump casing 62 (Se FIG. 2A, 2D and/or FIGS. 14A-G).

As mentioned above, the centrifugal pump impeller 20 has a number of vanes 310. The number L of vanes 310 is an important factor in relation to analysis of the vibrations resulting from rotation of the pump impeller 20. According to some embodiments the number L of vanes 310 may be any number higher than L=1. According to some embodiments the number L of vanes 310 may be anywhere in the range from L=2 to L=60. According to some embodiments the number L of vanes 310 may be anywhere in the range from L=2 to L=35.

The existence of a vibration signal signature $S_{FP}$ which is dependent on the vibration movement $V_{FP}$ of the casing may therefore provide information relating to a momentary internal state of the pumping process in the pump. A repetition frequency $f_R$ of the fluid pressure fluctuations depends on the number L of vanes 310 and on the speed of rotation $f_{ROT}$ of the impeller 20.

The inventor realized that some of the mechanical vibration of the casing 62 is caused by pressure fluctuations in the fluid material 30. The repetition frequency $f_R$ of the pressure fluctuations depends on the number L of vanes 310 and on the speed of rotation $f_{ROT}$ of the impeller 20.

When the monitored centrifugal pump impeller 20 rotates at a constant rotational speed such a repetition frequency $f_R$ may be discussed either in terms of repetition per time unit or in terms of repetition per revolution of the impeller being monitored, without distinguishing between the two. However, if the centrifugal pump impeller 20 rotates at a variable rotational speed the matter is further complicated, as discussed elsewhere in this disclosure, e.g. in connection with FIGS. 20, 21, 22A, 22B, and 22C. In fact, it appears as though even very small variations in rotational speed of the impeller may have a large adverse effect on detected signal quality in terms of smearing of detected vibration signals. Hence, a very accurate detection of the rotational speed $f_{ROT}$ of the pump impeller 20 appears to be of essence.

Moreover, the inventor realized that, not only the amplitude of the mechanical vibration $V_{FP}$ but also the time of occurrence of the mechanical vibration $V_{FP}$ may be indicative of data relating an operating point 205 of a centrifugal pump. Thus, the measurement signal $S_{MD}$ (See e.g. FIG. 5) may include at least one vibration signal amplitude component $S_{FP}$ dependent on a vibration movement

- wherein said vibration signal amplitude component $S_{FP}$ has a repetition frequency $f_R$ which
  - depends on the speed of rotation $f_{ROT}$ of the rotationally moving centrifugal pump impeller 20 and that also
  - depends on the number L of vanes 310 provided on impeller 20; and
- wherein there is a temporal relation between
  - the occurrence of the repetitive vibration signal amplitude component $S_{FP}$ and
  - the occurrence of a position signal P(i) which has a second repetition frequency $f_P$ dependent on the speed of rotation $f_{ROT}$ of the rotationally moving centrifugal pump impeller 20.

As regards constant rotational speed, the inventor concluded that if the speed of rotation $f_{ROT}$ is constant, the digital measurement signal $S_{MD}$, comprising a temporal sequence of vibration sample values S(i), has a repetition frequency $f_R$, that depends on the number L of vanes 310 provided.

Figure 15A:
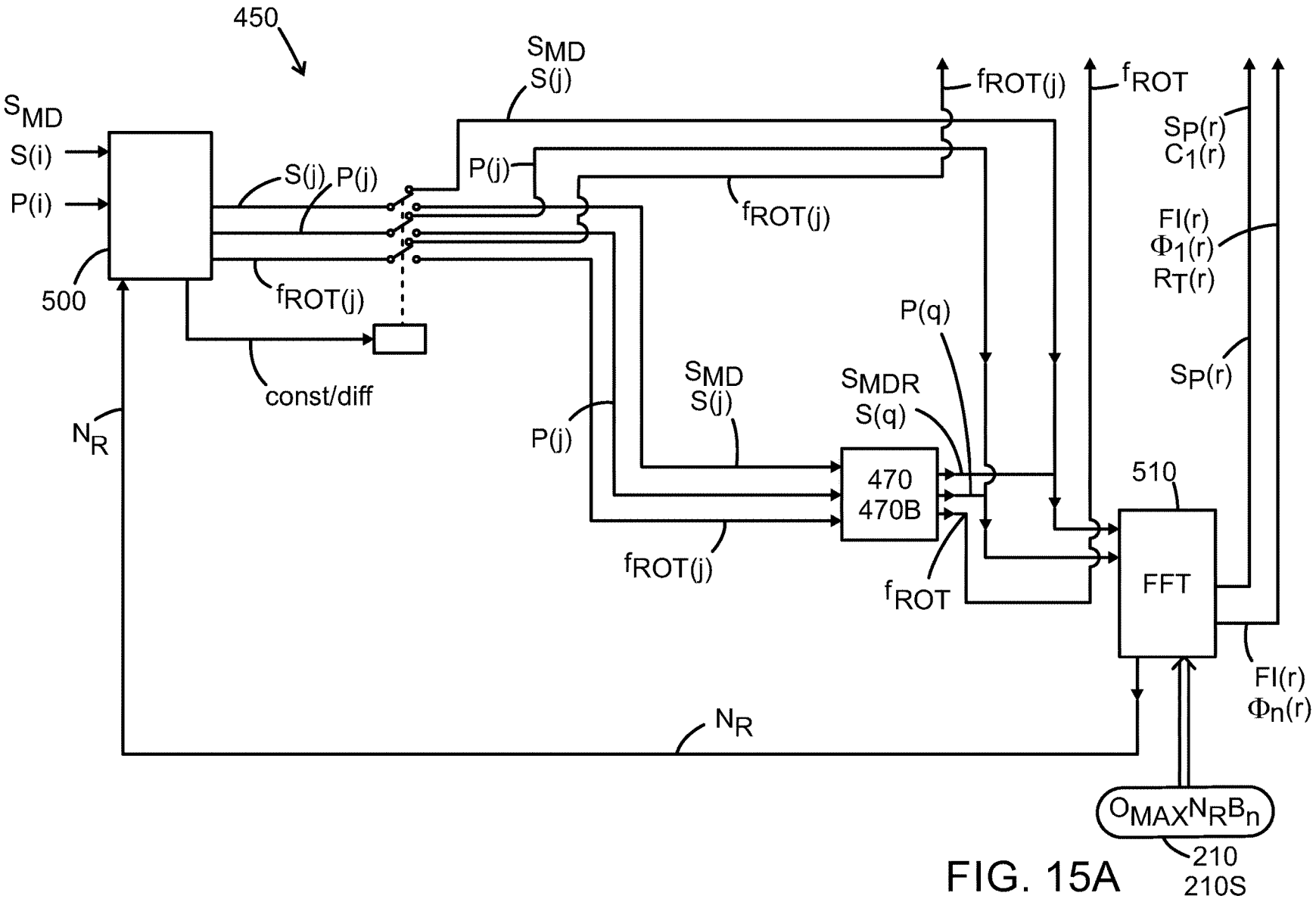
FIG. 15A is a block diagram illustrating an example of a status parameter extractor 450.

The status parameter extractor 450 may optionally include a Fast Fourier Transformer (FFT) coupled to receive the digital measurement signal $S_{MD}$, or a signal dependent on the digital measurement signal $S_{MD}$ (See FIG. 15A). In connection with the analysis of a centrifugal pump, having a rotating impeller 20, it may be interesting to analyse signal frequencies that are higher than the rotation frequency $f_{ROT}$ of the rotating impeller 20. In this context, the rotation frequency $f_{ROT}$ of the impeller 20 may be referred to as "order 1". If a signal of interest occurs at, say ten times per revolution of the impeller, that frequency may be referred to as Order 10, i.e. a repetition frequency $f_R$ (measured in Hz) divided by rotational speed $f_{ROT}$ (measured in revolutions per second, rps) equals 10 Hz/rps, i.e. order $Oi=f_R/f_{ROT}=10$ Referring to a maximum order as $O_{MAX}$, and the total number of frequency bins in the FFT to be used as $B_n$, the inventor concluded that the following applies according to an example:

$$Oi*B_n=N_R*O_{MAX}.$$

Conversely, $N_R=Oi*B_n/O_{MAX}$, wherein $O_{MAX}$ is a maximum order; and $B_n$ is the number of bins in the frequency spectrum produced by the FFT, and Oi is the number L of impeller vanes 310 in the monitored centrifugal pump.

The above variables $O_{MAX}$, $B_n$, and Oi, should be set so as to render the variable $N_R$ a positive integer. In connection with the above example it is noted that the FFT analyzer is configured to receive a reference signal, i.e. a position marker signal value PS, or $E_P$, once per revolution of the rotating impeller 20. As mentioned in connection with FIG. 2, a position marker device 180 may be provided such that, when the impeller 20 rotates around the axis of rotation 60, the position marker 180 passes by the position sensor 170 once per revolution of the impeller, thereby causing the position sensor 170 to generate a revolution marker signal value $P_S$, $E_P$.

Incidentally, referring to the above example of FFT analyzer settings, the resulting integer number $N_R$ may indicate the number of revolutions of the monitored impeller 20 during which the digital signal $S_{MD}$ is analysed. According to an example, the above variables $O_{MAX}$, $B_n$, and Oi, may be set by means of the Human Computer Interface, HCI, 210, 210S (See e.g. FIG. 1 and/or FIG. 5 and/or FIG. 15A).

Consider a case when the digital measurement signal $S_{MD}$ is delivered to an FFT analyzer: In such a case, when the FFT analyzer is set for ten vanes, i.e. L=10, and $B_n=160$ frequency bins, and the user is interested in analysing frequencies up to order $O_{MAX}=100$, then the value for $N_R$ becomes $N_R=Oi*B_n/O_{MAX}=10*160/100=16$.

Hence, it is necessary to measure during sixteen impeller revolutions ($N_R=16$) when $B_n=160$ frequency bins is desired, the number of vanes is L=10; and the user is interested in analysing frequencies up to order $O_{MAX}=100$. In connection with settings for an FFT analyzer, the order value $O_{MAX}$ may indicate a highest frequency to be analyzed in the digital measurement signal $S_{MD}$.

According to some embodiments, the setting of the FFT analyzer should fulfill the following criteria when the FFT analyzer is configured to receive a reference signal, i.e. a position marker signal value $P_S$, once per revolution of the rotating impeller 20: The integer value Oi is set to equal L, i.e. the number of vanes in the impeller 20, and the settable variables $O_{MAX}$, and $B_n$ are selected such that the mathematical expression $Oi*B_n/O_{MAX}$ becomes a positive integer. Differently expressed: When integer value Oi is set to equal L, then settable variables $O_{MAX}$ and $B_n$ should be set to integer values so as to render the variable $N_R$ a positive integer, wherein $N_R=Oi*B_n/O_{MAX}$ According to an example, the number of bins $B_n$ is settable by selecting one value $B_n$ from a group of values. The group of selectable values for the frequency resolution $B_n$ may include $B_n$=200
$B_n$=400
$B_n$=800
$B_n$=1600
$B_n$=3200

Figure 14A:
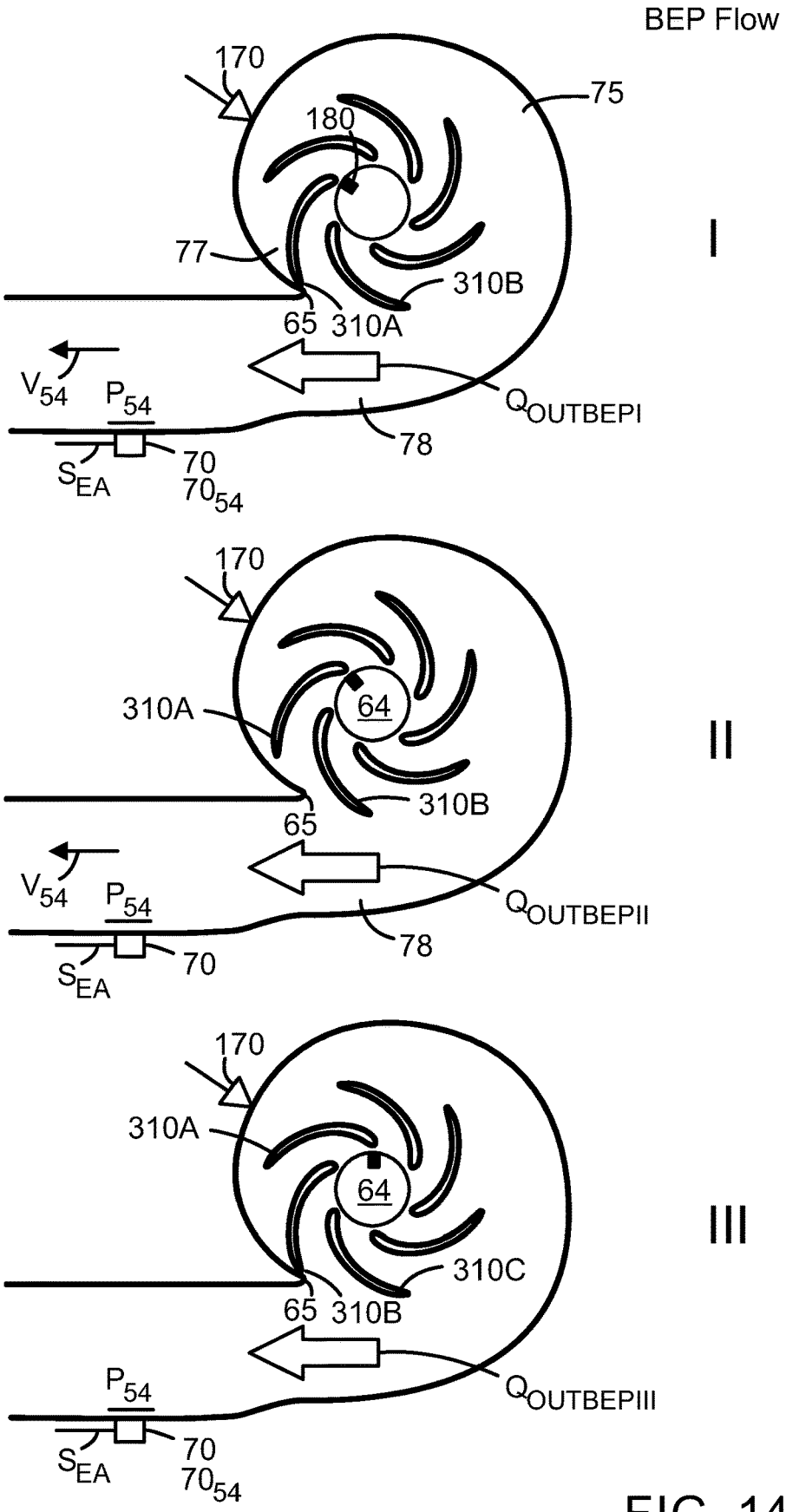
FIGS. 14A, 14B and 14C show another example of a cross-sectional view of the pump during operation.
Figure 14B:
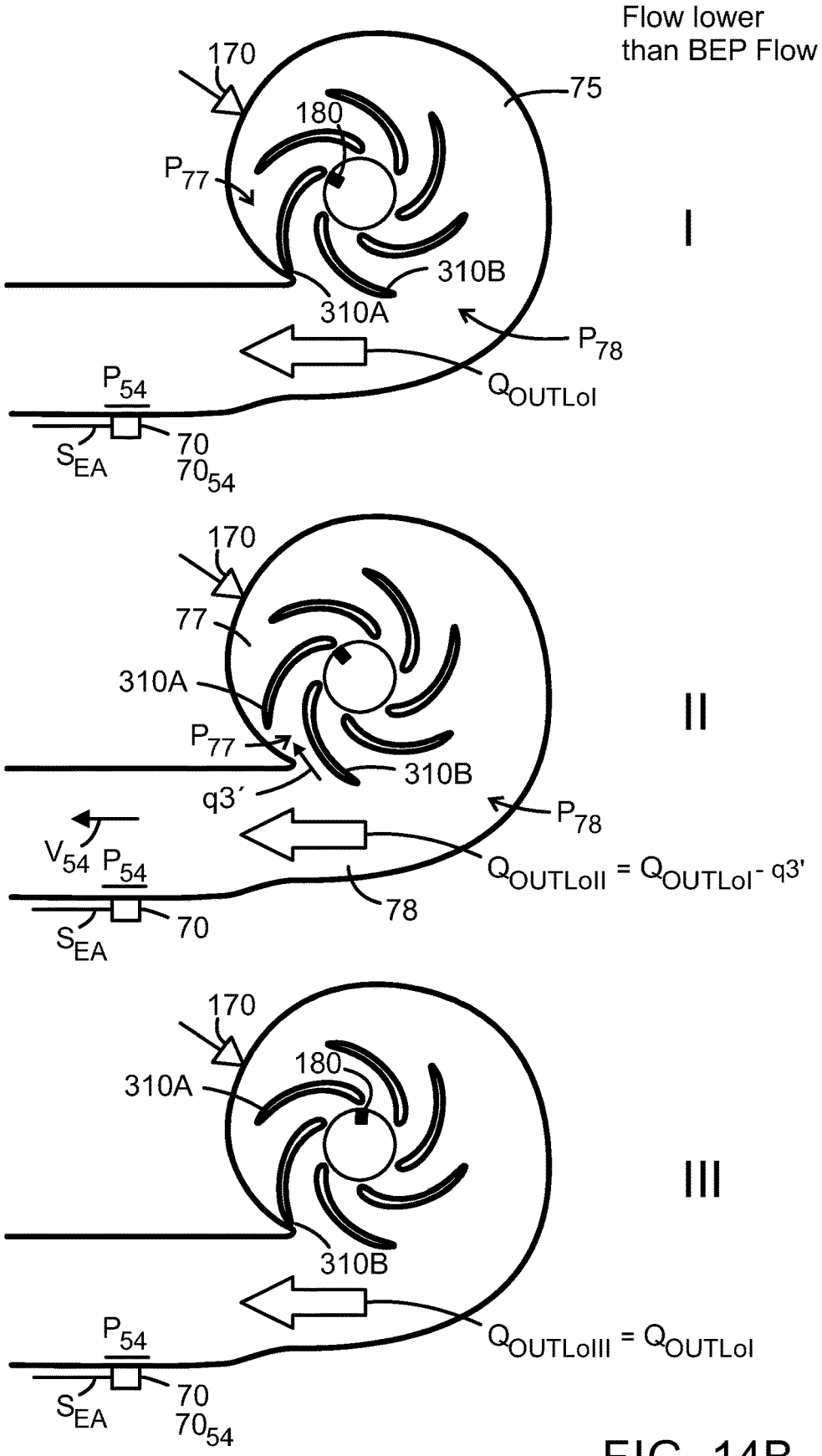
Figure 14C:
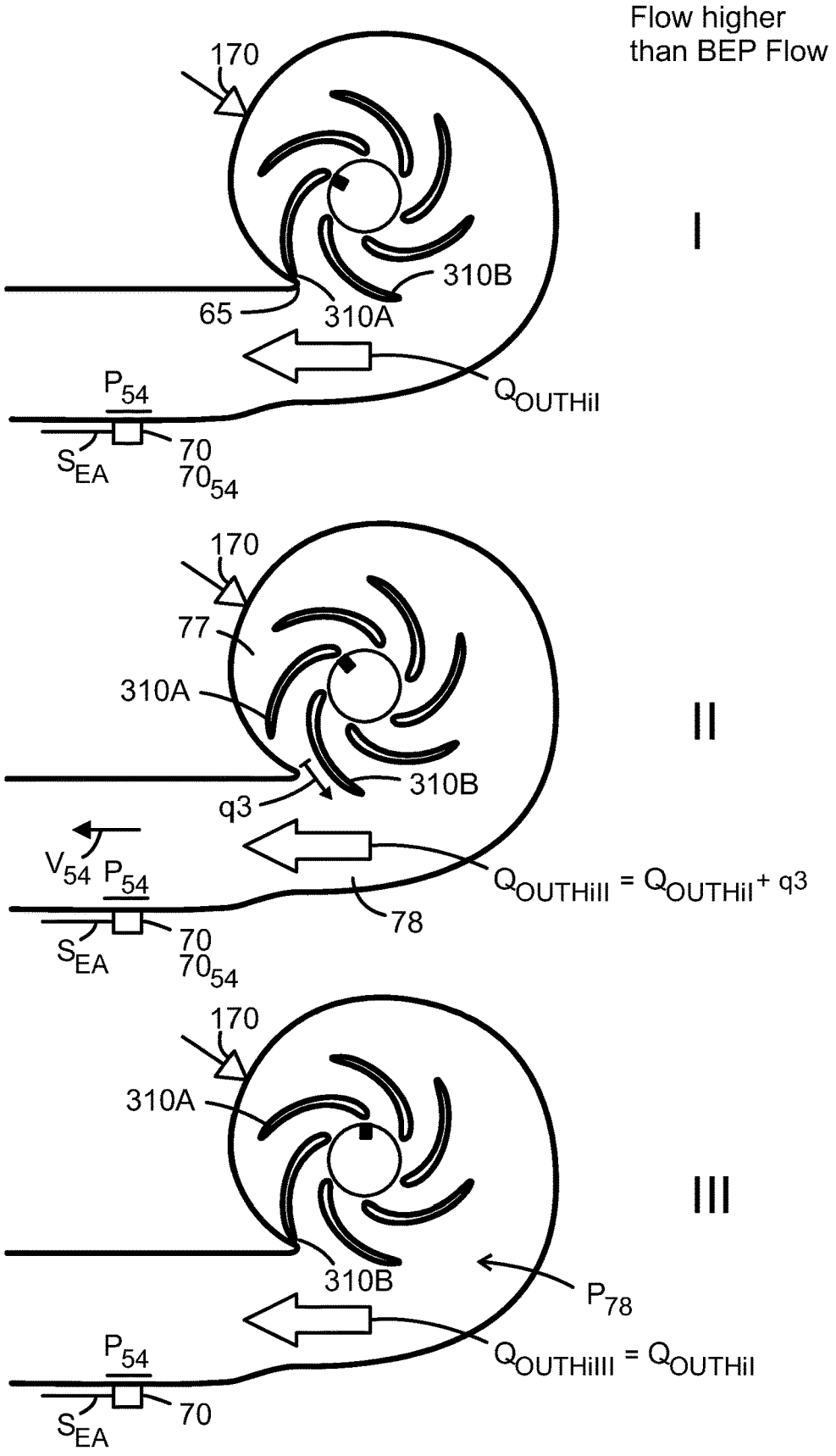

FIGS. 14A, 14B and 14C show another example of a cross-sectional view of the pump during operation.

According to the example of FIGS. 14A, 14B, 14C, the centrifugal pump impeller 20 has six vanes 310, i.e. the number L=6.

For the purpose of this example, the sample frequency is such that there are n=7680 samples per revolution at that rotational speed $f_{ROT}$ of the impeller 20, or a multiple of that number of samples. Thus, n may be e.g. 768 samples per revolution, or n may be e.g. 76800 samples per revolution. The actual number of samples per revolution is not important, but it can vary dependent on system conditions and settings of the system.

As mentioned above, the impeller 20 is rotatable, and thus the position sensor 170 may generate a position signal Ep for indicating momentary rotational positions of the impeller 20. A position marker 180 may be provided in association with the impeller 20 such that, when the impeller 20 rotates, the position marker 180 passes by the position sensor 170 once per revolution of the impeller, thereby causing the position signal Ep to exhibit a position marker signal value $P_S$. Each such position marker signal value $P_S$ is indicative of a stationary position, i.e. a certain rotational position of the impeller 20 in relation to the immobile stator.

As discussed e.g. in connection with FIG. 2A, the pump delivers an outlet flow $Q_{OUT}$ and a sensor 70, $\mathbf{70}_{54}$ may be mounted on the casing 62 by the outlet for generating a vibration signal $S_{EA}$, $S_{MD}$, Se(i), S(j), S(q) dependent on pressure pulsation $P_{FP}$ in the fluid material delivered from the pump.

It follows from Bernoulli's principle that an increase in the speed of a fluid occurs simultaneously with a decrease in fluid pressure (See equations 1 and 2 above). In an analysis of the flow pattern out of the pump 10 it is therefore of interest to look at the momentary pressure $P_{54}$ in the outlet region and its dependence on the fluid speed $v_{54}$ (See e.g. FIG. 14A part I). The continuity equation for a fluid means that the total flow into and out of a closed volume must be zero. In other words, the sum of the flow into a closed volume and the flow out of the closed volume must be zero. For an incompressible fluid in a flowpipe, such as the outlet of the pump 10, the continuity equation can thus be written:

$$v_1A_1=v_2A_2$$

wherein $A_1$=the inflow area
$v_1$=the fluid speed through inflow area $A_1$
$A_2$=the outflow area
$v_2$=the fluid speed through outflow area $A_2$ When the cross-sectional area of the outlet is constant it follows that a pulsating flow $Q_{OUT}$ must result in a pulsating fluid speed $v_{54}$. A pulsating fluid speed $v_{54}$ occurs simultaneously with a pulsating fluid pressure pressure $P_{54}$, in accordance with Bernoulli's principle.

FIG. 14A illustrates an interpretation of a flow pattern during BEP Operation, i.e. flow at design point.

FIG. 14A part I illustrates a rotational position of the rotating impeller 20 wherein a vane tip 310A is just passing by the tongue 65. Here, vane tip 310A is at its closest position to the tongue, and the passage opening between narrow volute portion 77 and the broad volute portion 78 is at its minimum. The vane 310A is followed by an adjacent vane 310B.

Figure 19A:
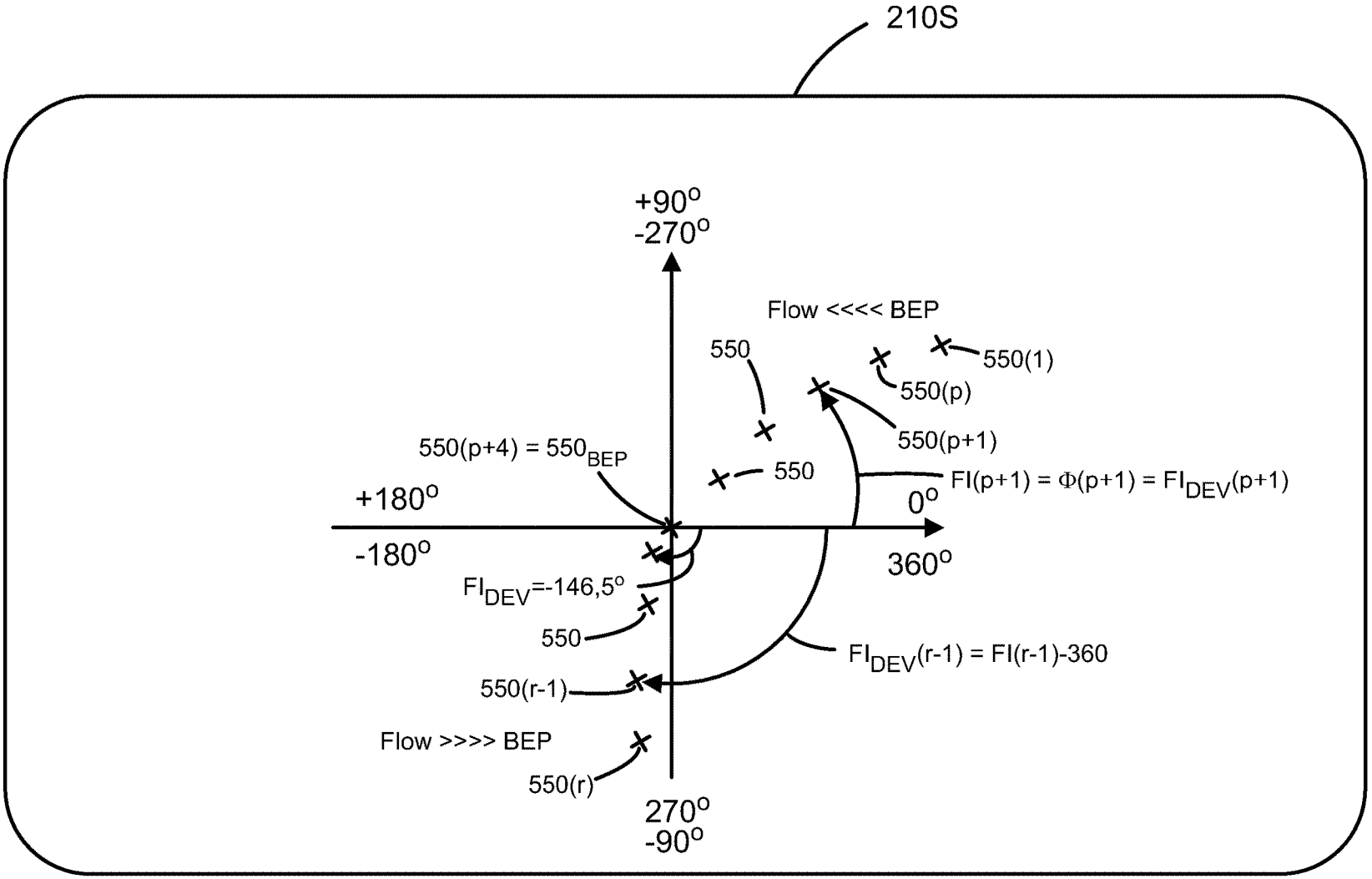
FIG. 19A is an illustration of yet another example of a visual indication of an analysis result in terms of internal status of the centrifugal pump 10.

When the pump operates at a state such that the total output flow $Q_{OUT}$ from the outlet 66 is the flow for which the pump was designed, i.e. the Best Efficiency Point flow $Q_{OUTBEP}$ of the pump, then the pressure pulsation in the fluid exhibits minimal pulsation amplitudes (see 550BEP in FIG. 19A in conjunction with FIG. 14A).

As illustrated in FIG. 14A, the position marker 180 may be located, in relation to the impellers, such that the position signal Ep exhibits a position marker signal value $P_S$ when vane tip 310A is at its closest position to the tongue 65. When that is the case, then the exhibited minimal pulsation amplitudes appear to occur at a zero degree phase angle.

The momentary flow from the outlet 66 at the moment shown in FIG. 14AI is here referred to as $Q_{OUTBEPI}$.

FIG. 14A part II illustrates another rotational position of the rotating impeller 20, a short time later than the rotational position shown in FIG. 14A part I. In FIG. 14A, part II the adjacent vane 310B is located closer to the tongue 65, and the vane 310A now is located in the narrow volute section 77, whereas vane 310B is located in the larger volute section 78.

Thus, at this moment the impeller passage 320, between vane 310A and vane 310B, provides a larger passage opening between narrow and broad volute portions 77 and 78. A portion of the flow from inlet 64, through the passage 320 between vanes 310A and 310B, goes to the larger volute portion, and another portion of the flow from inlet 64, through the passage 320 between vanes 310A and 310B, goes to the narrow volute portion at the moment when the impeller 20 is in the rotational position shown in FIG. 14A part II during BEP Operation. It is believed that there is no "leak flow" between narrow and broad volute portions during BEP Operation, or that there is substantially no "leak flow" between narrow and broad volute portions during BEP Operation. Thus, at the moment illustrated in FIG. 14A part II when the passage 320 between vanes 310A and 310B opens equally much to the narrow volute section and to the larger volute section, then approximately half of the flow from inlet 64, through the passage between vanes 310A and B, goes to the larger volute portion, and approximately half of the flow from inlet 64, through the passage between vanes 310A and B, goes to the narrow volute portion during BEP Operation.

The momentary flow from the outlet 66 at the moment shown in FIG. 14AII is here referred to as $Q_{OUTBEPII}$. It appears as if the momentary flow $Q_{OUTBEPI}$ is of substantially the same magnitude as the momentary flow $Q_{OUTBEPI}$ (FIG. 14AI). However, it is believed that the momentary flow $Q_{OUTBEPI}$ may deviate by a very small amount from the momentary flow $Q_{OUTBEPI}$, thereby rendering a relatively small pulsation during BEP operation.

FIG. 14A part III illustrates a rotational position of the impeller 20 wherein the vane tip 310B is just passing by the tongue 65. Here, vane tip 310B is at its closest position to the tongue 65, so that the vane tip 310B substantially closes the passage opening between narrow and broad volute portions. The vane 310B is followed by an adjacent vane 310C. Thus, FIG. 14A part III corresponds to FIG. 14A part I. Accordingly, the momentary flow from the outlet 66 at the moment shown in FIG. 14AIII, here referred to as $Q_{OUTBEPII}$, is of the same magnitude as the momentary flow $Q_{OUTBEPI}$ (FIG. 14AI).

FIG. 14B illustrates an interpretation of a flow pattern during operation at a total output flow $Q_{OUT}$ below design point, i.e. below BEP. The low momentary flow from the outlet 66 at the moment shown in FIG. 14B part I is here referred to as $Q_{OUTLoI}$.

As indicated in FIG. 14B part II, there appears to be a leakage flow q3' from the large volute portion 78 to the narrow volute portion 77. Therefore, the momentary flow from the outlet 66 at the moment shown in FIG. 14B part II, here referred to as $Q_{OUTLoII}$, appears to be lower than the momentary flow $Q_{OUTLoI}$.

The momentary outlet flow $Q_{OUTLoII}$ is believed to be of a magnitude $Q_{OUTLoI}$−q3'.

The leakage flow q3' from the large volute portion 78 to the narrow volute portion 77 during operation at a flow below design point is believed to be caused by a pressure difference between the large volute portion 78 and the narrow volute portion 77. This is because a pressure $P_{78}$ in the large volute portion 78 is higher than a pressure $P_{77}$ in the narrow volute portion 77 during operation at a flow below design point.

From a perspective of flow through the pump, from pump inlet to pump outlet, the moment shown in FIG. 14B part III corresponds to the moment shown in FIG. 14B part I. Accordingly, the momentary flow from the outlet 66 at the moment shown in FIG. 14B1III, here referred to as $Q_{OUTLoIII}$, is believed to be of the same magnitude as the momentary flow $Q_{OUTLoI}$ (FIG. 14BI).

The flow cycle illustrated by FIG. 14B part I, 14B part II, 14B part III therefore appears to exhibit a pulsation, the amplitude of that pulsation being dependent on the magnitude of the maximum leakage flow q3'. When the impeller has L=6 vanes, then the pulsation will exhibit L=6 such flow cycles as the impeller rotates a full revolution.

It is believed that the above described flow pulsation renders a pulsating fluid speed $v_{54}$ in the region 54 (See FIGS. 1 and 2A in conjunction with FIG. 14B). Accordingly, in view of Bernoulli's principle, the fluid pressure $P_{54}$ in that region 54 also exhibits a pulsation. Thus, the fluid pressure pulsation $P_{FP}$ in that region 54 has a repetition frequency $f_R$ dependent on a speed of rotation $f_{ROT}$ of the impeller 20.

More particularly, the pressure $P_{54}$, detected by vibration sensor 70, $\mathbf{70}_{54}$ positioned to detect pressure fluctuations in the outlet fluid from the pump 10 would appear to exhibit cycles as follows:

When the impeller moves from the position shown in FIG. 14B part I to the position shown in FIG. 14B part II, there is a reduction in the flow, from $Q_{OUTLoI}$ to $Q_{OUTLoI}$−q3', and therefore a reduction in the speed $v_{54}$ rendering an increase in the pressure P54.

Conversely, when the impeller moves from the position shown in FIG. 14B part II to the position shown in FIG. 14B part III, there is an increase in the flow, from $Q_{OUTLoI}$−q3' to $Q_{OUTLoI}$, and therefore an increase in the fluid speed $v_{54}$ rendering a reduction in the pressure P54.

Accordingly, the phase of the detected pressure pulsation $P_{54}$ depends on the current Operating Point 205 in relation to BEP and on impeller position (See FIG. 2B). The below table summarizes an interpretation of how the momentary outlet fluid pressure $P_{54}$ changes in dependence on impeller position when the pump operates at an outlet flow below BEP flow.

| Impeller position (Below BEP flow) | Pressure $P_{54}$ |
|---|---|
| I | At lowest peak |
| I towards II | Increasing pressure $P_{54}$ |
| At II or near II | Increasing, passing a highest peak $P_{54}$, then decreasing |
| II towards III | Decreasing pressure $P_{54}$ |
| IIII = I | At lowest peak |

It appears as though the amplitude and the phase value of the detected pressure pulsation $P_{54}$ is indicative of the current Operating Point 205 in relation to BEP.

Accordingly, it appears to be of interest to establish the impeller position at the moment of occurrence of the highest peak value $P_{54}$. Another way of expressing this is: In terms of the distance between two adjacent vane tips, 310A and 310B, it appears to be of interest to establish at what position, between the two adjacent vane tips, the highest peak value $P_{54}$ occurs. In this connection reference is also made to the discussion about the phase value of the detected pressure pulsation in connection with table 5 below.

FIG. 14C illustrates an interpretation of a flow pattern during operation at a total output flow $Q_{OUT}$ above design point, i.e. above BEP.

The relatively high momentary flow from the outlet 66 at the moment shown in FIG. 14C part I is here referred to as $Q_{OUTHiI}$.

As indicated in FIG. 14C part II, there appears to be a leakage flow q3 from the narrow volute portion 77 to the large volute portion 78. Therefore, the momentary flow from the outlet 66 at the moment shown in FIG. 14C part II, here referred to as $Q_{OUTHiII}$, appears to be higher than the momentary flow $Q_{OUTHiI}$.

The momentary outlet flow $Q_{OUTHiII}$ is believed to be of a magnitude $Q_{OUTHiI}$+q3.

The leakage flow q3 from the narrow volute portion 77 to the large volute portion 78 during operation at a flow level higher than design point is believed to be caused by a pressure difference between the narrow volute portion 77 and the large volute portion 78. This is because a pressure $P_{78}$ in the large volute portion 78 is lower than a pressure $P_{77}$ in the narrow volute portion 77 during operation at a flow above design point.

From a perspective of flow through the pump, from pump inlet to pump outlet, the moment shown in FIG. 14C part III corresponds to the moment shown in FIG. 14C part I. Accordingly, the momentary flow from the outlet 66 at the moment shown in FIG. 14C part III, here referred to as $Q_{OUTHiIII}$, is believed to be of the same magnitude as the momentary flow $Q_{OUTHiI}$ (FIG. 14C part I).

The flow cycle illustrated by FIG. 14C part I, 14C part II, 14C part III therefore appears to exhibit a pulsation, the amplitude of that pulsation being dependent on the magnitude of the maximum leakage flow q3. When the impeller has L=6 vanes, then the pulsation will exhibit L=6 such flow cycles as the impeller rotates a full revolution. As discussed above in connection with FIG. 14B, and in view of Bernoulli's principle, the fluid pressure $P_{54}$ in the region 54 near the pump the outlet 66 exhibits a fluid pressure pulsation $P_{FP}$.

More particularly, the pressure $P_{54}$, detected by vibration sensor 70, $\mathbf{70}_{54}$ positioned to detect pressure fluctuations in the outlet fluid from the pump 10 would appear to exhibit cycles as follows:

When the impeller moves from the position shown in FIG. 14C part I to the position shown in FIG. 14C part II, there is an increase in the flow, from $Q_{OUTHiI}$ to $Q_{OUTHiI}$+q3, and therefore an increase in the fluid speed $v_{54}$ rendering a reduction in the pressure P54.

Conversely, when the impeller moves from the position shown in FIG. 14C part II to the position shown in FIG. 14C part III, there is a reduction in the flow, from $Q_{OUTHiI}$+q3 to $Q_{OUTHiI}$, and therefore a reduction in the fluid speed $v_{54}$ rendering an increase in the pressure P54.

Accordingly, the phase of the detected pressure pulsation $P_{54}$ depends on the current Operating Point 205 in relation to BEP and on impeller position (See FIG. 2B). The below table summarizes an interpretation of how the momentary outlet fluid pressure $P_{54}$ changes in dependence on impeller position when the pump operates at an outlet flow higher than BEP flow.

| Impeller position (higher than BEP flow) | Pressure $P_{54}$ |
|---|---|
| I | At highest peak |
| I towards II | Decreasing pressure $P_{54}$ |
| At II or near II | Decreasing, passing a lowest peak $P_{54}$, then increasing |
| II towards III | Increasing pressure $P_{54}$ |
| IIII = I | At highest peak |

It appears as though the amplitude and the phase value of the detected pressure pulsation $P_{54}$ is indicative of the current Operating Point 205 in relation to BEP.

Accordingly, it appears to be of interest to establish the impeller position at the moment of occurrence of the lowest peak value $P_{54}$. Another way of expressing this is: In terms of the distance between two adjacent vane tips, 310A and 310B, it appears to be of interest to establish at what position, between the two adjacent vane tips, the lowest peak value $P_{54}$ occurs. In this connection reference is also made to the discussion about the phase value of the detected pressure pulsation in connection with table 5 below.

According to an interpretation, the flow patterns illustrated by FIGS. 14A to 14C provide a cause of the detected phase values as discussed e.g. in relation to FIGS. 16 to 19D. In particular, it is noted that said first polar angle (X1(r), FI(r), Φ(r), $T_D$, $T_{D1}$) exhibits a phase shift of approximately 180 degrees, when the operating point 205 changes from below BEP to above BEP, and/or when the operating point 205 changes from above BEP to below BEP. Thus, this phase shift is to be kept in mind when looking at FIGS. 14B and 14C. In this connection, reference is made to internal status indicator object 550 which is discussed elsewhere in this disclosure, e.g in connection with FIGS. 16 to 19D.

Accordingly, it appears to be desirable to control the pump such that a current internal status 550(*r*) is shifted towards the reference point (O, 530) at origo, in the polar plot according FIGS. 16 to 19B, or to a position which is as close as possible the reference point (O, 530), so that the flow pattern is as close as possible to the flow pattern indicated in FIG. 14A.

Figure 14D:
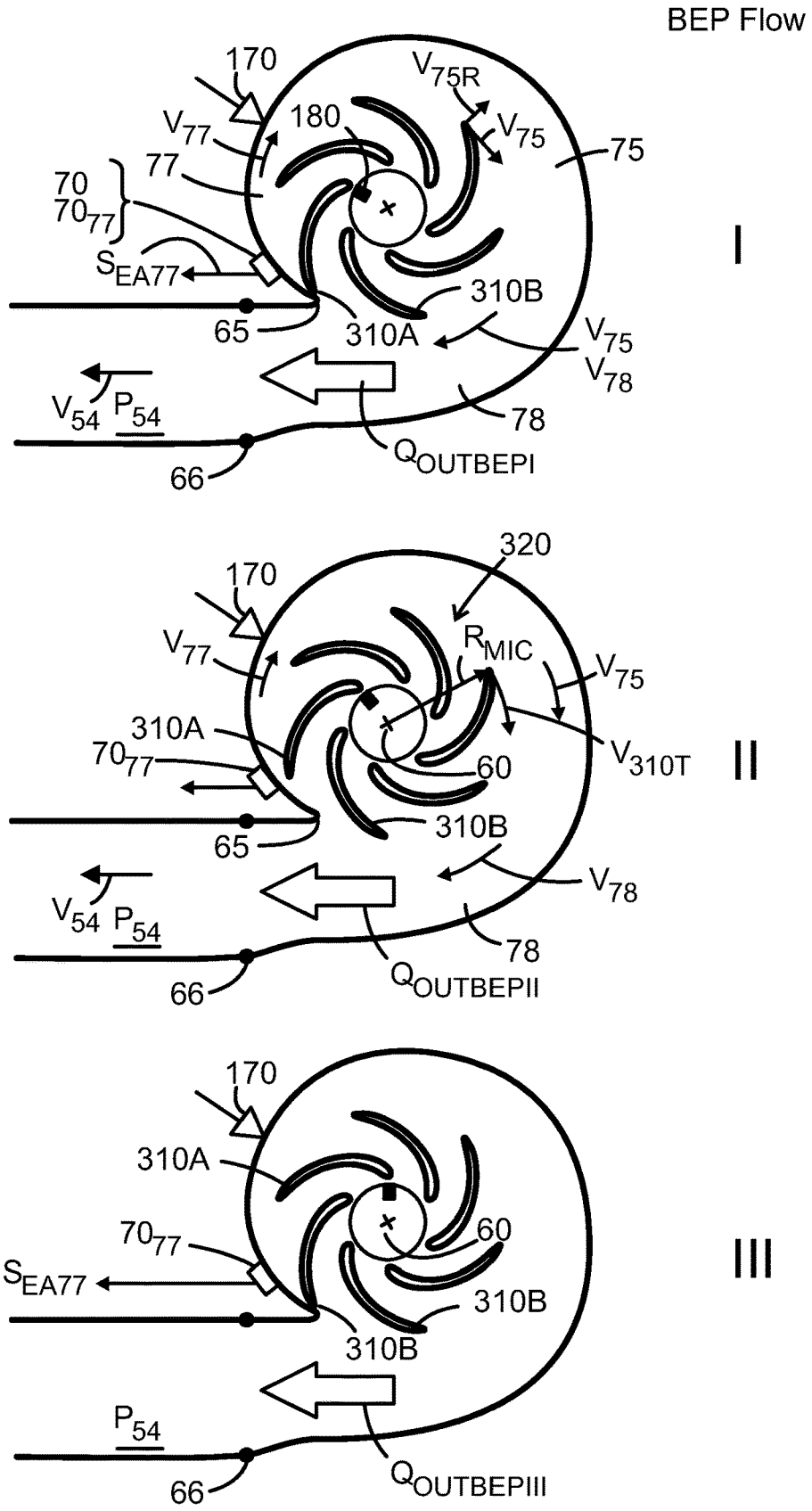
FIGS. 14D, 14E and 14F illustrate another aspect of flow and pressure patterns in a pump.
Figure 14E:
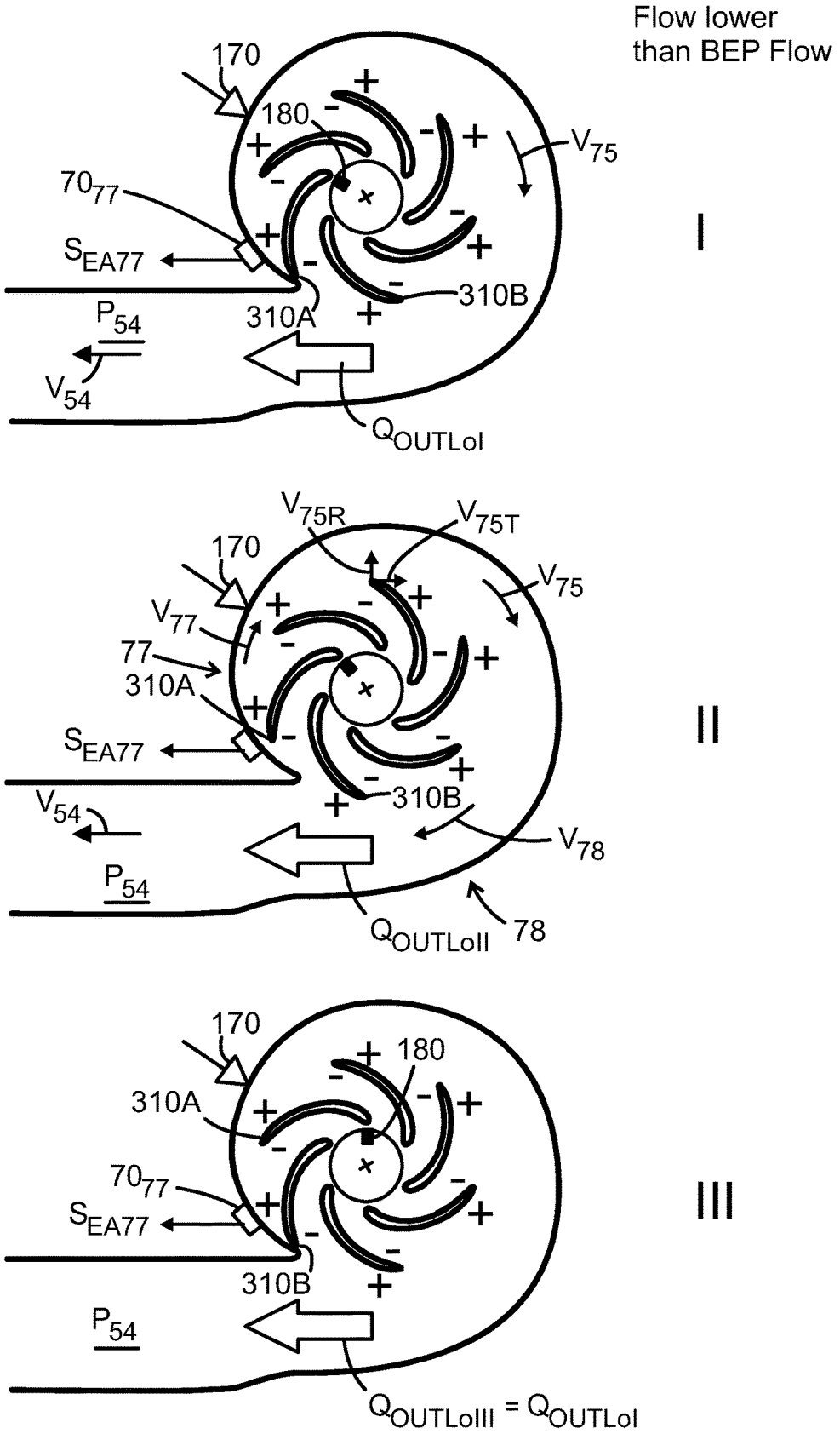
Figure 14F:
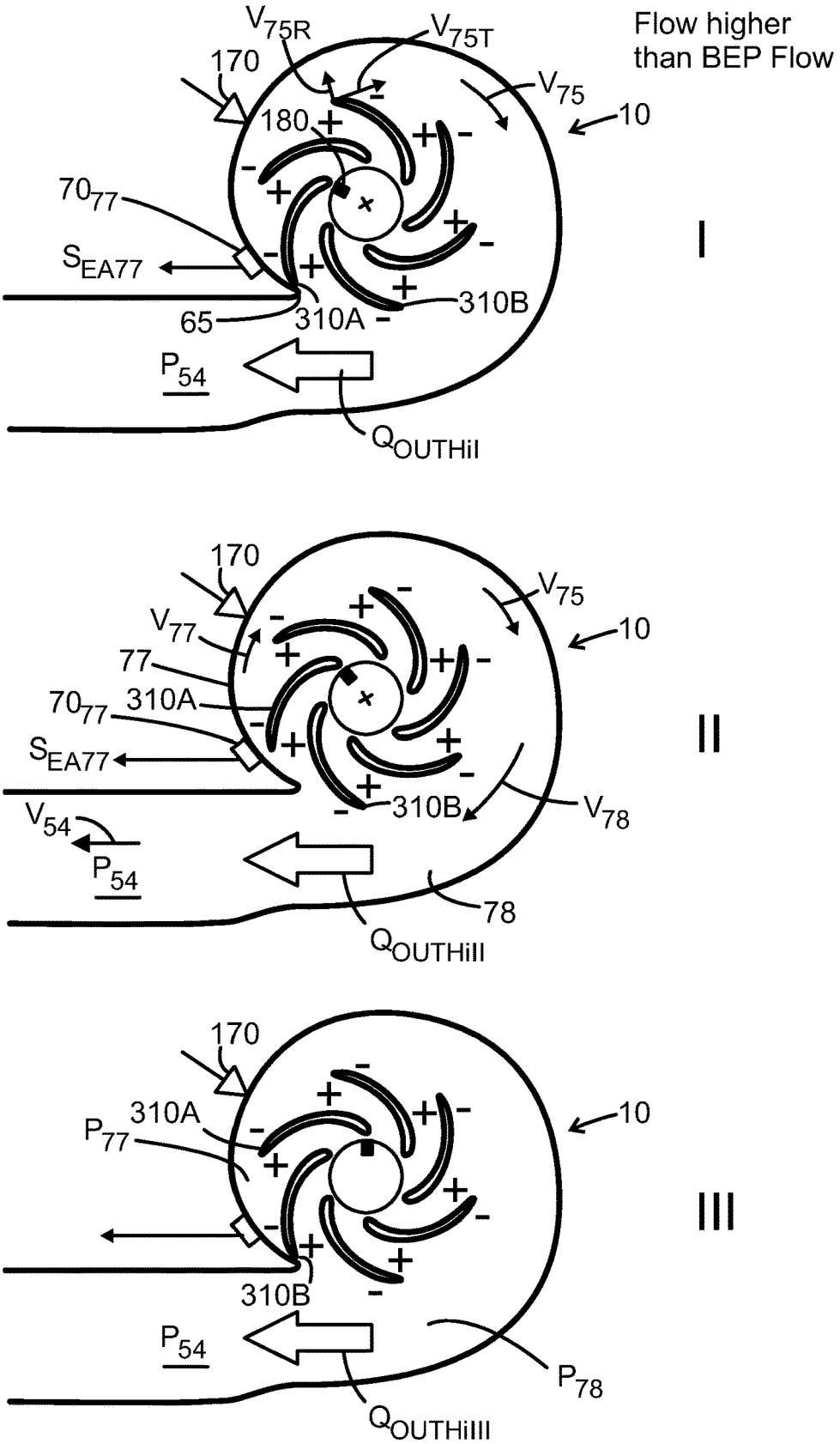

FIGS. 14D, 14E and 14F show another example of a cross-sectional view of the pump during operation, and they illustrate another aspect of flow and pressure patterns in the pump, and the detection thereof. According to the example of FIGS. 14D, 14E and 14F the centrifugal pump 10 may include a sensor 70, $\mathbf{70}_{77}$ attached to the casing 62 at the first volute part 77 by the narrower cross sectional area near the tongue 65 (See also FIG. 2D). The pump 10 of FIGS. 14D, 14E and 14F may include parts, and be configured, as described above in relation to FIGS. 1A, 2A and 2D and/or as described elsewhere in this document. However, the example centrifugal pump 10 of FIGS. 14D, 14E and 14F may include a sensor 70, $\mathbf{70}_{77}$ attached to the casing 62 at the first volute part 77 by the narrower cross sectional area near the tongue 65.

The positioning of the sensor $\mathbf{70}_{77}$, as illustrated in FIGS. 14D, 14E and 14F, appears to be advantageous in that the sensor is located comparatively close to the passing vane tips, which appear to exhibit detectable local high pressures and low pressures when the pump runs away from BEP flow, as discussed in more detail below in connection with FIGS. 14E and 14 F.

FIG. 14D parts I, II and III illustrate an interpretation of a flow and pressure pattern during BEP Operation, i.e. flow at design point.

As mentioned above the fluid may flow axially towards the inlet 64 at the center of the impeller 20, and the rotating impeller vanes 310 deflect the fluid so that it flows out through apertures 320 between the vanes 310. The rotating impeller vanes 310 cause centrifugal acceleration of the fluid, and thus, the fluid undergoes a change in direction and is accelerated. When the pump is running at BEP flow $Q_{OUTBEP}$ the accelerated fluid, when reaching the tip of the vanes and departing from the apertures 320 into the volute 75 has reached a tangential velocity $v_{75}$, and when the pump is running at BEP flow $Q_{OUTBEP}$ the tangential fluid velocity $v_{75}$ is maintained as the fluid travels along the volute 75 to the outlet 66.

Thus, the accelerated fluid 30 has a tangential speed component $v_{75}$ that corresponds to the tangential speed of the vane tips 310A, 310B, 310C, when the pump is running at BEP flow $Q_{OUTBEP}$. In fact, if the pump is running exactly at BEP flow $Q_{OUTBEP}$, then the tangential fluid speed component $v_{75}$ appears to be the same as the tangential speed $v_{310T}$ of the vane tips. In this manner, as the fluid travels along the volute 75, it is joined by more and more fluid 30 exiting the rotating impeller passages 320 but, as the cross sectional area of the volute increases, the tangential fluid velocity $v_{75}$ is maintained when the pump is running at BEP flow $Q_{OUTBEP}$.

Incidentally, the accelerated fluid 30 also has a radial speed component $v_{75R}$ that corresponds to the gradual widening of the cross-sectional area of the volute, when the pump is running at BEP flow $Q_{OUTBEP}$. The gradual widening of the cross-sectional area of the volute is such that the amount of fluid per time unit being added to the volute is balanced by the widening per time unit of the cross-sectional area when the pump is running at BEP flow $Q_{OUTBEP}$. Thus, in accordance with the continuity equation, the tangential fluid velocity $v_{75}$ is maintained when the pump is running at BEP flow $Q_{OUTBEP}$.

In this manner, the fluid appears to exhibit laminar flow, or substantially laminar flow, in the volute when the pump is running at BEP flow $Q_{OUTBEP}$.

FIG. 14D part I illustrates a rotational position of the rotating impeller 20 wherein a vane tip 310A is just passing by the tongue 65. Here, vane tip 310A is at its closest position to the tongue, and the passage opening between narrow volute portion 77 and the broad volute portion 78 is at its minimum. The vane 310A is followed by an adjacent vane 310B.

The momentary flow from the outlet 66 at the moment shown in FIG. 14DI is here referred to as $Q_{OUTEPI}$.

FIG. 14D part II illustrates another rotational position of the rotating impeller 20, a short time later than the rotational position shown in FIG. 14D part I. In FIG. 14D, part II the adjacent vane 310B is located closer to the tongue 65, and the vane tip 310A now is located in the narrow volute section 77, whereas vane 310B is located in the larger volute section 78.

Thus, at this moment the vane tip 310A now is located comparatively close to the vibration sensor $\mathbf{70}_{77}$, as illustrated in FIG. 14D part II. This appears to be advantageous, as discussed in more detail below in relation to FIGS. 14E and 14F.

The accelerated fluid 30, at the vane tip 310A, has a tangential fluid speed component $v_{77}$ that corresponds to the tangential speed $v_{310T}$ of the vane tip 310A, when the pump is running at BEP flow $Q_{OUTBEP}$. As the fluid 30 travels along the volute 75, it is joined by more and more fluid 30 exiting the rotating impeller passages 320 but, as the cross sectional area of the volute increases, the tangential fluid velocity $v_{75}$ is maintained when the pump is running at BEP flow $Q_{OUTBEP}$, and the tangential fluid speed component $v_{78}$ in the wide part 78 of the volute is same, or approximately the same, as the tangential fluid speed component $v_{77}$ in the narrow part 77 of the volute.

FIG. 14D part III illustrates a rotational position of the impeller 20 wherein the vane tip 310B is just passing by the tongue 65. Here, vane tip 310B is at its closest position to the tongue 65, so that the vane tip 310B substantially closes the passage opening between narrow and broad volute portions. The vane 310B is followed by an adjacent vane 310C. Thus, FIG. 14D part III corresponds to FIG. 14D part I. Accordingly, the momentary flow and pressure pattern at the moment shown in FIG. 14DIII is the same as the flow and pressure pattern at the moment shown in FIG. 14DI.

Vane Tip Local Pressure Regions During Operation at Flow Lower than BEP Flow

FIG. 14E parts I, II and III illustrate an interpretation of a flow and pressure pattern during operation at a total output flow $Q_{OUTLo}$ below design point, i.e. below BEP flow. The low momentary flow from the outlet 66 at the moment shown in FIG. 14E part I is here referred to as $Q_{OUTLoI}$.

As mentioned above the fluid may flow axially towards the inlet 64 at the center of the impeller 20, and the rotating impeller 20 deflects the fluid so that it flows out through apertures 320 between the vanes 310 (See FIG. 2D in conjunction with FIG. 14D, 14E, 14F). The rotating impeller causes centrifugal acceleration of the fluid, and thus, the fluid undergoes a change in direction and is accelerated. When the pump is running at an output flow $Q_{OUTLo}$ below design point, i.e. below BEP flow, the accelerated fluid, when reaching the tip of the vanes and departing from the apertures 320 into the volute 75 has reached a radial speed component $v_{75R}$ that is low in relation to the gradual widening of the cross-sectional area of the volute. The amount of fluid entering the volute 75 from an aperture 320 between two adjacent vanes 310, as a consequence of the low radial speed component $v_{75R}$, is such that the amount of fluid per time unit being added to the volute is smaller than the widening per time unit of the cross-sectional area when the pump is running at an output flow $Q_{OUTHi}$ above design point. Thus, in accordance with the continuity equation, the tangential fluid velocity $v_{75}$ is gradually decreased when the pump is running at an output flow $Q_{OUTHi}$ below design point. Thus, with reference to FIG. 14E part II, the tangential fluid velocity $v_{78}$ in the wide part 78 of the volute is lower than the tangential fluid velocity $v_{77}$ in the narrower part 77 when the pump is running at an output flow below design point.

Accordingly, an effect of the pump running below design point is that the tangential fluid velocity $v_{75}$ becomes lower than the tangential velocity of the vane tips. Now, when we look at an individual vane tip, this speed deviation, between the higher tangential velocity of the vane tip at the inner edge of the volute and the lower tangential fluid velocity $v_{75}$, causes a local high pressure region on the leading side of the vane tip, indicated by a plus sign "+" in FIG. 14F parts I, II and III, and a local low pressure region on the trailing side of the vane tip, indicated by a minus sign "−" in FIG. 14F parts I, II and III.

FIG. 14E part I illustrates a rotational position of the rotating impeller 20 wherein a vane tip 310A is just passing by the tongue 65. Thus, at this moment, the local high pressure region on the leading side of the vane tip 310A, indicated by a plus sign "+" in FIG. 14E part I, is approaching the sensor $\mathbf{70}_{77}$ and it is believed to cause an increase of the momentary fluid pressure in the region of fluid adjacent the sensor $\mathbf{70}_{77}$.

FIG. 14E part II illustrates another rotational position of the rotating impeller 20, a short time later than the rotational position shown in FIG. 14E part I. In FIG. 14E, part II, the vane tip 310A is located in the narrow volute section 77 and it is just passing by the sensor $\mathbf{70}_{77}$. Thus, at this moment the vane tip 310A now is located comparatively close to the vibration sensor $\mathbf{70}_{77}$, as illustrated in FIG. 14E part II, and the momentary fluid pressure in the region of fluid adjacent the sensor $\mathbf{70}_{77}$ is believed to decrease from the high pressure of the leading side of the vane tip 310A towards the low pressure of the trailing side of vane tip 310A indicated by a minus sign "−" in FIG. 14E part II. Accordingly, at the moment illustrated by FIG. 14E part II, the sensor $\mathbf{70}_{77}$ appears to detect a negative pressure derivative.

FIG. 14E part III illustrates a rotational position of the impeller 20 a short time later than the rotational position shown in FIG. 14E part II, and the vane tip 310B is just passing by the tongue 65. Accordingly, at the moment illustrated in FIG. 14E part III, the sensor $\mathbf{70}_{77}$ is believed to detect a positive pressure derivative since the local low pressure of the trailing side of vane tip 310A is departing from the region of fluid adjacent the sensor $\mathbf{70}_{77}$ and the local high pressure of the leading side of vane tip 310B is approaching the region of fluid adjacent the sensor $\mathbf{70}_{77}$.

Accordingly, the phase of the detected pressure pulsation $P_{77}$ depends on the current Operating Point 205 in relation to BEP and on impeller position (See FIG. 2B). The below table summarizes an interpretation of how the momentary fluid pressure $P_{77}$ changes in dependence on impeller position when the pump operates at an outlet flow below BEP flow.

| Impeller position (Below BEP flow) | Pressure $P_{77}$ |
|---|---|
| I | Increasing |
| I to II | Continued increase, passing a highest peak, then decreasing |

-continued

| Impeller position (Below BEP flow) | Pressure $P_{77}$ |
|---|---|
| II | Decreasing |
| II to III | Continued decrease, Passing a lowest peak, the Increasing |
| IIII = I | Increasing |

Thus, it appears as though the amplitude and the phase value of the detected pressure pulsation $P_{77}$ is indicative of the current Operating Point 205 in relation to BEP. In this connection reference is also made to the discussion about the phase value of the detected pressure pulsation in connection with table 5 below.

As a consequence of the higher tangential velocity of the vane tip and the lower tangential fluid velocity $v_{75}$, causing local high pressure regions on the leading sides of the vane tips, indicated by plus signs "+" in FIG. 14E parts I, II and III, and causing local low pressure regions on the trailing sides of the vane tips, indicated by minus signs "−" in FIG. 14E parts I, II and III, the fluid appears to exhibit turbulent flow in the volute when the pump is running at an output flow $Q_{OUTLo}$ below design point, i.e. lower than BEP flow. The occurrence of turbulent flow therefore appears to result in a lower energy efficiency of the pumping process, since a part of the energy fed to the impeller by a drive motor results in whirling fluid movement and increased warming of the fluid as a result of the whirls.

In this manner, the fluid appears to exhibit turbulent flow in the volute when the pump is running at an output flow $Q_{OUTLo}$ below design point, i.e. lower than BEP flow.

From a perspective of flow through the pump, from pump inlet to pump outlet, the moment shown in FIG. 14E part III corresponds to the moments shown in FIG. 14E part I, and FIG. 14B part I and FIG. 14B part III. Accordingly, the momentary flow from the outlet 66 at the moment shown in FIG. 14E part III, here referred to as $Q_{OUTLoIII}$, is believed to be of the same magnitude as the momentary flow $Q_{OUTLoI}$ (See FIG. 14E part I and FIG. 14B part I). By contrast, the momentary flow from the outlet 66 at the moment shown in FIG. 14E part II, here referred to as $Q_{OUTLoII}$, is believed to be lower than the momentary flows $Q_{OUTLoI}$ and $Q_{OUTLoII}$ (FIG. 14E part I & 14E part III). The momentary flow $Q_{OUTLoII}$ (FIG. 14E part II) corresponds to the flow $Q_{OUTLoII}$ in FIG. 14B part II. When the pump is running at an output flow below design point, the outlet flow $Q_{OUTLo}$ therefore appears to exhibit a pulsation, the amplitude of that pulsation being dependent on the magnitude of the maximum leakage flow q3', as discussed above in connection with FIG. 14B part I, part II and part III. Moreover, experiments appear to indicate that the amplitude of vibrations detected by sensor 70, $\mathbf{70}_{77}$ attached to the casing 62 at the first, narrower, volute part 77 increase in magnitude when the pump operates further away from the design point. Moreover, experiments appear to indicate that the amplitude of vibrations detected by sensor 70, $\mathbf{70}_{77}$ attached to the casing 62 at the first, narrower, volute part 77 corresponds to the magnitude of the pulsation in the outlet flow $Q_{OUTLo}$ when the pump is running at an output flow $Q_{OUTLo}$ below design point, i.e. lower than BEP flow. When the impeller has L=6 vanes, then the pulsation will exhibit L=6 such flow cycles as the impeller rotates a full revolution.

Vane Tip Local Pressure Regions During Operation at Flow Higher than BEP Flow

FIG. 14F parts I, II and III illustrate an interpretation of a flow and pressure pattern during operation at a total output flow $Q_{OUTHi}$ above design point, i.e. higher than BEP flow. The high momentary flow from the outlet 66 at the moment shown in FIG. 14F part I is here referred to as $Q_{OUTHiI}$.

As mentioned above the fluid may flow axially towards the inlet 64 at the center of the impeller 20, and the rotating impeller 20 deflects the fluid so that it flows out through apertures 320 between the vanes 310. The impeller vanes 310 cause centrifugal acceleration of the fluid, and thus, the fluid undergoes a change in direction and is accelerated. When the pump is running at an output flow $Q_{OUTHi}$ above design point, i.e. higher than BEP flow, the accelerated fluid, when reaching the tip of the vanes and departing from the apertures 320 into the volute 75 has reached a radial speed component $v_{75R}$ that is high in relation to the gradual widening of the cross-sectional area of the volute. The amount of fluid entering the volute 75 from an aperture 320 between two adjacent vanes 310, as a consequence of the high radial speed component $v_{75R}$, is such that the amount of fluid per time unit being added to the volute exceeds the widening per time unit of the cross-sectional area when the pump is running at an output flow $Q_{OUTHi}$ above design point. Thus, in accordance with the continuity equation, the tangential fluid velocity $v_{75}$ is gradually increased when the pump is running at an output flow $Q_{OUTHi}$ above design point. With reference to FIG. 14F part II, tangential fluid velocity $v_{78}$ in the wide part 78 of the volute is higher than the tangential fluid velocity $v_{77}$ in the narrower part 77 when the pump is running at an output flow above design point.

Accordingly, an effect of the pump running above design point is that the tangential fluid velocity $v_{75}$ becomes higher than the tangential velocity of the vane tips. Now, when we look at an individual vane tip, this speed deviation, between the higher tangential fluid velocity $v_{75}$ and the lower tangential velocity of the vane tip, causes a local high pressure region on the trailing side of the vane tip, indicated by a plus sign "+" in FIG. 14F parts I, II and III, and a local low pressure region on the leading side of the vane tip, indicated by a minus sign "−" in FIG. 14F parts I, II and III.

FIG. 14F part I illustrates a rotational position of the rotating impeller 20 wherein a vane tip 310A is just passing by the tongue 65. Thus, at this moment, the local low pressure region on the leading side of the vane tip 310A, indicated by a minus sign "−" in FIG. 14F part I, is approaching the sensor $\mathbf{70}_{77}$ and it is believed to cause a lowering of the pressure in the region of fluid adjacent the sensor $\mathbf{70}_{77}$.

FIG. 14F part II illustrates another rotational position of the rotating impeller 20, a short time later than the rotational position shown in FIG. 14F part I. In FIG. 14F, part II, the vane tip 310A is located in the narrow volute section 77 and it is just passing by the sensor $\mathbf{70}_{77}$. Thus, at this moment the vane tip 310A now is located comparatively close to the vibration sensor $\mathbf{70}_{77}$, as illustrated in FIG. 14F part II, and the momentary fluid pressure in the region of fluid adjacent the sensor $\mathbf{70}_{77}$ is believed to increase from the low pressure of the leading leading side of the vane tip 310A towards the high pressure of the trailing side of vane tip 310A indicated by a plus sign "+" in FIG. 14F part II. Accordingly, at the moment illustrated by FIG. 14F part II, the sensor $\mathbf{70}_{77}$ appears to detect a positive pressure derivative.

FIG. 14F part III illustrates a rotational position of the impeller 20 a short time later than the rotational position shown in FIG. 14F part II, and the vane tip 310B is just passing by the tongue 65. Accordingly, at the moment illustrated in FIG. 14F part III, the sensor $\mathbf{70}_{77}$ is believed to detect a negative pressure derivative since the local high pressure of the trailing side of vane tip 310A is departing from the region of fluid adjacent the sensor $\mathbf{70}_{77}$ and the local low pressure of the leading side of vane tip 310B is approaching the region of fluid adjacent the sensor $\mathbf{70}_{77}$.

Accordingly, the phase of the detected pressure pulsation $P_{77}$ depends on the current Operating Point 205 in relation to BEP and on impeller position (See FIG. 2B). The below table summarizes an interpretation of how the momentary fluid pressure $P_{77}$ changes in dependence on impeller position when the pump operates at an outlet flow higher than BEP flow.

| Impeller position (higher than BEP flow) | Pressure $P_{77}$ |
|---|---|
| I | Decreasing |
| I to II | Continued decrease, Passing a lowest peak, and then Increasing |
| II | Increasing |
| II to III | Continued increase, passing a highest peak, and then Decreasing |
| IIII = I | Decreasing |

Thus, it appears as though the amplitude and the phase value of the detected pressure pulsation $P_{77}$ is indicative of the current Operating Point 205 in relation to BEP. In this connection reference is also made to the discussion about the phase value of the detected pressure pulsation in connection with table 5 below.

As a consequence of the higher tangential fluid velocity $v_{75}$ and the lower tangential velocity of the vane tip, causing local high pressure regions on the trailing sides of the vane tips, indicated by plus signs "+" in FIG. 14F parts I, II and III, and causing local low pressure regions on the leading sides of the vane tips, indicated by minus signs "−" in FIG. 14F parts I, II and III, the fluid appears to exhibit turbulent flow in the volute when the pump is running at an output flow $Q_{OUTHi}$ above design point, i.e. higher than BEP flow. The occurrence of turbulent flow therefore appears to result in a lower energy efficiency of the pumping process, since a part of the energy fed to the impeller by a drive motor results in whirling fluid movement and increased warming of the fluid as a result of the whirls.

In this manner, the fluid appears to exhibit turbulent flow in the volute when the pump is running at an output flow $Q_{OUTHi}$ above design point, i.e. higher than BEP flow.

From a perspective of flow through the pump, from pump inlet to pump outlet, the moment shown in FIG. 14F part III corresponds to the moments shown in FIG. 14F part I, and FIG. 14C part I and FIG. 14C part III. Accordingly, the momentary flow from the outlet 66 at the moment shown in FIG. 14F part III, here referred to as $Q_{OUTHiIII}$, is believed to be of the same magnitude as the momentary flow $Q_{OUTHiI}$ (FIG. 14F part I and FIG. 14C part I). By contrast, the momentary flow from the outlet 66 at the moment shown in FIG. 14FII, here referred to as $Q_{OUTHiII}$, is believed to be higher than the momentary flows $Q_{OUTHiI}$ and $Q_{OUTHiI}$ (FIG. 14F part I & 14F part III). The momentary flow $Q_{OUTHiII}$ (FIG. 14F part II) corresponds to the flow $Q_{OUTHiII}$ FIG. 14C part II. When the pump is running at an output flow above design point, the outlet flow $Q_{OUTHi}$ therefore appears to exhibit a pulsation, the amplitude of that pulsation being dependent on the magnitude of the maximum leakage flow q3, as discussed above in connection with FIG. 14C part I, part II and part III. Moreover, experiments appear to indicate that the amplitude of vibrations detected by sensor 70, $\mathbf{70}_{77}$ attached to the casing 62 at the first, narrower, volute part 77 increase in magnitude when the pump operates further away from the design point. Moreover, experiments appear to indicate that the amplitude of vibrations detected by sensor 70, $\mathbf{70}_{77}$ attached to the casing 62 at the first, narrower, volute part 77 corresponds to the magnitude of the pulsation in the outlet flow $Q_{OUTHi}$ when the pump is running at an output flow $Q_{OUTHi}$ above design point, i.e. higher than BEP flow. When the impeller has L=6 vanes, then the pulsation will exhibit L=6 such flow cycles as the impeller rotates a full revolution.

According to an interpretation, the flow and pressure patterns illustrated by FIGS. 14D to 14F provide a cause of the detected phase values as discussed e.g. in relation to FIGS. 16 to 19D.

In particular, it is noted that said first polar angle X1(r), FI(r), Φ(r), $T_D$, $T_{D1}$ exhibits a phase shift of approximately 180 degrees, when the operating point 550 changes from below BEP to above BEP, or vice versa. Thus, this phase shift is to be kept in mind when looking at FIGS. 14E and 14F. In this connection, reference is made to internal status indicator object 550 which is discussed elsewhere in this disclosure, e.g in connection with FIGS. 16 to 19D.

Moreover, an analysis appears to indicate that a detected pressure signal $\mathbf{70}_{77}$ exhibits a different phase as compared to detected pressure signal $\mathbf{70}_{54}$. Thus it may be possible to evaluate or detect an internal state of said centrifugal pump 10 based on said mutual order of occurrence of the vibration signature detected by sensor 7054 and the vibration signature detected by sensor $\mathbf{70}_{77}$.

A Method of Identifying the Current Operating Point

Figure 14G:
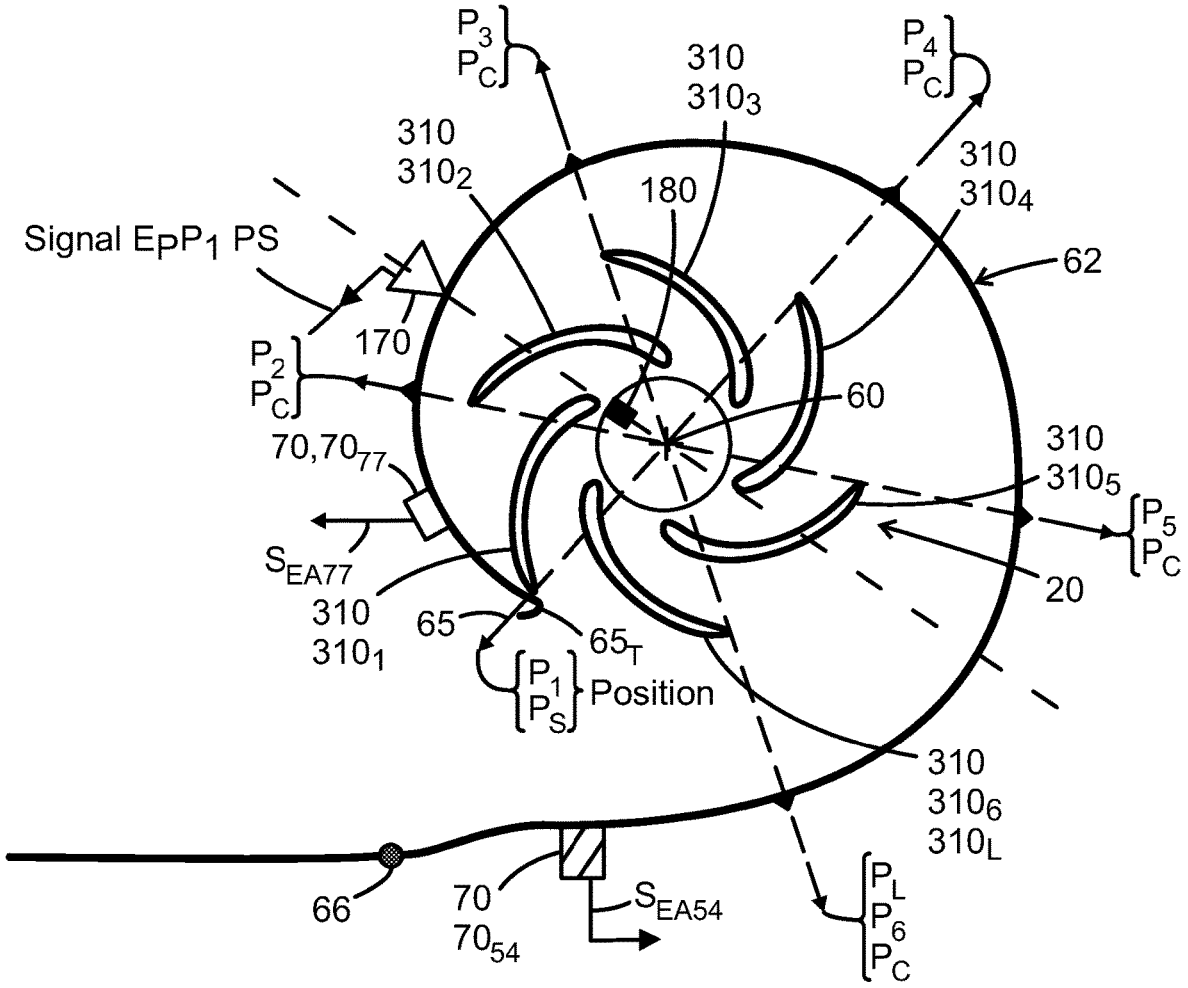
FIG. 14G is another illustration of the example pump 10 of any of FIG. 1A, 1B, 2A, 2B, 2D, 2E or any of 14A to 14F.

FIG. 14G is another illustration of the example pump 10 of any of FIG. 1A, 1B, 2A, 2B, 2D, 2E or any of 14A to 14F. The disclosure relating to FIG. 14G may be relevant to any of the pumps discussed in this disclosure. For the sake of clarity, the example pump illustrated in FIG. 14G does not illustrate all features of the pump 10. For example, FIG. 14G shows one of the walls of the pump outlet, but the wall part close to the tongue 65 has been eliminated from FIG. 14G so as to more clearly show an example stator position P1, $P_S$.

As shown in FIG. 14G the example pump 10 comprises a casing 62 in which a rotatable impeller 20 is disposed so that it can rotate around an axis of rotation 60. The casing 62 forms a volute 75 and the pump includes a tongue 65 separating one part 77 of the volute from another part 78 of the volute. The tongue 65 has a tongue tip 65T. The tongue 65 may have an elongated shape wherein the tip 65T may form an edge. Thus, the tongue 65 may separate the outlet pipe 66 from the narrow volute part 77.

In other words, the casing 62 may include a tongue 65 having an elongated shape wherein the elongated tip 65T may form an edge that separates an outlet 66 from a narrow volute part 77. During operation of the pump, at the Best Efficiency Operating Point (BEP), fluid that approaches the tongue tip 65T will ideally be divided in two parts so as to flow in the directions from the elongated tongue tip 65T to the outlet 66, and from the elongated tongue tip 65T into the narrow volute part 77 (See FIG. 14G in conjunction with FIG. 14A and/or FIG. 14D).

The example pump illustrated in FIG. 14G is designed for clockwise direction of the impeller rotation. As shown in FIG. 14G, a position marker device 180 may be provided in association with the impeller 20 such that, when the impeller 20 rotates around the axis of rotation 60, the position marker 180 passes by the position sensor 170 once per revolution of the impeller, thereby causing the position sensor 170 to generate a revolution marker signal value $P_S$. Alternatively, position signal values $P_S$, PC may be generated by an encoder 170, as disclosed elsewhere in this disclosure.

When there is one position position marker signal value $P_S$ per revolution and the rotational speed $f_{ROT}$ is constant, or substantially constant, there will be a constant, or substantially constant, number of vibration sample values S(i) for every revolution of the pump impeller 20. For the purpose of this example, the position signal P(0) is indicative of the vibration sample i=0, as shown in table 2 (See below). For the purpose of an example, the position of the position signal P(0) in relation to the impeller 20 may not be important, as long as the repetition frequency $f_P$ is dependent on the speed of rotation $f_{ROT}$ of the rotationally moving centrifugal pump impeller 20. Hence, if the position signal Ep has one pulse Ps per revolution of the impeller 20, the digital position signal will also have one Position signal value P(i)=1 per revolution, the remaining Position signal values being zero.

TABLE 2

| #01 Time slot dt i, j | #02 Position P(i) | #03 S(i) | #04 $f_{ROT}$(i) |
|---|---|---|---|
| 0 | $P_S = 1$ | S(0) | const |
| 427 | 0 | S(427) | const |
| 853 | 0 | S(853) | const |
| 1280 | 0 | S(1280) | const |
| 1707 | 0 | S(1707) | const |
| 2133 | 0 | S(2133) | const |
| 2560 | 0 | S(2560) | const |
| 2987 | 0 | S(2987) | const |
| 3413 | 0 | S(3413) | const |
| 3840 | 0 | S(3840) | const |
| 4267 | 0 | S(4267) | const |
| 4693 | 0 | S(4693) | const |
| 5120 | 0 | S(5120) | const |
| 5547 | 0 | S(5547) | const |
| 5973 | 0 | S(5973) | const |
| 6400 | 0 | S(6400) | const |
| 6827 | 0 | S(6827) | const |
| 7253 | 0 | S(7253) | const |
| 7680 | $P_S = 1$ | S(7680) | const |

Thus, at a certain constant speed $f_{ROT}$ there may be n time slots per revolution, as indicated by table 2, and n may be a positive integer. In the example of table 2, n=7680.

Having one position signal $P_S$ per revolution, we know that the position signal will be repetitive every n slots when the rotational speed $f_{ROT}$ is constant. Thus, a number of virtual position signals $P_C$ may be generated by calculation. In an example, consider that virtual position signals $P_C$ are generated. The provision of L virtual position signals $P_C$, i.e. one virtual position signal $P_C$ per vane 310, may be used for establishing a temporal relation between

- the occurrence of the repetitive vibration signal amplitude component $S_{FP}$ and
- the occurrence of a position signal $P_C$, P(i) which has a second repetition frequency $f_P$ dependent on the speed of rotation $f_{ROT}$ of the rotationally moving centrifugal pump impeller 20.

Having L equidistant vanes 310 in the impeller and one position signal Ps per revolution and a constant speed of rotation $f_{ROT}$ it is possible to generate one virtual position signal $P_C$ per vane, so that the total number of position signals Ps, $P_C$ are evenly distributed. Each such position marker signal value $P_S$ and Pc is indicative of a stationary position, i.e. a position of the immobile casing 62, as illustrated by "Ps" and "Pc" in FIG. 14G. The casing 62 may also be referred to as stator 62, since it is static or immobile.

Thus, a position signal Ps or $P_C$ will occur at every n/L sample value position, as indicated in Table 3, when there are provided n time slots per revolution. In table 3, n=7680, and L=6, and thus there is provided a position signal $P_C$ at every 1280 sample, the calculated position signals being indicated as 1C.

As illustrated in the FIG. 14G example, the position marker signal values $P_S$ and Pc are indicative of L stationary positions P1, P2, P3, P4, P5 and PL, where L=6, since there are 6 vanes 310, $\mathbf{310}_1$, $\mathbf{310}_2$, $\mathbf{310}_3$, $\mathbf{310}_4$, $\mathbf{310}_5$, $\mathbf{310}_6$, $\mathbf{310}_L$ in the illustrated impeller 20.

It may be assumed that the operating point of the pump is substantially constant during a single revolution of the impeller 20. In other words, the position of the pulsation event in the fluid is substantially immobile during a single revolution of the impeller 20.

Since the vibration signal amplitude component $S_{FP}$, $S_P$ is generated by a pulsation event in the fluid (See FIGS. 14A to 14F), it will be repetitive with the frequency of one vibration signal amplitude component $S_{FP}$, $S_P$ per vane 310. Thus, it can be assumed that the temporal relation between

- the occurrence of the repetitive vibration signal amplitude component $S_{FP}$, $S_P$ and
- the occurrence of a position signal P, PC will be substantially constant for each of the L data blocks, L being L=6 in this example.

Table 3 illustrates the principle of a temporal progression of position signal values P(i) with calculated Positions signal values P(i) being indicated as "1C".

TABLE 3

| #00 | #01 Time slot dt i (*1000) | #02 Position P(i) | #03 S(i) | #04 $f_{ROT}$(i) |
|---|---|---|---|---|
| | 0 | $P_S = 1$ | S(0) | const |
| Passage I | 427 | 0 | S(427) | const |
| Passage I | 853 | 0 | S(853) | const |
| Passage I | 1280 | $P_C = 1C$ | S(1280) | const |
| Passage II | 1707 | 0 | S(1707) | const |
| Passage II | 2133 | 0 | S(2133) | const |
| Passage II | 2560 | $P_C = 1C$ | S(2560) | const |
| Passage III | 2987 | 0 | S(2987) | const |
| Passage III | 3413 | 0 | S(3413) | const |
| Passage III | 3840 | $P_C = 1C$ | S(3840) | const |
| Passage IV | 4267 | 0 | S(4267) | const |
| Passage IV | 4693 | 0 | S(4693) | const |
| Passage IV | 5120 | $P_C = 1C$ | S(5120) | const |
| Passage V | 5547 | 0 | S(5547) | const |
| Passage V | 5973 | 0 | S(5973) | const |
| Passage V | 6400 | $P_C = 1C$ | S(6400) | const |
| Passage VI | 6827 | 0 | S(6827) | const |
| Passage VI | 7253 | 0 | S(7253) | const |
| Passage VI | 7680 | $P_S = 1$ | S(7680) | const |

TABLE 4

| #00 | #01 Time slot dt i, j | #02 Position P(i) | #03 S(i) | #04 $f_{ROT}$(i) |
|---|---|---|---|---|
| | 0 | $P_S = 1$ | S(0) | const |
| Passage I | 40 | 0 | S(40) | const |
| Passage I | 80 | 0 | S(80) | const |
| Passage I | 120 | 0 | S(120) | const |

TABLE 4-continued

| #00 | #01 Time slot dt i, j | #02 Position P(i) | #03 S(i) | #04 $f_{ROT}(i)$ |
|---|---|---|---|---|
| Passage I | 160 | 0 | S(160) | const |
| Passage I | 200 | 0 | S(200) | const |
| Passage I | 240 | 0 | S(240) | const |
| Passage I | 280 | 0 | S(280) | const |
| Passage I | 320 | 0 | S(320) | const |
| Passage I | 360 | 0 | S(360) | const |
| Passage I | 400 | 0 | S(400) | const |
| Passage I | 440 | 0 | S(440) | const |
| Passage I | 480 | 0 | S(480) | const |
| Passage I | 520 | 0 | S(520) | const |
| Passage I | 560 | 0 | S(560) | const |
| Passage I | 600 | 0 | S(600) | const |
| Passage I | 640 | 0 | S(640) | const |
| Passage I | 680 | 0 | S(680) | const |
| Passage I | 720 | 0 | S(720) | const |
| Passage I | 760 | 0 | S(760) | const |
| Passage I | 800 | 0 | S(800) | const |
| Passage I | 840 | 0 | S(840) | const |
| Passage I | 880 | 0 | S(880) | const |
| Passage I | 920 | 0 | S(920) | const |
| Passage I | 960 | 0 | S(960) | const |
| Passage I | 1000 | 0 | S(1000) | const |
| Passage I | 1040 | 0 | S(1040) | const |
| Passage I | 1080 | 0 | S(1080) | const |
| Passage I | 1120 | 0 | S(1120) | const |
| Passage I | 1160 | 0 | S(1160) | const |
| Passage I | 1200 | 0 | S(1200) | const |
| Passage I | 1240 | 0 | S(1240) | const |
| Passage I | 1280 | $P_C$ = 1C | S(1280) | const |

TABLE 5

| #00 | #01 Time slot dt i, j | #02 Position % | #03 S(i) | #04 $f_{ROT}(i)$ |
|---|---|---|---|---|
| | 0 = $N_0$ | 0% | | const |
| Passage I | 40 | 3% | | const |
| Passage I | 80 | 6% | | const |
| Passage I | 120 | 9% | | const |
| Passage I | 160 | 13% | | const |
| Passage I | 200 | 16% | | const |
| Passage I | 240 | 19% | | const |
| Passage I | 280 | 22% | | const |
| Passage I | 320 | 25% | | const |
| Passage I | 360 | 28% | | const |
| Passage I | 400 | 31% | | const |
| Passage I | 440 | 34% | | const |
| Passage I | 480 | 38% | | const |
| Passage I | 520 | 41% | | const |
| Passage I | 560 | 44% | | const |
| Passage I | 600 | 47% | | const |
| Passage I | 640 | 50% | | const |
| Passage I | 680 | 53% | | const |
| Passage I | 720 | 56% | | const |
| Passage I | 760 = $N_P$ | 59% | S(760) = Sp | const |
| Passage I | 800 | 63% | | const |
| Passage I | 840 | 66% | | const |
| Passage I | 880 | 69% | | const |
| Passage I | 920 | 72% | | const |
| Passage I | 960 | 75% | | const |
| Passage I | 1000 | 78% | | const |
| Passage I | 1040 | 81% | | const |
| Passage I | 1080 | 84% | | const |
| Passage I | 1120 | 88% | | const |
| Passage I | 1160 | 91% | | const |
| Passage I | 1200 | 94% | | const |
| Passage I | 1240 | 97% | | const |
| Passage I | 1280 = $N_B$ | 100% | | const |

As mentioned above, the impeller 20 is rotatable around the axis of rotation 60, and thus the position sensor 170, being mounted in an immobile manner, may generate a position signal Ep having a sequence of impeller position signal values $P_S$ for indicating momentary rotational positions of the impeller 20. As shown in FIG. 2A a position marker 180 may be mechanically coupled to the impeller 20 such that, when the impeller 20 rotates around the axis of rotation 60, the position marker 180 passes by the position sensor 170 during one revolution of the impeller 20, thereby causing the position sensor 170 to generate a revolution marker signal value $P_S$.

As mentioned above, the position sensor 170 may generate a position signal Ep having a sequence of impeller position signal values $P_S$ for indicating momentary rotational positions of the impeller 20 when the impeller 20 rotates. With reference to tables 2-4 in this document, such a marker signal value $P_S$ is illustrated as "1" in column #2 in tables 2-4.

When the rotating impeller is provided with one position marker device 180, the marker signal value $P_S$ will be provided once per revolution. The marker signal value $P_S$ is illustrated as "1" in column #2 in tables 2-4. Having L equidistant vanes 310 in the impeller and one position signal value $P_S$ per revolution and a constant speed of rotation $f_{ROT}$ it is possible to generate one virtual position signal $P_C$ per vane, so that the total number of position signal values $P_S$, $P_C$ are evenly distributed, as discussed above (See FIG. 14G). Thus, a position signal $P_S$ or Pc will occur at every n/L sample value position, as indicated in Table 3, when there are provided n time slots per revolution. In table 3, n=7680, and L=6, and thus there is provided a position signal $P_C$ at every 1280 sample, the calculated position signals being indicated as 1C.

It is believed that the mutually equidistant positions of the vanes 310 is of importance for some embodiments of this disclosure when the marker signal value $P_S$, illustrated as "1" in column #2 in tables 2-4, is provided once per revolution and virtual position signal values $P_C$ are generated in an evenly distributed manner such that a position signal P or $P_C$ will occur at every n/L sample value position, as indicated in Table 3, when there are provided n time slots per revolution in a sequence of impeller position signal values for indicating momentary rotational positions of the impeller 20. In table 3 an actually detected revolution marker signal value $P_S$ is reflected as "1" (see column #2, time slot "0" and time slot "7680" in table 3), and virtual position signal values $P_C$ are reflected as "1C" (see column #2, time slot "0" and time slot "7680" in table 3).

This is believed to be of importance for some embodiments of this disclosure since the position markers 180 cause the generation of position reference signal values, and the vanes 310 are involved in the causing of a signal event, such as e.g. an amplitude peak value, in the vibration signal (See references $S_{EA}$, $S_{MD}$, Se(i), S(j), S(q) e.g. in FIGS. 1 and 15). Moreover, the temporal duration between the occurrence of a position reference signal value and the occurrence of a signal event in the vibration signal, caused by pulsation in the fluid material 30, may be indicative of an internal state of the pump, as discussed elsewhere in this disclosure.

Table 4 is an illustration of the first block of data, i.e. relating to Passage I, having n/L=7680/6=1280 consecutive time slots. It is to be understood that if there is a constant speed phase (See FIG. 9) for the duration of a complete revolution of the impeller 20, then each of the blocks I to VI (See table 3) will have the same appearance as Passage I being illustrated in table 4.

According to embodiments of this disclosure, with reference to column #03 in table 4, the vibration sample values S(i) are analyzed for detection of a vibration signal signature $S_{FP}$. The vibration signal signature $S_{FP}$ may be manifested as a peak amplitude sample value Sp. According to an example, with reference to column #03 in table 4, the vibration sample values S(i) are analyzed by a peak value detector for detection of a peak sample value Sp. With reference to table 5, the peak value analysis leads to the detection of a highest vibration sample amplitude value S(i). In the illustrated example, the vibration sample amplitude value S(i=760) is detected to hold a highest peak value Sp.

Having detected the peak value Sp to be located in time slot 760, a temporal relation between the occurrence of the repetitive vibration signal amplitude component Sp and the occurrence of a position signal P(i) can be established. In table 5 the time slots carrying position signals P(i) are indicated as 0% and 100%, respectively, and all the slots in between may be labelled with their respective locations, as illustrated in column #02 in table 5. As illustrated in the example in col. #02 of table 5, the temporal location of slot number i=760 is at a position 59% of the temporal distance between slot i=0 and slot i=1280. Differently expressed, 760/1280=0.59=59%

Consequently, the inventor concluded that the temporal relation between the occurrence of the repetitive vibration signal amplitude component $S_{FP}$ and the occurrence of a position signal P(i)

may be used as an indication of the physical position of the event signature between two adjacent vanes 310 in the rotating impeller 20, such as between vanes 310A and 310B. In this connection reference is made to the discussion of FIGS. 14A-14C, and 14D-14F, about the amplitude and the phase value of the detected pressure pulsation $P_{54}$ and $P_{77}$, respectively. As stated there, it appears as though the amplitude and the phase value of the detected pressure pulsation $P_{54}$ and/or $P_{77}$ is indicative of the current Operating Point 205 in relation to BEP (See also FIG. 2B).

Accordingly, it appears to be of interest to establish the impeller position at the moment of occurrence of the peak value $P_{54}$ and/or $P_{77}$. Another way of expressing this is: In terms of the distance between two adjacent vane tips, 310A and 310B, it appears to be of interest to establish at what position, between the two adjacent vane tips, the highest peak value $P_{54}$ and/or $P_{77}$ occurs. This is because that position, i.e. the position at which the highest peak value occurs, appears to be indicative the current operating state of the pump. More specifically, the position at which the highest peak value occurs appears to be indicative the current operating state of the pump in relation to the Best Operating Point.

Accordingly, a position of the detected event signature 205, expressed as a percentage of the distance between the tips of two adjacent vanes 310A, 310B (see FIGS. 14A-14C, and 14D-14F in conjunction with table 5), can be obtained by:

Counting a total number of samples ($N_B$–$N_0$=$N_B$–0=$N_B$=1280) from the first reference signal occurrence in sample number $N_0$=0 to the second reference signal occurrence in sample number $N_B$=1280, and Counting another number of samples ($N_P$–$N_0$=$N_P$–0=$N_P$) from the first reference signal occurrence at $N_0$=0 to the occurrence of the peak amplitude value Sp at sample number $N_P$, and generating said first temporal relation ($R_T$(r); $T_D$; FI(r)) based on said another number $N_P$ and said total number $N_B$. This can be summarized as:

$$R_T(r) = R_T(760) = (N_P - N_0)/(N_B - N_0) = (760 - 0)/(1280 - 0) = 0{,}59 = 59\%$$

Thus, information identifying a momentary operating point 205 may be generated by:

Counting a total number of samples ($N_B$) from the first reference signal occurrence to the second reference signal occurrence, and Counting another number of samples ($N_P$) from the first reference signal occurrence to the occurrence of the peak amplitude value Sp at sample number $N_P$, and generating said first temporal relation ($R_T$(r); $T_D$; FI(r)) based on a relation between said sample number $N_P$ and said total number of samples i.e. $N_B$.

Since S=v*t, wherein S=distance, v=constant speed, and t is time, the temporal relation can be directly translated into a distance. Consequently, col. #02 of table 5, can be regarded as indicating the physical location of the event signature at a position 59% of the distance between vane 310A and vane 310B (see FIG. 14E, 14F and/or FIG. 14B, 14C in conjunction with col. #02 of table 5). Alternatively, col. #02 of table 5, can be regarded as indicating the physical location of the event signature at a percentage of the distance between the first static position P1 and the second static position P2 (See FIG. 14G in conjunction with col. #02 of table 5 and in view of FIGS. 14E, 14F and/or FIG. 14B, 14C).

According to another example, with reference to table 6, the temporal relation between the occurrence of the repetitive vibration signal amplitude component Sp and the occurrence of a position signal P(i) can be regarded as a phase deviation or phase value FI, expressed in degrees.

TABLE 6

| #00 | #01 Time slot dt i | #02 phase FI degrees | #03 S(i) | #04 $f_{ROT}$(i) |
|---|---|---|---|---|
| | 0 | 0 | | const |
| Passage I | 40 | 11, 25 | | const |
| Passage I | 80 | 22, 5 | | const |
| Passage I | 120 | 33, 75 | | const |
| Passage I | 160 | 45 | | const |
| Passage I | 200 | 56, 25 | | const |
| Passage I | 240 | 67, 5 | | const |
| Passage I | 280 | 78, 75 | | const |
| Passage I | 320 | 90 | | const |
| Passage I | 360 | 101, 25 | | const |
| Passage I | 400 | 112, 5 | | const |
| Passage I | 440 | 123, 75 | | const |
| Passage I | 480 | 135 | | const |
| Passage I | 520 | 146, 25 | | const |
| Passage I | 560 | 157, 5 | | const |
| Passage I | 600 | 168, 75 | | const |
| Passage I | 640 | 180 | | const |
| Passage I | 680 | 191, 25 | | const |
| Passage I | 720 | 202, 5 | | const |
| Passage I | 760 | 213, 75 | S(760) = Sp | const |
| Passage I | 800 | 225 | | const |
| Passage I | 840 | 236, 25 | | const |
| Passage I | 880 | 247, 5 | | const |
| Passage I | 920 | 258, 75 | | const |
| Passage I | 960 | 270 | | const |
| Passage I | 1000 | 281, 25 | | const |

TABLE 6-continued

| #00 | #01 Time slot dt i | #02 phase FI degrees | #03 S(i) | #04 $f_{ROT}(i)$ |
|---|---|---|---|---|
| Passage I | 1040 | 292, 5 | | const |
| Passage I | 1080 | 303, 75 | | const |
| Passage I | 1120 | 315 | | const |
| Passage I | 1160 | 326, 25 | | const |
| Passage I | 1200 | 337, 5 | | const |
| Passage I | 1240 | 348, 75 | | const |
| Passage I | 1280 | 360 | | const |

In fact, by using the position signal as a reference signal for the digital measurement signal $S_{MD}$, S(i), S(j), and adjusting the settings of a Fast Fourier Transformer in a certain manner, the Fast Fourier Transformer may be used for extracting the amplitude top value as well as the phase value, as discussed below. Consequently, col. #02 of table 6, can be regarded as indicating the location of the detected event signature 205, and/or indicating the physical location of the internal status indicator object 550 at a position 213.75 degrees of the distance between vane 310A and vane 310B when the total distance between vane 310A and vane 310B is regarded as 360 degrees (see FIGS. 14A to 14F in conjunction with col. #02 of table 6).

When the phase angle parameter value FI, X1 has a numerical value exceeding 180 degrees, it may be translated into a phase deviation value $FI_{DEV}$, wherein $$FI_{DEV}=FI-360$$

In this case, when $$FI(r)=360*760/1280=213.75 \text{ degrees}$$

then the corresponding phase deviation value $FI_{DEV}$ will be $$FI_{DEV}=FI-360=213,75-360=-146.25 \text{ degrees}$$

This is illustrated in FIG. 19A.

Referring to FIG. 19A in conjunction with col. #02 of table 6, the phase angle FI appears to be indicative of a current operating point in relation to a Best Efficiency Point. In other words, the phase angle Φ(r)=FI(r) may exhibit a predetermined value when the pump operates at BEP flow condition. When the phase angle Φ(r)=FI(r) deviates from the predetermined value, that deviation appears to be indicative of operation away from BEP flow condition. In the example illustrated in FIG. 19A, the predetermined value was zero (0) degrees, so that the status indicator object $\mathbf{550}_{BEP}$ indicative of the pump operating at BEP flow condition exhibits a zero degree phase angle. Thus, the status indicator object $\mathbf{550}_{BEP}$=550(*p*+4) has a phase angle Φ(r)=FI(r)=Φ(p+4)=0 degrees.

Figure 16:
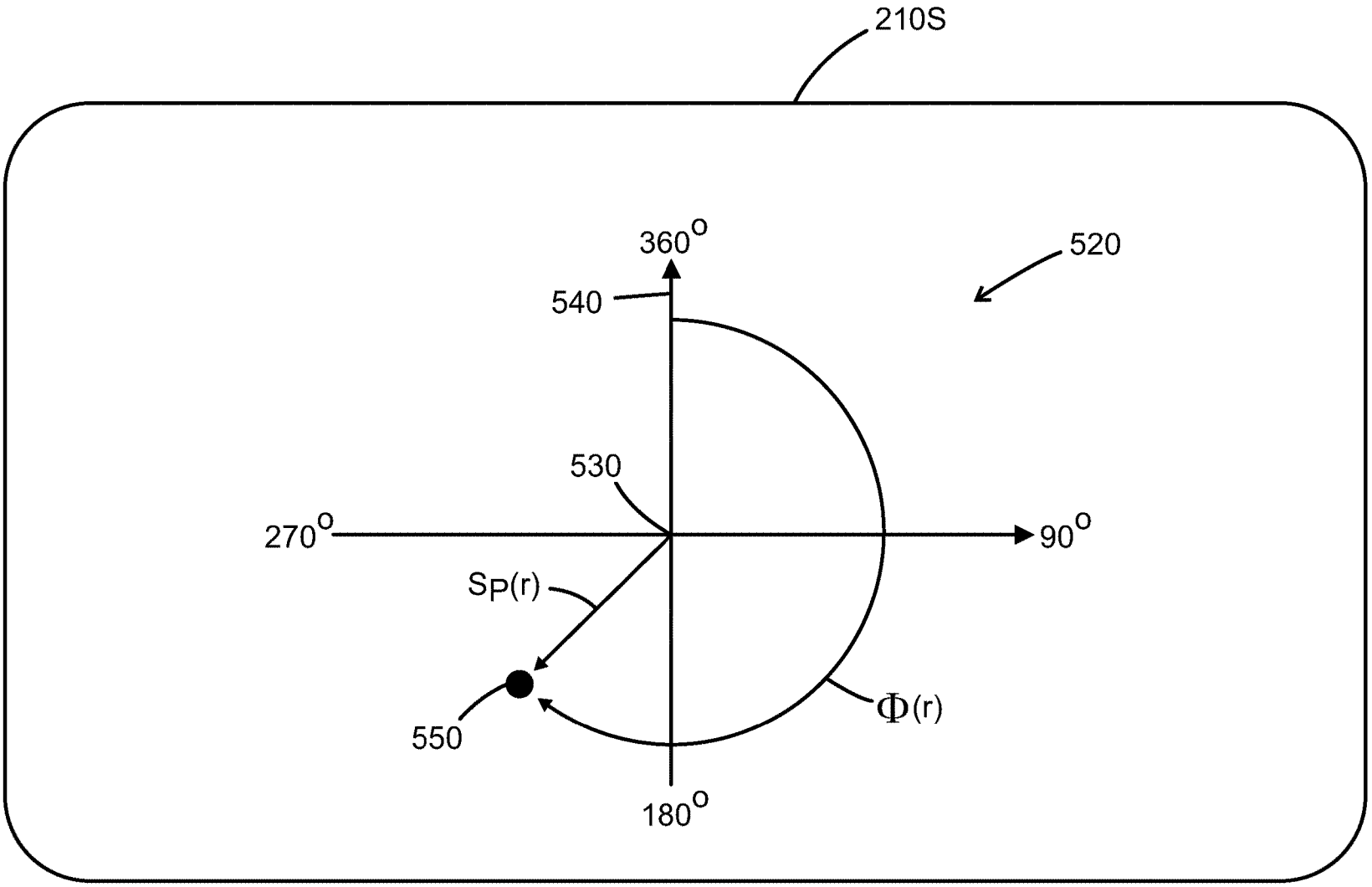
FIG. 16 is an illustration of an example of a visual indication of an analysis result.

The physical location of the pulsation peak 205, when expressed as a part of the distance between two adjacent vanes 310, may be referred to as information identifying a momentary operating point 205 (compare FIG. 2B). In other words, this disclosure provides a manner of identifying information identifying a momentary operating point 205 in a centrifugal pump. Hence, this disclosure provides a manner of generating information indicative of the location of the detected event signature 205, when expressed as a proportion of the distance between two adjacent vanes 310 in a rotating impeller 20. With reference to FIG. 15A and FIG. 16 the internal status indicator object 550, and/or the operating point 205, 550 may be presented as a phase angle FI(r), as discussed in connection with FIGS. 15 and 16 below. According to embodiments of this disclosure, the internal status indicator object 550 and/or the operating point 205, 550 can be presented as a percentage (see col. #02 of table 5 above). Moreover, according to embodiments of this disclosure, the internal status indicator object 550 and/or the operating point 205, 550 can be presented as a temporal duration, or as a part of a temporal duration. As discussed above, in connection with table 5, since $S=v_{310T}*t$, wherein S=distance, $v_{310T}$=the tangential speed of a vane tip, and t is time, the temporal relation can be directly translated into a distance. In this context it is noted that the tangential speed $v_{310T}$ of a vane depends on the angular velocity $f_{ROT}$ of the impeller 20 and of the radius $R_{MIC}$ of the impeller 20 (See FIG. 14D, part II).

FIG. 15A is a block diagram illustrating an example of a status parameter extractor 450. The status parameter extractor 450 of FIG. 15A includes an impeller speed detector 500 that receives the digital vibration signal $S_{MD}$, S(i) and the digital position signal (Pi). The impeller speed detector 500 may also be referred to as an impeller speed value generator 500. The impeller speed detector 500 may generate the three signals S(j), P(j) and $f_{ROT}(j)$ on the basis of the received digital vibration signal $S_{MD}$, S(i) and the digital position signal (Pi). This may be achieved e.g. in the manner described above in relation to FIGS. 7 to 13. In this connection it is noted that the three signals S(j), P(j) and $f_{ROT}(j)$ may be delivered simultaneously, i.e. they all relate to the same time slot j. In other words, the three signals S(j), P(j) and $f_{ROT}(j)$ may be provided in a synchronized manner. The provision of signals, such as S(j), P(j) and $f_{ROT}(j)$, in a synchronized manner advantageously provides accurate information about temporal relations between signal values of the individual signals. Thus, for example, a speed value $f_{ROT}(j)$ delivered by the impeller speed value generator 500 is indicative of a momentary rotational speed of the impeller 20 at the time of detection of the amplitude value S(j).

It is noted that the signals S(j) and P(j), delivered by the impeller speed value generator 500, are delayed in relation to the signals S(i) and (Pi) received by the impeller speed value generator 500. It is also noted that the signals S(j) and P(j) are equally delayed in relation to the signals S(i) and (Pi), thus the temporal relation between the two has been maintained. In other words, the signals S(j) and P(j) are synchronously delayed.

The impeller speed detector 500 may deliver a signal indicative of whether the speed of rotation has been constant for a sufficiently long time, in which case the signals S(j) and P(j) may be delivered to a Fast Fourier Transformer 510.

The variables $O_{MAX}$, $B_n$, and L, should be set so as to render the variable $N_R$ a positive integer, as discussed above. According to an example, the above variables $O_{MAX}$, $B_n$, and L, may be set by means of the Human Computer Interface, HCI, 210, 210S (See e.g. FIG. 1 and/or FIG. 5 and/or FIG. 15A). As mentioned above the resulting integer number $N_R$ may indicate the number of revolutions of the monitored centrifugal pump impeller 20 during which the digital signals S(j) and P(j) are analysed by the FFT 510. Thus, based on the settings of the variables $O_{MAX}$, $B_n$, and L, the FFT 510 may generate the value $N_R$, indicative of the duration of the analysis of a measurement session, and after a measurement session, the FFT 510 delivers a set of status value Sp(r) and FI(r).

The notion "r", in status values Sp(r) and FI(r), indicates a point in time. It is to be noted that there may be a delay in time from the reception of a first pair of input signals S(j), P(j) at the inputs of the FFT 510 until the delivery of a corresponding pair of status values Sp(r) and FI(r) from the FFT 510. A pair of status values Sp(r) and FI(r) may be based on a temporal sequence of pairs of input signals S(j), P(j). The duration of the temporal sequence of pairs of input signals S(j), P(j) should include at least two successive position signal values P(j)=1 and the corresponding vibration input signal values S(j).

The status values Sp(r) and FI(r) may also be referred to as $C_L$ and $\Phi_L$, respectively, as explained below.

For the purpose of conveying an intuitive understanding of this signal processing it may be helpful to consider the superposition principle and repetitive signals such as sinus signals. A sinus signal may exhibit an amplitude value and a phase value. In very brief summary, the superposition principle, also known as superposition property, states that, for all linear systems, the net response at a given place and time caused by two or more stimuli is the sum of the responses which would have been caused by each stimulus individually. Acoustic waves are a species of such stimuli. Also a vibration signal, such as the vibration signal $S_{EA}$, $S_{MD}$, S(j), S(r) including the signal signature is a species of such stimuli. In fact, the vibration signal $S_{EA}$, $S_{MD}$, S(j), S(r) including the signal signature $S_{FP}$ may be regarded as a sum of sinus signals, each sinus signal exhibiting an amplitude value and a phase value. In this connection, reference is made to the Fourier series (See Equation 5 below):

$$F(t) = \sum_{n=0}^{n=\infty} C_n \sin(n\omega t + \Phi_n) \quad \text{(Eq. 5)}$$

wherein

- n=0 the average value of the signal during a period of time (it may be zero, but need not be zero),
- n=1 corresponds to the fundamental frequency of the signal F(t),
- n=2 corresponds to the first harmonic partial of the signal F(t)
- $\omega$=the angular frequency i.e. ($2*\pi*f_{ROT}$),
- $f_{ROT}$=the impeller speed of rotation expressed as periods per second,
- t=time,
- $\Phi_n$=phase angle for the n:th partial, and
- $C_n$=Amplitude for the n:th partial It follows from the above Fourier series that a time signal may be regarded as composed of a superposition of a number of sinus signals.

An overtone is any frequency greater than the fundamental frequency of a signal.

In the above example, it is noted that the fundamental frequency will be $f_{ROT}$, i.e. the impeller speed of rotation, when the FFT 510 receives a marker signal value P(j)=1 only one time per revolution of the impeller 20 (See e.g. FIG. 14G in conjunction with FIGS. 5 and 15A).

Using the model of Fourier analysis, the fundamental and the overtones together are called partials. Harmonics, or more precisely, harmonic partials, are partials whose frequencies are numerical integer multiples of the fundamental (including the fundamental, which is 1 times itself).

With reference to FIG. 15A and equation 5 above, the FFT 510 may deliver the amplitude value Cn(r) for n=L, i.e. $C_L$ (r)=Sp(r). The FFT 510 may also deliver phase angle for the partial (n=L), i.e. $\Phi_L$(r)=FI(r).

Now consider an example when an impeller rotates at a speed of 10 revolutions per minute (rpm), the impeller having ten (10) vanes 310. A speed of 10 rpm renders one revolution every 6 seconds, i.e. $f_{ROT}$=0.1667 rev/sec. The impeller having ten vanes (i.e. L=10) and running at a speed of $f_{ROT}$=0.1667 rev/sec renders a repetition frequency $f_R$ of 1.667 Hz for the signal relating to the vanes 310, since the repetition frequency $f_R$ is the frequency of order 10.

The position signal P(j), P(q) (see FIG. 15A) may be used as a reference signal for the digital measurement signal S(j),S(r). According to some embodiments, when the FFT analyzer is configured to receive a reference signal, i.e. the position signal P(j), P(q), once per revolution of the rotating impeller 20, the setting of the FFT analyzer should fulfill the following criteria:

- The integer value Oi is set to equal L, i.e. the number of vanes in the impeller 20, and
- the settable variables $O_{MAX}$, and $B_n$ are selected such that the mathematical expression $Oi*B_n/O_{MAX}$ becomes a positive integer. Differently expressed: When integer value Oi is set to equal L, then settable variables $O_{MAX}$ and $B_n$ should be set to integer values so as to render the variable $N_R$ a positive integer, wherein $N_R = Oi*B_n/O_{MAX}$

- $O_{MAX}$ is a maximum order; and
- $B_n$ is the number of bins in the frequency spectrum produced by the FFT, and
- Oi is a frequency of interest, expressed as an integer in orders, and wherein $f_{ROT}$ is the frequency of order 1, i.e. the fundamental frequency. In other words, the speed of rotation $f_{ROT}$ of the impeller 20 is the fundamental frequency and L is the number of vanes in the impeller 20.

Using the above setting, i.e. integer value Oi is set to equal L, and with reference to FIG. 15A and equation 5 above, the FFT 510 may deliver the amplitude value $C_n$ for n=L, i.e. $C_L$=Sp(r). The FFT 510 may also deliver phase angle for the partial (n=L), i.e. $\Phi_L$=FI(r). Thus, according to embodiments of this disclosure, when the FFT 510 receives a position reference signal P(j), P(q) once per revolution of the rotating impeller 20, then the FFT analyzer can be configured to generate a peak amplitude value $C_L$ for a signal whose repetition frequency $f_R$ is the frequency of order L, wherein L is the number of equidistantly positioned vanes 310 in the rotating impeller 20.

With reference to the discussion about equation 5 above in this disclosure, the amplitude of the signal whose repetition frequency $f_R$ is the frequency of order L may be termed $C_1$ for n=L, i.e. $C_L$. Referring to equation 5 and FIG. 15A, the amplitude value $C_L$ may be delivered as a peak amplitude value indicated as Sp(r) in FIG. 15A.

Again with reference to equation 5, above in this disclosure, the phase angle value $\Phi_L$ for the signal whose repetition frequency $f_R$ is the frequency of order L may be delivered as a temporal indicator value, the temporal indicator value being indicative of a temporal duration $T_{D1}$ between occurrence of an detected event signature and occurrence of a rotational reference position of said rotating impeller.

Hence, according to embodiments of this disclosure, when the FFT 510 receives a position reference signal P(j), P(q) once per revolution of the rotating impeller 20, then the FFT analyzer can be configured to generate a phase angle value $\Phi_L$ for a signal whose repetition frequency $f_R$ is the frequency of order L, wherein L is the number of equidistantly positioned vanes 310 in the rotating impeller 20.

Hence, using the above setting, i.e. integer value Oi being set to equal L, and with reference to FIG. 15A and equation 5 above, the FFT 510 may generate the phase angle value $\Phi_L$.

With reference to FIG. 15A in conjunction with FIG. 1, the status values $Sp(r)=C_L$ and $FI(r)=\Phi_L$ may be delivered to the Human Computer Interface (HCI) 210 for providing a visual indication of the analysis result. As mentioned above, the analysis result displayed may include information indicative of an internal state of the centrifugal pump process for enabling the operator 230 to control the centrifugal pump.

FIG. 16 is an illustration of an example of a visual indication of an analysis result. According to an example, the visual indication of the analysis result may include the provision of a polar coordinate system 520. A polar coordinate system is a two-dimensional coordinate system in which each point on a plane is determined by a distance from a reference point 530 and an angle from a reference direction 540. The reference point 530 (analogous to the origin of a Cartesian coordinate system) is called the pole 530, and the ray from the pole in the reference direction is the polar axis. The distance from the pole is called the radial coordinate, radial distance or simply radius, and the angle is called the angular coordinate, polar angle, or azimuth.

According to an example, the amplitude value Sp(r) is used as the radius, and the temporal relation value FI(r), $\Phi(r)$, $T_D$ is used as the angular coordinate.

In this manner an internal status of the monitored centrifugal pump may be illustrated by providing an internal status indicator object 550 on the display 210S (FIG. 16 in conjunction with FIG. 1). FIG. 16 in conjunction with FIG. 1 and FIG. 14 may be useful for understanding the following example.

Hence, an example relates to an electronic centrifugal pump monitoring system 150, 210S for generating and displaying information relating to a pumping process in a centrifugal pump 10 having an impeller 20 that rotates around an axis 60 at a speed of rotation $f_{ROT}$ for causing fluid material 30 to exit the pump outlet 66. The example monitoring system 150 includes:

- a computer implemented method of representing an internal state of said pumping process in said centrifugal pump on a screen display 210S, the method comprising:
- displaying on said screen display 210S
  - a polar coordinate system 520, said polar coordinate system 520 having
    - a reference point (O, 530), and
    - a reference direction (0°, 360°, 540); and
  - a first internal status indicator object (550, $S_{P1}$, $T_{D1}$), indicative of said internal state of said pumping process, at a first radius (Sp(r), $S_{P1}$) from said reference point (O) and at a first polar angle (FI(r), $\Phi(r)$, $T_D$, $T_{D1}$) in relation to said reference direction (0°,360°, 540),
    - said first radius (X2(r) Sp(r), $S_{P1}$) being indicative of an amplitude of detected fluid pulsation, and
    - said first polar angle (X1(r), FI(r), $\Phi(r)$, $T_D$, $T_{D1}$) being indicative of a direction of deviation of the current operating point 205 from a current Best Efficiency operating Point.

The first polar angle (X1(r), FI(r), $\Phi(r)$, $T_D$, $T_{D1}$) may also be indicative of a position of the detected event signature 205 between two vanes 310 in the rotating impeller 20.

As mentioned above, the status parameter extractor 450 may be configured to generate successive pairs of the status values Sp(r) and FI(r). The status parameter extractor 450 may also generate time derivative values of the status values Sp(r) and FI(r), respectively. This may be done e.g. by subtracting a most recent previous status value Sp(r−1) from the most recent status value Sp(r) divided by the temporal duration between the two values. Similarly a numerical derivative of the internal status value FI may be achieved. Thus, derivative values dSp(r) and dFI(r) may be generated. The derivative values dSp(r) and dFI(r) may be used for indicating movement of the first internal status indicator object (550, $S_{P1}$, $T_{D1}$).

Figure 17:
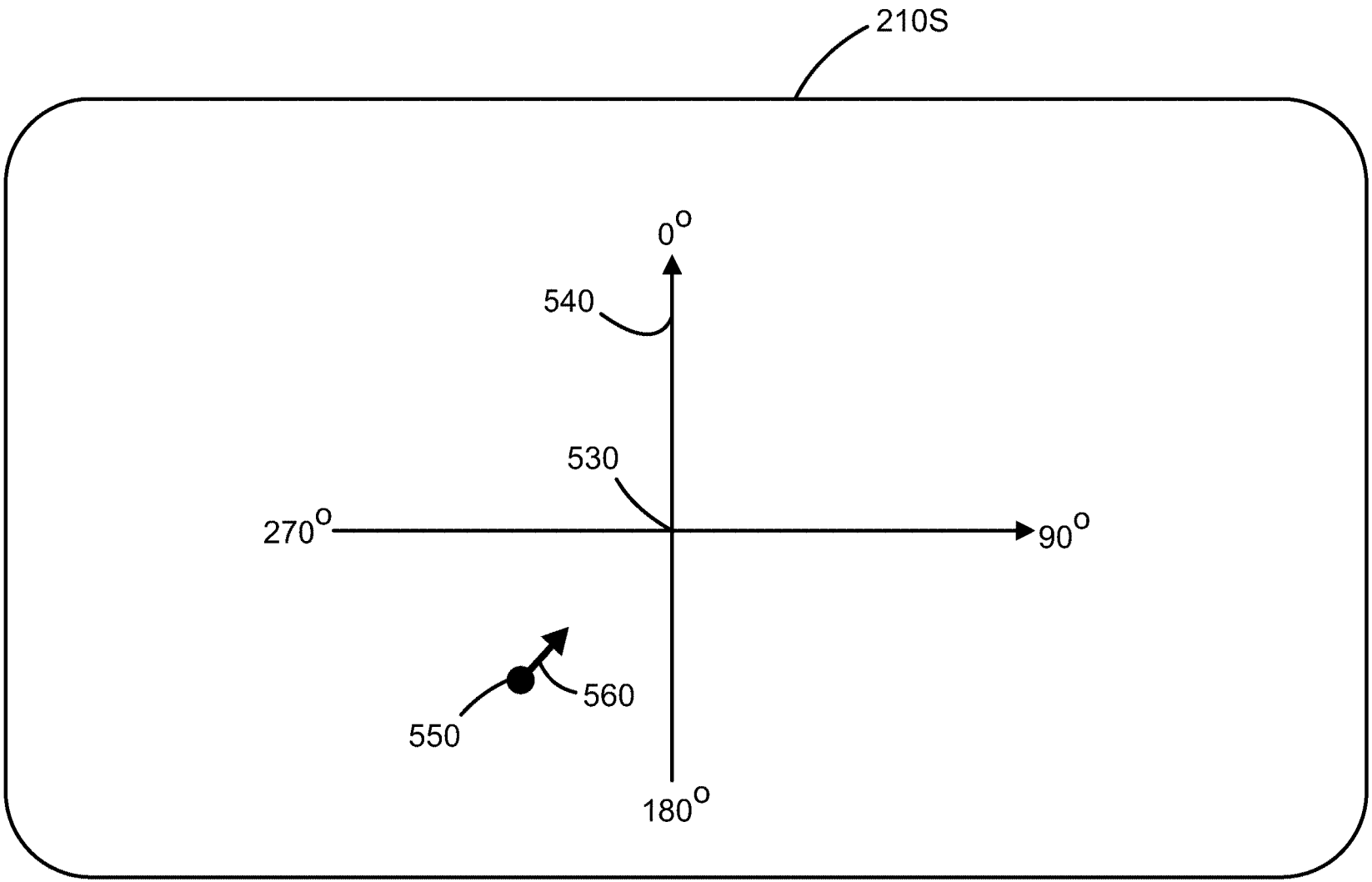
FIGS. 17 and 18 are illustrations of another example of a visual indication of an analysis result.
Figure 18:
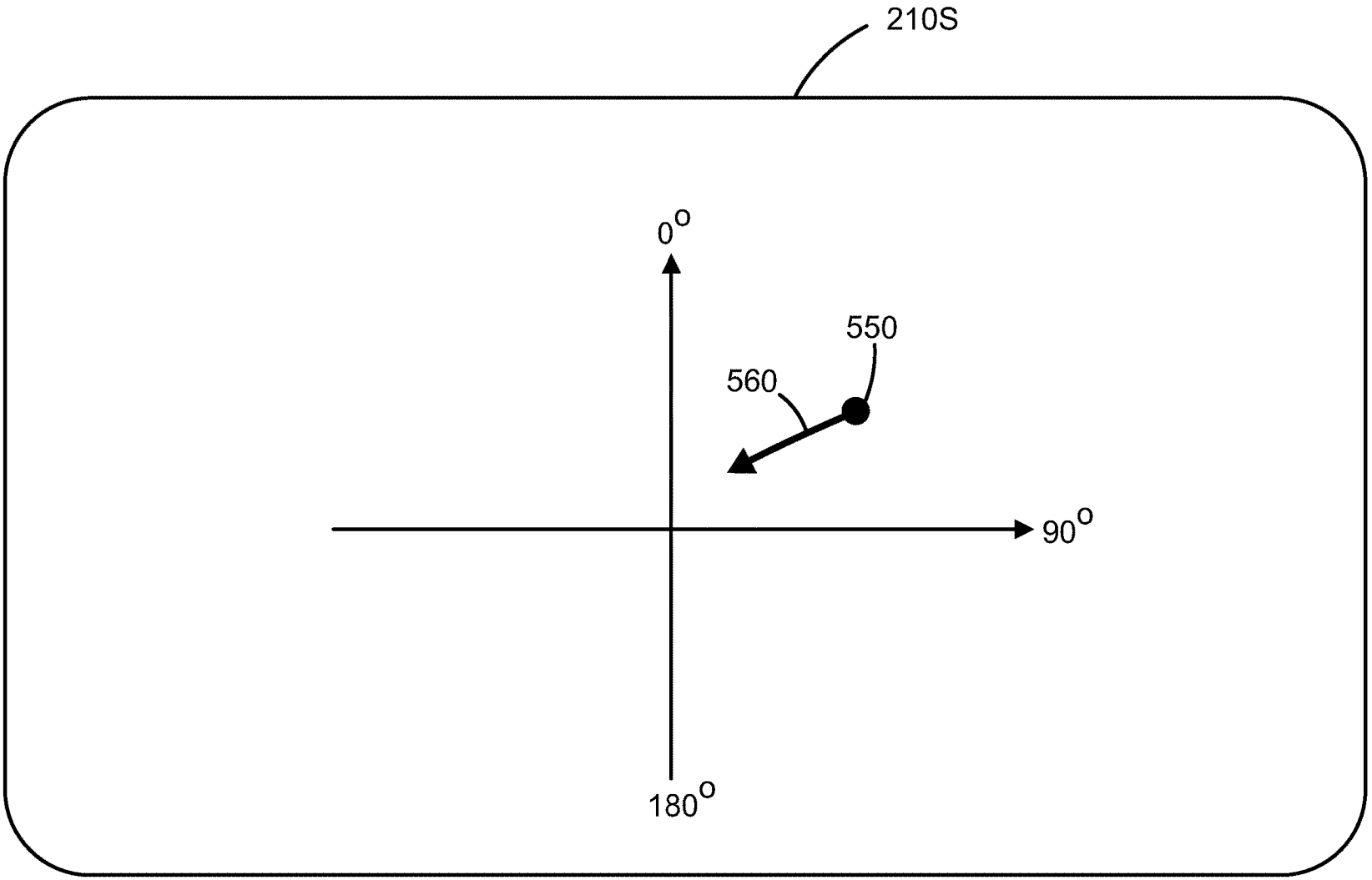

FIGS. 17 and 18 are illustrations of another example of a visual indication of an analysis result. With reference to FIGS. 17 and 18 the above mentioned derivative values may be used for displaying, on said screen display 210S, an arrow 560 originating at the position of the first internal status indicator object (550, $S_{P1}$, $T_{D1}$) and having an extension that depends on the magnitude of the derivative values. In other words, the absence of an arrow 560 means that the internal status is stable, not having changed for the temporal duration. The arrow 560 in FIG. 18 is longer than the arrow 560 in FIG. 17, thereby indicating a faster ongoing change of the internal status of the pump represented in FIG. 18 than that of the pump represented in FIG. 17.

FIG. 19A is an illustration of yet another example of a visual indication of an analysis result in terms of internal status of the centrifugal pump 10. The example visual indication analysis result of FIG. 19A is based on the polar coordinate system 520, as disclosed above in connection with FIG. 16.

A most recent internal status indicator object 550(*r*) indicates a current internal status of the pump 10. Another internal status indicator object 550(*r*−1) indicates a most recent previous internal status of the pump 10.

An internal status indicator object 550(1), indicates an internal status of the pump 10 at a very low flow rate, far below BEP. It is noted that when starting up a centrifugal pump, the flow will initially be very low.

With reference to FIG. 19A, a gradually increasing flow, as it nears to the BEP flow, is indicated by a gradually closer position of the internal status indicator object 550(1) to the polar coordinate reference point (O, 530) at origo.

In this manner, the current internal status of the centrifugal pump 20 may be represented and visualized such that it intuitively makes sense to an operator 230 of the pump system 5. It is to be noted that, whereas the display of a single internal status indicator object 550, as shown in FIG. 16, represents a current internal status, or a latest detected internal status of the pump 10, the display of a temporal progression of internal status indicator objects ranging from an initial status 550(1) via intermediate states, such as 550(*p*), 550(*p*+1) and 550(*r*−1) to 550(*r*), as shown in FIG. 19A, represents a current internal status 550(*r*) as well as a history of several earlier internal states of the pump 10. In FIG. 19A the most recent earlier state is referenced as 550(*r*−1). Some of the other earlier internal states illustrated in FIG. 19A are shown as internal status indicator objects 550(*p*+4), 550(*p*+1), 550(*p*), and 550(1). The internal status indicator object 550(*p*+4) is shown very close to origo and it illustrates operation of the pump at the Best Efficiency Point of operation $\mathbf{550}_{BEP}$ or operation of the pump very near the Best Efficiency Point of operation.

With reference to FIG. 19A in conjunction with FIG. 16 and the corresponding description above, it is noted that FIG. 19A provides a clear indication of the advantageous and useful information provided by the data generated in accordance with methods disclosed in this disclosure, such as the internal status indicator object 550. It is noted that the internal status indicator object 550 is indicative of said internal state of said pumping process.

In particular, it is noted that the polar angle X1(r), FI(r), Φ(r), $T_D$, $T_{D1}$ is indicative of a direction of deviation of the current operating point 205 from a current Best Efficiency operating Point.

In this connection, it is noted that the Best Efficiency operating Point of a pump, when connected to a fluid system 52, can change e.g. due to a change in the backpressure from the fluid system 52. The data generated in accordance with methods disclosed in this disclosure, such as the polar angle X1(r), FI(r) will advantageously provide very accurate information about the current operating point, and—when current operating point 205, 550 deviates from BEP—the polar angle X1(r), FI(r) will provide information about the direction of deviation of the current operating point 205, 550 from a current Best Efficiency operating Point.

In summary, useful information provided by the data generated in accordance with methods disclosed in this disclosure, includes an amplitude value Sp(r), $S_{P1}$ that is indicative of detected fluid pulsation associated with the pump 10 during operation. Thus, the amplitude value Sp(r), $S_{P1}$ originating in the is indicative of said internal state of said pumping process in terms of current fluid pulsation amplitudes.

Moreover, the useful information provided by the data generated in accordance with methods disclosed in this disclosure, includes a polar angle value X1(r), FI(r) that may be indicative of a current deviation from the current BEP.

An observation, based on this type of measurements on a number of centrifugal pumps 10 coupled to piping systems 40 and fluid material consumers 50, is that the detected polar angle (X1(r), FI(r), Φ(r), $T_D$, $T_{D1}$) appears to always have a phase shift of approximately 180 degrees when internal status indicator object 550 and/or the operating point 205, 550 shifts from an operating point below BEP to operating point above BEP, or vice versa. Additionally, the amplitude X2(r) Sp(r), $S_{P1}$ of detected fluid pulsation is at its minimum when the pump 10 operates at BEP flow, as discussed elsewhere in this disclosure e.g. in connection with FIG. 14A.

Accordingly, the radius (X2(r) Sp(r), $S_{P1}$) is indicative of an amplitude of detected fluid pulsation, and said first polar angle (X1(r), FI(r), Φ(r), $T_D$, $T_{D1}$) exhibits a phase shift of approximately 180 degrees, when the internal status indicator object 550 and/or the operating point 205, 550 changes from below BEP to above BEP, or vice versa. Accordingly, it appears to be desirable to control the pump such that a current internal status 550(*r*) is shifted towards the reference point (O, 530) at origo, in the polar plot according figures, or to a position which is as close as possible the reference point (O, 530).

Moreover, it appears as though, for any pump/system combination, controlling the pump such that the internal status indicator object 550 is steered as close as possible to the reference point (O, 530) in the polar plot, renders operation with the best possible efficiency and/or with the lowest possible pulsation.

Thus, it is concluded, that the provision of the status indicator values X2(r), Sp(r) and X1(r), FI(r) enables an improvement in ability to control fluid systems. In particular, the methods and illustrations herein disclosed provide very clear and interpretable measurement results, that enable greatly improved operation of pumps 10 and fluid systems 5, 40, 50. As noted above, the parameter value X1 may be indicative of a direction of deviation of the current operating point 205 from a current Best Efficiency operating Point (BEP). In this connection, it is noted that the fluid system flow-pressure characteristic may vary during operation, and thus the BEP may also change (See FIG. 2B). Accordingly, the methods and illustrations herein disclosed enable agility in terms of providing a manner of detecting the current operating point 205 in relation to the current BEP.

Another observation, based on this type of measurements on a number of centrifugal pumps 10 coupled to piping systems 40 and fluid material consumers 50, is that an individual pump/system combination appear to create a unique pattern of movement of its internal status indicator object 550.

Figure 19B:
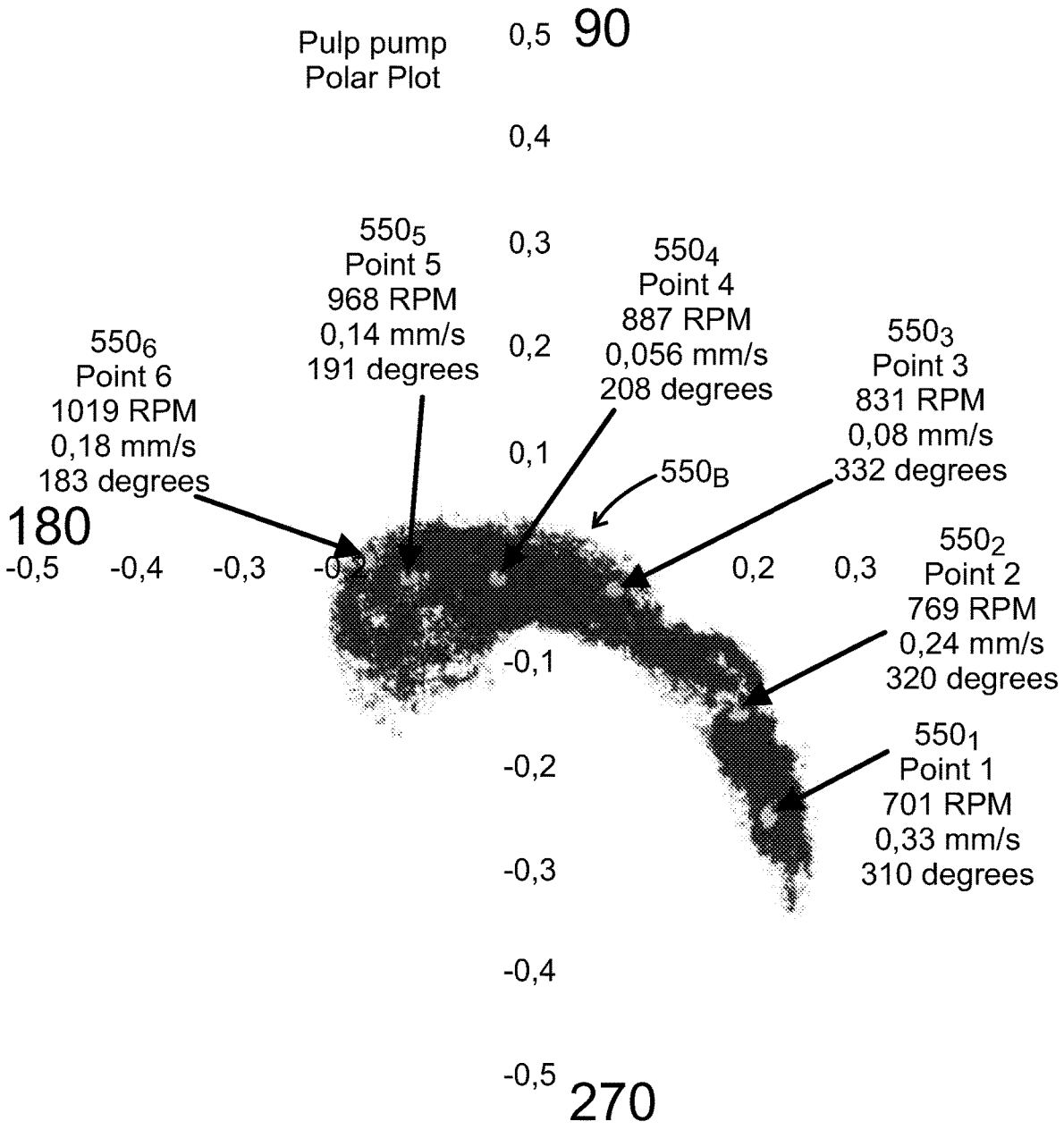
FIGS. 19B, 19C and 19D are illustrations of a large number of internal status indicator objects relating to a pump that has operated at flow below BEP as well as at flow over BEP.
Figure 19C:
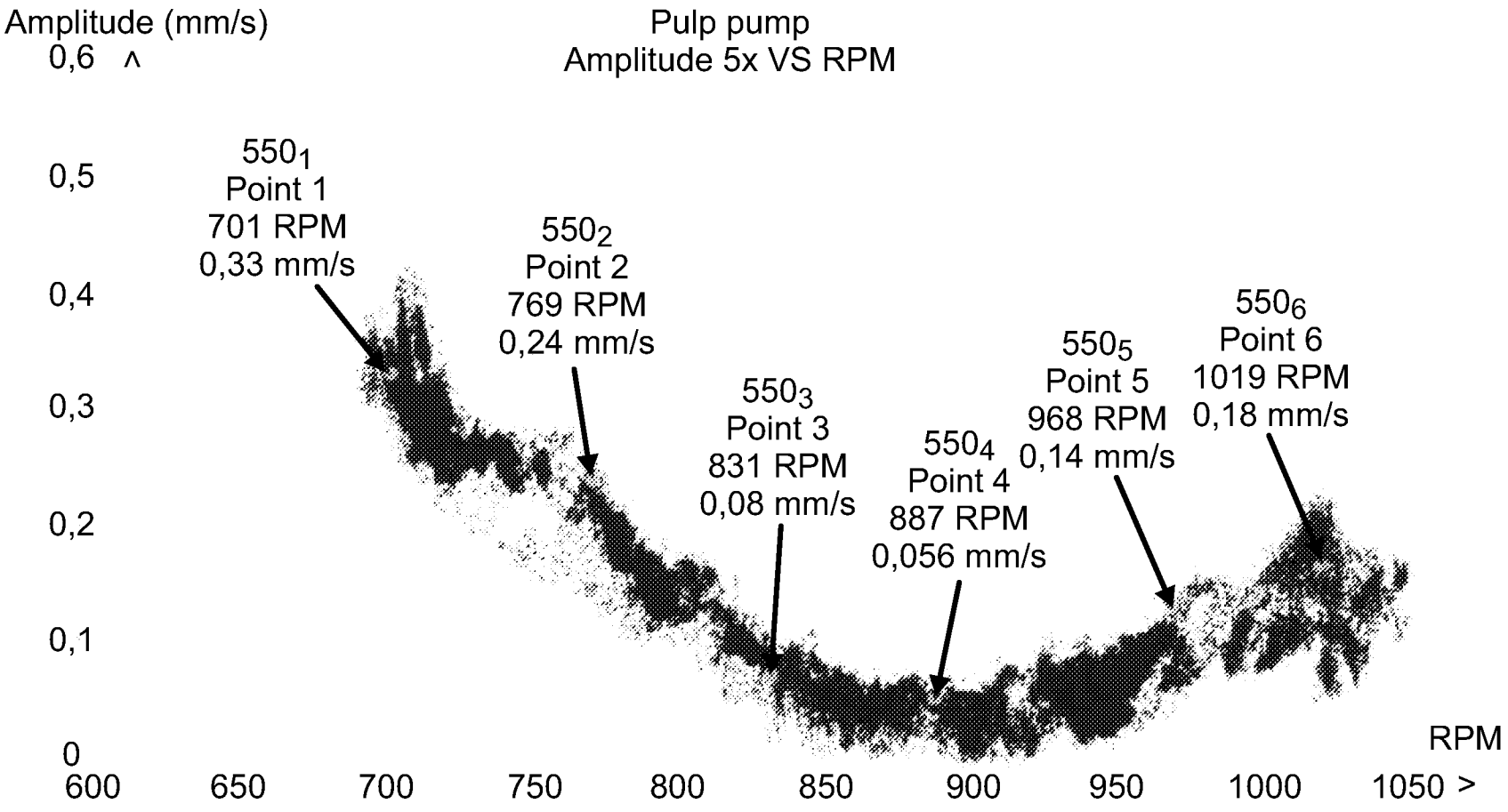
Figure 19D:
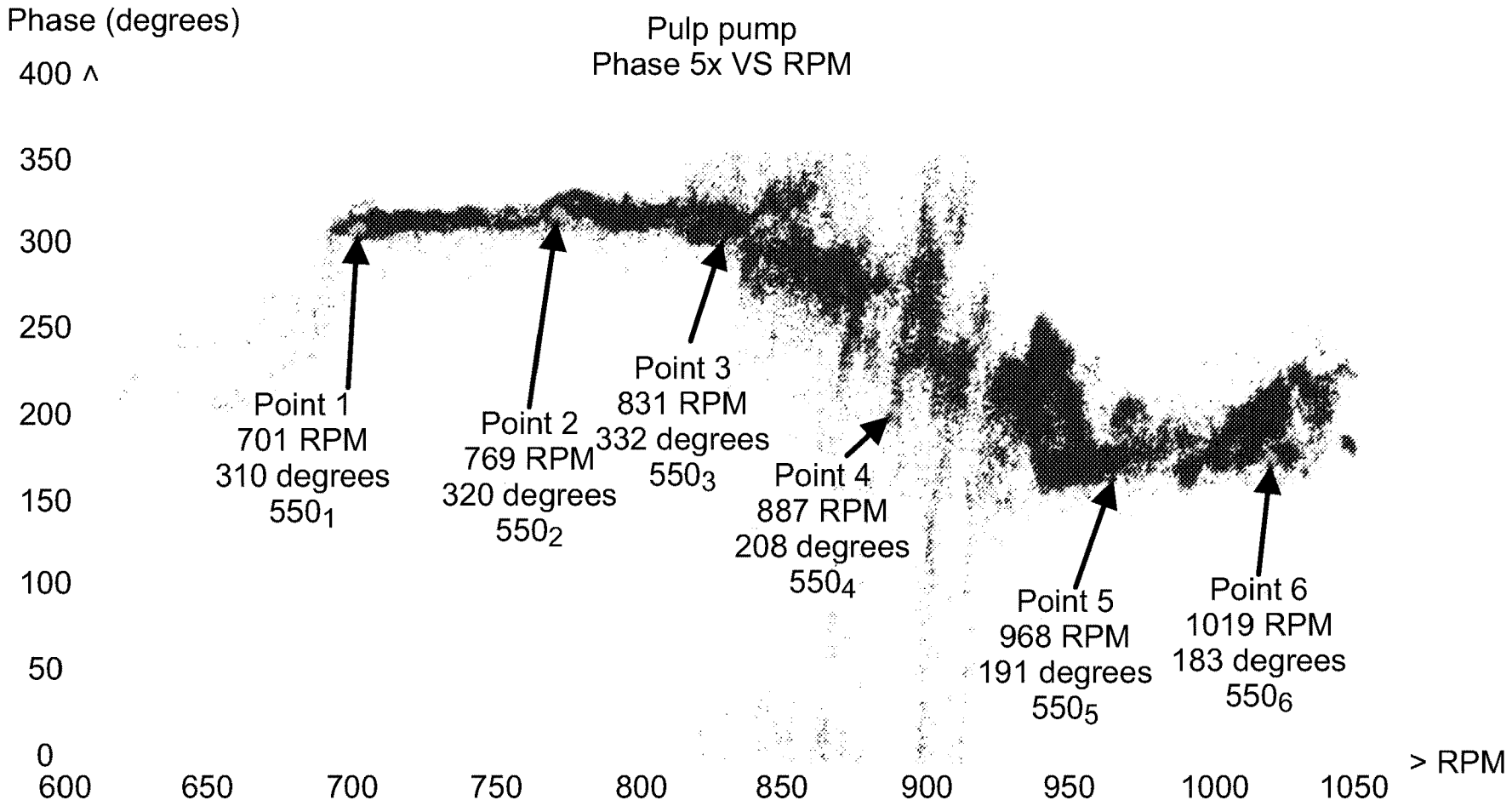

FIGS. 19B, 19C and 19D are illustrations of a large number of internal status indicator objects relating to a pump 10 that has operated below BEP, as indicated by status indicator objects $\mathbf{550}_1$, $\mathbf{550}_2$, and $\mathbf{550}_3$, as well as at flow over BEP, as indicated by status indicator objects $\mathbf{550}_4$, $\mathbf{550}_5$, and $\mathbf{550}_6$. The cloudlike lumps of black dots are internal status indicator objects 550 collected during a long time and over a range of operating conditions.

Figure 19F:
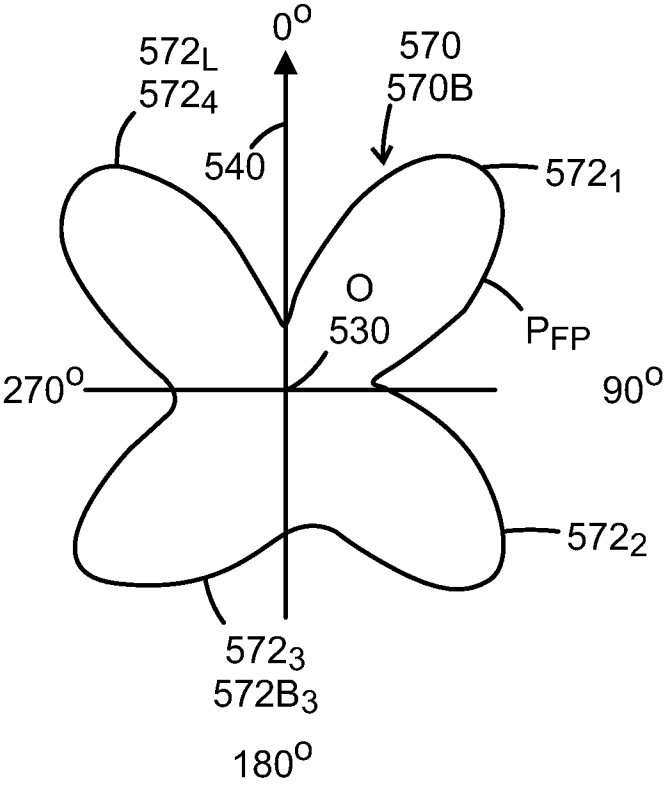
FIG. 19F is another illustration of a second time plot of the amplitude of a detected fluid pressure pulsation in the same centrifugal pump as discussed in connection with FIG. 19E.
Figure 19E:
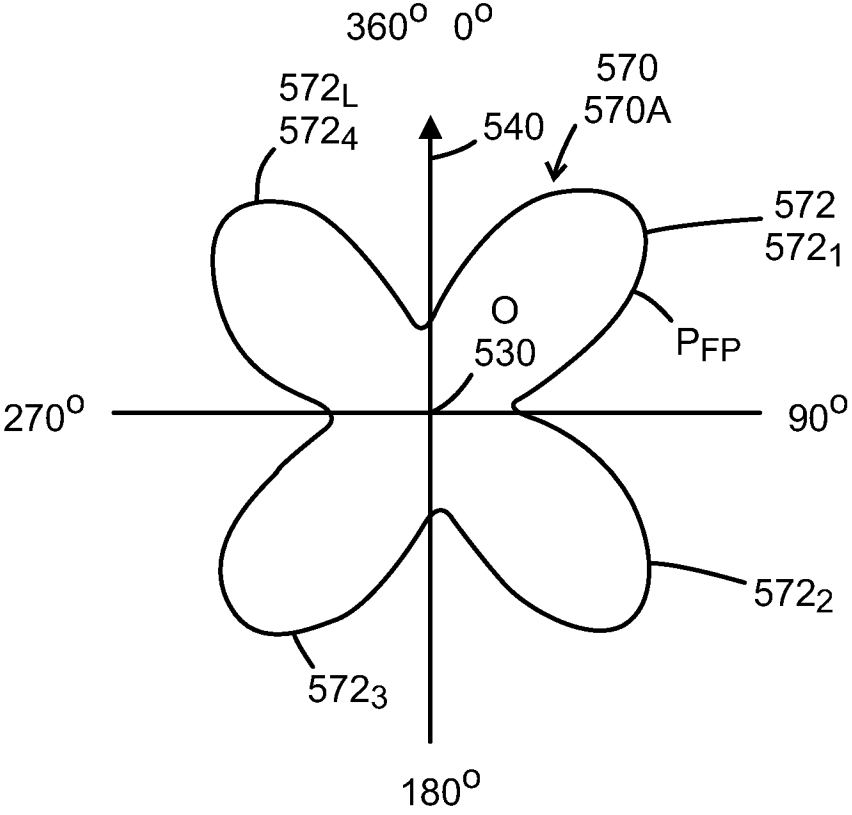
FIG. 19E is an illustration of a first time plot of the amplitude of a detected fluid pressure pulsation in a centrifugal pump having four impeller vanes.

FIG. 19E is an illustration of a first time plot 570, 570A of the amplitude of a detected fluid pressure pulsation $P_{FP}$ in a centrifugal pump 10 having four impeller vanes 310 (See FIG. 19E in conjunction with FIG. 2A). The time plot in FIG. 19E is a polar plot, i.e. time is progressing in a clockwise angular direction and 360 degrees corresponds to a full revolution of the impeller 20. The radius at a certain point of the plot depends on the detected amplitude of the detected fluid pressure pulsation $P_{FP}$.

The amplitude time plot 570, 570A in FIG. 19E, relating to four impeller vanes, exhibits four highest amplitude peaks, and four lowest amplitude peaks. It is to be noted that the angular positions of the amplitude peaks change, depending on the current operating state OP of the pump (See discussion in connection with FIGS. 14A to 14F and 16 to 19B). Thus, the amplitude time plot 570 in a pump having L impeller vanes, exhibits L highest amplitude peaks, and L lowest amplitude peaks, wherein L is the number of vanes on the impeller in the pump 10. Thus, the amplitude time plot 570 appears to exhibit one signal signature per vane 310. A single signal signature appears to exhibit one highest amplitude peak, and one lowest amplitude peak.

FIG. 19F is another illustration of a second time plot 570, 570B of the amplitude of a detected fluid pressure pulsation $P_{FP}$ in the same centrifugal pump 10 as discussed above in connection with FIG. 19E. The second time plot 570, 570B was recorded at another time as compared to the first time plot 570, 570A of FIG. 19E.

The inventor concluded, when studying the shape of the amplitude time plot 570 during a long time, and under various operating conditions, that the shape of the amplitude time plot 570 changed dependent on an internal state X of the centrifugal pump 10.

The inventor concluded that the shape of the amplitude time plot 570 appears to be indicative of an internal state X of the pump 10. During normal operation, the L individual signal signatures $\mathbf{572}_1$, $\mathbf{572}_2$, $\mathbf{572}_3$, $\mathbf{572}_4$, $\mathbf{572}_L$, appears to exhibit a uniform shape, or a substantially uniform shape, as illustrated by FIG. 19E.

However, as illustrated in FIG. 19F, the shape of an individual signal signature $\mathbf{572}B_3$ may exhibit a shape that deviates from the shape of the other signal signatures.

The inventor concluded that the shape of the amplitude time plot 570B appears to indicate that a physical feature associated with at least one of the vanes 310 or a physical feature associated with at least one of the impeller passages 320 deviates from normal. In other words, when an individual signal signature exhibits a shape that deviates from the shape of the other signal signatures that deviation appears to indicate that a physical feature associated with at least one of the vanes 310, or a physical feature associated with at least one of the impeller passages 320, deviates from normal. It is believed that such a deviation may be indicative of a damage to the surface of vane 310, or alternatively such a deviation may be indicative of an impeller passage 320 being partly clogged by a particle that got stuck in the impeller passage 320.

An Example of Variable Speed Phase Status Parameter Extractor

As mentioned above, the analysis of the measurements data is further complicated if the centrifugal pump impeller 20 rotates at a variable rotational speed $f_{ROT}$. In fact, it appears as though even very small variations in rotational speed of the impeller may have a large adverse effect on detected signal quality in terms of smearing. Hence, a very accurate detection of the rotational speed $f_{ROT}$ of the pump impeller 20 appears to be of essence, and an accurate compensation for any speed variations appears to also be of essence.

With reference to FIG. 15A, the impeller speed detector 500 may deliver a signal indicating when the speed of rotation varies, as discussed in connection with FIG. 9. Referring again to FIG. 15A, the signals S(j) and P(j) as well as the speed value $f_{ROT}$(j) may be delivered to a speed variation compensatory decimator 470. The speed variation compensatory decimator 470 may also be referred to as a fractional decimator. The decimator 470 is configured to decimate the digital measurement signal $S_{MD}$ based on the received speed value $f_{ROT}$(j). According to an example, the decimator 470 is configured to decimate the digital measurement signal $S_{MD}$ by a variable decimation factor D, the variable decimation factor D being adjusted during a measuring session based on the variable speed value $f_{ROT}$(j). Hence, the compensatory decimator 470 is configured to generate a decimated digital vibration signal $S_{MDR}$ such that the number of sample values per revolution of said rotating impeller is kept at a constant value, or at a substantially constant value, when said rotational speed varies. According to some embodiments, the number of sample values per revolution of said rotating impeller is considered to be a substantially constant value when the number of sample values per revolution varies less than 5%. According to a preferred embodiment, the number of sample values per revolution of said rotating impeller is considered to be a substantially constant value when the number of sample values per revolution varies less than 1%. According to a most preferred embodiment, the number of sample values per revolution of said rotating impeller is considered to be a substantially constant value when the number of sample values per revolution varies by less than 0.2%.

Thus, the FIG. 15A embodiment includes the fractional decimator 470 for decimating the sampling rate by a decimation factor D=N/U, wherein both U and N are positive integers. Hence, the fractional decimator 470 advantageously enables the decimation of the sampling rate by a fractional number. Hence, the speed variation compensatory decimator 470 may operate to decimate the signals S(j) and P(j) and $f_{ROT}$(j) by a fractional number D=N/U. According to an embodiment the values for U and N may be selected to be in the range from 2 to 2000. According to an embodiment the values for U and N may be selected to be in the range from 500 to 1500. According to yet another embodiment the values for U and N may be selected to be in the range from 900 to 1100. In this context it is noted that the background of the term "fraction" is as follows: A fraction (from Latin fractus, "broken") represents a part of a whole or, more generally, any number of equal parts. In positive common fractions, the numerator and denominator are natural numbers. The numerator represents a number of equal parts, and the denominator indicates how many of those parts make up a unit or a whole. A common fraction is a numeral which represents a rational number. That same number can also be represented as a decimal, a percent, or with a negative exponent. For example, 0.01, 1%, and 10-2 are all equal to the fraction 1/100. Hence, the fractional number D=N/U may be regarded as an inverted fraction.

Thus, the resulting signal $S_{MDR}$, which is delivered by fractional decimator 470, has a sample rate of $$f_{SR} = f_S/D = f_S * U/N$$

where $f_S$ is the sample rate of the signal $S_{MD}$ received by fractional decimator 470.

The fractional value U/N is dependent on a rate control signal received on an input port 490. The rate control signal may be a signal indicative of the speed of rotation $f_{ROT}$ of the rotating impeller.

The variable decimator value D for the decimator may be set to $D=f_S/f_{SR}$, wherein $f_S$ is the initial sample rate of the A/D converter, and $f_{SR}$ is a set point value indicating a number of samples per revolution in the decimated digital vibration signal $S_{MDR}$. For example, when there are twelve (12) vanes in the impeller to be monitored, the set point value $f_{SR}$ may be set to 768 samples per revolution, i.e. the number of samples per revolution is set to fsr in the decimated digital vibration signal $S_{MDR}$. The compensatory decimator 470, 470B is configured to generate a position signal P(q) at a regular interval of the decimated digital vibration signal $S_{MDR}$, the regular interval being dependent on the set point value $f_{SR}$. For example, when $f_{SR}$ is set to 768 samples per revolution, a position signal P(q) may be delivered once with every 768 sample of the decimated vibration signal S(q). In this manner the position signal P(q) is indicative of a static angular position, in a manner similar to the position signal value $P_S$ discussed above.

According to another example, the compensatory decimator 470, 470B is configured to generate a position signal P(q) once per L divided by $f_{SR}$ samples of the decimated vibration signal S(q). Thus, a position signal P(q) may be delivered at a regular interval of the decimated digital vibration signal $S_{MDR}$, the regular interval being $L/f_{SR}$. In this manner the position signal P(q) is indicative of L static angular positions, in a manner similar to the virtual position signal values $P_C$ discussed above.

Hence, the sampling frequency $f_{SR}$, also referred to as $f_{SR2}$, for the output data values R(q) is lower than input sampling frequency $f_S$ by a factor D. The factor D can be set to an arbitrary number larger than 1, and it may be a fractional number, as discussed elsewhere in this disclosure. According to preferred embodiments the factor D is settable to values between 1.0 to 20.0. In a preferred embodiment the factor D is a fractional number settable to a value between about 1.3 and about 3.0. The factor D may be obtained by setting the integers U and N to suitable values. The factor D equals N divided by U:

$$D=N/U$$

According to an embodiment, the integers U and N are settable to large integers in order to enable the factor D=N/U to follow speed variations with a minimum of inaccuracy. Selection of variables U and N to be integers larger than 1000 renders an advantageously high accuracy in adapting the output sample frequency to tracking changes in the rotational speed of the impeller 20. So, for example, setting N to 500 and U to 1001 renders D=2,002.

The variable D is set to a suitable value at the beginning of a measurement and that value is associated with a certain speed of rotation of a rotating part to be monitored. Thereafter, during measuring session, the fractional value D is automatically adjusted in response to the speed of rotation of the rotating part to be monitored so that the output signal $S_{MDR}$ provides a substantially constant number of sample values per revolution of the rotating impeller.

Figure 20:
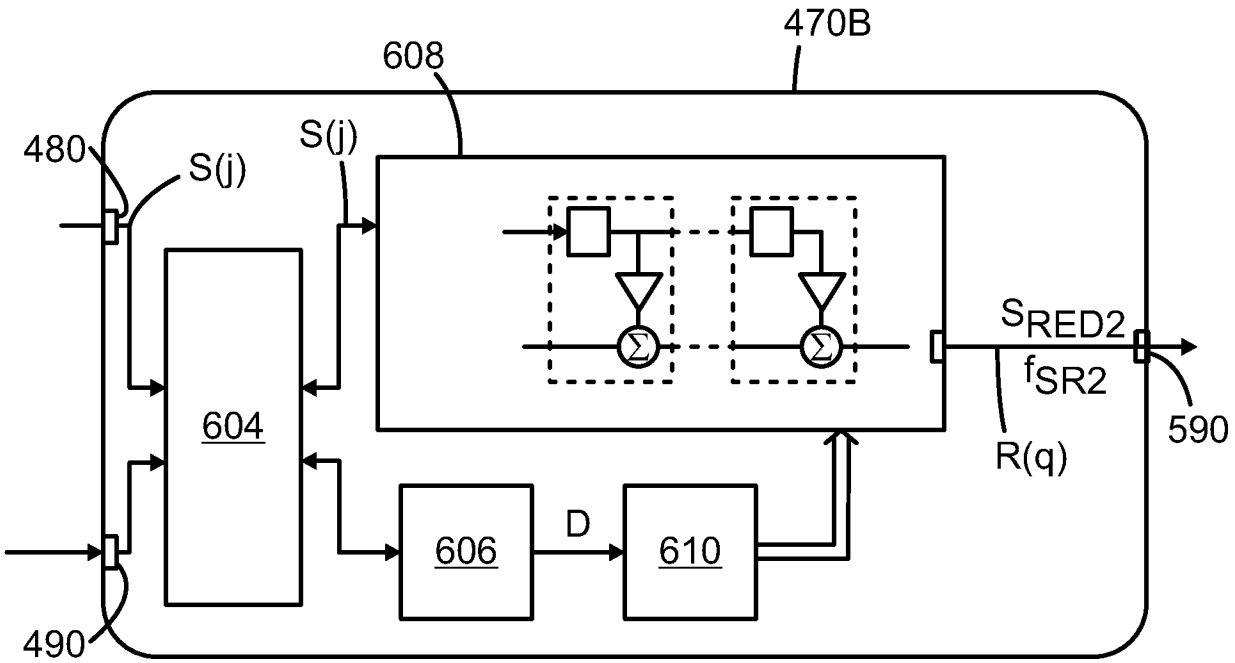
FIG. 20 is a block diagram of an example of a compensatory decimator.

FIG. 20 is a block diagram of an example of compensatory decimator 470. This compensatory decimator example is denoted 470B.

Compensatory decimator 470B may include a memory 604 adapted to receive and store the data values S(j) as well as information indicative of the corresponding speed of rotation $f_{ROT}$ of the monitored rotating impeller. Hence the memory 604 may store each data value S(j) so that it is associated with a value indicative of the speed of rotation $f_{ROT}(j)$ of the monitored impeller at time of detection of the sensor signal $S_{EA}$ value corresponding to the data value S(j). The provision of data values S(j) associated with corresponding speed of rotation values $f_{ROT}(j)$ is described with reference to FIGS. 7-13 above.

Compensatory decimator 470B receives the signal $S_{MD}$, having a sampling frequency $f_{SR1}$, as a sequence of data values S(j), and it delivers an output signal $S_{MDR}$, having a reduced sampling frequency $f_{SR}$, as another sequence of data values R(q) on its output 590.

Compensatory decimator 470B may include a memory 604 adapted to receive and store the data values S(j) as well as information indicative of the corresponding speed of rotation $f_{ROT}$ of the monitored rotating impeller. Memory 604 may store data values S(j) in blocks so that each block is associated with a value indicative of a relevant speed of rotation of the monitored impeller, as described below in connection with FIG. 21.

Compensatory decimator 470B may also include a compensatory decimation variable generator 606, which is adapted to generate a compensatory value D. The compensatory value D may be a floating number. Hence, the compensatory number can be controlled to a floating number value in response to a received speed value $f_{ROT}$ so that the floating number value is indicative of the speed value $f_{ROT}$ with a certain inaccuracy. When implemented by a suitably programmed DSP, as mentioned above, the inaccuracy of floating number value may depend on the ability of the DSP to generate floating number values.

Moreover, compensatory decimator 470B may also include a FIR filter 608. In this connection, the acronym FIR stands for Finite Impulse Response. The FIR filter 608 is a low pass FIR filter having a certain low pass cut off frequency adapted for decimation by a factor $D_{MAX}$. The factor $D_{MAX}$ may be set to a suitable value, e.g. 20,000. Moreover, compensatory decimator 470B may also include a filter parameter generator 610.

Operation of compensatory decimator 470B is described with reference to FIGS. 21 and 22 below.

Figure 21:
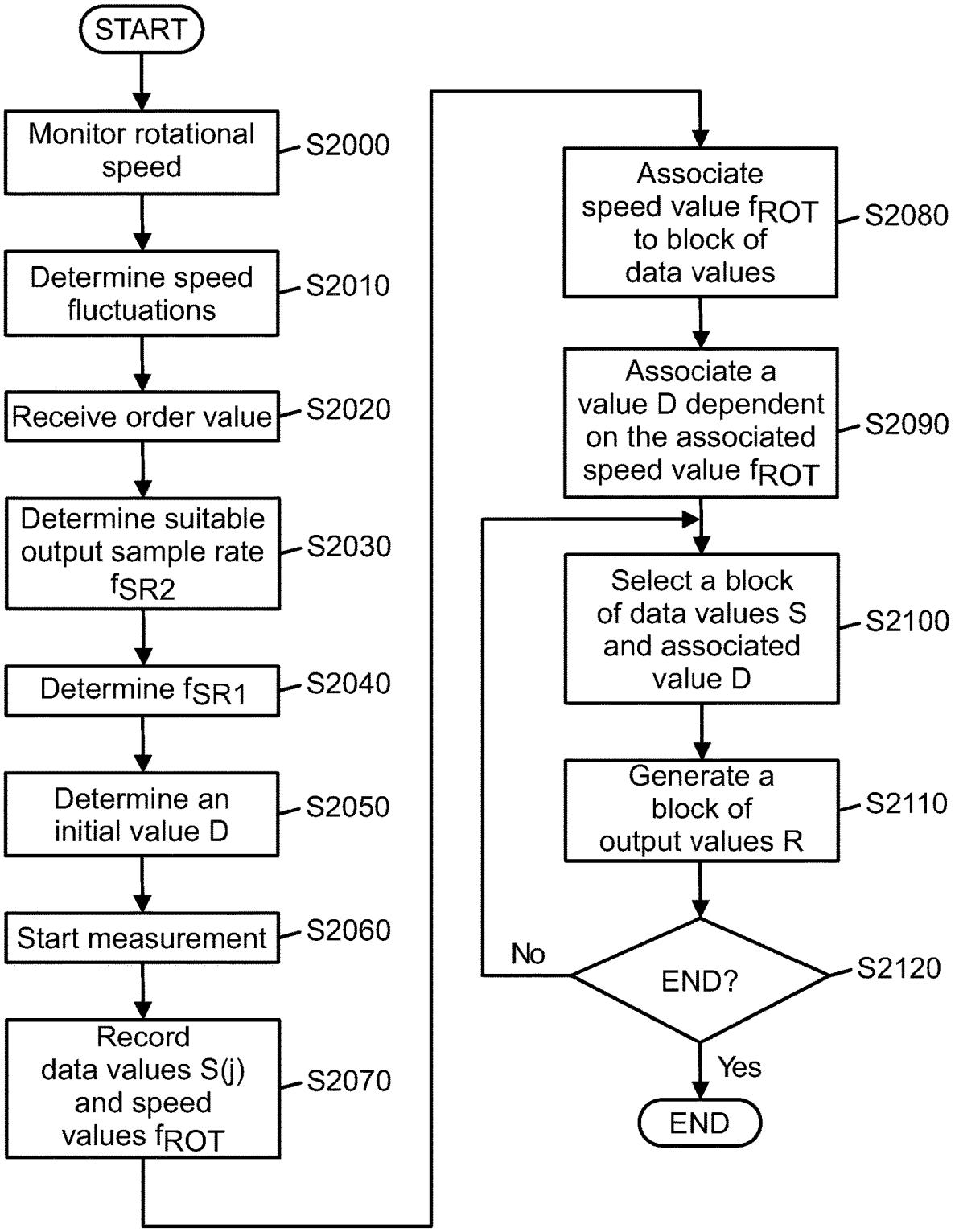
FIG. 21 is a flow chart illustrating an embodiment of a method of operating the compensatory decimator of FIG. 20.

FIG. 21 is a flow chart illustrating an embodiment of a method of operating the compensatory decimator 470B of FIG. 20.

In a first step S2000, the speed of rotation $f_{ROT}$ of the impeller to be monitored is recorded in memory 604 (FIGS. 20 & 21), and this may be done at substantially the same time as measurement of vibrations begin. According to another example the speed of rotation of the impeller to be monitored is surveyed for a period of time. The highest detected speed $f_{ROTmax}$ and the lowest detected speed $f_{ROTmin}$ in may be recorded, e.g. in memory 604 (FIGS. 20 & 21).

In step S2010, the recorded speed values are analysed, for the purpose of establishing whether the speed of rotation varies.

In step S2020, the user interface 210, 210S displays the recorded speed value $f_{ROT}$ or speed values $f_{ROTmin}$, $f_{ROTmax}$, and requests a user to enter a desired order value Oi. As mentioned above, the impeller rotation frequency $f_{ROT}$ is often referred to as "order 1". The interesting signals may occur about ten times per impeller revolution (Order 10). Moreover, it may be interesting to analyse overtones of some signals, so it may be interesting to measure up to order 100, or order 500, or even higher. Hence, a user may enter an order number Oi using user interface 210, 210S.

In step S2030, a suitable output sample rate $f_{SR}$ is determined. The output sample rate $f_{SR}$ may also be referred to as $f_{SR2}$ in this disclosure. According to an embodiment output sample rate $f_{SR}$ is set to $f_{SR}=C*Oi*f_{ROTmin}$ wherein C is a constant having a value higher than 2.0

Oi is a number indicative of the relation between the speed of rotation of the monitored impeller and the repetition frequency of the signal to be analysed.

$f_{ROTmin}$ is a lowest speed of rotation of the monitored impeller to expected during a forthcoming measurement session. According to an embodiment the value $f_{ROTmin}$ is a lowest speed of rotation detected in step S2020, as described above.

The constant C may be selected to a value of 2.00 (two) or higher in view of the sampling theorem. According to embodiments of the present disclosure the Constant C may be preset to a value between 2.40 and 2.70.

According to an embodiment the factor C is advantageously selected such that 100*C/2 renders an integer. According to an embodiment the factor C may be set to 2.56. Selecting C to 2.56 renders 100*C=256=2 raised to 8.

In step S2050, a compensatory decimation variable value D is determined. When the speed of rotation of the impeller to be monitored varies, the compensatory decimation variable value D will vary in dependence on momentary detected speed value.

According to an embodiment, a maximum compensatory decimation variable value $D_{MAX}$ is set to a value of $D_{MAX}=f_{ROTmax}/f_{ROTmin}$, and a minimum compensatory decimation variable value $D_{MIN}$ is set to 1.0. Thereafter a momentary real time measurement of the actual speed value $f_{ROT}$ is made and a momentary compensatory value D is set accordingly.

$f_{ROT}$ is value indicative of a measured speed of rotation of the rotating impeller to be monitored In step S2060, the actual measurement is started, and a desired total duration of the measurement may be determined. The total duration of the measurement may be determined in dependence on a desired number of revolutions $N_R$ of the monitored impeller.

When measurement is started, a digital signal $S_{MD}$ is delivered to input 480 of the compensatory decimator. In the following the signal $S_{MD}$ is discussed in terms of a signal having sample values S(j), where j is an integer.

In step S2070, record data values S(j) in memory 604, and associate each vibration data value S(j) with a speed of rotation value $f_{ROT}(j)$.

In a subsequent step S2080, analyze the recorded speed of rotation values, and divide the recorded data values S(j) into blocks of data dependent on the speed of rotation values. In this manner a number of blocks of block of data values S(j) may be generated, each block of data values S(j) being associated with a speed of rotation value. The speed of rotation value indicates the speed of rotation of the monitored impeller, when this particular block data values S(j) was recorded. The individual blocks of data may be of mutually different size, i.e. individual blocks may hold mutually different numbers of data values S(j).

If, for example, the monitored rotating impeller first rotated at a first speed $f_{ROT1}$ during a first time period, and it thereafter changed speed to rotate at a second speed $f_{ROT2}$ during a second, shorter, time period, the recorded data values S(j) may be divided into two blocks of data, the first block of data values being associated with the first speed value $f_{ROT1}$, and the second block of data values being associated with the second speed value $f_{ROT2}$. In this case the second block of data would contain fewer data values than the first block of data since the second time period was shorter.

According to an embodiment, when all the recorded data values S(j) have been divided into blocks, and all blocks have been associated with a speed of rotation value, then the method proceeds to execute step S2090.

In step S2090, select a first block of data values S(j), and determine a compensatory decimation value D corresponding to the associated speed of rotation value $f_{ROT}$. Associate this compensatory decimation value D with the first block of data values S(j). According to an embodiment, when all blocks have been associated with a corresponding compensatory decimation value D, then the method proceeds to execute step S2100. Hence, the value of the compensatory decimation value D is adapted in dependence on the speed $f_{ROT}$.

In step S2100, select a block of data values S(j) and the associated compensatory decimation value D, as described in step S2090 above.

In step S2110, generate a block of output values R in response to the selected block of input values S and the associated compensatory decimation value D. This may be done as described with reference to FIG. 22.

In step S2120, Check if there is any remaining input data values to be processed. If there is another block of input data values to be processed, then repeat step S2100. If there is no remaining block of input data values to be processed then the measurement session is completed.

Figure 22A:
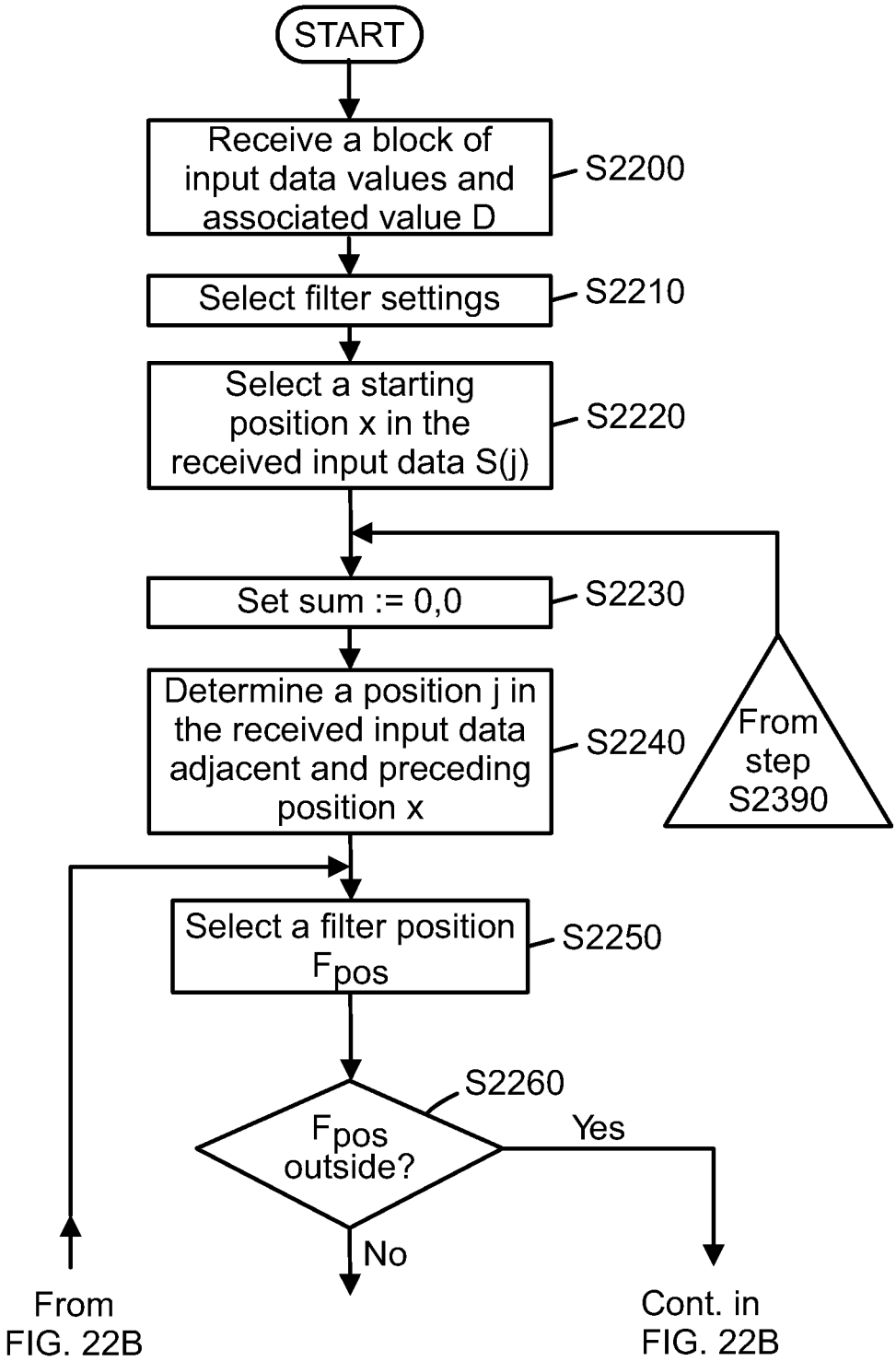
FIGS. 22A, 22B and 22C illustrate a flow chart of an embodiment of a method of operating the compensatory decimator of FIG. 20.
Figure 22B:
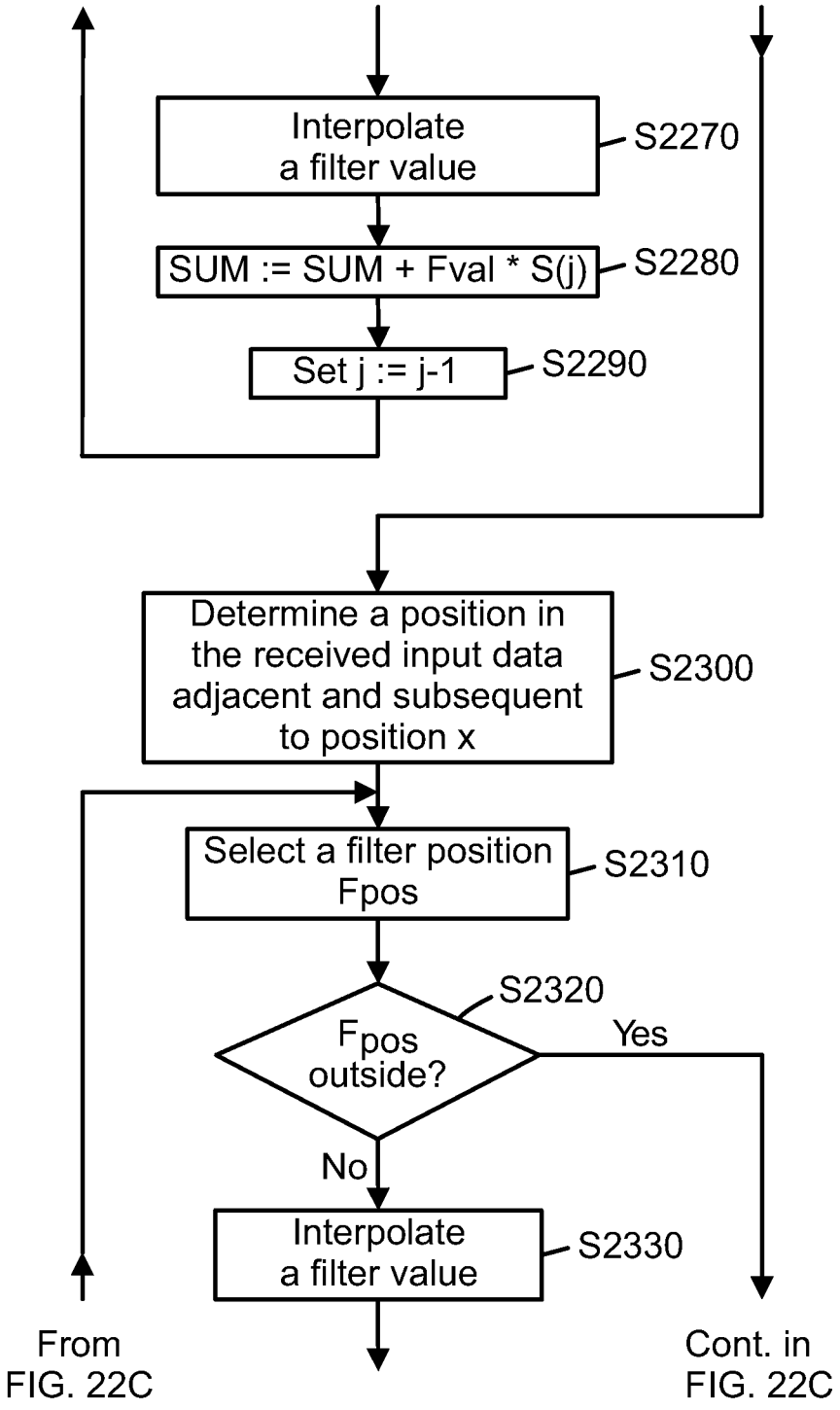
Figure 22C:
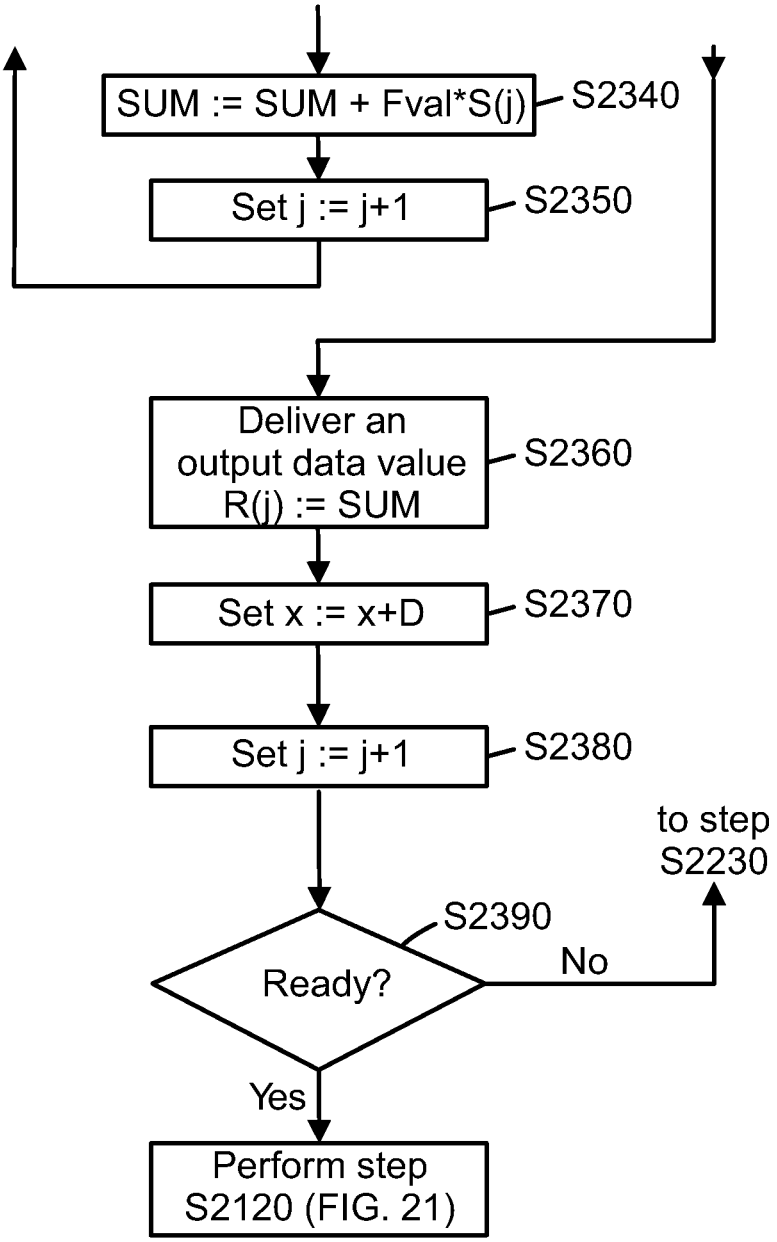

FIGS. 22A, 22B and 22C illustrate a flow chart of an embodiment of a method of operating the compensatory decimator 470B of FIG. 20.

In a step S2200, receive a block of input data values S(j) and an associated specific compensatory decimation value D. According to an embodiment, the received data is as described in step S2100 for FIG. 21 above. The input data values S(j) in the received block of input data values S are all associated with the specific compensatory decimation value D.

In steps S2210 to S2390 the FIR-filter 608 (See FIG. 20) is adapted for the specific compensatory decimation value D as received in step S2200, and a set of corresponding output signal values R(q) are generated. This is described more specifically below.

In a step S2210, filter settings suitable for the specific compensatory decimation value D are selected. As mentioned in connection with FIG. 20 above, the FIR filter 608 is a low pass FIR filter having a certain low pass cut off frequency adapted for decimation by a factor $D_{MAX}$. The factor $D_{MAX}$ may be set to a suitable value, e.g. 20.

A filter ratio value $F_R$ is set to a value dependent on factor $D_{MAX}$ and the specific compensatory decimation value D as received in step S2200. Step S2210 may be performed by filter parameter generator 610 (FIG. 20).

In a step S2220, select a starting position value x in the received input data block s(j). It is to be noted that the starting position value x does not need to be an integer. The FIR filter 608 has a length $F_{LENGTH}$ and the starting position value x will then be selected in dependence of the filter length $F_{LENGTH}$ and the filter ratio value $F_R$. The filter ratio value $F_R$ is as set in step S2210 above. According to an embodiment, the starting position value x may be set to $x:=F_{LENGTH}/F_R$.

In a step S2230 a filter sum value SUM is prepared, and set to an initial value, such as e.g. SUM:=0,0

In a step S2240 a position j in the received input data adjacent and preceding position x is selected. The position j may be selected as the integer portion of x.

In a step S2250 select a position Fpos in the FIR filter that corresponds to the selected position j in the received input data. The position Fpos may be a compensatory number.

The filter position Fpos, in relation to the middle position of the filter, may be determined to be $$Fpos = [(x - j) * F_R]$$

wherein $F_R$ is the filter ratio value.

In step S2260, check if the determined filter position value Fpos is outside of allowable limit values, i.e. points at a position outside of the filter. If that happens, then proceed with step S2300 below. Otherwise proceed with step S2270.

In a step S2270, a filter value is calculated by means of interpolation. It is noted that adjacent filter coefficient values in a FIR low pass filter generally have similar numerical values. Hence, an interpolation value will be advantageously accurate. First an integer position value IFpos is calculated:

$$IFpos := \text{Integer portion of } Fpos$$

The filter value Fval for the position Fpos will be:

$$Fval = A(IFpos) + [A(IFpos + 1) - A(IFpos)] * [Fpos - IFpos]$$

wherein A(IFpos) and A(IFpos+1) are values in a reference filter, and the filter position Fpos is a position between these values.

In a step S2280, calculate an update of the filter sum value SUM in response to signal position j:

$$SUM := SUM + Fval * S(j)$$

In a step S2290 move to another signal position:

$$\text{Set } j := j - 1$$

Thereafter, go to step S2250.

In a step 2300, a position j in the received input data adjacent and subsequent to position x is selected. This position j may be selected as the integer portion of x. plus 1 (one), i.e j:=1+Integer portion of x In a step S2310 select a position in the FIR filter that corresponds to the selected position j in the received input data. The position Fpos may be a compensatory number. The filter position Fpos, in relation to the middle position of the filter, may be determined to be $$Fpos = [(j - x) * F_R]$$

wherein $F_R$ is the filter ratio value.

In step S2320, check if the determined filter position value Fpos is outside of allowable limit values, i.e. points at a position outside of the filter. If that happens, then proceed with step S2360 below. Otherwise proceed with step S2330.

In a step S2330, a filter value is calculated by means of interpolation. It is noted that adjacent filter coefficient values in a FIR low pass filter generally have similar numerical values. Hence, an interpolation value will be advantageously accurate. First an integer position value IFpos is calculated:

$$IFpos := \text{Integer portion of } Fpos$$

The filter value for the position Fpos will be:

$$Fval(Fpos) = A(IFpos) + [A(IFpos + 1) - A(IFpos)] * [Fpos - IFpos]$$

wherein A(IFpos) and A(IFpos+1) are values in a reference filter, and the filter position Fpos is a position between these values.

In a step S2340, calculate an update of the filter sum value SUM in response to signal position j:

$$SUM := SUM + Fval * S(j)$$

In a step S2350 move to another signal position:

$$\text{Set } j := j + 1$$

Thereafter, go to step S2310.

In a step S2360, deliver an output data value R(j). The output data value R(j) may be delivered to a memory so that consecutive output data values are stored in consecutive memory positions. The numerical value of output data value R(j) is:

$$R(j) := \text{SUM}$$

In a step S2370, update position value x:

$$x := x + D$$

In a step S2380, update position value j $$j := j + 1$$

In a step S2390, check if desired number of output data values have been generated. If the desired number of output data values have not been generated, then go to step S2230. If the desired number of output data values have been generated, then go to step S2120 in the method described in relation to FIG. 21.

In effect, step S2390 is designed to ensure that a block of output signal values R(q), corresponding to the block of input data values S received in step S2200, is generated, and that when output signal values R corresponding to the input data values S have been generated, then step S2120 in FIG. 21 should be executed.

The method described with reference to FIG. 22 may be implemented as a computer program subroutine, and the steps S2100 and S2110 may be implemented as a main program.

Figure 23:
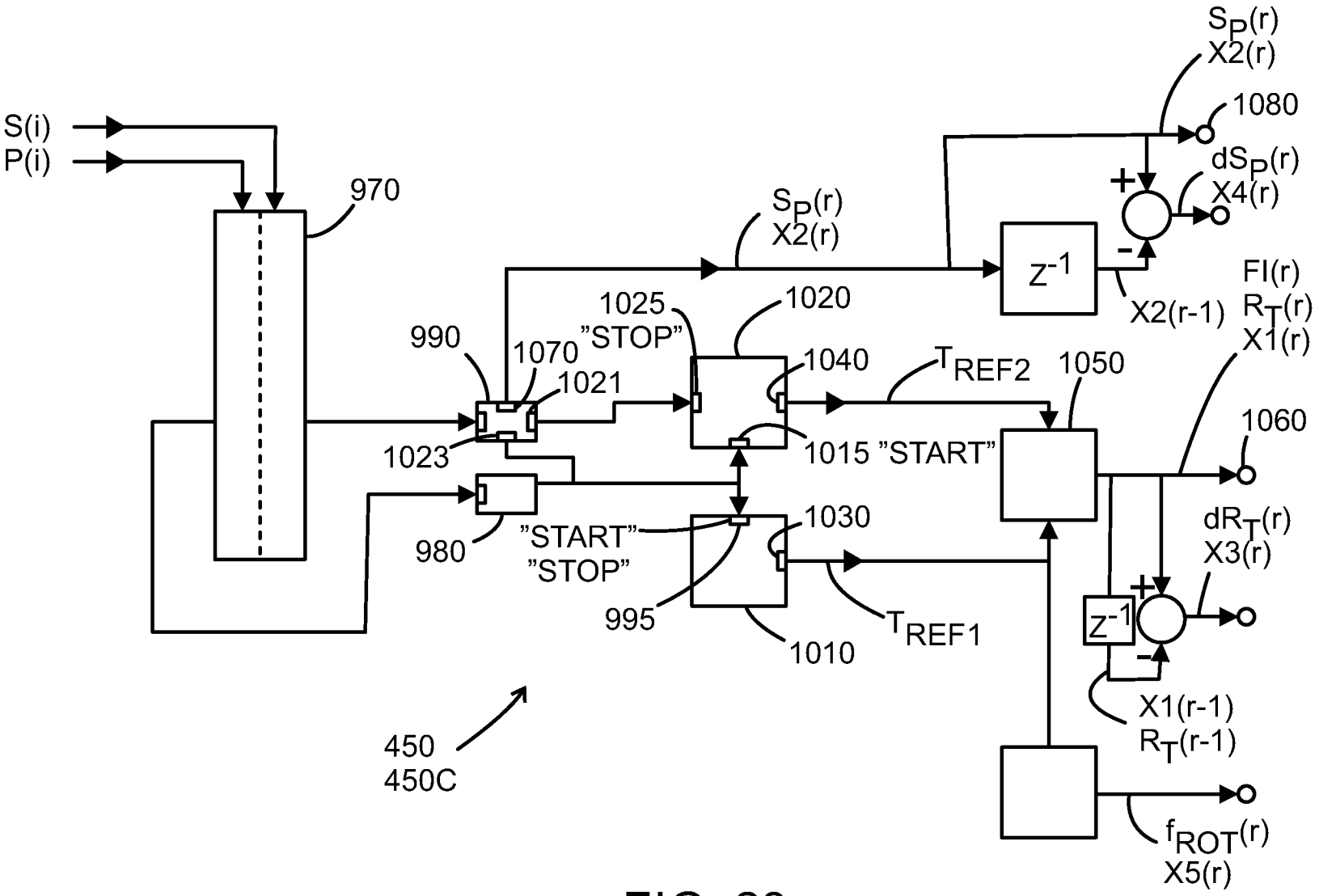
FIG. 23 is a block diagram that illustrates another example of a status parameter extractor.

FIG. 23 is a block diagram that illustrates another example of a status parameter extractor 450, referred to as status parameter extractor 450C. The status parameter extractor 450C may include i.a. a vibration event signature detector and position signal value detector and a relation generator, as discussed below. The vibration event signature detector may be embodied by a peak detector, as discussed below.

Accordingly, FIG. 23 is a block diagram illustrating an example of a part of the analysis apparatus 150. In the FIG. 23 example, some of the functional blocks represent hardware and some of the functional blocks either may represent hardware, or may represent functions that are achieved by running program code on the data processing device 350, as discussed in connection with FIGS. 3 and 4. The apparatus 150 in FIG. 5 shows an example of the analysis apparatus 150 shown in FIG. 1 and/or FIG. 3. The parameter extractor 450 in the apparatus 150 of FIG. 5 may embodied by the status parameter extractor 450C of FIG. 23.

According to aspects of the solution disclosed in this document, reference position signal values Ep, 1,1C, $P_S$, $P_C$ are generated at L predetermined rotational positions of the rotatable impeller 20, the L predetermined rotational positions following a pattern that reflects the angular positions of the L vanes 310 in the impeller 20. The provision of such reference position signal values Ep, 1,1C together with the provision of vibration event signature detection in a manner as herein disclosed, makes it possible to generate data indicative of a current operating point 205, 550 in relation to a best efficiency operating point in an advantageously accurate manner.

Although it has been exemplified with vanes 310 that are positioned in an equidistant pattern, i.e. evenly distributed in the impeller 20, this solution is also operable with other patterns of angular positions of the L vanes 310 in the impeller 20. When other patterns of angular positions of the L vanes 310 in the impeller is used, it is of importance that the reference position signal values Ep, 1,1C are generated at L predetermined rotational positions of the impeller 20, the L predetermined rotational positions following a pattern that reflects the angular positions of the L vanes 310 in the impeller 20.

With reference to FIG. 5, the A/D converter 330 may be configured to deliver a sequence of pairs of vibration measurement values S(i) associated with corresponding position signal values P(i) to the status parameter extractor 450. The status parameter extractor 450 is configured to generate one or more parameter values X1, X2, X3, . . . , Xm, where the index m is a positive integer.

The status parameter extractor 450 may be embodied e.g as discussed in connection with FIG. 15A. Alternatively, the status parameter extractor 450 may be embodied e.g as discussed in connection with FIG. 23.

The status parameter extractor 450C, of FIG. 23, is adapted to receive a sequence of measurement values S(i) and a sequence of positional signals P(i), together with temporal relations there-between.

Thus, an individual vibration measurement value S(i) is associated with a corresponding position value P(i). Such a signal pair S(i) and P(i) are delivered to a memory 970. With reference to FIG. 23, the status parameter extractor 450C comprises a memory 970. The memory 970 may operate to receive data, in the form of a signal pair S(i) and P(i), so as to enable analysis of temporal relations between occurrences of events in the received signals. Columns #2 and #3 in Table 3 provide an illustration of an example of the data collected in the memory 970 during one full revolution of an impeller, when a position signal 1, 1C is provided six times per revolution, since there are L=6 vanes 310 in the impeller 20. Table 4 and table 5 provide more detailed information about example signal values in the first 1280 time slots of table 3.

The position signal 1, 1C may be generated by physical marker devices 180 an/or some position signals 1C may be virtual position signals. The time sequence of position signal sample values P(i), P(j), P(q)) should be provided at an occurrence pattern that reflects the angular positions of the vanes 310 in the impeller 20.

For example, when there are six (L=6) equidistant vanes 310 in the impeller 20, the angular distance between any two adjacent vanes 310 is 60 degrees. This is since 360 degrees is one full revolution and, when L=6, the angular distance between any two adjacent vanes is 360/L=360/6=60. Accordingly, the corresponding time sequence of position signal sample values P(i), representing a full revolution of the impeller 20, should include six (L=6) position signal values 1, 1C with a corresponding occurrence pattern, as illustrated in table 3.

The status parameter extractor 450C further comprises a position signal value detector 980 and vibration event signature detector 990. The vibration event signature detector 990 may be configured to detect a vibration signal event such as an amplitude peak value in the received sequence of measurement values S(i).

The output of the position signal value detector 980 is coupled to a START/STOP input 995 of a reference signal time counter 1010, and to a START input 1015 of an event signature time counter 1020. The output of the position signal value detector 980 may also coupled to a START/STOP input 1023 of vibration event signature detector 990 for indicating the start and the stop of the duration to be analyzed. Detector 990 transmits on its output when a position signal value 1, 1C is detected.

The vibration event signature detector 990 is configured to analyse all the sample values S(i) between two consecutive position signal values 1, 1C for detecting a highest peak amplitude value Sp therein. The vibration event signature detector 990 has a first output 1021 which is coupled to a STOP input 1025 of the event signature time counter 1020.

The reference signal time counter 1010 is configured to count the duration between two consecutive position signal values 1, 1C, thereby generating a first reference duration value $T_{REF1}$ on an output 1030. This may be achieved, e.g. by reference signal time counter 1010 being a clock timer that counts the temporal duration between two consecutive position signal values 1, 1C. Alternatively, the reference signal time counter 1010 may count the number of time slots (See column #01 in table 3) between two consecutive position signal values 1, 1C.

The event signature time counter 1020 is configured to count the duration from the occurrence of a position signal value 1, 1C to the occurrence of a vibration signal event such as an amplitude peak value. This may be attained in the following manner:

- The event signature time counter 1020 starts counting when receiving, on START input 1015, information that position signal value detector 980 detected an occurrence of a position signal value 1, 1C.
- The event signature time counter 1020 stops counting when receiving, on STOP input 1025, information that vibration event signature detector 990 detected a vibration signal event such as an amplitude peak value in the received sequence of measurement values S(i).

In this manner, the event signature time counter 1020 may be configured to count the temporal duration from the occurrence of a position signal value 1, 1C to the occurrence of a an amplitude peak value. The temporal duration from the occurrence of a position signal value 1, 1C to the occurrence of a an amplitude peak value is here referred to as a second reference duration value $T_{REF2}$. The second reference duration value $T_{REF2}$ may be delivered on an output 1040.

The output 1040 is coupled to an input of a relation generator 1050 so as to provide the second reference duration value $T_{REF2}$ to the relation generator 1050.

The relation generator 1050 also has an input coupled to receive the first reference duration value $T_{REF1}$ from the output 1030 of reference signal time counter 1010. The relation generator 1050 is configured to generate a relation value X1 based on the received second reference duration value $T_{REF2}$ and the received first reference duration value $T_{REF1}$. The relation value X1 may also be referred to as $R_T(r)$; $T_D$; FI(r). The relation value X1 may be generated L times per revolution of the impeller 20. Moreover, the L times generated relation values X1 from a single revolution of the impeller may be averaged to generate one value X1(r) per revolution of the impeller 20. In this manner, the status parameter extractor 450C may be configured to deliver an updated value X1(r) once per revolution.

For the purpose of clarity, an example of a relation value X1 is generated in the following manner: Please refer to column #03 in table 4 in conjunction with FIG. 23: The vibration sample values S(i) are analyzed, by vibration event signature detector 990, for the detection of a vibration signal signature $S_{FP}$.

The vibration signal signature $S_{FP}$ may be manifested as a peak amplitude sample value Sp. With reference to table 6, the peak value analysis leads to the detection of a highest vibration sample amplitude value S(i). In the illustrated example, the vibration sample amplitude value S(i=760) is detected to hold a highest peak value Sp.

Having detected the peak value Sp to be located in time slot 760, a temporal relation value X1 can be established.

The reference positions are indicated by data in column #02 in table 6. The reference positions are expressed as values for the phase angle FI, X1. As explained above in the disclosure relating to table 6, two position signal sample values P(i), carrying position signal values 1, 1C are expressed as phase angles 0 and 360 degrees, respectively, in column #02 in table 6.

Consequently, column #02 in conjunction with column #03 of table 6, can be regarded as indicating the location of the detected event signature 205, and/or indicating the physical location of the internal status indicator object 550, at an angular position of 213.75 degrees (See column #03 of table 6 in conjunction with FIG. 16 and/or FIG. 19A). When the Best Operating Point is at an angular position of zero degrees, as in the example of FIG. 19A, the angular position of 213.75 degrees would indicate a deviation from BEP by 213.75 degrees.

However, as discussed elsewhere in this disclosure, the phase angle FI, X1 appears to exhibit a phase shift of approximately 180 degrees, when the operating point 550, 205 changes from below BEP to above BEP, or vice versa. Therefore, it would appear to be relevant to analyze a current phase angle parameter value FI, X1 in terms of deviation from the reference direction, illustrated as zero (0) degrees and 360 degrees in FIGS. 16, 17, 18 and 19A.

Thus, any phase angle parameter value FI, X1 having a numerical value exceeding 180 degrees, may be translated into a phase deviation value $FI_{DEV}$, wherein $$FI_{DEV} = FI - 360$$

Accordingly, when the phase angle parameter value FI, X1 is 213.75 degrees (See column #03 of table 6 in conjunction with FIG. 16 and/or FIG. 19A), then the corresponding phase deviation value $FI_{DEV}$ is:

$$FI_{DEV} = FI - 360 = 213{,}75 - 360 = -146{,}25 \text{ degrees}$$

Thus, referring to FIG. 19A in conjunction with col. #02 of table 6, the phase angle FI appears to be indicative of a current operating point in relation to a Best Efficiency Point. In other words, the phase angle Φ(r)=FI(r) may exhibit a predetermined value when the pump operates at BEP flow condition. When the phase angle Φ(r)=FI(r) deviates from the predetermined value, that deviation appears to be indicative of operation away from BEP flow condition. In the example illustrated in FIG. 19A, the predetermined value was zero (0) degrees, so that the status indicator object $\mathbf{550}_{BEP}$ indicative of the pump operating at BEP flow condition exhibits a zero degree phase angle. Thus, the status indicator object relating to Best Efficiency Operation $\mathbf{550}_{BEP}$=550(*p*+4) may have a phase angle Φ(r)=FI(r)=Φ(p+4)=0 degrees.

Accordingly, a deviation value indicative of a current operating point deviation from BEP can be obtained by:

- Counting a total number of samples ($N_B-N_0=N_B-0=N_B=1280$) from the first reference signal occurrence in sample number $N_0=0$ to the second reference signal occurrence in sample number $N_B=1280$, and
- Counting another number of samples ($N_P-N_0=N_P-0=N_P$) from the first reference signal occurrence at $N_0=0$ to the occurrence of the peak amplitude value Sp at sample number $N_P$, and
- generating said first temporal relation (X1, $R_T$(r); $T_D$; FI(r)) based on said another number $N_P$ and said total number $N_B$. This can be summarized as:

$$X1(r) = FI(r) = R_T(r) = R_T(760) = (N_P - N_0)/(N_B - N_0) = (760 - 0)/(1280 - 0)$$

When the above relation is expressed as a phase angle FI:

$$FI(r)=360*760/1280=213.75 \text{ degrees}$$

Thus, information indicative of a momentary operating point X1, or identifying a momentary operating point X1, may be generated by:

- Counting a total number of samples ($N_B$) from the first reference signal occurrence to the second reference signal occurrence, and
- Counting another number of samples ($N_P$) from the first reference signal occurrence to the occurrence of the peak amplitude value Sp at sample number $N_P$, and
- generating said first temporal relation (X1; $R_T$(r); $T_D$; FI(r)) based on a relation between said sample number $N_P$ and said total number of samples i.e. $N_B$.

When the phase angle parameter value FI, X1 has a numerical value exceeding 180 degrees, it may be translated into a phase deviation value $FI_{DEV}$, wherein $$FI_{DEV}=FI-360$$

In this case, when $$FI(r)=360*760/1280=213.75 \text{ degrees}$$

then the corresponding phase deviation value $FI_{DEV}$ will be $$FI_{DEV} = FI - 360 = 213{,}75 - 360 = -146{,}25 \text{ degrees}$$

This is illustrated in FIG. 19A.

For clarity, FIG. 19A also illustrates a phase angle parameter value FI(p+1) for the status indicator object 550(*p*+1) and the corresponding phase deviation value $FI_{DEV}$(p+1). Moreover, FIG. 19A also illustrates a phase deviation value $FI_{DEV}$(r−1) corresponding to the phase angle parameter value FI(r−1) for the status indicator object 550(*r*−1).

The relation generator 1050 may generate an update of relation value X1 with a delivery frequency that depends on the rotational speed of the impeller 20. The delivery frequency may be adapted, dependent on processing capacity of the data processing device 350 (See e.g. FIG. 3). The status parameter extractor 450C may be configured to deliver an updated value FI(r), X1(r) e.g. once per 100 revolutions. Alternatively, the updated value FI(r), X1(r) may be delivered e.g. once per 10 revolutions.

Alternatively, the status parameter extractor 450C may be configured to deliver an updated value X1(r) once per revolution. In this manner a delivered updated value X1(r) may be based on L values generated during one revolution. The latest update, number r, of the first internal status parameter X1(r) may be delivered on a first status parameter extractor output 1060.

With reference to FIG. 23, the vibration event signature detector 990 may be configured to detect a peak amplitude sample value Sp. The vibration event signature detector 990 has an output 1070 for delivering a detected vibration signal amplitude peak value Sp. The detected vibration signal amplitude peak value Sp may be delivered from the output 1070 of vibration signal peak amplitude detector 990 to an output 1080 of status parameter extractor 450C. The output 1080 constitutes a second status parameter extractor output for delivery of a second internal status parameter X2(r), also referred to as Sp(r). The second internal status parameter X2(r) is delivered at the same delivery frequency as the first internal status parameter X1(r).

Moreover, the first internal status parameter X1(r) and the second internal status parameter X2(r) are preferably delivered simultaneously, as a set of internal status parameter data (X1(r); X2(r)). In the notation X1(r), the "r" is a sample number indicating a time slot, i.e. increasing number value of "r" indicates temporal progression, in the same manner as the number "i" in column #01 in table 3.

Improved pumping of fluid at several flow rates by a pump A problem to be addressed by examples in this disclosure is how to improve the pumping process in a centrifugal pump. This problem is addressed by examples, such as a system including a pump 10 having an adaptive volute and a vibration sensor.

Another problem to be addressed by examples in this disclosure is how to improve the pumping process in a centrifugal pump during dynamic and variable fluid system conditions. This problem is addressed by examples, such as a system including a pump 10 having an adaptive volute and a vibration sensor and a method of operating such a system.

Figure 24:
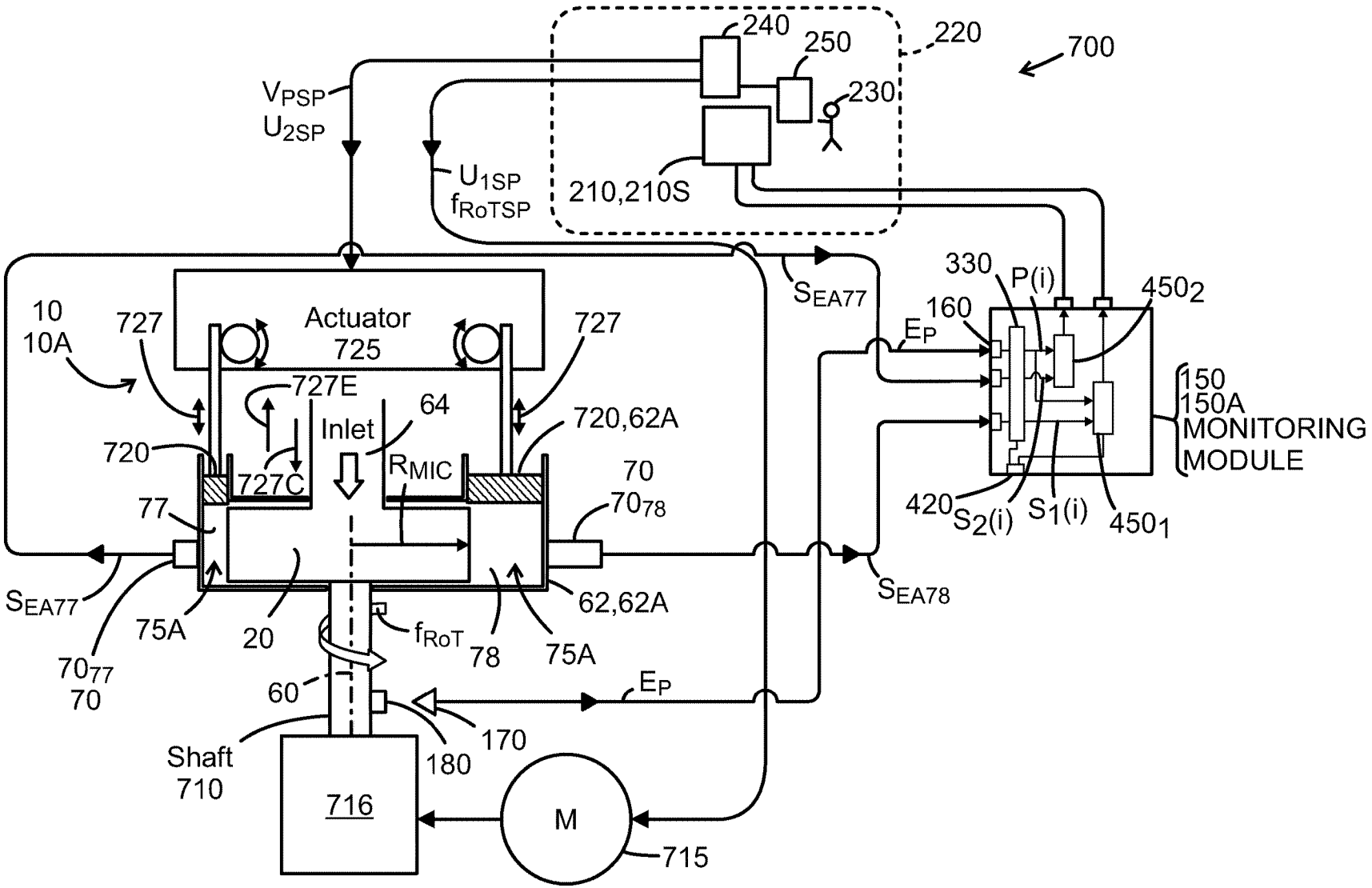
FIG. 24 illustrates a pump having an adaptive volute and a sensor.

FIG. 24 illustrates a pump 10 having an adaptive volute 75A and a sensor 70, $\mathbf{70}_{77}$, $\mathbf{70}_{78}$.

By controlling the volume of the volute, by adjusting a cross sectional area of the volute based on vibration data from the sensor 70, $\mathbf{70}_{77}$, $\mathbf{70}_{78}$, a best efficiency point of operation flow can be achieved while varying the rotational speed. Thus, a speed of operation $f_{ROT}$ of the impeller 20 can be controlled based on required flow, while the cross sectional area of the adaptive volute is controlled based on at least one of the internal state parameters X1, X2, X3, . . . , Xm, disclosed herein, such as e.g. the parameter X1(r), FI(r).

This solution advantageously enables the provision of a desired flow $Q_{OUT}$ while maintaining the internal state of the pump at a Best Efficiency Point of operation, or substantially at a Best Efficiency Point of operation.

This solution also advantageously enables the provision of a laminar, or substantially laminar, desired flow through the pump while maintaining the internal state of the pump at a Best Efficiency Point of operation, or substantially at a Best Efficiency Point of operation during dynamic and variable fluid system conditions. This advantageously enables the delivery of fluid with a minimized, or eliminated, fluid pulsation. Moreover, this solution advantageously enables the delivery of fluid with a minimized, or eliminated, turbulent flow. Minimized, or eliminated, turbulent flow, is of value in a number of industries, such as e.g. in the dairy industry, wherein there is a need to transport fluids, such as milk products which may be adversely affected by turbulent flow.

The pump 10, 10A may operate and function as disclosed in WO 2021/055879, the content of which is hereby incorporated by reference.

The set-up as illustrated in FIG. 24 may be used in combination with the example status parameter extractors 450, 450C as exemplified in this disclosure. With reference to FIG. 15A, the set-up, as illustrated in FIG. 24, may be used for generating the marker signal P(i) which is delivered to impeller speed value generator 500. Thus, the impeller speed value generator 500 will receive a marker signal P(i) having a position indicator signal value every 360/L degrees during a revolution of the impeller 20. Thus, the Fast Fourier Transformer 510 will receive a marker signal value P(j)=1, from the speed value generator 500, every 360/L degrees during a revolution of the impeller 20 when the rotational speed $f_{ROT}$ is constant. Alternatively, the Fast Fourier Transformer 510 will receive a marker signal value P(q)=1, from the decimator 470, 470B, every 360/L degrees during a revolution of the impeller 20 when the rotational speed $f_{ROT}$ varies.

Moreover, the speed value generator 500 will be able to generate even more accurate speed values $f_{ROT}(j)$ when it receives a marker signal P(i) having a position indicator signal value, e.g. P(i)=1, every 360/L degrees during a revolution of the impeller 20.

As for appropriate settings of the FFT 510 when it receives a marker signal value P(j)=1 every 360/L degrees during a revolution of the impeller 20, this means that the fundamental frequency will be the repetition frequency $f_R$.

Again, reference is made to the Fourier series (See Equation 6 below):

$$F(t) = \sum_{n=0}^{n=\infty} C_n \sin(n\omega t + \Phi_n) \quad \text{(Eq. 6)}$$

wherein n=0 the average value of the signal during a period of time (it may be zero, but need not be zero)

n=1 corresponds to the fundamental frequency of the signal F(t).

n=2 corresponds to the first harmonic partial of the signal F(t).

$\omega$=the angular frequency of interest i.e. $(2*\pi*f_R)$ $f_R$=a frequency of interest, expressed as periods per second t=time $\Phi_n$=phase angle for the n:th partial $C_n$=Amplitude for the n:th partial In this embodiment it is noted that the fundamental frequency will be one per vane 310 when the FFT 510 receives a marker signal value P(j)=1 every 360/L degrees during a revolution of the impeller 20.

As noted above, the settings of the FFT 510 should be done with a consideration of the reference signal. As noted above, the position signal P(j), P(q) (see FIG. 15A) may be used as a reference signal for the digital measurement signal S(j),S(q).

According to some embodiments, when the FFT analyzer is configured to receive a reference signal, i.e. the position signal P(i), P(q), $P_S$, $P_C$ once every 360/L degrees during a revolution of the impeller 20 and L is the number of vanes 310 in the impeller 20, then the setting of the FFT analyzer may be set to fulfill the following criteria:

The integer value Oi is set to unity, i.e. to equal 1, and the settable variables $O_{MAX}$, and $B_n$ are selected such that the mathematical expression $$Oi*B_n/Y$$

becomes a positive integer.

Differently expressed: When integer value Oi is set to equal 1, then settable variables $O_{MAX}$ and $B_n$ should be set to integer values so as to render the variable $N_R$ a positive integer, $$\text{wherein } N_R = Oi*B_n/O_{MAX}$$

Using the above setting, i.e. integer value Oi is set to equal unity, and with reference to FIG. 15A and equation 6 above, the FFT 510 may deliver the amplitude value $C_n$ for n=1, i.e. $C_1$=Sp(r). The FFT 510 may also deliver the phase angle for the fundamental frequency (n=1), i.e. $\Phi_1$=FI(r).

With reference to FIG. 15A in conjunction with FIG. 1 and equation 6 above, the status values Sp(r)=$C_1$ and FI(r)

$=\Phi_1$ may be delivered to the Human Computer Interface (HCI) 210 for providing a visual indication of the analysis result. As mentioned above, the analysis result displayed may include information indicative of an internal state of the centrifugal pump process for enabling the operator 230 to control the centrifugal pump. With reference to FIGS. 16, 17, 18, 19A, and 19B, the example illustrations of visual indications of analysis results are valid for the set-up of the rotating pump impeller 20, as illustrated in FIG. 24, whereby the FFT 510 will receive a marker signal P(i), P(j), P(q) having a position indicator signal value every 360/L degrees, wherein L is the number of vanes 310 in the impeller 20.

Whereas the above discussion in relation to settings of the FFT 510 refers to the Fourier series and equations 5 and 6 for the purpose of conveying an intuitive understanding of the background for the settings of an FFT transformer 510, it is noted that the use of digital signal processing may involve the discrete Fourier transform (See Equation 7 below):

Equation 7:

$$F(n) = \sum_{k=0}^{N-1} f(k)e^{-j2\pi nk/N}\left(n = 0 \ldots 1: N-1\right)$$

Thus, according to embodiments of this disclosure the above discrete Fourier transform (DFT) may be comprised in signal processing for generating data indicative of the internal state of a centrifugal pump, such as that discussed in connection with embodiments of the status parameter extractor 450. In this connection, reference is made to e.g. FIGS. 3, 4, 5, 15 and/or 24. In view of the above discussion on the subject of FFT and the Fourier series, the discrete Fourier transform will not be discussed in further detail, as the skilled reader of this disclosure is well acquainted with it.

In summary, as regards appropriate settings of the FFT 510 and the above equations 5 and 6, it is noted that the phase angle for the n:th partial, i.e. $\Phi_n$, may be indicative of the information identifying a momentary operating point. In particular, the phase angle for the n:th partial, i.e. $\Phi_n$, may be indicative of the position of the detected event signature 205, expressed as a part of the distance between two adjacent vanes 310 in a rotating impeller 20. With reference to table 6 above and FIG. 14, the total distance between two adjacent vanes may be regarded as 360 degrees, and value of the phase angle for the n:th partial, i.e. $\Phi_n$, divided by 360 may be indicative of a percentage of the total distance between the two adjacent vanes. This can be seen e.g. by comparing col. #2 in table 5 and table 6 above. As mentioned above, $\Phi_n$=phase angle for the n:th partial, and $C_1$=Amplitude for the n:th partial. As discussed above, considering the number L of vanes in the rotating impeller 20 and the number of reference signals being generated and, as a consequence thereof, the order Oi of a signal of interest, the FFT 510 may be set so as to deliver a phase angle for the n:th partial, $\Phi_n$, and an amplitude for the n:th partial, Cn, so that the phase angle for the n:th partial, i.e. $\Phi_n$, may be indicative of the information identifying a momentary operating point. Moreover, as noted above, the FFT 510 may be set so as to render the variable $N_R$ a positive integer, wherein $$N_R = Oi * B_n / O_{MAX}$$

and wherein

Oi is set to a integer value such as e.g. the number L of vanes 310, $O_{MAX}$ is set to an integer value, $B_n$ is set to a integer value.

With reference to FIG. 24, an example system 700 includes a centrifugal pump 10, 10A having an adaptive volute 75A and a sensor 70, $\mathbf{70}_{77}$, $\mathbf{70}_{78}$.

Adaptive volutes 75A of the present disclosure can include one or more mechanisms to adjust a cross-sectional area of the volute such that the volute can maintain near uniform static pressure, i.e., best efficiency operation (BEP), around a periphery of the impeller disposed within the casing 62 of the pump 10 (See also discussion related to FIGS. 14A and 14D). For example, the volute cross-sectional area can be expanded or contracted to shift the BEP of the pump based on one or more operating parameters of the pump and/or fluid system to maintain a higher operating efficiency across a varying range of conditions.

The one or more operating parameters can include the one or more of the internal state parameters disclosed in this disclosure, such as the internal state parameters X1, X2, X3, . . . , Xm, where the index m is a positive integer, as discussed e.g. in connection with FIG. 2C.

Thus, for example, the volute area can be expanded or contracted to shift the operating point of the pump based on the first parameter value, i.e. the first polar angle X1(r), FI(r), Φ(r), $T_D$, $T_{D1}$.

Alternatively, the volute area can be expanded or contracted to shift the operating point of the pump based on the second parameter value, i.e. the detected amplitude value X2(r) Sp(r), $S_{P1}$ which is indicative of an amplitude of detected fluid pressure pulsation $P_{FP}$. According to another example, the volute area can be expanded or contracted to shift the BEP of the pump based on the first parameter value, i.e. the first polar angle X1(r), and based on the second parameter value, i.e. the detected amplitude value X2(r) Sp(r).

The adaptive centrifugal pump 10A of FIG. 24 has an impeller 20 that, during operation, rotates at a speed of rotation $f_{ROT}$, driven by a shaft 710. The shaft is caused to rotate by a drive motor 715. The shaft 710 may be connected to the drive motor 715 via a gear box 716.

Referring to FIG. 24, a sensor 70, $\mathbf{70}_{77}$, $\mathbf{70}_{78}$ may be mounted on the casing 62 for generating a vibration signal $S_{EA}$, $S_{MD}$, Se(i), S(i), S(q) dependent on fluid material pressure pulsation $P_{FP}$ in the pump. The vibration sensor 70, $\mathbf{70}_{77}$, $\mathbf{70}_{78}$ may include one or more of the sensors as disclosed in connection with FIG. 2A.

The pump 10A may also be also provided with a position sensor 170 for generating a position signal EP, PS, P(i), P(j), P(q) indicative of a rotational position of said impeller 20 in relation to the casing 62. As shown in FIG. 24, a position marker device 180 may be provided in association with the impeller 20 such that, when the impeller 20 rotates around the axis of rotation 60, the position marker 180 passes by the position sensor 170 once per revolution of the impeller, thereby causing the position sensor 170 to generate a revolution marker signal value PS. The position marker 180 is illustrated, in FIG. 24, as being attached to the shaft 710, but that is only an example. The position signal EP, PS, P(i), P(j), P(q) may be generated in a manner as disclosed anywhere else in this disclosure (See for example the disclosure of alternative position sensors 170 and position markers 180 in connection with FIG. 2A).

As mentioned above, the centrifugal pump 10A of FIG. 24 has an adaptive volute 75A. With reference to FIG. 24, the example pump 10A comprises a casing 62A having a movable volute boundary wall 720. The volute boundary wall 720 may be movable in a direction parallel to the axis of rotation 60.

The movable volute boundary wall 720 may be formed as a plane which is perpendicular to the direction of the axis of rotation 60. The movable volute boundary wall 720 is curved, and it has an inner radius that may correspond to the radius $R_{MIC}$ of the impeller 20 (See FIG. 24 and FIG. 14D part II). The outer radius of the movable volute boundary wall 720 exhibits a gradually widening radius so as to fit the spiral casing 62A of the pump.

The movable volute boundary wall 720 may be coupled to an actuator 725 configured to cause movement 727 of the movable volute boundary wall 720 in response to a Volume set point signal $V_{PSP}$, $U2_{SP}$. Accordingly, the actuator may be configured to cause movement 727E of the movable volute boundary wall 720 in a direction 727E that causes the volute cross-sectional area to be expanded in response to the Volume set point signal $V_{PSP}$, $U2_{SP}$ providing an "Expand value". Conversely, the actuator may be configured to cause movement 727C of the movable volute boundary wall 720 in a direction 727C that causes the volute cross-sectional area to be contracted, i.e. smaller, in response to the Volume set point signal $V_{PSP}$, $U2_{SP}$ providing a "Reduce value". Thus, the volume of the volute 75A may be adjusted, thereby enabling a controlled variable flow $Q_{OUT}$ from the pump outlet 66 at a certain impeller rotational speed $f_{ROT}$ (See FIG. 24 in conjunction with any of FIGS. 2A, 2D, 2E, 14A to 14G.

By controlling the volume of the volute, by adjusting a cross sectional area of the volute based on vibration data from the sensor 70, $70_{77}$, $70_{78}$, a best efficiency point of operation flow can be achieved while varying the rotational speed $f_{ROT}$. Thus, a speed of operation $f_{ROT}$ of the impeller 20 can be controlled based on required flow, while the cross sectional area of the adaptive volute is controlled based on at least one of the internal state parameters X1, X2, X3, . . . , Xm, disclosed herein, such as e.g. the parameter X1(r), FI(r). This solution advantageously enables the provision of a desired flow $Q_{OUT}$ while maintaining the internal state of the pump at a desired operating point in relation to BEP, such as e.g. at a Best Efficiency Point of operation, or substantially at a Best Efficiency Point of operation.

Referring to FIG. 24, a centrifugal pump controller 240 may be configured to deliver an impeller speed set point value $U1_{SP}$, $f_{ROTSP}$ so as to control the rotational speed $f_{ROT}$ of the impeller 20. According to some embodiments, the set point value $U1_{SP}$, $f_{ROTSP}$ is set by the operator 230.

The centrifugal pump controller 240 may also be configured to deliver the Volume set point signal $V_{PSP}$, $U2_{SP}$, as discussed above, so as to control the outlet fluid volume per impeller revolution. According to some embodiments, the set point value $U2_{SP}$, $V_{PSP}$, is set by the operator 230.

In order to assist the operator 230, the control room may include the HCI 210, 210S (See also FIGS. 1A and/or 1B) which is coupled to the analysis apparatus 150, or monitoring module 150A, configured to provide information indicative of an internal state X of the centrifugal pump 10. The HCI 210 may include a display 210S, and it may be configured to convey information as disclosed in connection with one or more of FIGS. 16, 17, 18, 19A, 19B, 19C, 19D,19E, and/or 19F.

Accordingly, the system 700 provides an improved user interface 210, 210S, 250 that enables an operator 230, to control the pump 10A so as to improve the pumping process in the centrifugal pump 10A.

Figure 25A:
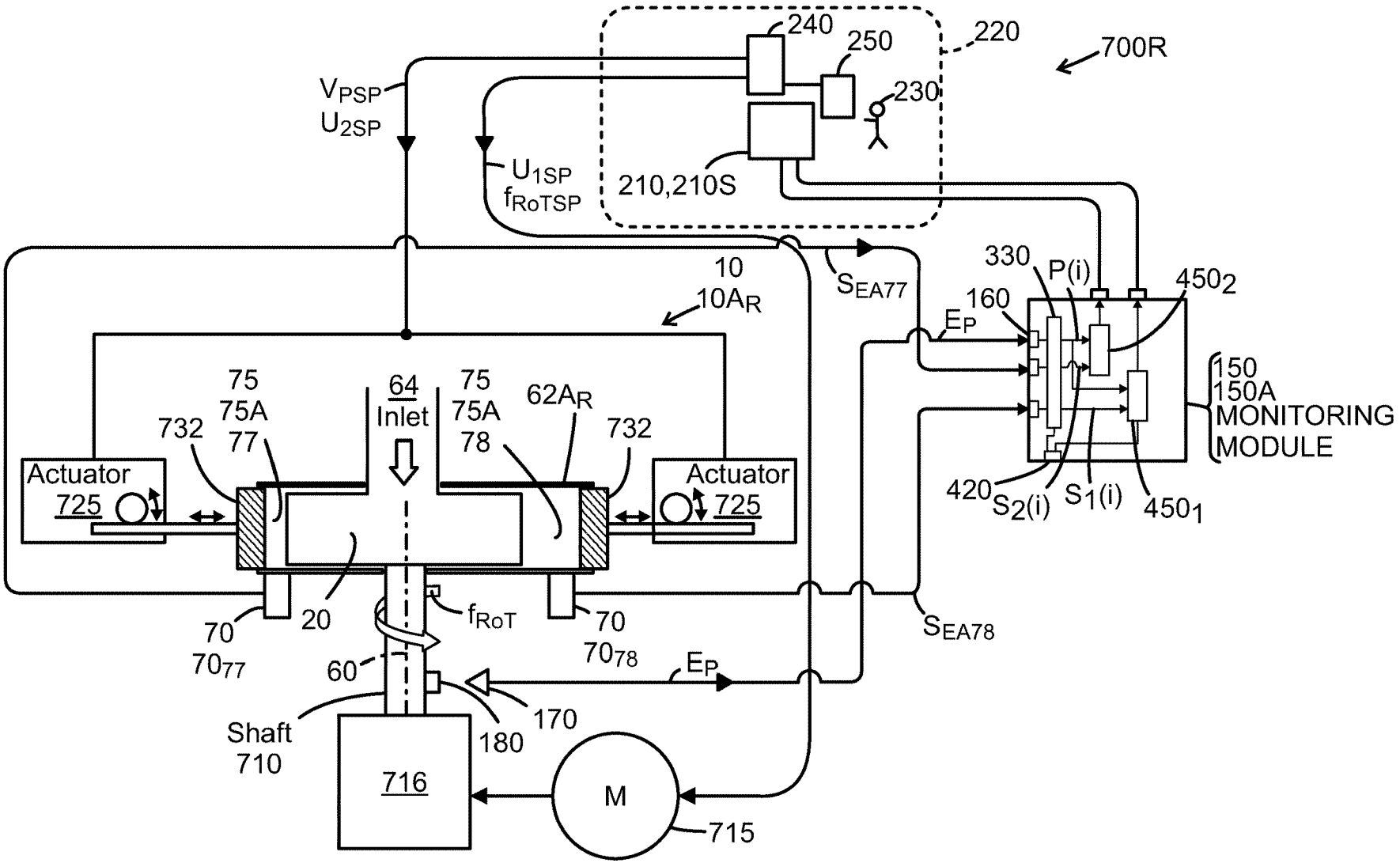
FIG. 25A shows another example system including a pump having an adaptive volute and a sensor.

FIG. 25A shows another example system 700R including a pump 10A, $10A_R$ having an adaptive volute $75A_R$ and a sensor 70, $70_{77}$, $70_{78}$. In FIG. 25A the pump $10A_R$ is shown in a sectional side view, i.e. a view in which the axis of rotation 60 of the impeller is parallel to the plane of the paper.

Figure 25B:
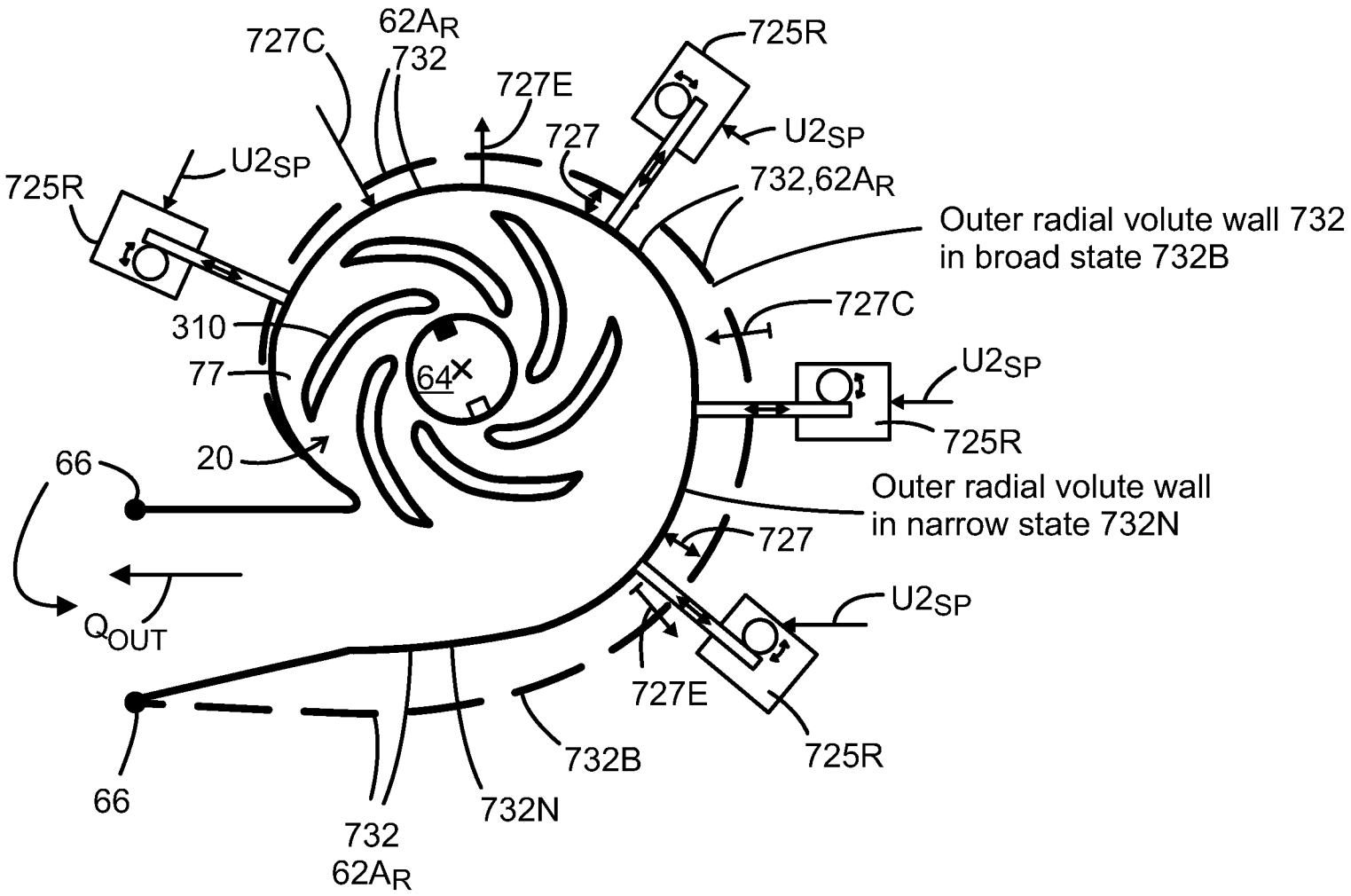
FIG. 25B is a sectional top view of the pump shown in FIG. 25A.

FIG. 25B is a sectional top view of the pump $10A_R$ shown in FIG. 25A.

The system 700R illustrated in FIGS. 25A and 25B may include the features of the system 700 disclosed and described above in connection with FIG. 24, but in the example system 700R the example pump $10A_R$ it is the radially outer boundary wall 732 of the adaptive volute that is movable.

As mentioned above, the centrifugal pump $10A_R$ of FIG. 25 has an adaptive volute $75A_R$. With reference to FIG. 25A, the example pump $10A_R$ comprises a casing $62A_R$ having a movable volute boundary wall 732. The movable volute boundary wall 732 may be movable in a direction perpendicular to the axis of rotation 60 of the impeller 20. The movable volute boundary wall 732 may be formed as movable spiral 732. In this manner the movable spiral wall 732 provides an adjustable gradual widening of the adaptive volute $75A_R$.

The movable volute boundary wall 732R may be coupled to an actuator 725R configured to cause radial movement 727 of the movable volute boundary wall 732R in response to a Volume set point signal $V_{PSP}$, $U2_{SP}$. Accordingly, the actuator 725R may be configured to cause movement 727E of the movable volute boundary wall 732R in a direction 727E that causes the volute cross-sectional area to be expanded in response to the Volume set point signal $V_{PSP}$, $U2_{SP}$ providing an "Expand value". Conversely, the actuator may be configured to cause movement 727C of the movable volute boundary wall 720 in a direction 727C that causes the volute cross-sectional area to be contracted, i.e. smaller, in response to the Volume set point signal $v_{PSP}$, $U2_{SP}$ providing a "Reduce value". Thus, the volume of the volute $75A_R$ may be adjusted, thereby enabling a controlled variable flow $Q_{OUT}$ from the pump outlet 66 at a certain impeller rotational speed $f_{ROT}$ (See FIG. 25A and/or 25B in conjunction with any of FIGS. 2A, 2D, 2E, 14A to 14G.

By controlling the volume of the volute, by adjusting a cross sectional area of the volute based on vibration data from the sensor 70, $70_{77}$, $70_{78}$, a best efficiency point of operation flow can be achieved while varying the rotational speed $f_{ROT}$. Thus, a speed of operation $f_{ROT}$ of the impeller 20 can be controlled based on required flow, while the cross sectional area of the adaptive volute is controlled based on at least one of the internal state parameters X1, X2, X3, . . . , Xm, disclosed herein, such as e.g. the parameter X1(r), FI(r).

With reference to FIG. 24 and FIGS. 25A and 25B, when the operator desires to increase the flow $Q_{OUT}$ from the pump 10 the operator may adjust the impeller speed of rotation set point value $f_{ROTSP}$ to a higher value until the desired flow $Q_{OUT}$ from the pump 10 is obtained. Conversely, when the operator desires to decrease the flow $Q_{OUT}$ from the pump 10 the operator may adjust the impeller speed of rotation set point value $f_{ROTSP}$ to a lower value until the desired flow $Q_{OUT}$ from the pump 10 is obtained.

This solution advantageously enables the provision of a desired flow $Q_{OUT}$ while maintaining the internal state of the pump at a desired operating point in relation to the Best Efficiency Point of operation (BEP). When it is desired to operate the pump at a Best Efficiency Point of operation, or substantially at a Best Efficiency Point of operation, the operator may adjust the Volume set point signal value $v_{PSP}$, $U2_{SP}$ to a value that renders the parameter X1, FI to adopt the reference value corresponding to the Best Efficiency Point of operation. The numerical FI value corresponding to the Best Efficiency Point of operation for an individual pump may depend on the physical locations of the sensors 180 and 70 on the pump 10, 10A, 10$A_R$.

Whereas FIGS. 24 and 25A and 25B illustrate different configurations providing a pump with an adaptive volute 75A, 75$A_R$ it is to be noted that the present disclosure is not limited to the pump configurations illustrated. The pump 10, 10A may be configured and function as disclosed in WO 2021/055879, the content of which is hereby incorporated by reference. One skilled in the art will appreciate further features and advantages of the disclosure based on the above-described embodiments. Accordingly, the disclosure is not to be limited by what has been particularly shown and described, except as indicated by the appended claims.

Figure 26:
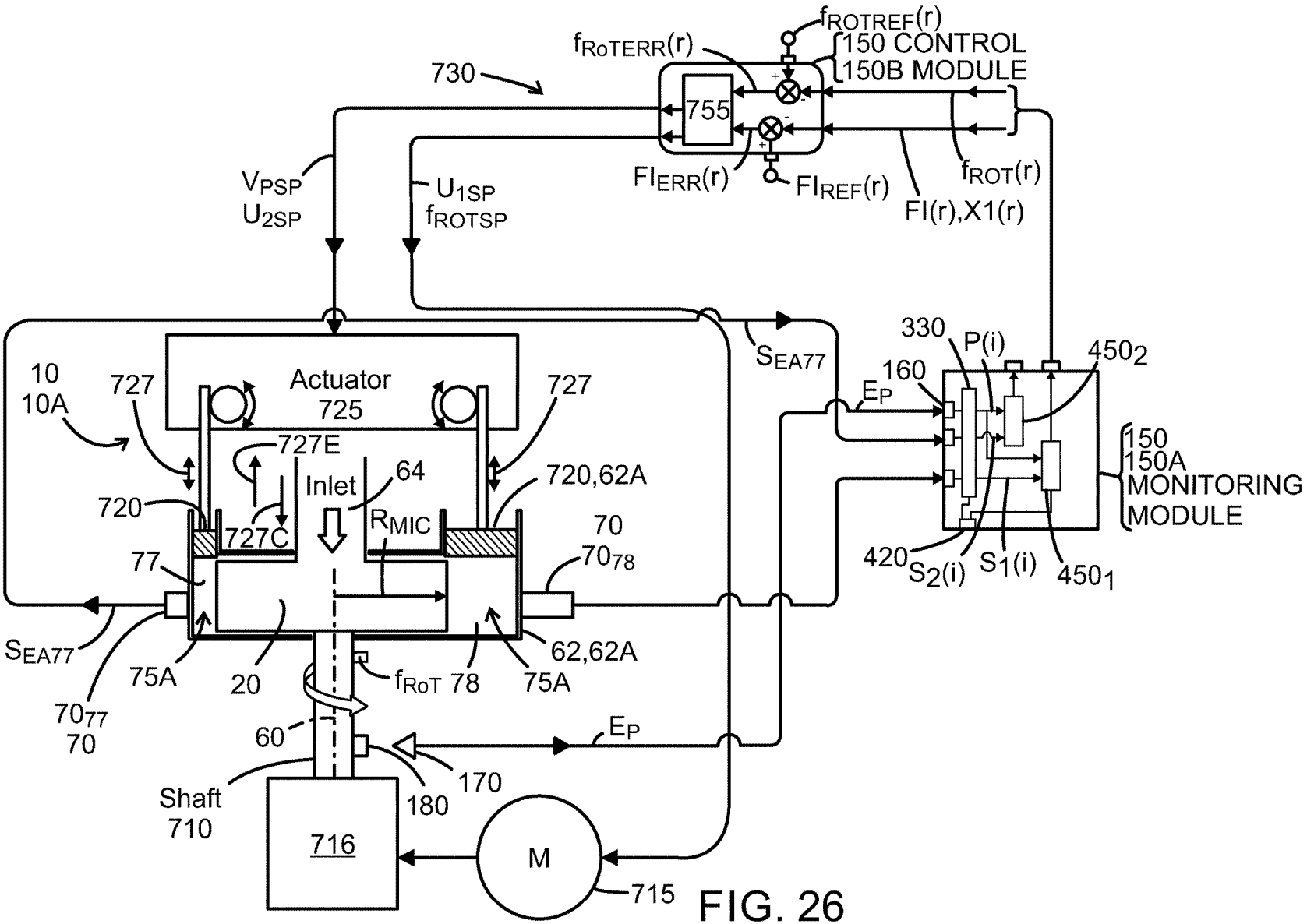
FIG. 26 shows a somewhat diagrammatic and schematic view of yet another embodiment of a system including a pump having an adaptive volute and a sensor.

FIG. 26 shows a somewhat diagrammatic and schematic view of yet another embodiment of a system 730 including a pump 10A, 10$A_R$ having an adaptive volute 75A, 75$A_R$ and a sensor 70, 70$_{77}$, 70$_{78}$. In FIG. 25A the pump 10A is shown in a sectional side view, i.e. a view in which the axis of rotation 60 of the impeller is parallel to the plane of the paper. The system 730 of FIG. 26 may include parts, and be configured, as described in any of the other embodiments described in this disclosure, e.g. in relation to FIGS. 1-25. In particular, the apparatus 150, 150A, shown in FIG. 26 may be configured as described in any of the other embodiments described in this disclosure, e.g. in relation to FIGS. 1-25. However, in the embodiment of the system 730 illustrated in FIG. 26, the apparatus 150 includes a monitoring module 150A as well as a control module 150B. Although the drawing illustrates the apparatus 150 as two boxes, it is to be understood that the apparatus 150 may well be provided as a single entity 150 including a monitoring module 150A as well as a control module 150B, as indicated by the unifying reference 150.

The system 730 is configured to control an internal state of in a pump 10A, 10$A_R$ having an adaptive volute 75A, 75$A_R$ and a sensor 70, 70$_{77}$, 70$_{78}$.

The system 730 may comprise a device 170, 180 for generating a position signal relating to a rotational position of the impeller 20 in the pump 10A 10$A_R$. The device 170, 180 may include the position sensor 170 and the marker 180 as described elsewhere in this disclosure, for generating a time sequence of position signal sample values P(i), P(j), P(q).

A sensor 70, 70$_{77}$, 70$_{78}$ is provided and it is configured to generate a vibration signal $S_{EA}$, $S_{MD}$, Se(i), S(j), S(q) dependent on fluid material pressure pulsations $P_{FP}$. The vibration signal $S_{EA}$, Se(i), S(j), S(q) may include a time sequence of vibration sample values Se(i), S(j), S(q).

The apparatus 150 of the system 730 may comprise a monitoring module 150A and a control module 150B. The monitoring module 150A comprises a status parameter extractor 450, 450C configured to detect a first occurrence of a first reference position signal value in said time sequence of position signal sample values P(i), P(j), P(q) (See tables 2, 3 and 4 above, wherein column #2 illustrates the position signal having values 1; 1C).

The status parameter extractor 450 may be configured to detect a second occurrence of a second reference position signal value 1; 1C; 360 degrees; in said time sequence of position signal sample values P(i), P(j), P(q)). The status parameter extractor 450, 450C may also be configured to detect an occurrence of an event signature $S_P$(r); Sp in said time sequence of vibration sample values Se(i), S(j), S(q).

The status parameter extractor 450 may be configured to generate data indicative of a first temporal relation FI(r), X1(r) between the event signature occurrence, and the first and second occurrences.

As mentioned above, the system 730 includes a control module 150B configured to receive data indicative of an internal state of the pump 10A, 10$A_R$ from the monitoring module 150, 150A. The data indicative of an internal state can include any of the information generated or delivered by the status parameter extractor 450, as described above in relation to any of the FIGS. 1-25 in this disclosure. With reference to FIG. 26, the control module 150B includes a regulator 755 for controlling an adaptive volute (75A) based on an operating point reference value $FI_{REF}$(r) (See FIG. 26), said first temporal relation FI(r); X1(r) (See FIGS. 1-25), and an operating point error value $FI_{ERR}$(r) (see FIG. 26).

The operating point error value ($FI_{ERR}$(r)) depends on said operating point reference value $FI_{REF}$(r), and said first temporal relation $R_T$(r); $T_D$; FI(r) (See FIGS. 3-26). The operating point reference value $FI_{REF}$(r) may be generated by manual input (not shown in FIG. 26, but it may alternatively be done as discussed e.g. in connection with FIG. 1A and/or FIG. 1B above.

As shown in FIG. 26, the said operating point error value ($FI_{ERR}$(r)) may depend on a difference between said operating point reference value $FI_{REF}$(r)), and the first temporal relation $R_T$(r); $T_D$; FI(r); X1(r).

The regulator 755 may be configured to control an operating parameter, such as speed of rotation of impeller and/or cross-sectional area of an adaptive volute in dependence on the operating point reference value $FI_{REF}$(r).

The status parameter extractor 450 may be configured to generate said first temporal relation $R_T$(r); $T_D$; FI(r); X1(r) as a phase angle (FI(r).

The regulator 755 may be configured to include a proportional-integral-derivative controller (PID controller). Alternatively, the regulator 755 may be configured to include a proportional-integral controller (PI controller). Alternatively, the regulator 755 may be configured to include a proportional controller (P controller).

Alternatively, the regulator 755 may be configured to include Kalman filtering, also known as linear quadratic estimation (LQE). Kalman filtering is an algorithm that uses a series of measurements observed over time, including statistical noise and other inaccuracies, and produces estimates of unknown variables that tend to be more accurate than those based on a single measurement alone, by estimating a joint probability distribution over the variables for each timeframe.

FIG. 27 shows a schematic block diagram of a distributed process monitoring system 770. Reference numeral 780 relates to a client location with a pump 10 having an impeller 20, as discussed above in relation to preceding drawings in this document. The client location 780, which may also be referred to as client part or pump location 780, may for example be the premises of a mining company, or e.g. a manufacturing plant for the manufacture of cement.

The distributed process monitoring system 770 is operative when one sensor 70 is, or several sensors 70, 70$_{77}$, 70$_{78}$ are, attached on or at measuring points on the pump.

The measuring signals $S_{EA}$ and $E_P$ (See e.g. FIGS. 1, 27, 26, 25) may be coupled to input ports of a pump location communications device 790. The pump location communications device 790 may include an Analogue-to-Digital converter 795 for A/D-conversion of the measuring signals $S_{EA}$, and $E_P$. The A/D converter 975 may operate as disclosed in relation to A/D converter 330 elsewhere in this document, e.g. in connection with FIGS. 3 and 5. The pump location communications device 790 has a communication port 800 for bi-directional data exchange. The communication port 800 is connectable to a communications network 810, e.g. via a data interface 820, for enabling delivery of digital data corresponding to the measuring signals $S_{EA}$, and $E_P$. The communications network 810 may be the world wide internet, also known as the Internet. The communications network 810 may also comprise a public switched telephone network.

A server computer 830 is connected to the communications network 810. The server 830 may comprise a database 840, user input/output interfaces 850 and data processing hardware 852, and a communications port 855. The server computer 830 is located on a server location 860, which is geographically separate from the pump location 780. The server location 860 may be in a first city, such as the Swedish capital Stockholm, and the pump location 780 may be on the countryside near a pump, and/or in another country such as for example in Norway, Australia or in the USA. Alternatively, the server location 860 may be in a first part of a county and the pump location 780 may be in another part of the same county. The server location 860 may also be referred to as supplier part 860, or supplier location 860.

According to an example a central control location 870 comprises a monitoring computer 880 having data processing hardware and software for monitoring and/or controlling an internal state of a pump 10 at a remote pump location 780. The monitoring computer 880 may also be referred to as a control computer 880. The control computer 880 may comprise a database 890, user input/output interfaces 900 and data processing hardware 910, and a communications port 920, 920A, or several communications ports 920, 920A, 920B. The central control location 870 may be separated from the pump location 780 by a geographic distance. The central control location 870 may be in a first city, such as the Swedish capital Stockholm, and the pump location 780 may be on the countryside near a pump, and/or in another country such as for example in Norway, Australia or in the USA. Alternatively, the central control location 870 may be in a first part of a county and the pump location 780 may be in another part of the same county. By means of communications port 920, 920A the control computer 880 can be coupled to communicate with the pump location communications device 790. Hence, the control computer 880 can receive the measuring signals $S_{EA}$, and EP (See e.g. FIGS. 1, 27, 26, 25) from the pump location communications device 790 via the communications network 810.

The system 770 may be configured to enable the reception of measuring signals $S_{EA}$, and $E_P$ in real time, or substantially in real time or enabling real time monitoring and/or real time control of the pump 10 from the location 870. Moreover, the control computer 880 may include a monitoring module 150, 150A as disclosed in any of the examples in this document, e.g. as disclosed in connection with any of the drawings 1-26 above.

A supplier company may occupy the server location 860. The supplier company may sell and deliver apparatuses 150 and/or monitoring modules 150A and/or software for use in an such apparatuses 150 and/or monitoring modules 150A. Hence, supplier company may sell and deliver software for use in the control computer 880 at the central control location 870. Such software 370, 390, 400 is discussed e.g. in connection with FIG. 4. Such software 370, 390, 400 may be delivered by transmission over said communications network 810. Alternatively such software 370, 390, 400 may be delivered as a computer readable medium 360 for storing program code. Thus the computer program 370, 390, 400 may be provided as an article of manufacture comprising a computer storage medium having a computer program encoded therein.

According to an example embodiment of the system 770 the monitoring computer 880 may substantially continuously receive measurement signals measuring signals $S_{EA}$, and $E_P$ (See e.g. FIGS. 1, 27, 26, 25) from the pump location communications device 790, e.g via the communications network 810, so as to enable continuous or substantially continuous monitoring of the internal state of the pump 10. The user input/output interfaces 900 at the central control location 870 may comprise a screen 900S for displaying images and data as discussed in connection with HCI 210 elsewhere in this document. Thus, user input/output interfaces 900 may include a display, or screen, 900S, 210S for providing a visual indication of an analysis result. The analysis result displayed may include information indicative of an internal state of the pump process for enabling an operator 930 at the central control location 870 to control the pump 10.

Moreover, the monitoring computer 880 at the central control location 870 may be configured to deliver information indicative of an internal state of the pump process to the HCI 210, via the communications port 920, 920B and via the communications network 810. In this manner, the monitoring computer 880 at the central control location 870 may be configured to enable an operator 230 at the client location 780 to control the pump. The local operator 230 at the client location 780 may be placed in the control room 220 (See FIG. 1A and/or FIG. 1B and/or FIG. 27). Thus, the client location 780, 220 may include a second pump location communications device 790B. The second pump location communications device 790B has a communication port 800B for bi-directional data exchange, and the communication port 800B is connectable to the communications network 810, e.g. via a data interface 820B.

Although it has, for the purpose of clarity, been described as two location communications devices 790, 790B, there may, alternatively, be provided a single pump location communications device 790, 790B, and/or a single communications port 800, 800B for bi-directional data exchange. Thus, the items 790 and 790B may be integrated as one unit at the pump location 780, and likewise, the items 820 and 820B may be integrated as one unit at the pump location 780.

Figure 28A:
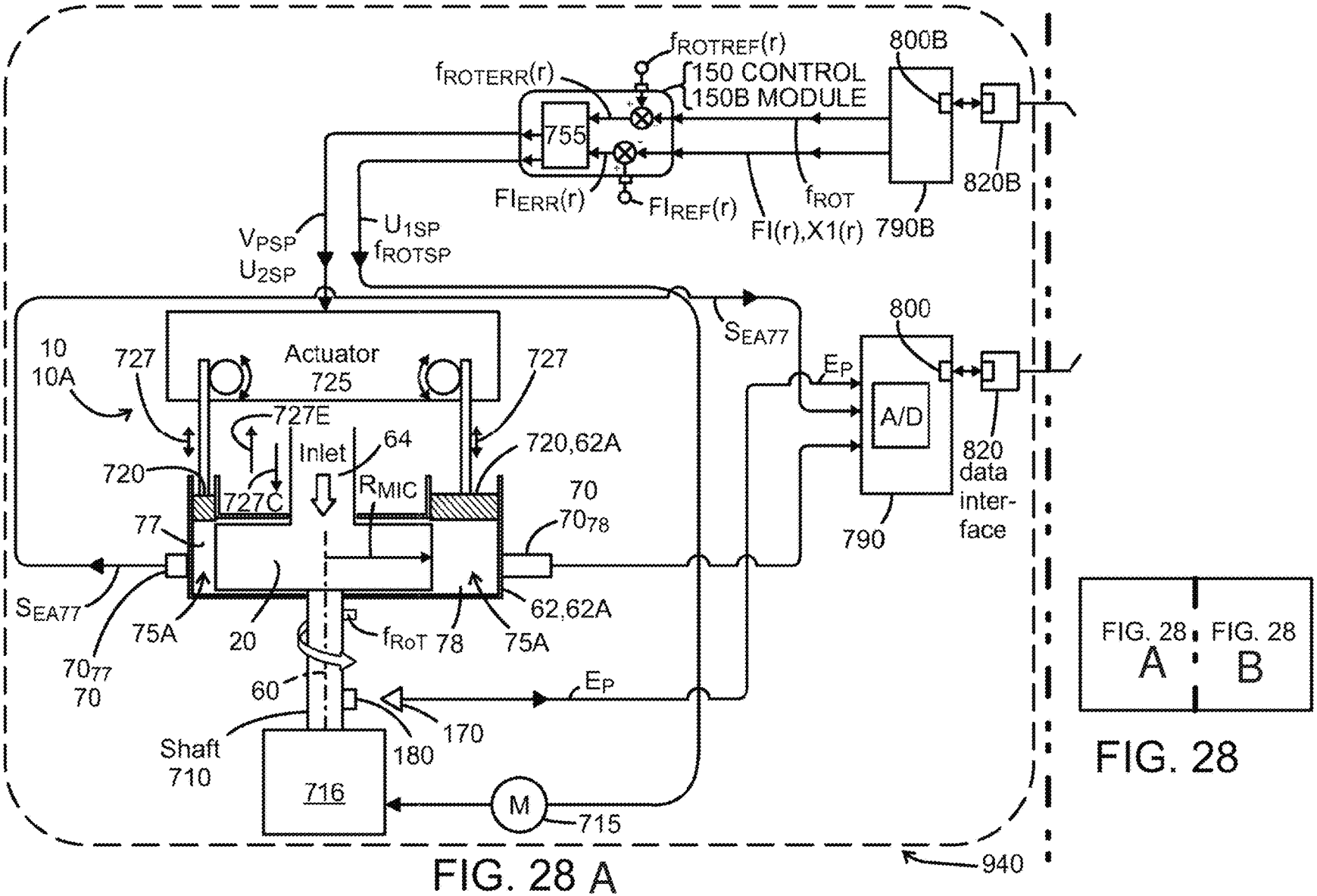
FIG. 28A-FIG. 28B are portions of a single figure (collectively referred to herein as FIG. 28), split across multiple sheets for clarity, and show a schematic block diagram of yet another embodiment of a distributed process monitoring system.
Figure 28B:
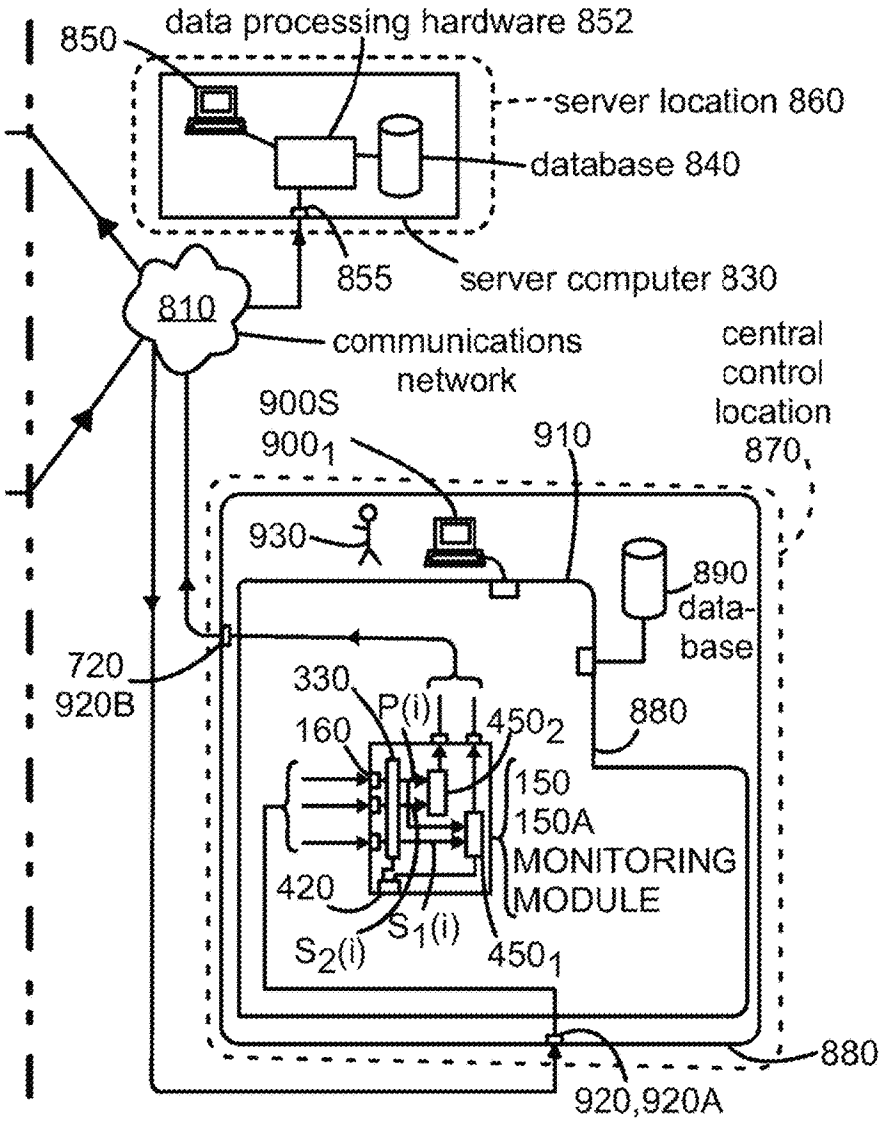

FIG. 28 shows a schematic block diagram of yet another embodiment of a distributed process monitoring system 940. Reference numeral 780 relates to a pump location with a pump 10 having an impeller 20, as discussed above in relation to preceding drawings in this document. The distributed process monitoring system 940 of FIG. 28 may include parts, and be configured, as described in any of the other embodiments described in this disclosure, e.g. in relation to FIGS. 1-28. In particular, the monitoring apparatus 150, also referred to as monitoring module 150A, shown in FIG. 28 may be configured as described in any of the other embodiments described in this disclosure, e.g. in relation to FIGS. 1-28. In particular, the process monitoring system 940 illustrated in FIG. 28, may be configured to include a monitoring module 150A, as disclosed in connection with FIG. 27, but located at the central control location 870.

Moreover, in the process monitoring system 940 illustrated in FIG. 28, the pump location 780 includes a control module 150B, as described above e.g. in connection with FIG. 26.

Thus, the internal state of the pump 10 may be automatically controlled by control module 150B located at or near the pump location 780, whereas the monitoring computer 880 at the central control location 870 may be configured to deliver information indicative of an internal state of the pump process to the HCI 900, 900S for enabling an operator 930 at the central control location 870 to monitor the internal state of the pump 10.

The measuring signals $S_{EA}$, $S_{EA77}$, $S_{EA78}$, and EP (See e.g. FIGS. 1, 27, 26, 25) may be coupled to input ports of the pump location communications device 790. The pump location communications device 790 may include an Analogue-to-Digital converter 795 for A/D-conversion of the measuring signals $S_{EA}$, $S_{EA77}$, $S_{EA78}$, and EP. The A/D converter 975 may operate as disclosed in relation to A/D converter 330 elsewhere in this document, e.g. in connection with FIGS. 3 and 5. The pump location communications device 790 has a communication port 800 for bi-directional data exchange. The communication port 800 is connectable to the communications network 810, e.g. via a data interface 820. The communication port 800 is connectable to a communications network 810, e.g. via a data interface 820, for enabling delivery of digital data corresponding to the measuring signals $S_{EA}$, $S_{EA77}$, $S_{EA78}$, and Ep.

Moreover, the client location 780 may include a second pump location communications device 790B. The second pump location communications device 790B has a communication port 800B for bi-directional data exchange, and the communication port 800B is connectable to the communications network 810, e.g. via a data interface 820B so as to enable reception, by the control module 150B, of data indicative of an internal state of the pump 10.

As illustrated in FIG. 28, data indicative of an internal state of the pump 10 may be generated by the monitoring module 150A at the central location 870.

Although FIG. 28, for the purpose of clarity, describes two location communications devices 790, 790B, there may, alternatively, be provided a single pump location communications device 790, 790B, and/or a single communications port 800, 800B for bi-directional data exchange. Thus, the items 790 and 790B may be integrated as one unit at the pump location 780, and likewise, the items 820 and 820B may be integrated as one unit at the pump location 780.

FIG. 29 shows a schematic block diagram of yet another embodiment of a distributed process control system 950. Again, reference numeral 780 relates to a pump location with a pump 10 having an impeller 20, as discussed above in relation to preceding drawings in this document. The distributed process monitoring system 950 of FIG. 29 may include parts, and be configured, as described in any of the other embodiments described in this disclosure, e.g. in relation to FIGS. 1-28. In particular, the monitoring apparatus 150, also referred to as monitoring module 150A, shown in FIGS. 28 and 29 may be configured as described in any of the other embodiments described in this disclosure, e.g. as discussed in relation to FIGS. 1-28. Moreover, the process monitoring system 950 illustrated in FIG. 29, may be configured to include a control module 150B, as described above e.g. in connection with FIG. 26 as well as a monitoring module 150A, as disclosed in connection with FIG. 27.

In the example of FIG. 29, the monitoring module 150A and the control module 150B are provided at the control location 870. The control location 870 may be remote from the pump location 780. Communication of data between the control location 870 and the pump location 780 may be provided via data ports 820 and 920 and the communications network 810, as discussed above in connection with preceding figures.

Various examples are disclosed below:

An example 1 relates to a system for monitoring an internal state of a centrifugal pump (10) having a casing (62) in which a rotatable impeller (20) is disposed, the casing (62) defining a volute (75), and a shaped portion (63) separating a first part (77) of the volute (75) from a second part (78) of the volute so as to form a pump outlet (66) for delivering a fluid material (30) from the volute, the impeller (20) defining a number (L) of impeller passages for urging the fluid material (30) into the volute (75) by centrifugal force when the impeller (20) rotates thereby causing a vibration ($V_{FP}$) having a repetition frequency ($f_R$) dependent on an impeller speed of rotation ($f_{ROT}$).

2. The system according to any preceding example, further comprising:

a monitoring unit (150B) for receiving a first vibration signal ($S_{FP}$; $S_{EA}$, $S_{MD}$, Se(i), S(j), S(q)) including a time sequence of vibration sample values (Se(i), S(j), S(q)) indicative of vibration ($V_{FP1}$) exhibited by a first casing part defining said first volute part (77);

and a second vibration signal ($S_{FP}$; $S_{EA}$, $S_{MD}$, Se(i), S(J), S(q)) including a time sequence of vibration sample values (Se(i), S(j), S(q)) indicative of vibration ($V_{FP2}$) exhibited by a second casing part (X102) defining said second volute part (78);

said monitoring unit including a status parameter extractor (450) configured to detect, in said first vibration signal, an occurrence of a first vibration signal event signature ($S_P$(r); Sp);

said status parameter extractor (450) being configured to detect, in said second vibration signal, an occurrence of a second a vibration signal event signature ($S_P$(r); Sp).

3. The system according to any preceding example, wherein:

said status parameter extractor (450) is configured to generate data indicative of a temporal relation between said first vibration signal event signature and said second vibration signal event signature; and an analyser for detecting said internal state of said centrifugal pump (10) based on said temporal relation.

4. The system according to any preceding example, wherein:

said status parameter extractor (450) is configured to generate data indicative of a mutual order of occurrence between said first vibration signal event signature and said second vibration signal event signature; and, an analyser (X451) for evaluating or detecting an internal state of said centrifugal pump (10) based on said mutual order of occurrence.

An example 5 relates to a system for monitoring an internal state of a centrifugal pump (10) having a rotatable impeller (20) having a number (L) of vanes (310) for engaging a fluid material (30) when the impeller (20) rotates thereby causing a vibration ($V_{FP}$) having a repetition frequency ($f_R$) dependent on a speed of rotation ($f_{ROT}$) of said impeller (20).

6. The system according to any preceding example, comprising:

a monitoring unit for receiving a signal ($E_P$, P(i), P(j), P(q)) indicative of a rotational position of said rotatable impeller (20), and a signal ($S_{FP}$; $S_{EA}$, $S_{MD}$, Se(i), S(j), S(q)) indicative of said vibration ($V_{FP}$), said monitoring unit being configured to extract, from said vibration signal and said position signal, a first status value ($R_T$(r); $T_D$; FI(r)) indicative of an operating point of said centrifugal pump (10).

7. The system according to any preceding example, comprising:

a status parameter extractor (450) configured to detect a first occurrence of a first reference position signal value (1; 1C, 0%) in a time sequence of position signal sample values (P(i), P(j), P(q));

said status parameter extractor (450) being configured to detect a second occurrence of a second reference position signal value (1; 1C; 100%) in said time sequence of position signal sample values (P(i), P(j), P(q));

said status parameter extractor (450) being configured to detect a third occurrence of an event signature ($S_P$(r); Sp) in a time sequence of vibration sample values (Se(i), S(j), S(q));

said status parameter extractor (450) being configured to generate data indicative of a first duration between said first occurrence and said second occurrence; and said status parameter extractor (450) being configured to generate data indicative of a second duration between said third occurrence and at least one of said first occurrence and/or said second occurrence;

said status parameter extractor (450) being configured to generate data indicative of a first temporal relation ($R_T$(r); $T_D$; FI(r)) between said second duration, and said first duration; and an analyser (X451) for evaluating an internal state of said centrifugal pump (10) based on an operating point reference value ($FI_{REF}$(r)), said first temporal relation ($R_T$(r); $T_D$; FI(r)), and an operating point error value ($FI_{ERR}$(r)), wherein said operating point error value ($FI_{ERR}$(r)) depends on said operating point reference value ($FI_{REF}$(r)), and said first temporal relation ($R_T$(r); $T_D$; FI(r)).

An example 8 relates to a system for monitoring an internal state of a centrifugal pump (10) having a casing (62) in which a rotatable impeller (20) is disposed, the casing (62) defining a volute (75) and a shaped portion (63) forming a pump outlet (66) thereby separating a first part (77) of the volute (75) from a second part of the volute, the impeller (20) defining a number (L) of impeller passages for urging a fluid material (30) into the volute (75) by centrifugal force when the impeller (20) rotates causing a casing vibration ($V_{FP}$) having a repetition frequency ($f_R$) dependent on a speed of rotation ($f_{ROT}$) of the impeller (20).

9. The system according to any preceding example, comprising:

a monitoring unit for receiving a signal ($E_P$, P(i), P(j), P(q)) indicative of a rotational position of said rotatable impeller (20) in relation to said casing, and a signal ($S_{FP}$; $S_{EA}$, $S_{MD}$, Se(i), S(j), S(q)) indicative of said vibration ($V_{FP}$), said monitoring unit comprising a status parameter extractor (450) configured to extract, from said vibration signal and said position signal, a first status value ($R_T$(r); $T_D$; FI(r); X1) indicative of said internal state, such as an operating point, during operation of said centrifugal pump (10).

10. The system according to any preceding example, wherein the shaped portion includes a volute tongue separating a first part (77) of the volute (75) from a second part of the volute.

11. The system according to any preceding example, wherein said first volute part (77) having a first cross sectional area, and said second volute part having a second cross sectional area, said first cross sectional area being smaller than said second cross sectional area.

12. The system according to any preceding example, wherein a vibration sensor is attached to said casing for generating a vibration signal ($S_{FP}$; $S_{EA}$, $S_{MD}$, Se(i), S(j), S(q)); said vibration sensor being configured to generate said vibration signal based on vibration ($V_{FP1}$) exhibited by said casing.

13. The system according to any preceding example, wherein a position marker (180) is provided on a rotatable part configured to rotate when the rotatable impeller (20) rotates, and a position sensor is configured to generate a position signal indicative of a predetermined rotational position of said rotatable impeller (20), said position signal including a time sequence of position signal values (P(i), P(j), P(q)).

14. The system according to any preceding example, comprising a first sensor for generating a first vibration signal ($S_{FP}$; $S_{EA}$, $S_{MD}$, Se(i), S(j), S(q)); said first sensor being configured to generate said first vibration signal based on vibration ($V_{FP1}$) exhibited by a first casing part (X101) defining said first volute part (77); and a second sensor for generating a second vibration signal ($S_{FP}$; $S_{EA}$, $S_{MD}$, Se(i), S(j), S(q)); said second sensor being configured to generate said second vibration signal based on vibration ($V_{FP2}$) exhibited by a second casing part (X102) defining said second volute part (78).

An example 15 relates to a system for monitoring an internal state of a centrifugal pump (10) having a rotatable impeller (20) having a number (L) of vanes (310) for engaging a fluid material (30) when the impeller (20) rotates, thereby causing a vibration ($V_{FP}$) having a repetition frequency ($f_R$) dependent on a speed of rotation ($f_{ROT}$) of the impeller (20).

An example 16 relates to a system for monitoring an internal operating state of a centrifugal pump (10) having a casing (62) in which a rotatable impeller (20) is disposed, the casing (62)

defining a volute (75) and a shaped portion (63) forming a pump outlet (66) thereby separating a first part (77) of the volute (75) from a second part of the volute, the impeller (20) defining a number (L) of impeller passages for urging a fluid material (30) into the volute (75) by centrifugal force when the impeller (20) rotates causing a casing vibration ($V_{FP}$) having a repetition frequency ($f_R$) dependent on a speed of rotation ($f_{ROT}$) of the impeller (20).

An example 17 relates to a system for monitoring an internal operating state of a centrifugal pump (10) having a casing (62) in which a rotatable impeller (20) is disposed, the casing (62)

defining a volute (75) and a shaped portion (63) forming a pump outlet (66) thereby separating a first part (77) of the volute (75) from a second part of the volute, the impeller (20) defining a number (L) of impeller passages for urging a fluid material (30) into the volute (75) by centrifugal force when the impeller (20) rotates causing a pulsation ($v_P$), in said fluid material (30), the pulsation ($v_P$) having a repetition frequency ($f_R$) dependent on a speed of rotation ($f_{ROT}$) of the impeller (20).

18. The system according to any preceding example, wherein said fluid material pulsation causes a vibration ($V_{FP}$) of the casing (62).

19. The system according to any preceding example, comprising a monitoring unit for receiving a signal ($E_P$, P(i), P(j), P(q)) indicative of a rotational position of the rotatable impeller (20) during operation of the centrifugal pump (10), and a signal ($S_{FP}$; $S_{EA}$, $S_{MD}$, Se(i), S(j), S(q)) indicative of said vibration ($V_{FP}$).

20. The system according to any preceding example, comprising a status parameter extractor (450) configured to extract, from said vibration signal and said position signal, data indicative of a first status value ($R_T$(r); $T_D$; FI(r); X1) indicative of said internal state of said centrifugal pump (10).

21. The system according to any preceding example, comprising a monitoring unit for receiving a signal ($E_P$, P(i), P(j), P(q)) indicative of a rotational position of said rotatable impeller (20), and a signal ($S_{FP}$; $S_{EA}$, $S_{MD}$, Se(i), S(j), S(q)) indicative of said vibration ($V_{FP}$), said a monitoring unit including a status parameter extractor (450) configured to detect a first occurrence of a first reference position signal value (1; 1C, 0%) in a time sequence of position signal sample values (P(i), P(j), P(q));

said status parameter extractor (450) being configured to detect a second occurrence of a second reference position signal value (1; 1C; 100%) in said time sequence of position signal sample values (P(i), P(j), P(q));

said status parameter extractor (450) being configured to detect a third occurrence of an event signature ($S_P$(r); Sp) in a time sequence of vibration sample values (Se(i), S(j), S(q));

said status parameter extractor (450) being configured to generate data indicative of a first duration between said first occurrence and said second occurrence; and said status parameter extractor (450) being configured to generate data indicative of a second duration between said third occurrence and at least one of said first occurrence and/or said second occurrence;

said status parameter extractor (450) being configured to generate data indicative of a first relation ($R_T$(r); $T_D$; FI(r); X1) between said second duration, and said first duration; and an analyser (X451) for detecting said internal state of said centrifugal pump (10) based on said first relation ($R_T$(r); $T_D$; FI(r)).

22. The system according to example 21, wherein said first relation ($R_T$(r); $T_D$; FI(r)) constitutes a first status value ($R_T$(r); $T_D$; FI(r); X1).

23. The system according to any preceding example, wherein said analyser is configured to detect said internal state based on an operating point reference value ($FI_{REF}$(r)), said first relation ($R_T$(r); $T_D$; FI(r)), and an operating point error value ($FI_{ERR}$(r)), wherein said operating point error value ($FI_{ERR}$(r)) depends on said operating point reference value ($FI_{REF}$(r)), and said first temporal relation ($R_T$(r); $T_D$; FI(r)).

24. The system according to any preceding example, comprising:

a status parameter extractor (450) configured to detect a first occurrence of a first reference position signal value (1; 1C, 0%) in a time sequence of position signal sample values (P(i), P(j), P(q));

said status parameter extractor (450) being configured to detect a second occurrence of a second reference position signal value (1; 1C; 100%) in said time sequence of position signal sample values (P(i), P(j), P(q));

said status parameter extractor (450) being configured to detect a third occurrence of an event signature ($S_P$(r); Sp) in a time sequence of vibration sample values (Se(i), S(j), S(q));

said status parameter extractor (450) being configured to generate data indicative of a first duration between said first occurrence and said second occurrence; and said status parameter extractor (450) being configured to generate data indicative of a second duration between said third occurrence and at least one of said first occurrence and/or said second occurrence;

said status parameter extractor (450) being configured to generate data indicative of a first relation ($R_T$(r); $T_D$; FI(r)) between said second duration, and said first duration; and an analyser (X451) for evaluating an internal state of said centrifugal pump (10) based on an operating point reference value ($FI_{REF}$(r)), said first relation ($R_T$(r); $T_D$; FI(r)), and an operating point error value ($FI_{ERR}$(r)), wherein said operating point error value ($FI_{ERR}$(r)) depends on said operating point reference value ($FI_{REF}$(r)), and said first relation ($R_T$(r); $T_D$; FI(r)).

25. The system according to any preceding example, wherein:

said analyser (X451) generates said first status value ($R_T(r)$; $T_D$; FI(r)) indicative of an operating point of said centrifugal pump (10) based on said first relation ($R_T(r)$; $T_D$; FI(r)).

26. The system according to any preceding example, wherein:

said operating point reference value ($FI_{REF}(r)$) is a predetermined relation value indicative of a Best Efficiency Point of operation of said centrifugal pump (10); and said analyser (X451) generates said first status value ($R_T(r)$; $T_D$; FI(r)) indicative of an operating point of said centrifugal pump (10) based on said operating point error value ($FI_{ERR}(r)$).

27. The system according to any preceding example, further comprising a sensor for generating said vibration signal ($S_F$P; $S_{EA}$, $S_{MD}$, Se(i), S(j), S(q)) when said centrifugal pump (10) exhibits said vibration ($V_{FP}$).

28. The system according to any preceding example, wherein:

said centrifugal pump (10) includes said rotatable impeller (20); and a casing (62) in which the impeller (20) is disposed, the casing (62) having an inlet (64) for receiving said fluid material (30), and an outlet (66) for delivering said fluid material (30) impelled by said impeller (20) when said impeller (20) rotates; and wherein said sensor is configured to generate said vibration signal ($S_{FP}$; $S_{EA}$, $S_{MD}$, Se(i), S(j), S(q)) when said casing exhibits said vibration ($V_{FP}$).

29. The system according to any preceding example, wherein:

said casing (62) defines a volute (75) configured as a curved funnel that increases in cross sectional area as it approaches said outlet (66).

30. The system according to any preceding example, wherein:

said impeller (20) vanes (310) define a number (L) of impeller passages for urging said fluid material (30) into said volute (75) by centrifugal force when said impeller (20) rotates.

31. The system according to any preceding example, wherein:

said centrifugal pump (10) includes said rotatable impeller (20); and a casing (62) in which the impeller (20) is disposed, said casing (62) defining a volute (75) configured as a curved funnel having a cross sectional area;

said casing (62) having a shaped portion (63) for separating a first part (77) of said volute (75) from a second part (78) of said volute;

said first volute part (77) having a first cross sectional area, and said second volute part (78) having a second cross sectional area, said first cross sectional area being smaller than said second cross sectional area.

32. The system according to any preceding example, further comprising:

a first sensor for generating a first vibration signal ($S_{FP}$; $S_{EA}$, $S_{MD}$, Se(i), S(j), S(q)); said first sensor being configured to generate said first vibration signal based on vibration ($V_{FP1}$) exhibited by a first casing part (X101) defining said first volute part (77); and a second sensor for generating a second vibration signal ($S_{FP}$; $S_{EA}$, $S_{MD}$, Se(i), S(j), S(q)); said second sensor being configured to generate said second vibration signal based on vibration ($V_{FP2}$) exhibited by a second casing part (X102) defining said second volute part (78);

a status parameter extractor (450) configured to detect a fourth occurrence of an event signature ($S_P(r)$; Sp) in a time sequence of first vibration signal sample values (Se(i), S(j), S(q));

said status parameter extractor (450) being configured to detect a fifth occurrence of said event signature ($S_P(r)$; Sp) in a time sequence of second vibration signal sample values (Se(i), S(j), S(q));

said status parameter extractor (450) being configured to generate data indicative of a mutual order of occurrence between said fourth occurrence and said fifth occurrence; and, an analyser (X451) for evaluating an internal state of said centrifugal pump (10) based on said mutual order of occurrence.

An example 33 relates to a system comprising a centrifugal pump (10) having a casing (62) in which a rotatable impeller (20) is disposed, the casing (62) defining a central pump inlet (64) for a fluid material (30), an outlet (66), and a volute (75), the rotatable impeller (20) having a number (L) of vanes for urging, when the rotatable impeller (20) rotates, the fluid material (30) from the central pump inlet (64) into the volute (75), thereby causing a fluid material pulsation ($v_P$) having a repetition frequency ($f_R$) dependent on a speed of rotation ($f_{ROT}$) of the rotatable impeller (20);

the system further comprising a vibration sensor for generating a vibration signal ($S_{FP}$; $S_{EA}$, $S_{MD}$, Se(i), S(j), S(q)) dependent on the fluid material pulsation ($v_P$);

a position sensor for generating a signal ($E_P$, P(i), P(j), P(q)) indicative of a rotational position of said rotatable impeller (20) in relation to said casing, and a status parameter extractor (450) configured to extract, from said vibration signal and said position signal, a first status value ($R_T(r)$; $T_D$; FI(r); X1) indicative of an internal state of said centrifugal pump (10) during operation.

34. The system according to any preceding example, wherein:

the rotatable impeller (20) has a number (L) of vanes for urging, when the rotatable impeller (20) rotates, the fluid material (30) from the central pump inlet (64) into the volute (75), thereby causing a fluid material flow with a pulsation ($v_P$) having a repetition frequency ($f_R$) dependent on a speed of rotation ($f_{ROT}$) of the rotatable impeller (20).

An example 35 relates to a system for monitoring an internal state of a centrifugal pump (10) having a casing (62) in which a rotatable impeller (20) is disposed, the casing (62) defining a volute (75) and a shaped portion (63) forming an outlet (66), the rotatable impeller (20) defining a number (L) of impeller passages for urging, when the impeller (20)

rotates, a fluid material (30) into the volute (75), thereby causing a fluid material pulsation ($v_P$) having a repetition frequency ($f_R$) dependent on a speed of rotation ($f_{ROT}$) of the impeller (20); the system comprising a vibration sensor for generating a vibration signal ($S_{FP}$; $S_{EA}$, $S_{MD}$, Se(i), S(j), S(q)) dependent on the fluid material pulsation ($v_P$);

a position sensor for generating a signal ($E_P$, P(i), P(j), P(q)) indicative of a rotational position of said rotatable impeller (20) in relation to said casing, and a status parameter extractor (450) configured to extract, from said vibration signal and said position signal, a first status value ($R_T$(r); $T_D$; FI(r); X1) indicative of said internal state during operation of said centrifugal pump (10).

36. The system according to any preceding example, wherein:

said vibration sensor is configured to generate said vibration signal based on vibration ($V_{FP1}$) exhibited by the casing in response to the fluid material pulsation ($v_P$).

37. The system according to any preceding example, wherein said vibration sensor is attached to the casing (62).

38. The system according to any preceding example, wherein a position marker (180) is provided on a rotatable part configured to rotate when the rotatable impeller (20) rotates, and said position sensor (170) is configured to generate said position signal ($E_P$, P(i), P(j), P(q)) dependent on said position marker (180).

39. The system according to any preceding example, wherein:

said status parameter extractor (450) is configured to detect a first occurrence of a first reference position signal value (1; 1C, 0%) in a time sequence of position signal sample values (P(i), P(j), P(q));

said status parameter extractor (450) being configured to detect a second occurrence of a second reference position signal value (1; 1C; 100%) in said time sequence of position signal sample values (P(i), P(j), P(q));

said status parameter extractor (450) being configured to detect a third occurrence of an event signature ($S_P$(r); Sp) in a time sequence of vibration sample values (Se(i), S(j), S(q));

said status parameter extractor (450) being configured to generate data indicative of a first duration between said first occurrence and said second occurrence; and said status parameter extractor (450) being configured to generate data indicative of a second duration between said third occurrence and at least one of said first occurrence and/or said second occurrence;

said status parameter extractor (450) being configured to generate data indicative of a first relation ($R_T$(r); $T_D$; FI(r)) between said second duration, and said first duration.

40. The system according to any preceding example, wherein:

said data indicative of a first relation ($R_T$(r); $T_D$; FI(r); X1) is said first status value ($R_T$(r); $T_D$; FI(r); X1).

41. The system according to any preceding example, further comprising an analyser (X451) for evaluating the internal state of the centrifugal pump (10) based on an operating point reference value ($FI_{REF}$(r)), said first relation ($R_T$(r); $T_D$; FI(r)), and an operating point error value ($FI_{ERR}$(r)), wherein said operating point error value ($FI_{ERR}$(r)) depends on said operating point reference value ($FI_{REF}$(r)), and said first relation ($R_T$(r); $T_D$; FI(r)).

42. The system according to any preceding example, wherein:

when said operating point reference value ($FI_{REF}$(r)) is adjusted to a value indicating a pump best efficiency flow (BEP), then said operating point error value ($FI_{ERR}$(r)) is indicative of a pump operating point deviating from said pump best efficiency flow (BEP).

43. The system according to any preceding example, wherein:

when said operating point reference value ($FI_{REF}$(r)) is adjusted to a value indicating a pump best efficiency flow (BEP), then a deviation of said operating point error value ($FI_{ERR}$(r)) from a zero value is indicative of a pump operating point deviating from said pump best efficiency flow (BEP).

44. The system according to any preceding example, wherein said vibration signal includes a time sequence of vibration sample values (Se(i), S(j), S(q)) indicative of vibration ($V_{FP1}$) exhibited by the casing; and said position signal includes a time sequence of position signal values (P(i), P(j), P(q)).

45. The system according to any preceding example, further comprising a shaped portion (63) forming said outlet (66).

46. The system according to any preceding example, wherein a shaped portion (63) couples the volute to the outlet (66) of the pump.

47. The system according to any preceding example, wherein the shaped portion (63) includes a volute tongue separating a first part (77) of the volute (75) from a second part of the volute.

48. The system according to any preceding example, wherein the outlet (66) includes a volute tongue separating a first part (77) of the volute (75) from a second part of the volute.

49. The system according to any preceding example, wherein said position marker (180) is positioned on said rotatable part such that said position signal ($E_P$, P(i), P(j), P(q)) includes a reference position signal value (1; 1C, 0%; 100%) at a predetermined angular position in relation to said volute tongue.

50. The system according to any preceding example, wherein said position marker (180) is positioned on said rotatable part such that said position signal ($E_P$, P(i), P(j), P(q)) includes a reference position signal value (1; 1C, 0%; 100%) indicating at least one predetermined angular position in relation to said outlet (66).

51. The system according to any preceding example, wherein the rotatable impeller (20) includes vanes (310) defining said number (L) of impeller passages.

52. The system according to any preceding example, in particular when dependent on example 49, wherein said status parameter extractor (450) is configured to detect an occurrence of an event signature ($S_P$(r); Sp) in a time sequence of vibration sample values (Se(i), S(j), S(q)).

53. The system according to any preceding example, in particular when dependent on example 49, wherein said status parameter extractor (450) is configured to detect an occurrence of an event signature ($S_P$(r); Sp) in a time sequence of vibration sample values (Se(i), S(j), S(q)); and said status parameter extractor (450) is configured to generate data indicative of an angular position of the rotatable impeller (20) at the occurrence of said event signature (Sp(r); Sp)

based on said reference position signal value (1; 1C, 0%; 100%) and said time sequence of vibration sample values (Se(i), S(j), S(q)).

An example 54 relates to a system comprising a centrifugal pump (10) having a casing (62) in which a rotatable impeller (20) is disposed, the casing (62) defining a central pump inlet (64) for a fluid material (30), an outlet (66), and a volute (75), the rotatable impeller (20) having a number (L) of vanes for urging, when the rotatable impeller (20) rotates, the fluid material (30) from the central pump inlet (66) into the volute (75), thereby causing a fluid material flow with a pulsation ($v_P$) having a repetition frequency ($f_R$) dependent on a speed of rotation ($f_{ROT}$) of the rotatable impeller (20);

the system further comprising a vibration sensor for generating a vibration signal ($S_{FP}$; $S_{EA}$, $S_{MD}$, Se(i), S(j), S(q)) dependent on the fluid material pulsation ($v_P$);

a position sensor for generating a signal ($E_P$, P(i), P(j), P(q)) indicative of a rotational position of said rotatable impeller (20) in relation to said casing, and a status parameter extractor (450) configured to extract, from said vibration signal and said position signal, a first status value ($R_T$(r); $T_D$; FI(r); X1) indicative of an internal state of said centrifugal pump (10) during operation.

55. The system according to any preceding example, wherein said vibration signal includes a time sequence of vibration sample values (Se(i), S(j), S(q)) indicative of vibration ($V_{FP1}$) exhibited by the casing; and said position signal includes a time sequence of position signal values (P(i), P(j), P(q)); said time sequence of position signal values (P(i), P(j), P(q)) including a reference position signal value (1; 1C, 0%; 100%) indicative of a predetermined angular position of the rotatable impeller in relation to said casing.

56. The system according to any preceding example, in particular when dependent on example 55, wherein said status parameter extractor (450) is configured to detect an occurrence of an event signature ($S_P$(r); Sp) in a time sequence of vibration sample values (Se(i), S(j), S(q)); and said status parameter extractor (450) is configured to generate, based on said reference position signal value (1; 1C, 0%; 100%) and said time sequence of vibration sample values (Se(i), S(j), S(q)), data indicative of an angular position of the rotatable impeller (20) in relation to said casing at the occurrence of said event signature ($S_P$(r); Sp).

57. The system according to any preceding example, in particular when dependent on example 56, wherein Said data indicative of an angular position of the rotatable impeller (20) in relation to said casing at the occurrence of said event signature ($S_P$(r); Sp) is said first status value ($R_T$(r); $T_D$; FI(r); X1).

58. The system according to any preceding example, wherein the fluid material pulsation causes a vibration ($V_{FP}$) of the casing (62).

59. The system according to any preceding example, wherein said operating point error value ($FI_{ERR}$(r)) depends on a difference between said operating point reference value ($FI_{REF}$(r)), and said first relation ($R_T$(r); $T_D$; FI(r)).

60. The system according to any preceding example, wherein said operating point error value ($FI_{ERR}$(r)) is indicative of a pump operating point deviating from said operating point reference value ($FI_{REF}$(r)).

61. The system according to any preceding example, further comprising a drive motor for causing said speed of rotation ($f_{ROT}$) of the impeller (20) in response to a drive motor speed control signal ($U1_{SP}$); wherein said operating point error value ($FI_{ERR}$(r)) is indicative of a deviation of a drive motor control signal value from a drive motor set point ($U1_{SP}$, $F_{ROTSP}$) associated with said operating point reference value ($FI_{REF}$(r)).

62. The system according to any preceding example, further comprising a drive motor for causing said speed of rotation ($f_{ROT}$) of the impeller (20) in response to a drive motor speed control signal; wherein said operating point error value ($FI_{ERR}$(r)) is indicative of a deviation ($F_{ROT_ERR}$(r)) of said impeller rotational speed ($f_{ROT}$) from an impeller rotational speed set point ($f_{ROT_SP}$; U1SP, FROTSP).

63. The system according to any preceding example, further comprising a regulator for controlling said impeller rotational speed ($f_{ROT}$) based on an operating point reference value ($FI_{REF}$(r)), said first relation ($R_T$(r); $T_D$; FI(r)), and an operating point error value ($FI_{ERR}$(r)), wherein said operating point error value ($FI_{ERR}$(r)) depends on said operating point reference value ($FI_{REF}$(r)), and said first relation ($R_T$(r); $T_D$; FI(r)).

64. The system according to any preceding example, further comprising a drive motor for causing the impeller (20) to rotate at said speed of rotation ($f_{ROT}$) in response to a drive motor speed control signal; wherein said regulator is configured to control an impeller rotational speed set point ($f_{ROT_SP}$; U1SP, FROTSP) in dependence on said operating point reference value ($FI_{RF}$(r)).

65. The system according to any preceding example, wherein

Said event signature ($S_P$(r); Sp) is a vibration signal amplitude peak value.

66. The system according to any preceding example, wherein a said impeller passage is a passage from a pump inlet (64) to said volute.

67. The system according to any preceding example, wherein a said impeller passage is a rotatable passage having an impeller opening facing said volute such that the impeller opening rotates when the impeller rotates.

68. The system according to any preceding example, further comprising a piping system, coupled to said pump outlet (66), for receiving said fluid material (30)

69. The system according to any preceding example, wherein said regulator is configured to control a volute set point value ($U2_{SP}$) in dependence on said operating point reference value ($FI_{REF}(r)$), and wherein said volute is an adaptive volute (75) having an adjustable volume, and wherein said volute set point value ($U2_{SP}$; $v_{PSP}$) controls said adjustable volute volume.

70. The system according to according to any preceding example, wherein said event signature is indicative of an fluid pressure ($P_{FL}$, $P_{54}$) generated when the rotating the impeller (20) interacts with said fluid material (30).

71. The system according to according to any preceding example, wherein said status parameter extractor (450) is configured to generate said first temporal relation ($R_T(r)$; $T_D$; FI(r)) as a phase angle (FI(r)).

72. The system according to according to any preceding example, wherein said status parameter extractor (450) is configured to generate said event signature as an amplitude value ($S_P(r)$; Sp; $C_L(r)$; $C_1(r)$).

73. The system according to according to any preceding example, wherein said status parameter extractor (450) comprises a Fourier Transformer configured to generate said first temporal relation ($R_T(r)$; $T_D$; FI(r)).

74. The system according to according to any preceding example, wherein said status parameter extractor (450) is configured to count a total number of samples ($N_B$) from the first occurrence to the second occurrence, and said status parameter extractor (450) is configured to count another number of samples ($N_P$) from the first occurrence to the third occurrence, and said status parameter extractor (450) is configured to generate said first temporal relation ($R_T(r)$; $T_D$; FI(r)) based on said another number and said total number; or wherein said status parameter extractor (450) is configured to count a total number of samples ($N_B$) from the first occurrence to the second occurrence, and said status parameter extractor (450) is configured to count another number of samples ($N_P$) from the first occurrence to the third occurrence, and said status parameter extractor (450) is configured to generate said first temporal relation ($R_T(r)$; $T_D$; FI(r)) based on a relation between said another number and said total number, wherein:

said relation between said another number and said total number is indicative of internal state of said centrifugal pump (10).

An example 75 relates to a system for monitoring an internal operating state of a centrifugal pump (10) having a casing (62) in which a rotatable impeller (20) is disposed, the casing (62)

defining a volute (75) and a shaped portion (63) forming a pump outlet (66) thereby separating a first part (77) of the volute (75) from a second part of the volute, the impeller (20) defining a number (L) of impeller passages for urging a fluid material (30) into the volute (75) by centrifugal force when the impeller (20) rotates causing a pulsation ($v_P$), in said fluid material (30), the pulsation ($v_P$) having a repetition frequency ($f_R$) dependent on a speed of rotation ($f_{ROT}$) of the impeller (20).

An example 76 relates to a system for monitoring an internal state of a centrifugal pump (10) having a rotatable impeller (20) including vanes (310) defining a number (L) of impeller passages for urging a fluid material (30) into a volute (75) when the impeller (20) rotates thereby causing a fluid material pulsation (VP) having a repetition frequency ($f_R$) dependent on a speed of rotation ($f_{ROT}$) of the impeller (20).

An example 77 relates to a centrifugal pump arrangement (X310) comprising a centrifugal pump (10) having a casing (62) in which a rotatable impeller (20) is disposed, the casing (62) defining a pump inlet (64) for a fluid material (30), an outlet (66) for the fluid material (30), and a volute (75), the rotatable impeller (20) having a number (L) of vanes for urging, when the rotatable impeller (20) rotates, the fluid material (30) from the pump inlet (64) into the volute (75), thereby causing a fluid material flow with a pulsation ($v_P$) having a repetition frequency ($f_R$) dependent on a speed of rotation ($f_{ROT}$) of the rotatable impeller (20);

the centrifugal pump arrangement (X310) further comprising a vibration sensor for generating a vibration signal ($S_{FP}$; $S_{EA}$, $S_{MD}$, Se(i), S(j), S(q)) dependent on the fluid material pulsation ($v_P$);

a position sensor for generating a position signal ($E_P$, P(i), P(j), P(q)) indicative of a rotational position of said rotatable impeller (20) in relation to said casing, and a pump location data port (X211), connectable to a communications network (X250), for data exchange with a pump monitoring apparatus (X150) for monitoring of an internal status of said centrifugal pump (10);

a pump location communications device (X212) being configured to deliver, via said pump location data port (X211):

data indicative of said vibration signal ($S_{FP}$; $S_{EA}$, $S_{MD}$, Se(i), S(j), S(q)), and data indicative of said position signal ($E_P$, P(i), P(i), P(q)).

An example 78 relates to a pump monitoring apparatus (X320) for cooperation with a centrifugal pump arrangement (X310) according to any preceding example, the pump monitoring apparatus (X320) comprising:

a monitoring apparatus data port (X221), connectable to a communications network (X250), for data exchange with said centrifugal pump arrangement (X310);

a monitoring apparatus communications device (X222) configured to receive, via said monitoring apparatus data port (X221):

data indicative of a vibration signal ($S_{FP}$; $S_{EA}$, $S_{MD}$, Se(i), S(j), S(q)), and data indicative of a position signal ($E_P$, P(i), P(j), P(q));

the pump monitoring apparatus (X320) further comprising:

a status parameter extractor (450) configured to extract, from said vibration signal and said position signal, a first status value ($T_{D1}$, $R_T$(r); $T_D$; FI(r); X1) indicative of an internal state of said centrifugal pump (10) during operation.

79. The pump monitoring apparatus according to any preceding example, further comprising:

a screen display (210S); and wherein said received vibration signal ($S_{FP}$; $S_{EA}$, $S_{MD}$, Se(i), S(j), S(q)) is dependent on fluid material pulsation ($v_P$); said vibration signal including a time sequence of vibration sample values (Se(i), S(j), S(q)); and wherein said status parameter extractor (450) is configured to detect an occurrence of an event signature ($S_P$(r); Sp) in said time sequence of vibration sample values (Se(i), S(j), S(q));

said status parameter extractor (450) is configured to display, on said screen display (210S), a polar coordinate system, said polar coordinate system having a reference point (O), and a reference direction (0,360); and a first internal status indicator object ($S_{P1}$, $T_{D1}$), indicative of said internal state, at a first polar angle ($T_{D1}$) in relation to said reference direction (0,360), said first polar angle ($T_{D1}$) being indicative of an angular position of the rotatable impeller (20) in relation to the pump casing at the occurrence of said event signature ($S_P$(r); Sp).

An example 80 relates to a system comprising a centrifugal pump (10) having a casing (62) in which a rotatable impeller (20) is disposed, the casing (62) defining a central pump inlet (64) for a fluid material (30), an outlet (66), and a volute (75), the rotatable impeller (20) having a number (L) of vanes for urging, when the rotatable impeller (20) rotates, the fluid material (30) from the central pump inlet (64) into the volute (75), thereby causing a fluid material pulsation ($v_P$) having a repetition frequency ($f_R$) dependent on a speed of rotation ($f_{ROT}$) of the rotatable impeller (20).

81. The system according to example 80, further comprising a vibration sensor for generating a vibration signal ($S_{FP}$; $S_{EA}$, $S_{MD}$, Se(i), S(j), S(q)) dependent on the fluid material pulsation ($v_P$);

a position sensor for generating a signal ($E_P$, P(i), P(j), P(q)) indicative of a rotational position of said rotatable impeller (20) in relation to said casing, and a status parameter extractor (450) configured to extract, from said vibration signal and said position signal, a first status value ($R_T$(r); $T_D$; FI(r); X1) indicative of an internal state of said centrifugal pump (10) during operation.

82. In a digital monitoring system for generating and displaying information relating to an internal state of a centrifugal pump (10) having a casing defining a volute (75) in which a rotatable impeller (20) is disposed for urging, when the rotatable impeller (20) rotates, a fluid material (30) from a central pump inlet (64) into the volute (75), thereby causing a fluid material flow with a pulsation ($v_P$) having a repetition frequency ($f_R$) dependent on a speed of rotation ($f_{ROT}$) of the rotatable impeller (20);

a computer implemented method of representing said internal state of said centrifugal pump (10) on a screen display (210S), the method comprising:

receiving a signal ($E_P$, P(i), P(j), P(q)) indicative of a rotational position of said rotatable impeller (20) in relation to said casing, said position signal including a time sequence of position signal values (P(i), P(j), P(q)); said time sequence of position signal values (P(i), P(j), P(q)) including a reference position signal value (1; 1C, 0%; 100%) indicative of at least one predetermined angular position of the rotatable impeller in relation to said casing, and receiving a vibration signal ($S_{FP}$; $S_{EA}$, $S_{MD}$, Se(i), S(j), S(q)) dependent on the fluid material pulsation ($v_P$); said vibration signal including a time sequence of vibration sample values (Se(i), S(j), S(q));

detecting an occurrence of an event signature ($S_P$(r); Sp) in said time sequence of vibration sample values (Se(i), S(j), S(q));

displaying on said screen display (210S)

a polar coordinate system, said polar coordinate system having a reference point (O), and a reference direction (0,360); and a first internal status indicator object ($S_{P1}$, $T_{D1}$), indicative of said internal state, at a first polar angle ($T_{D1}$) in relation to said reference direction (0,360), said first polar angle ($T_{D1}$) being indicative of an angular position of the rotatable impeller (20) in relation to the pump casing at the occurrence of said event signature ($S_P$(r); Sp).

83. In a digital monitoring system for generating and displaying information relating to an internal state of a centrifugal pump (10) having a casing defining a volute (75) in which a rotatable impeller (20) is disposed for urging, when the rotatable impeller (20) rotates, a fluid material (30) from a pump inlet (64) into the volute (75), thereby causing a fluid material flow with a pulsation ($v_P$) having a repetition frequency ($f_R$) dependent on a speed of rotation ($f_{ROT}$) of the rotatable impeller (20);

a computer implemented method of representing said internal state of said centrifugal pump (10) on a screen display (210S), the method comprising:

receiving a signal ($E_P$, P(i), P(j), P(q)) including a reference position signal value (1; 1C, 0%; 100%) indicative of at least one predetermined angular position of the rotatable impeller in relation to said casing, and receiving a vibration signal ($S_{FP}$; $S_{EA}$, $S_{MD}$, Se(i), S(j), S(q)) dependent on the fluid material pulsation ($v_P$); said vibration signal including a time sequence of vibration sample values (Se(i), S(j), S(q));

detecting an occurrence of an event signature ($S_P$(r); Sp) in said time sequence of vibration sample values (Se(i), S(j), S(q));

displaying on said screen display (210S)

a polar coordinate system, said polar coordinate system having a reference point (O), and a reference direction (0,360); and a first internal status indicator object ($S_{P1}$, $T_{D1}$), indicative of said internal state, at a first polar angle ($T_{D1}$) in relation to said reference direction (0,360), said first polar angle ($T_{D1}$) being indicative of an angular position of the rotatable impeller (20) in relation to the pump casing at the occurrence of said event signature ($S_P$(r); Sp).

84. In a digital monitoring system for generating and displaying information relating to an internal state of a centrifugal pump (10) having a casing defining a volute (75) in which a rotatable impeller (20) is disposed for urging, when the rotatable impeller (20) rotates, a fluid material (30) from a pump inlet (64) into the volute (75), thereby causing a fluid material flow with a pulsation ($v_P$) having a repetition frequency ($f_R$) dependent on a speed of rotation ($f_{ROT}$) of the rotatable impeller (20);

a computer implemented method of representing said internal state of said centrifugal pump (10) on a screen display (210S), the method comprising:

receiving a signal ($E_P$, P(i), P(j), P(q)) indicative of a rotational position of said rotatable impeller (20) in relation to said casing, generate a position reference value (1; 1C, 0%; 100%) based on said position signal ($E_P$, P(i), P(j), P(q)) such that said position reference value is provided a first number of times per revolution of said rotatable impeller (20), said first number of position reference values being indicative of a first number of predetermined rotational positions of said rotatable impeller (20), and receiving a vibration signal ($S_{FP}$; $S_{EA}$, $S_{MD}$, Se(i), S(j), S(q)) dependent on the fluid material pulsation ($v_P$); said vibration signal including a time sequence of vibration sample values (Se(i), S(j), S(q));

detecting an occurrence of an event signature ($S_P$(r); Sp) in said time sequence of vibration sample values (Se(i), S(j), S(q));

displaying on said screen display (210S)

a polar coordinate system, said polar coordinate system having a reference point (O), and a reference direction (0,360); and a first internal status indicator object ($S_{P1}$, $T_{D1}$), indicative of said internal state, at a first polar angle ($T_{D1}$, $R_T$(r); $T_D$; FI(r); X1) in relation to said reference direction (0,360), said first polar angle ($T_{D1}$) being indicative of an angular position of the rotatable impeller (20) in relation to the pump casing at the occurrence of said event signature (Sp(r); Sp).

85. A computer implemented method for generating and displaying information relating to an internal state of a centrifugal pump (10) having a casing defining a volute (75) in which a rotatable impeller (20) is disposed for urging, when the rotatable impeller (20) rotates, a fluid material (30) from a pump inlet (64) into the volute (75), thereby causing a fluid material flow with a pulsation ($v_P$) having a repetition frequency ($f_R$) dependent on a speed of rotation ($f_{ROT}$) of the rotatable impeller (20);

the method comprising:

receiving a signal ($E_P$, P(i), P(j), P(q)) including a reference position signal value (1; 1C, 0%; 100%) indicative of at least one predetermined angular position of the rotatable impeller in relation to said casing, receiving a vibration signal ($S_{FP}$; $S_{EA}$, $S_{MD}$, Se(i), S(j), S(q)) dependent on the fluid material pulsation ($v_P$); said vibration signal including a time sequence of vibration sample values (Se(i), S(j), S(q));

detecting an occurrence of an event signature ($S_P$(r); Sp, 205) in said time sequence of vibration sample values (Se(i), S(j), S(q)); and representing said internal state of said centrifugal pump (10) on a screen display (210S), by displaying on said screen display (210S):

a polar coordinate system, said polar coordinate system having a reference point (O), and a reference direction (0,360); and a first internal status indicator object (550; $S_{P1}$, $T_{D1}$), indicative of said internal state, at a first polar angle ($T_{D1}$, $R_T$(r); $T_D$; FI(r); X1) in relation to said reference direction (0,360), said first polar angle ($T_{D1}$) being indicative of an angular position of the rotatable impeller (20) in relation to the pump casing at the occurrence of said event signature ($S_P$(r); Sp, 205).

86. The method according to any preceding example, further comprising:

displaying on said screen display (210S)

said first internal status indicator object ($S_{P1}$, $T_{D1}$) at a first radius ($S_{P1}$) from said reference point (O), said first radius ($S_{P1}$) being indicative of an amplitude of said pulsation.

87. The method according to any preceding example, wherein the impeller has said first number of vanes.

88. The method according to any preceding example, wherein wherein a said predetermined rotational position is a position of an impeller vane in relation to a pump outlet.

89. The method according to any preceding example, wherein wherein a said predetermined rotational position is a certain angular position of an impeller vane tip in relation to a pump outlet.

90. The method according to any preceding example, wherein wherein a said predetermined rotational position is a certain angular position of an impeller vane tip in relation to a volute tongue.

91. The method according to any preceding example, wherein said reference direction (0,360) is indicative of a certain angular position of the rotatable impeller in relation to said casing.

92. The method according to any preceding example, wherein said casing includes a volute tongue, and said reference direction (0,360) corresponds to a rotational position where an impeller vane tip is at its closest position in relation to said volute tongue.

93. The method according to any preceding example, wherein said first polar angle ($T_{D1}$) is indicative of a momentary angular position of the rotatable impeller (20) in relation to the pump casing at the occurrence of said event signature ($S_P$(r); Sp) during operation of said centrifugal pump.

94. The method according to any preceding example, wherein

Said certain angular position is said predetermined angular position so that said reference position signal value (1; 1C, 0%; 100%) is indicative of said reference direction (0,360).

An example 95 relates to a computer program for performing the method according to any preceding example, the computer program comprising computer program code means adapted to perform the steps of the method according to any preceding example when said computer program is run on a computer.

96. The computer program according to any preceding example, the computer program being embodied on a computer readable medium.

97. The system according to any preceding example, wherein the casing comprises at least two fixed vanes which are positioned between said volute and said impeller.

98. The system according to any preceding example, wherein the casing comprises at least one fixed vane which is positioned at a radial distance from an axis of rotation (60) of said impeller, said radial distance being larger than a radius of said impeller.

99. In a digital monitoring system for generating and displaying information relating to an internal state of a centrifugal pump (10) having a casing defining a volute (75) in which a rotatable impeller (20) is disposed for urging, when the rotatable impeller (20) rotates, a fluid material (30) from a pump inlet (64) towards an outlet (66) via the volute (75);

a computer implemented method of representing said internal state of said centrifugal pump (10) on a screen display (210S), the method comprising:

receiving a signal ($E_P$, P(i), P(j), P(q)) including a reference position signal value (1; 1C, 0°,360°) indicative of at least one predetermined angular position of the rotatable impeller in relation to said casing, and receiving a vibration signal ($S_{FP}$; $S_{EA}$, $S_{MD}$, Se(i), S(j), S(q)) dependent on a fluid material pulsation ($P_{FP}$); said vibration signal including a time sequence of vibration sample values (S(q)), wherein a sample value (Se(i), S(j), S(q)) has an amplitude value;

displaying on said screen display (210S)

a polar coordinate system, said polar coordinate system having a reference point (O), and a reference direction (0,360); and an amplitude time plot (570, 570A) including at least one vibration sample value (S(q)) plotted at a vibration sample polar angle (FI(q)) in relation to said reference direction (0°,360°) and at a vibration sample radius (S(q)) from said reference point (O); said vibration sample radius (S(q)) being indicative of an amplitude of said vibration sample value (S(q)).

100. The method according to example 99, wherein said amplitude time plot (570, 570A) includes at least a part of said time sequence of vibration sample values (S(q)), wherein an individual vibration sample value (S(q)) is plotted at an individual vibration sample polar angle (FI(q)) in relation to said reference direction (00,360°) and at an individual vibration sample radius (S(q)) from said reference point (O); and wherein said vibration sample polar angle (FI(q)) corresponds to an angular position of said impeller (20) at a time of detection of said vibration sample value (S(q)) during operation of the pump; and said amplitude time plot (570, 570B) has a shape that is indicative of said internal state of the pump (10).

101. A method of operating a centrifugal pump (10) having a casing (62) in which a rotatable impeller (20) is disposed, the rotatable impeller (20) having a number (L) of vanes for urging, when the rotatable impeller (20) rotates, the fluid material (30) from a pump inlet (66) into the volute (75), the method comprising receiving a vibration signal ($S_{FP}$; $S_{EA}$, $S_{MD}$, Se(i), S(j), S(q)) dependent on a fluid material pulsation (VP);

receiving a signal ($E_P$, P(i), P(j), P(q)) indicative of a rotational position of said rotatable impeller (20) in relation to said casing;

generating, based on said vibration signal and said position signal, information indicative of an internal state of the centrifugal pump (10).

102. The method according to example 101 or any preceding example, wherein said generating, includes extraction of a first status value (FI, X1; FI(r); X1(r)) indicative of an internal state of said centrifugal pump (10) during operation.

103. The method according to according to example 102 or any preceding example, wherein said generating, includes generating an amplitude time plot (570, 570A), wherein said amplitude time plot (570) has a shape that is indicative of an internal state of the pump (10).

104. The method according to example 103 or any preceding example, wherein the amplitude time plot (570) exhibits a predetermined number (L) of signal signatures.

105. The method according to any preceding example, wherein a signal signature exhibits at least one highest amplitude peak, and at least one lowest amplitude peak.

106. The method according to any preceding example, wherein said predetermined number (L) of signal signatures exhibit a uniform shape, or a substantially uniform shape, during normal operation of the pump.

107. The method according to any preceding example, wherein when an individual signal signature exhibits a shape that deviates from the shape of other signal signatures that deviation indicates a malfunction.

108. The method according to any preceding example, wherein when an individual signal signature exhibits a shape that deviates from the shape of the other signal signatures that deviation indicates that a physical feature associated with a vane (310), or a physical feature associated with an impeller passage (320), deviates from normal.

109. The method according to any preceding example, further comprising:

detecting an occurrence of an event signature ($S_P$(r); Sp) in a time sequence of vibration sample values (Se(i), Si), S(q)); and generating, based on said reference position signal value (1; 1C, 0%; 100%) and said time sequence of vibration sample values (Se(i), S(j), S(q)), data indicative of an angular position (FI(r); X1) of the impeller (20) in relation to said casing at the occurrence of said event signature ($S_P$(r); Sp).

110. The method according to any preceding example, wherein said data indicative of an angular position is said first status value (FI(r); X1).

111. The method according to any preceding example, wherein detecting a first occurrence of a first reference position signal value (1; 1C, 0%) in a time sequence of position signal sample values (P(i), P(j), P(q));

detecting a second occurrence of a second reference position signal value (1; 1C; 100%) in said time sequence of position signal sample values (P(i), P(j), P(q));

detecting a third occurrence of an event signature ($S_P$(r); Sp) in a time sequence of vibration sample values (Se(i), S(j), S(q));

generating data indicative of a first duration between said first occurrence and said second occurrence; and generating data indicative of a second duration between said third occurrence and at least one of said first occurrence and/or said second occurrence;

generating data indicative of a first relation (FI, FI(r)) between said second duration, and said first duration.

112. The method according to any preceding example, wherein said data indicative of a first relation ($R_T$(r); $T_D$; FI(r); X1) is said first status value ($R_T$(r); $T_D$; FI(r); X1).

113. The method according to any preceding example, further comprising:

determining an internal state of the centrifugal pump (10) based on an operating point reference value ($FI_{REF}$(r)), said first relation ($R_T$(r); $T_D$; FI(r)), and an operating point error value ($FI_{ERR}$(r)), wherein said operating point error value ($FI_E$x(r)) depends on said operating point reference value ($FI_{REF}$(r)), and said first relation ($R_T$(r); $T_D$; FI(r)).

114. The method according to any preceding example, further comprising:

conveying, to a user interface (210, 210S) information indicative of an internal state (X) of the centrifugal pump (10).

115. The method according to any preceding example, wherein said first status value (FI, X1; FI(r); X1(r)) is based on a time of occurrence of a fluid pressure pulsation event ($S_P$(r)) and a time of occurrence of a rotational reference position.

116. The method according to any preceding example, wherein said first status value (X1; X1(r)) is a temporal relation value (FI, FI(r)) based on a time of occurrence of a fluid pressure pulsation event ($S_P$(r)) and at least two times of occurrence of a rotational reference position.

117. A computer program comprising program instructions, the computer program being loadable into one or more processors and configured to cause one or more hardware processors to perform the method according to any one of the preceding examples.

118. A computer program product comprising a non-transitory computer-readable storage medium having thereon the computer program according to example 117.

119. A system for monitoring an internal state of a centrifugal pump (10), the system being configured to perform the method according to any preceding example.

120. The system according to example 119, further comprising one or more hardware processors configured to perform the method according to any preceding example.

121. A method of operating a centrifugal pump (10) having a casing forming a volute (75) in which a rotatable impeller (20) is disposed for urging a fluid material (30) into the volute, the method comprising:

monitoring a fluid pressure pulsation event inside the pump casing;

generating, based on said monitoring, a vibration signal indicative of occurrence of said first fluid pressure pulsation event;

generating a reference signal indicative of a rotational reference position of said rotating impeller;

determining a temporal relation value (FI, FI(r)) based on time of occurrence of said fluid pressure pulsation event ($S_P$(r)) and said reference signal.

122. The method of example 121, further comprising determining an operation parameter of the pump based on the determined temporal relation value (FI, FI(r)).

123. The method of example 122, wherein the operation parameter comprises a rotation speed set point value ($U1_{SP}$, $f_{ROTSP}$) for controlling a rotational speed (U1, $f_{ROT}$) of the impeller (20).

124. The method according to any preceding example, wherein said volute is an adaptive volute (75) having an adjustable cross sectional area.

125. The method according to example 124, wherein the operation parameter comprises a volute set point value ($U2_{SP}$; $v_{PSP}$) for controlling said adjustable cross sectional area.

126. The method according to any preceding example, wherein said volute is an adaptive volute (75) having a first adjustable cross sectional area (A77), and a second adjustable cross sectional area (A78) wherein the operation parameter comprises a volute set point value ($U2_{SP}$; $v_{PSP}$) for simultaneously controlling said first and second adjustable cross sectional areas.

127. The method according to any preceding example, wherein said volute is an adaptive volute (75) having an adjustable volume, and wherein the operation parameter comprises a volute set point value ($U2_{SP}$; $v_{PSP}$) for controlling said adjustable volute volume.

128. The method according to any preceding example, wherein said volute set point value ($U2_{SP}$; $V_{PSP}$) controls a pump outlet fluid volume per per impeller revolution.

129. The method according to any preceding example, wherein said temporal relation value (FI, FI(r)) is indicative of an internal state (205, 550, X)) of said centrifugal pump (10).

130. The method according to any preceding example, wherein said temporal relation value (FI, FI(r)) is indicative of a current operating point (205, 550; X) of the centrifugal pump (10).

131. The method according to any preceding example, wherein said temporal relation value (FI, FI(r)) is indicative of a current operating point deviation ($FI_{DEV}$; $FI_{DEV}(p+1)$; 550($p$+1)) from a Best Efficiency Point of operation of the centrifugal pump (10).

132. The method according to any preceding example, further comprising displaying, on a user interface, the determined operation parameter (U1, $f_{ROT}$; $U2_{SP}$; $V_{PSP}$) as a suggestion to a user.

133. The method according to any preceding example, further comprising delivering a signal to a regulator to change the operation of the pump to correspond to the determined operation parameter (U1, $f_{ROT}$; $U2_{SP}$; $V_{PSP}$).

134. The method according to any preceding example, wherein adjusting the volume of the adaptive volute occurs during operation of the pump.

135. The method according to any preceding example, wherein said temporal relation value (FI, FI(r)) is based on a time of occurrence of said fluid pressure pulsation event ($S_P$(r)) and a time of occurrence of said rotational reference position.

136. The method according to any preceding example, wherein said temporal relation value (FI, FI(r)) is based on time of occurrence of said fluid pressure pulsation event ($S_P$(r)) and at least two times of occurrence of a rotational reference position.

137. A computer program product comprising a non-transitory computer-readable storage medium having thereon a computer program comprising program instructions, the computer program being loadable into one or more processors and configured to cause the one or more processors to perform the method according to any one of the preceding examples.

138. A system for operating a centrifugal pump (10), the system being configured to perform the method according to any preceding example.

139. The system according to example 138, further comprising one or more hardware processors configured to perform the method according to any preceding example.

140. The system according to example 138 or 139, further comprising a centrifugal pump having:

an impeller; and an adaptive casing (62A) forming an adaptive volute (75A) in which the impeller is disposed, the adaptive casing (62A) having an inlet for receiving fluid from an outside environment and an outlet for discharging out of the adaptive volute fluid impelled by the impeller, the adaptive casing (62A) being configured to adjust a volute volume based on the determined at least one operating parameter.

141. A centrifugal pump (10) having a casing forming a volute (75; 75A) in which a rotatable impeller (20) is disposed for urging a fluid material (30) into the volute thereby causing a fluid pressure pulsation ($P_{FP}$);

the centrifugal pump comprising a sensor for generating a signal ($S_{FIMP}$; $S_{EA}$, $S_{MD}$, Se(i), S(j), S(q)) indicative of said fluid pressure pulsation ($P_{FP}$).

142. The centrifugal pump (10) according to any preceding example, wherein said sensor (70, $\mathbf{70}_{78}$, $\mathbf{70}_{77}$) is attached to a casing (62) of the pump.

143. The centrifugal pump (10) according to any preceding example, wherein said sensor (70, $\mathbf{70}_{78}$, $\mathbf{70}_{77}$) mounted on a casing (62) of the pump for generating a vibration signal ($S_{EA}$, $S_{MD}$, Se(i), S(j), S(q)) dependent on fluid material pressure pulsation ($P_{FP}$).

144. The centrifugal pump (10) according to any preceding example, wherein said sensor (70, $\mathbf{70}_{78}$, $\mathbf{70}_{77}$) comprises an accelerometer.

145. The centrifugal pump (10) according to any preceding example, wherein said sensor (70, $\mathbf{70}_{78}$, $\mathbf{70}_{77}$) comprises an accelerometer including a Micro Electro-Mechanical System (MEMS) configured to generate said signal ($S_{FIMP}$; $S_{EA}$, $S_{MD}$, Se(i), S(j), S(q)) indicative of said fluid pressure pulsation ($P_{FP}$).

146. The centrifugal pump (10) according to any preceding example, wherein said sensor (70, $\mathbf{70}_{78}$, $\mathbf{70}_{77}$) comprises a semiconductor silicon substrate configured as a MEMS accelerometer.

147. The centrifugal pump (10) according to any preceding example, wherein said sensor (70, $\mathbf{70}_{78}$, $\mathbf{70}_{77}$) comprises a piezo-electric accelerometer configured to generate said signal ($S_{FIMP}$; $S_{EA}$, $S_{MD}$, Se(i), S(j), S(q)) indicative of said fluid pressure pulsation ($P_{FP}$).

148. The centrifugal pump (10) according to any preceding example, wherein said sensor (70, $\mathbf{70}_{78}$, $\mathbf{70}_{77}$) is piezoresistive sensor configured to generate said signal ($S_{FIMP}$; $S_{EA}$, $S_{MD}$, Se(i), S(j), S(q)) indicative of said fluid pressure pulsation ($P_{FP}$).

149. The centrifugal pump (10) according to any preceding example, wherein said sensor (70, $\mathbf{70}_{78}$, $\mathbf{70}_{77}$) is a velocity sensor configured to generate said signal ($S_{FIMP}$; $S_{EA}$, $S_{MD}$, Se(i), S(j), S(q)) indicative of said fluid pressure pulsation ($P_{FP}$).

150. The centrifugal pump (10) according to any preceding example, wherein said sensor (70, $\mathbf{70}_{78}$, $\mathbf{70}_{77}$) includes a coil and magnet arrangement configured to generate a velocity signal ($S_{FIMP}$; $S_{EA}$, $S_{MD}$, Se(i), S(j), S(q)) indicative of said fluid pressure pulsation ($P_{FP}$).

151. The centrifugal pump (10) according to any preceding example, further comprising a position marker device (180) for causing a position sensor (170) to generate an impeller revolution marker signal (EP; $P_S$).

151. The centrifugal pump (10) according to any preceding example, wherein said position marker device (180) is provided in association with the impeller (20) such that, when the impeller (20) rotates around an axis of rotation (60), a position marker (180) passes by a position sensor (170) at least once per revolution of the impeller.

152. The centrifugal pump (10) according to any preceding example, wherein said position marker device (180) comprises a reflective tape (180) attached on a rotating part associated with the pump.

153. The centrifugal pump (10) according to any preceding example, further comprising a position sensor (170) for generating a position signal (EP, PS, P(i), P(j), P(q)) in cooperation with said position marker device (180).

154. The centrifugal pump (10) according to any preceding example, wherein said position sensor (170) comprises a light source (170), such as e.g. a laser light source.

155. The centrifugal pump (10) according to any preceding example, wherein said position sensor (170) comprises a light source (170) for generating a position signal (EP, PS, P(i), P(j), P(q)) in cooperation with said reflective tape (180).

156. The centrifugal pump (10) according to any preceding example, wherein said position marker device (180) comprises a metal part (180) or a magnetic part (180).

157. The centrifugal pump (10) according to example 156, wherein said position sensor (170) comprises an inductive probe (170) that is configured to detect the presence of said metal part (180) or a magnetic part (180).

158. The centrifugal pump (10) according to any preceding example, wherein said position sensor (170) comprises a Hall effect sensor (170) for generating said position signal (EP, PS, P(i), P(j), P(q)).

159. The centrifugal pump (10) according to any preceding example, wherein said position marker device (180) is mounted on a shaft connected to the impeller (20).

160. A centrifugal pump arrangement (5; 10; 730; 780; 720) comprising a centrifugal pump (10) according to any preceding example.

161. The centrifugal pump arrangement (730; 780; 720) according to example 160 further comprising:

a first centrifugal pump arrangement data port (800, 820), connectable to a communications network;

a first centrifugal pump arrangement communications device (790) being configured to deliver, via said first centrifugal pump arrangement data port (820):

data indicative of said vibration signal ($S_{FIMP}$; $S_{EA}$, $S_{MD}$, Se(i), S(i), S(q)).

162. The centrifugal pump arrangement (730; 780; 720) according to example 160 further comprising:

a first centrifugal pump arrangement data port (800, 820), connectable to a communications network;

a first centrifugal pump arrangement communications device (790) being configured to deliver, via said first centrifugal pump arrangement data port (820):

data indicative of said vibration signal ($S_{FIMP}$; $S_{EA}$, $S_{MD}$, Se(i), S(j), S(q)), and data indicative of said position signal ($E_P$, P(i), P(j), P(q)).

163. The centrifugal pump arrangement (730; 780; 720) according to example 160 further comprising:

a sensor for generating a signal ($S_{FIMP}$; $S_{EA}$, $S_{MD}$, Se(i), S(j), S(q)) indicative of said fluid pressure pulsation ($P_{FP}$).

a position sensor for generating a signal ($E_P$, P(i), P(j), P(q)) indicative of a rotational position of said impeller, and a first centrifugal pump arrangement data port (800, 820), connectable to a communications network;

a first centrifugal pump arrangement communications device (790) being configured to deliver, via said first centrifugal pump arrangement data port (820):

data indicative of said vibration signal ($S_{FIMP}$; $S_{EA}$, $S_{MD}$, Se(i), S(j), S(q)), and data indicative of said position signal ($E_P$, P(i), P(j), P(q)).

164. The centrifugal pump arrangement according to any preceding example, wherein said communications network comprises the world wide internet, also known as the Internet.

165. The centrifugal pump arrangement according to any of examples 161 to 164, further comprising:

a second centrifugal pump arrangement data port (800B; 820B), connectable to a communications network;

a second centrifugal pump arrangement communications device (790B) being configured to receive, via said second centrifugal pump arrangement data port (800B; 820B):

data (FI; X1(r); X2, Sp(r); X5, $f_{ROT}$) indicative of an internal state of said centrifugal pump.

165. The centrifugal pump arrangement according to any preceding example, further comprising:

a second centrifugal pump arrangement data port (800B; 820B), connectable to a communications network;

a second centrifugal pump arrangement communications device (790B) being configured to receive, via said second centrifugal pump arrangement data port (800B; 820B):

data ($R_T$(r); $T_D$; FI(r); X1(r); X2, Sp(r), $f_{ROT}$, $dR_T$(r); d Sp(r)) indicative of an operating point (205) of said centrifugal pump.

166. The centrifugal pump arrangement according to any preceding example, further comprising:

a Human Computer Interface (HCI; 210) for enabling user input/output; and a screen display (210S); and wherein said Human Computer Interface (HCI; 210) is configured to display, on said screen display (210S), data (FI; X1(r); X2, Sp(r); X5, $f_{ROT}$) indicative of said internal state (X) of said centrifugal pump.

167. The centrifugal pump arrangement according to any preceding example, further comprising:

a Human Computer Interface (HCI; 210) for enabling user input/output; and a screen display (210S); and wherein said Human Computer Interface (HCI; 210) is configured to display, on said screen display (210S), data (FI; X1(r); X2, Sp(r); X5, $f_{ROT}$) indicative of an operating point (205) of said centrifugal pump.

168. The centrifugal pump arrangement according to any preceding example, wherein:

the second centrifugal pump arrangement communications device (790B) is said first centrifugal pump arrangement communications device (790) and said second centrifugal pump arrangement data port (800B; 820B) is said first centrifugal pump arrangement data port (820).

169. The centrifugal pump arrangement according to any preceding example, further comprising:

a control module (150, 150B) configured to receive said data (FI; X1(r); X2, Sp(r); X5, $f_{ROT}$) indicative of an internal state of said centrifugal pump.

170. The centrifugal pump arrangement according to any preceding example, wherein:

said control module (150, 150B) includes a regulator (755) configured to control a rotational speed (U1, $f_{ROT}$) of the impeller (20) based on said data (FI; X1(r); X2, Sp(r); X5, $f_{ROT}$) indicative of an internal state of said centrifugal pump; and/or a regulator configured to control the rotational speed ($f_{ROT}$) of the impeller (20) based on said data (FI; X1(r); X2, Sp(r); X5, $f_{ROT}$) indicative of an internal state of said centrifugal pump; and/or a regulator configured to control an adjustable volute volume of said centrifugal pump based on said data (FI; X1(r); X2, Sp(r); X5, $f_{ROT}$) indicative of an internal state of said centrifugal pump.

171. The centrifugal pump arrangement according to any preceding example, wherein:

said control module (150, 150B) includes a regulator (755) configured to control a rotational speed (U1, $f_{ROT}$) of the impeller (20) based on said value (FI(r)) indicative of an operating point (205) of said centrifugal pump, and/or a regulator configured to control an adjustable volute volume of said centrifugal pump based on said value (FI(r)) indicative of an operating point (205) of said centrifugal pump.

172. A monitoring apparatus (870; 880; 150; 150A) for cooperation with a centrifugal pump arrangement according to any preceding example, or according to any of examples 160 to 171, the monitoring apparatus comprising:

a monitoring apparatus data port (920, 920A), connectable to a communications network (810), for data exchange with a centrifugal pump arrangement; wherein said monitoring apparatus (870; 880; 150; 150A) is configured to receive, via said monitoring apparatus data port (920, 920A):

data indicative of a vibration signal ($S_{FIMP}$; $S_{EA}$, $S_{MD}$, Se(i), S(j), S(q)), and data indicative of a position signal ($E_P$, P(i), P(j), P(q));

the monitoring apparatus (870; 880; 150; 150A) further comprising:

a status parameter extractor (450) being configured to generate data (FI; X1(r); X2, Sp(r); X5, $f_{ROT}$) indicative of an internal state of said centrifugal pump based on said vibration signal and said position signal.

173. A monitoring apparatus (870; 880; 150; 150A) for cooperation with a centrifugal pump arrangement according to any preceding example, or according to any of examples 160 to 171, the monitoring apparatus comprising:

a monitoring apparatus data port (920, 920A), connectable to a communications network (810), for data exchange with a centrifugal pump arrangement; wherein said monitoring apparatus (870; 880; 150; 150A) is configured to receive, via said monitoring apparatus data port (920, 920A):

data indicative of a vibration signal ($S_{FIMP}$; $S_{EA}$, $S_{MD}$, Se(i), S(j), S(q));

the monitoring apparatus (870; 880; 150; 150A) further comprising:

a status parameter extractor (450) being configured to generate data (FI(r); X1(r); X2, Sp(r); X5, $f_{ROT}$) indicative of an internal state of said centrifugal pump based on said vibration signal.

174. The monitoring apparatus according to any preceding example, wherein:

said monitoring apparatus (870; 880; 150; 150A) is configured to transmit, via said monitoring apparatus data port (920, 920A):

generated data (FI; X1(r); X2, Sp(r); X5, $f_{ROT}$) indicative of said internal state of said centrifugal pump to said centrifugal pump arrangement.

175. The monitoring apparatus according to any preceding example, wherein said monitoring apparatus (870; 880; 150; 150A) is configured to generate and transmit a value ($R_T$(r); $T_D$; FI(r)) indicative of an operating point (205) of said centrifugal pump to said centrifugal pump arrangement.

176. An assembly for cooperation with a centrifugal pump arrangement according to any preceding example, or according to any of examples 160 to 171, the assembly comprising:

a monitoring module (150; 150A), a control module (150; 150B), and at least one assembly data port (920, 920A, 920B), connectable to a communications network (810), for data exchange with a centrifugal pump arrangement;

wherein said monitoring module (150; 150A) is configured to receive, via said assembly data port port (920, 920A):

data indicative of a vibration signal ($S_{FIMP}$; $S_{EA}$, $S_{MD}$, Se(i), S(j), S(q)), and data indicative of a position signal ($E_P$, P(i), P(j), P(q));

the monitoring module (150; 150A) being configured to generate data (FI; X1(r); X2, Sp(r); X5, $f_{ROT}$) indicative of an internal state of said centrifugal pump based on said vibration signal and said position signal, said control module (150; 150B) is arranged to communicate with said centrifugal pump arrangement via an assembly data port (920, 920B), and said control module (150, 150B) includes a regulator (755) configured to control a rotational speed (U1, $f_{ROT}$) of the impeller (20) based on said data ($T_D$; FI(r); $R_T$(r); X1(r); X2, Sp(r); X5, $f_{ROT}$) indicative of an internal state of said centrifugal pump; and/or a regulator configured to control an adjustable volute volume of said centrifugal pump based on said data (FI; X1(r); X2, Sp(r); X5, $f_{ROT}$) indicative of an internal state of said centrifugal pump.

177. The assembly according to any preceding example, wherein the assembly is arranged at a location geographically distant from said centrifugal pump (10).

The invention claimed is:

1. A method of operating a centrifugal pump having a casing forming an adaptive volute with an adjustable cross sectional area, in which casing a rotatable impeller is disposed for urging a fluid material into the volute, thereby causing a fluid pressure pulsation event having a repetition frequency dependent on a speed of rotation of the impeller, the method comprising:

receiving a vibration signal indicative of occurrence of said fluid pressure pulsation event, wherein the vibration signal is responsive to monitoring the fluid pressure pulsation event with a vibration sensor;

generating, based on a position signal generated by a position sensor, a reference signal indicative of a rotational reference position of said rotating impeller in relation to the casing;

determining a temporal relation value based on
time of occurrence of said fluid pressure pulsation event and
said reference signal;
determining an operation parameter of the pump based on the determined temporal relation value; wherein
the operation parameter comprises a volute set point value; and
controlling an actuator of the centrifugal pump to adjust cross sectional area based on the volute set point value.

2. The method according to claim 1, wherein
the operation parameter comprises a rotation speed set point value for controlling a rotational speed of the impeller.

3. The method according to claim 1, wherein
said adaptive volute has
a first adjustable cross sectional area, and
a second adjustable cross sectional area, and wherein
the operation parameter comprises said volute set point value for simultaneously controlling said first and second adjustable cross sectional areas.

4. The method according to claim 3, wherein
said adaptive volute has an adjustable volume, and wherein
said volute set point value controls said adjustable volute volume.

5. The method according to claim 4, wherein
said temporal relation value is indicative of an internal state of said centrifugal pump.

6. The method according to claim 5, wherein
said temporal relation value is indicative of a current operating point of the centrifugal pump.

7. The method according to claim 6, wherein
said temporal relation value is indicative of a current operating point deviation from a Best Efficiency Point of operation of the centrifugal pump.

8. The method according to claim 7, further comprising
displaying, on a user interface, the determined operation parameter as a suggestion to a user.

9. The method according to claim 8, further comprising
delivering a signal to a regulator to change the operation of the pump to correspond to the determined operation parameter.

10. The method according to claim 9, wherein
adjusting the volume of the adaptive volute occurs during operation of the pump.

11. The method according to claim 1, wherein
said temporal relation value is based on
a time of occurrence of said fluid pressure pulsation event and
a time of occurrence of said rotational reference position.

12. The method according to claim 1, wherein
said temporal relation value is based on
time of occurrence of said fluid pressure pulsation event and at least two times of occurrence of a rotational reference position.

13. The method according to claim 1, wherein
the rotatable impeller has a first number of vanes; said first number being higher than one; and wherein
said vibration signal includes a vibration signal amplitude component indicative of occurrence of said fluid pressure pulsation event; said vibration signal amplitude component being repetitive with the frequency of one vibration signal amplitude component per vane.

14. The method according to claim 13, wherein
said reference signal is indicative of a certain number of stationary reference positions per impeller revolution; said certain number being equal to said first number.

15. A computer program product comprising a non-transitory computer-readable storage medium having thereon a computer program comprising program instructions, the computer program being loadable into one or more processors and configured to cause the one or more processors to perform the method according to claim 1.

16. A system for operating a centrifugal pump, the system comprising one or more hardware processors configured to perform the method according to claim 1.

17. The system according to claim 16, further comprising a centrifugal pump having:
an impeller; and
an adaptive casing forming an adaptive volute in which the impeller is disposed, the adaptive casing having an inlet for receiving fluid from an outside environment and an outlet for discharging out of the adaptive volute fluid impelled by the impeller, the adaptive casing being configured to adjust a volute volume based on the determined operation parameter.

18. A system for operating a centrifugal pump having a casing forming an adaptive volute with an adjustable cross sectional area, in which casing a rotatable impeller is disposed for urging a fluid material into the volute, thereby causing a fluid pressure pulsation event having a repetition frequency dependent on a speed of rotation of the impeller, the system comprising:
one or more hardware processors configured to;
receive, based on monitoring with a vibration sensor, a vibration signal indicative of occurrence of said fluid pressure pulsation event;
generate, based on a position signal generated by a position sensor, a reference signal indicative of a rotational reference position of said rotating impeller in relation to the casing;
determine a temporal relation value based on time of occurrence of said fluid pressure pulsation event and said reference signal;
determine an operation parameter of the pump based on the determined temporal relation value; wherein the operation parameter comprises a volute set point value; and
control an actuator of the centrifugal pump to adjust the cross sectional area based on the volute set point value.

19. The system according to claim 18, wherein
the operation parameter further comprises a rotation speed set point value for controlling a rotational speed of the impeller.

20. The system according to claim 18, wherein
said temporal relation value is indicative of a current operating point of the centrifugal pump.

21. The system according to claim 18, wherein
said temporal relation value is indicative of a current operating point deviation from a Best Efficiency Point of operation of the centrifugal pump.

22. The system according to claim 18, further comprising
a user interface for displaying the determined operation parameter as a suggestion to a user.

23. The system according to claim 18, wherein
said one or more hardware processors further being configured to deliver a signal to a regulator to change the operation of the pump to correspond to the determined operation parameter.

24. The system according to claim 18, wherein said one or more hardware processors are configured to adjust the volume of the adaptive volute during operation of the pump.

25. The system according to claim 18, wherein said temporal relation value is based on a time of occurrence of said fluid pressure pulsation event and a time of occurrence of said rotational reference position.

26. The system according to claim 18, wherein said temporal relation value is based on time of occurrence of said fluid pressure pulsation event and at least two times of occurrence of a rotational reference position.

27. The system according to claim 18, wherein the rotatable impeller has a first number of vanes; said first number being higher than one; and wherein said vibration signal includes a vibration signal amplitude component indicative of occurrence of said fluid pressure pulsation event; said vibration signal amplitude component being repetitive with the frequency of one vibration signal amplitude component per vane.

28. The system according to claim 27, wherein said reference signal is indicative of a certain number of stationary reference positions per impeller revolution; said certain number being equal to said first number.

* * * * *